US012384594B2

(12) United States Patent
Zabaleta et al.

(10) Patent No.: US 12,384,594 B2
(45) Date of Patent: Aug. 12, 2025

(54) THREADED CONTAINER COMPONENTS HAVING FRUSTUM SHAPED SURFACES ENABLING NESTING

(71) Applicants: Daniel A. Zabaleta, Cooper City, FL (US); Dennis Stammen, Brookville, OH (US); Steven Todd Albright, Piqua, OH (US)

(72) Inventors: Daniel A. Zabaleta, Cooper City, FL (US); Dennis Stammen, Brookville, OH (US); Steven Todd Albright, Piqua, OH (US)

( * ) Notice: Subject to any disclaimer, the term of this patent is extended or adjusted under 35 U.S.C. 154(b) by 0 days.

(21) Appl. No.: 17/952,306

(22) Filed: Sep. 25, 2022

(65) Prior Publication Data

US 2023/0021579 A1 Jan. 26, 2023

Related U.S. Application Data

(63) Continuation-in-part of application No. 29/777,334, filed on Apr. 5, 2021, now Pat. No. Des. 1,033,216,
(Continued)

(51) Int. Cl.
*B65D 17/28* (2006.01)
*B65D 17/347* (2006.01)
(Continued)

(52) U.S. Cl.
CPC ..... *B65D 17/4014* (2018.01); *B65D 17/347* (2018.01); *B65D 21/0233* (2013.01); *B65D 43/0229* (2013.01)

(58) Field of Classification Search
CPC ..... B65D 17/4014; B65D 2543/00027; B65D 17/347; B65D 21/0219; B65D 21/0233;
(Continued)

(56) References Cited

U.S. PATENT DOCUMENTS 253,075 A 1/1882 Lyon
986,847 A 3/1911 Nair et al.
(Continued)

FOREIGN PATENT DOCUMENTS

AU 2012244852 B2 7/2014
CA 476789 9/1951
(Continued)

OTHER PUBLICATIONS

Customized Logo 401# Stretch Tin Can Lids for Food and Wine Paper Tube, curiousexpeditions.org, 2 pages. Found online Nov. 11, 2015 at http://papercanspackaging.sell.curiousexpeditions.org/iz6fge2df-customised-logo-401-stretch-tin-can-lids-for-food-and-wine-paper-tube-images.
(Continued)

*Primary Examiner* — Anthony D Stashick
*Assistant Examiner* — Marcos Javier Rodriguez Molina
(74) *Attorney, Agent, or Firm* — Allen D Hertz, P. A.; Allen D. Hertz

(57) ABSTRACT

A container lid comprising a frustum shaped sidewall, a chuck shoulder formed between an upper edge of the sidewall and a seaming panel, and at least one translative motion guide feature extending radially inward from the sidewall. A bottom (lower) edge of the sidewall can be closed by a bottom wall or rolled creating an open design. The frustum shaped sidewall and size of the translative motion guide features is designed to enable nesting of multiple container lids/caps. The lid is seamed to a container body. The lid and cap each include sealing surfaces designed to engage with one another creating a gas and liquid impervious seal, preferably capable of retaining pressure within a container. Alternatively, the translative motion guide feature can be integral with a frustum shaped container body, such as a cup.

19 Claims, 101 Drawing Sheets

Related U.S. Application Data which is a continuation-in-part of application No. 29/777,331, filed on Apr. 5, 2021, now Pat. No. Des. 1,033,215, which is a continuation-in-part of application No. 29/777,270, filed on Apr. 5, 2021, now Pat. No. Des. 1,033,217.

(60) Provisional application No. 63/248,531, filed on Sep. 26, 2021.

(51) Int. Cl.

| | |
|---|---|
| ***B65D 21/02*** | (2006.01) |
| ***B65D 43/02*** | (2006.01) |
| *B05B 11/00* | (2023.01) |
| *B05B 11/10* | (2023.01) |
| *B65D 47/06* | (2006.01) |
| *B65D 47/30* | (2006.01) |

(58) Field of Classification Search

CPC .... B65D 2231/022; B65D 2543/00046; B65D 2543/00092; B65D 2543/00277; B65D 2543/00509; B65D 2543/00546; B65D 2543/00962; B65D 43/0229; B65D 47/06; B65D 47/305; B05B 11/0008; B05B 11/1011; B05B 11/1047

USPC ..... 220/254.8, 826

See application file for complete search history.

(56) References Cited

U.S. PATENT DOCUMENTS 1,596,367 A 8/1926 Miller
1,602,126 A 10/1926 Russell
1,687,887 A 10/1928 Pletcher
1,691,276 A 11/1928 Freundt
1,696,388 A 12/1928 Curtis
1,765,383 A 6/1930 Punte
1,798,246 A 3/1931 Braner
2,004,964 A 6/1935 Behr et al.
2,026,304 A 12/1935 Deady
2,038,524 A 4/1936 Carvalho
2,102,666 A 12/1937 Annen
2,112,231 A 3/1938 Edwin et al.
2,117,407 A 5/1938 Davis
2,128,959 A 9/1938 Nicholls
2,207,564 A 7/1940 Wackman
2,303,205 A 11/1942 Frankenberg
2,337,456 A 12/1943 Draper
2,349,587 A 5/1944 Brand
2,359,775 A 10/1944 Mcmanus et al.
2,384,810 A 9/1945 Calleson
2,409,788 A 10/1946 Osborne
2,419,616 A 4/1947 White
2,426,550 A 8/1947 Coyle
2,430,036 A 11/1947 Thornburgh et al.
2,505,641 A 4/1950 Howe
2,661,863 A 4/1950 Howe
2,559,658 A 7/1951 Pottle
2,602,565 A 7/1952 Fdiek
2,661,862 A 12/1953 Howe
2,679,878 A 6/1954 Stine
2,683,579 A 7/1954 Stanley
2,706,065 A 4/1955 Stone
2,997,199 A 8/1961 Reachi
3,026,507 A 3/1962 Blosser et al.
3,029,507 A 4/1962 Gaggini
3,142,409 A 7/1964 Ross
3,176,872 A 4/1965 Zundel
3,191,564 A 6/1965 Fraze
3,225,957 A 12/1965 Huth
3,253,727 A 5/1966 Hart
3,255,917 A 6/1966 Fraze
3,270,544 A 9/1966 Maeder et al.
3,303,960 A 2/1967 Fraze
3,349,949 A 10/1967 Brown
3,349,950 A 10/1967 Wanderer
3,361,291 A 1/1968 Fraze
3,409,168 A 11/1968 Chmielowiec
3,439,640 A 4/1969 Fraze
3,439,833 A 4/1969 Fraze
3,446,389 A 5/1969 Brown
3,460,711 A 8/1969 Al-Roy
3,480,175 A 11/1969 Khoury
3,520,441 A 7/1970 Fitzgerald
3,601,273 A 8/1971 Kutcher
3,638,597 A 2/1972 Fraze
3,643,833 A 2/1972 Fraze et al.
3,688,718 A 9/1972 Schrecker
D224,963 S 10/1972 Saunders
3,726,432 A 4/1973 Gentile
3,752,353 A 8/1973 Slade
D229,824 S 1/1974 Erickson
3,795,342 A 3/1974 Ashton
3,812,646 A 5/1974 Baldyga et al.
3,812,991 A 5/1974 Wurt
3,844,443 A 10/1974 Cudzik
3,856,184 A 12/1974 Luviano
3,871,314 A 3/1975 Stargell
3,877,604 A 4/1975 Brown
3,880,318 A 4/1975 Fraze
3,910,453 A 10/1975 Kneusel
D238,150 S 12/1975 Cudzik
3,924,777 A 12/1975 Peyser
3,938,693 A 2/1976 Patel et al.
3,952,911 A 4/1976 Bozek et al.
3,967,752 A 7/1976 Cudzik
3,973,921 A 8/1976 Ward et al.
D243,231 S 2/1977 Smith
4,007,848 A 2/1977 Snyder
4,007,851 A 2/1977 Walker
4,042,144 A 8/1977 Henning
4,054,229 A 10/1977 Arfert
4,065,025 A 12/1977 Potts
4,078,695 A 3/1978 Potts
4,094,435 A 6/1978 Kennedy
4,098,058 A * 7/1978 Carrigan ..... B65B 7/2807 221/277
4,116,360 A 9/1978 McKernan et al.
4,116,361 A 9/1978 Stargell
4,122,971 A 10/1978 Potts
4,172,532 A 10/1979 Paisson
4,182,460 A 1/1980 Holk
4,197,956 A 4/1980 Murayama
4,262,815 A 4/1981 Klein
4,286,728 A 9/1981 Fraze et al.
D263,803 S 4/1982 Fraze
4,332,332 A 6/1982 Ingemann
4,386,713 A 6/1983 Baumeyer
4,399,925 A 8/1983 Fundom
4,411,707 A 10/1983 Brennecke et al.
D273,846 S 5/1984 Fraze
4,476,987 A 10/1984 Nolan
D277,826 S 3/1985 Brown, Sr.
4,561,561 A 12/1985 Ichikawa et al.
4,567,746 A 2/1986 Fraze et al.
4,574,975 A 3/1986 Cudzik et al.
4,679,699 A 7/1987 Malsbury et al.
4,685,849 A 8/1987 LaBarge et al.
4,705,186 A 11/1987 Barrash
4,711,611 A 12/1987 Fraze
4,717,039 A 1/1988 Ayyoubi
4,723,687 A 2/1988 Kutterer
4,726,489 A 2/1988 Padovani
4,732,031 A 3/1988 Bulso, Jr. et al.
4,785,963 A 11/1988 Magley
4,793,510 A 12/1988 Arfert et al.
4,809,861 A 3/1989 Wilkinson
4,821,912 A 4/1989 Wells
4,823,537 A 4/1989 Duke
RE32,927 E 5/1989 Taylor
4,865,215 A 9/1989 Wells
4,872,597 A 10/1989 Hanafusa

(56) References Cited

U.S. PATENT DOCUMENTS 4,880,131 A 11/1989 Gallagher et al.
4,928,244 A 5/1990 Vermesse
4,928,844 A 5/1990 La Barge
H803 H 8/1990 Sherrington
4,946,063 A 8/1990 Heyes et al.
4,982,862 A 1/1991 La Barge
5,052,576 A 10/1991 Budenbender
5,078,290 A 1/1992 Ochs
5,121,851 A 6/1992 Lyon et al.
5,125,212 A 6/1992 Smyth
5,138,858 A 8/1992 Johnson et al.
5,207,341 A 5/1993 Yeager
D337,521 S 7/1993 McNulty
D338,621 S 8/1993 Balson
5,240,138 A 8/1993 Gallagher
5,248,053 A 9/1993 Lundgren
5,292,025 A 3/1994 Dubreul
5,293,765 A 3/1994 Nussbaum
D348,137 S 6/1994 Campbell
5,339,977 A 8/1994 Schormair et al.
5,356,030 A 10/1994 Budenbender
5,381,924 A 1/1995 Kiefel
D355,735 S 2/1995 Shaffer
D356,456 S 3/1995 Henry
5,421,480 A 6/1995 Cudzik
5,443,175 A 8/1995 Kelly et al.
5,507,406 A 4/1996 Urciuoli et al.
5,511,920 A 4/1996 Artrip
5,529,202 A 6/1996 Shamis
5,582,319 A 12/1996 Heyes
5,605,244 A 2/1997 Bradshaw
D382,481 S 8/1997 McEldowney
D387,987 S 12/1997 Neiner
5,692,633 A 12/1997 Gordon
5,704,240 A 1/1998 Jordan
5,711,447 A 1/1998 Plester
5,713,235 A 2/1998 Diekhoff
5,718,352 A 2/1998 Diekhoff
5,772,799 A 6/1998 Sun et al.
5,779,086 A 6/1998 Barrash
5,778,723 A 7/1998 Diekhoff
5,785,198 A 7/1998 Credle
D397,062 S 8/1998 Hollington
5,799,775 A 9/1998 Spring
5,806,707 A 9/1998 Boehm et al.
5,816,428 A 10/1998 Plester
5,820,016 A 10/1998 Stropkay
5,822,843 A 10/1998 Diekhoff
5,875,906 A 3/1999 Price et al.
5,881,593 A 3/1999 Bulso, Jr. et al.
5,911,551 A 6/1999 Moran
5,947,315 A 9/1999 Valyi et al.
5,947,318 A 9/1999 Palm
D415,026 S 10/1999 Turner
D415,425 S 10/1999 Turner
5,975,322 A 11/1999 Reid
6,010,026 A 1/2000 Diekhoff et al.
6,010,028 A 1/2000 Jordan et al.
D424,438 S 5/2000 Turner
6,065,634 A 5/2000 Brifcani et al.
6,082,944 A 7/2000 Bachmann
6,102,225 A 8/2000 Lynn
6,105,807 A 8/2000 McCrossen
6,123,212 A 9/2000 Russell et al.
D434,983 S 12/2000 Hurst
6,164,472 A 12/2000 Folchini
6,174,274 B1 1/2001 Hawkins et al.
6,202,872 B1 3/2001 Smeyak et al.
6,206,222 B1 3/2001 Cudzik
6,216,904 B1 4/2001 Cagan
6,234,338 B1 5/2001 Searle
6,301,766 B1 10/2001 Kollé
D452,155 S 12/2001 Stodd
6,330,954 B1 12/2001 Turner et al.
6,332,551 B1 12/2001 Copeland
6,450,358 B1 9/2002 Berro
6,460,723 B2 10/2002 Nguyen et al.
D470,050 S 2/2003 Renz
D471,453 S 3/2003 Stodd
6,575,325 B2 6/2003 Dickie et al.
D476,889 S 7/2003 Fields
6,609,634 B2 8/2003 De Laforcade et al.
6,626,310 B2 9/2003 Taha
6,626,314 B1 9/2003 McHenry et al.
D480,304 S 10/2003 Stodd
6,651,833 B2 11/2003 Sciarini
6,688,484 B2 2/2004 Boulange et al.
6,688,487 B2 2/2004 Oakes et al.
6,729,495 B2 5/2004 Gardiner
6,739,471 B2 5/2004 Goetz et al.
6,779,677 B2 8/2004 Chupak
6,877,941 B2 4/2005 Brifeani et al.
6,889,862 B2 5/2005 Vaughan
6,910,598 B2 5/2005 Goetz et al.
6,959,830 B1 11/2005 Kanou et al.
6,981,601 B2 1/2006 Laveault et al.
7,014,060 B2 3/2006 Richardson
D518,885 S 4/2006 Stout, Jr.
D525,127 S 7/2006 Cogley
7,100,789 B2 9/2006 Nguyen
7,147,123 B2 12/2006 Yamashita
D559,680 S 1/2008 Jacober et al.
7,344,041 B2 3/2008 Heinicke et al.
D587,118 S 2/2009 Sadiq et al.
7,500,376 B2 3/2009 Bathurst et al.
7,500,577 B2 3/2009 Wichelhaus
7,555,927 B2 7/2009 Hanafusa et al.
7,743,635 B2 6/2010 Jentzsch
7,798,357 B2 9/2010 Hanafusa et al.
7,823,740 B2 11/2010 Perra
7,824,750 B2 11/2010 Takegoshi et al.
7,841,222 B2 11/2010 Cook et al.
7,861,874 B2 1/2011 Cook et al.
7,891,517 B2 2/2011 Simmons
7,905,130 B2 3/2011 Marshall et al.
7,918,359 B2 4/2011 Paris et al.
7,918,363 B2 4/2011 Morabito et al.
7,942,028 B2 5/2011 Gillest et al.
D639,164 S 6/2011 Walsh
D641,239 S 7/2011 Ramsey
D641,622 S 7/2011 Fields
8,016,148 B2 9/2011 Walsh
D647,400 S 10/2011 Fields
8,037,728 B2 10/2011 Hosoi
D649,049 S 11/2011 Fields
D651,452 S 1/2012 Hillebrenner
D653,109 S 1/2012 Stammen
8,091,402 B2 1/2012 Hanafusa et al.
8,210,377 B2 7/2012 Martin et al.
8,215,513 B1 7/2012 Grissom
8,302,768 B2 11/2012 Sibley
8,328,041 B2 12/2012 Brifcani
8,336,726 B2 12/2012 Ramsey et al.
8,336,728 B2 12/2012 Forrest
8,360,266 B2 1/2013 Adams et al.
D681,176 S 4/2013 Chacko
D684,470 S 6/2013 Concin et al.
8,474,634 B1 7/2013 Branson et al.
8,496,131 B2 7/2013 Forrest et al.
8,534,490 B2 9/2013 Chapin
8,556,106 B1 10/2013 Bayat et al.
D692,757 S 11/2013 Concin et al.
D692,758 S 11/2013 Concin et al.
D696,113 S 12/2013 Stein
8,608,007 B2 12/2013 Seo
8,613,369 B2 12/2013 Kitto
8,622,230 B2 1/2014 Grissom
8,720,717 B2 5/2014 Kaanta et al.
D706,908 S 6/2014 Knapp
D708,943 S 7/2014 Van Goolen
D708,944 S 7/2014 Van Goolen
8,844,761 B2 9/2014 Zabaleta et al.
8,863,947 B2 10/2014 Sibley
8,866,617 B2 10/2014 Kurosawa et al.

(56) References Cited

U.S. PATENT DOCUMENTS 8,939,311 B2 1/2015 Christopoulos et al.
8,985,371 B2 3/2015 Zabaleta et al.
9,016,504 B2 4/2015 McClung
D728,757 S 5/2015 Graham
D730,734 S 6/2015 Rapparini
9,145,239 B2 9/2015 Wohlgenannt
9,162,796 B2 10/2015 Bratsch
9,228,684 B2 1/2016 Knapp
9,265,287 B2 2/2016 Sims et al.
9,272,819 B1 3/2016 Zabaleta et al.
D752,978 S 4/2016 Zabeleta et al.
9,339,864 B2 5/2016 Hosoi
D761,398 S 7/2016 Murphy
D767,329 S 9/2016 Mock
D770,895 S 11/2016 Brown
9,493,274 B2 11/2016 Ledun et al.
9,505,527 B1 11/2016 Campbell
D777,034 S 1/2017 Sill
9,550,604 B2 1/2017 Burleson, Jr.
9,555,936 B2 1/2017 Martindale et al.
D782,907 S 4/2017 Sowieja
9,617,043 B2 4/2017 McGirr et al.
D786,673 S 5/2017 Moffat
9,637,269 B1 * 5/2017 Zabaleta ..... B65D 17/4014
9,676,524 B2 6/2017 Conley et al.
D792,220 S 7/2017 Simons
D793,861 S 8/2017 Siegel
D795,693 S 8/2017 Zabaleta et al.
D798,656 S 10/2017 Steel
D799,215 S 10/2017 Pacha
9,821,926 B2 11/2017 Robinson et al.
9,868,564 B2 1/2018 McGirr et al.
9,878,821 B2 1/2018 Sibley
D809,868 S 2/2018 Eyal
D812,474 S 3/2018 Rust
D813,606 S 3/2018 O'Nan
9,938,043 B2 4/2018 Chasteen et al.
10,040,593 B2 8/2018 Ross et al.
D828,753 S 9/2018 Zabaleta et al.
10,095,901 B1 10/2018 Fogarty
10,124,941 B2 11/2018 Sibley et al.
10,214,323 B2 2/2019 Conley et al.
10,232,990 B2 3/2019 Sang et al.
D860,716 S 9/2019 Abante et al.
10,427,832 B1 10/2019 Zabaleta et al.
10,486,864 B2 11/2019 Van Goolen
D871,133 S 12/2019 Bullock et al.
10,494,152 B2 12/2019 Ramsey
10,513,375 B2 12/2019 Karll
10,519,016 B2 12/2019 Kelly et al.
10,597,205 B2 3/2020 Sibley et al.
10,875,076 B2 12/2020 Scott
10,926,925 B2 2/2021 Seiders et al.
D916,590 S 4/2021 Albright
D917,281 S 4/2021 Will
D917,282 S 4/2021 Albright
D917,283 S 4/2021 Albright
D917,284 S 4/2021 Albright
10,968,010 B1 4/2021 Zabaleta et al.
11,130,606 B2 9/2021 Ross et al.
D959,981 S 8/2022 Stammen
D976,704 S 1/2023 Stammen
D977,971 S 2/2023 Stammen
D997,720 S 9/2023 Stammen
2001/0003292 A1 6/2001 Sun et al.
2001/0037668 A1 11/2001 Fields
2001/0040167 A1 11/2001 Flecheux et al.
2002/0008109 A1 1/2002 Hirota
2002/0030053 A1 3/2002 Copeland
2003/0051445 A1 3/2003 Martin et al.
2003/0116521 A1 6/2003 Chupak
2003/0213709 A1 11/2003 Gibler et al.
2003/0213803 A1 11/2003 Chasteen
2004/0089629 A1 5/2004 Villaescusa
2004/0159662 A1 8/2004 Johnson
2004/0256386 A1 12/2004 LaFortune
2005/0008458 A1 1/2005 Keech et al.
2005/0029264 A1 2/2005 Werth
2005/0039416 A1 2/2005 Hidding
2005/0067365 A1 3/2005 Hanafusa et al.
2005/0115969 A1 6/2005 Mizuma
2005/0127077 A1 6/2005 Chupak
2005/0150889 A1 7/2005 Perra
2006/0011633 A1 1/2006 Cook et al.
2006/0163253 A1 7/2006 Steadman
2007/0017089 A1 1/2007 Hosoi
2007/0045318 A1 3/2007 Gibson et al.
2007/0062952 A1 3/2007 Kobayashi et al.
2007/0170184 A1 7/2007 Canedo
2007/0249424 A1 10/2007 Marshall et al.
2007/0266755 A1 11/2007 Cook et al.
2008/0011702 A1 1/2008 Walsh
2008/0047922 A1 2/2008 Olson et al.
2008/0053997 A1 3/2008 Perra
2008/0099480 A1 5/2008 Chang
2008/0110922 A1 5/2008 Sines
2008/0168818 A1 7/2008 Gillest et al.
2008/0237235 A1 10/2008 Morabito
2009/0026201 A1 1/2009 Hall et al.
2009/0045158 A1 2/2009 Suriol
2009/0200306 A1 8/2009 Breunig
2009/0211329 A1 8/2009 Hanafusa et al.
2009/0236353 A1 9/2009 Martin et al.
2009/0261101 A1 10/2009 Forrest
2010/0051576 A1 3/2010 Tran et al.
2010/0059516 A1 3/2010 Parker
2010/0065528 A1 3/2010 Hanafusa et al.
2010/0126992 A1 5/2010 Phillips
2010/0133275 A1 6/2010 Phillips
2010/0264109 A1 10/2010 Pedraza et al.
2010/0294768 A1 11/2010 Ramsey et al.
2010/0320207 A1 12/2010 Sjogren et al.
2011/0036839 A1 2/2011 Gardner
2011/0036840 A1 2/2011 Zakai
2011/0056945 A1 3/2011 Ramsey
2011/0062106 A1 3/2011 Caspar
2011/0100946 A1 5/2011 Perra
2011/0114649 A1 5/2011 Adams et al.
2011/0168709 A1 7/2011 Wells
2011/0174639 A1 7/2011 Sibley
2011/0226636 A1 9/2011 Petti
2011/0232423 A1 9/2011 Raymond
2011/0278255 A1 11/2011 Forrest et al.
2012/0012586 A1 1/2012 Rinderer et al.
2012/0031913 A1 2/2012 Moore et al.
2012/0037631 A1 2/2012 Weist
2012/0055925 A1 3/2012 Van Goolen
2012/0061263 A1 3/2012 Sibley
2012/0064468 A1 3/2012 Sibley
2012/0138621 A1 7/2012 Bratsch
2012/0199548 A1 8/2012 Kitto
2012/0228294 A1 9/2012 Grissom
2012/0273490 A1 11/2012 Jensen
2013/0082055 A1 4/2013 Ramsey et al.
2013/0199017 A1 8/2013 Kurosawa et al.
2013/0200034 A1 8/2013 Kaanta
2013/0240527 A1 9/2013 Philippe
2013/0320077 A1 12/2013 Trani et al.
2014/0042164 A1 2/2014 Zabaleta
2014/0238994 A1 8/2014 Christopoulos et al.
2014/0262870 A1 9/2014 Sims et al.
2014/0263150 A1 9/2014 Robinson et al.
2014/0305942 A1 10/2014 Van Goolen
2015/0013416 A1 1/2015 Hosoi
2015/0108132 A1 4/2015 McGirr et al.
2015/0136776 A1 5/2015 Chasteen et al.
2015/0190003 A1 7/2015 Kelaher
2015/0210438 A1 7/2015 Ledun et al.
2015/0225107 A1 8/2015 Ross et al.
2015/0321789 A1 11/2015 McGirr et al.
2016/0016700 A1 1/2016 Stevens
2016/0107796 A1 4/2016 Sibley
2016/0166473 A1 6/2016 Young
2016/0244213 A1 8/2016 Conley et al.

(56) References Cited

U.S. PATENT DOCUMENTS

| | | | |
|---|---|---|---|
| 2017/0129644 | A1 | 5/2017 | Jobges |
| 2017/0174398 | A1 | 6/2017 | Cox |
| 2017/0197241 | A1 | 7/2017 | Ellefson |
| 2017/0355495 | A1 | 12/2017 | Martin et al. |
| 2017/0355583 | A1 | 12/2017 | Kelly et al. |
| 2018/0002065 | A1 | 1/2018 | Thielen et al. |
| 2018/0044071 | A1 | 2/2018 | Conley et al. |
| 2018/0044155 | A1 | 2/2018 | Ross et al. |
| 2018/0134460 | A1 | 5/2018 | Ramsey |
| 2018/0148237 | A1 | 5/2018 | Sibley et al. |
| 2019/0061995 | A1 | 2/2019 | Albright |
| 2019/0112096 | A1 | 4/2019 | Gogola |
| 2019/0291914 | A1 | 9/2019 | Albright |
| 2019/0351473 | A1 | 11/2019 | Stammen |
| 2020/0031529 | A1 | 1/2020 | Van Goolen |
| 2023/0021579 | A1 | 1/2023 | Zabaleta |

FOREIGN PATENT DOCUMENTS

| | | | | |
|---|---|---|---|---|
| CA | 2929949 | A1 | 5/2015 | |
| CA | 2665477 | A1 | 10/2015 | |
| CN | 103781568 | B | 11/2015 | |
| CN | 110615174 | B | 5/2022 | |
| DE | 29914655 | U1 | 11/1999 | |
| DE | 102006051409 | A1 | 4/2008 | |
| EP | 0414249 | A2 * | 2/1991 | ..... B65D 41/18 |
| EP | 0740971 | A1 | 11/1996 | |
| EP | 0892742 | A1 | 1/1999 | |
| EP | 0828663 | B1 | 12/1999 | |
| EP | 1154934 | B1 | 4/2004 | |
| EP | 1669299 | A1 | 6/2006 | |
| EP | 2269914 | A1 | 5/2011 | |
| EP | 2086700 | B1 | 11/2011 | |
| EP | 2212215 | B1 * | 2/2012 | ..... B65D 17/506 |
| EP | 2662295 | A1 | 11/2013 | |
| EP | 2662296 | A1 | 11/2013 | |
| EP | 2555988 | A1 | 6/2014 | |
| EP | 2253396 | B1 | 12/2014 | |
| EP | 2825334 | A1 | 1/2015 | |
| EP | 2692657 | B1 | 10/2016 | |
| GB | 2297076 | A | 7/1998 | |
| GB | 2552882 | A | 2/2018 | |
| GB | 2537370 | B | 8/2019 | |
| HU | 229285 | B1 | 4/2004 | |
| JP | 2004210403 | A | 7/2004 | |
| JP | D 1214756 | | 8/2004 | |
| JP | 2005096843 | A | 4/2005 | |
| JP | 3665002 | B2 | 6/2005 | |
| JP | 2005263230 | A | 9/2005 | |
| JP | 2005280768 | A | 10/2005 | |
| JP | 4173388 | B2 | 10/2008 | |
| JP | 2010036986 | A | 2/2010 | |
| JP | 5090290 | B2 | 12/2012 | |
| JP | 5151314 | B2 | 2/2013 | |
| JP | 5290569 | B2 | 9/2013 | |
| JP | 2013244996 | A | 12/2013 | |
| JP | D1579294 | | 6/2017 | |
| JP | D 1579295 | | 6/2017 | |
| JP | D1594206 | | 1/2018 | |
| JP | D1594408 | | 1/2018 | |
| JP | D1678521 | | 2/2021 | |
| JP | D1678522 | | 2/2021 | |
| KR | 301119524.0000 | | 7/2021 | |
| KR | 301125985.0000 | | 9/2021 | |
| KR | 301125987.0000 | | 9/2021 | |
| NL | 1029298 | C1 | 8/2005 | |
| NL | 1027703 | C1 | 6/2006 | |
| NL | 1028568 | C1 | 9/2006 | |
| NL | 2001544 | C2 | 10/2009 | |
| NL | 1043564 | B1 | 9/2021 | |
| NL | 1043660 | B1 | 10/2022 | |
| WO | WO1999032363 | A1 | 11/1998 | |
| WO | WO2000064771 | A1 | 11/2000 | |
| WO | WO2002083516 | A1 | 10/2002 | |
| WO | WO2004056667 | A1 | 7/2004 | |
| WO | WO2006009483 | A2 | 1/2006 | |
| WO | WO2007054568 | A1 | 5/2007 | |
| WO | WO2008/053014 | | 5/2008 | |
| WO | WO2009115377 | A1 | 9/2009 | |
| WO | WO2009151325 | A1 | 12/2009 | |
| WO | WO2010117009 | A1 | 10/2010 | |
| WO | WO2011025327 | A2 | 3/2011 | |
| WO | WO2011078057 | A1 | 6/2011 | |
| WO | WO2011124552 | A1 | 10/2011 | |
| WO | WO 2012046215 | A1 | 4/2012 | |
| WO | WO2012112051 | A2 | 8/2012 | |
| WO | WO2012133391 | A1 | 10/2012 | |
| WO | WO2012144490 | A1 | 10/2012 | |
| WO | WO2017123502 | A1 | 7/2017 | |
| WO | WO-2017151419 | A1 * | 9/2017 | ..... B65D 17/401 |
| WO | WO2018060889 | A1 | 4/2018 | |

OTHER PUBLICATIONS

Gold Candle Jars Timplate 307# Stretch Metal Can Lids, curiousexpeditions.org, 2 Pages. Found online Nov. 11, 2015 at http://papercanspackaging.sell.curiousexpeditions.org/iz6fge2dc-gold-candle-jars-tinplate-307-images.

PCT/US2022/044747 WIPO Search Report dated Jan. 12, 2023.

* cited by examiner

THREADED CONTAINER COMPONENTS HAVING FRUSTUM SHAPED SURFACES ENABLING NESTING

CROSS-REFERENCE TO RELATED APPLICATIONS

This Non-Provisional Patent Application claims the following benefits to:

A. is a Non-Provisional Patent Application claiming the benefit of United States Provisional Utility Patent Application Ser. No. 63/248,531, filed on 26 Sep. 2021, B. is a Continuation-In-Part claiming the benefit of U.S. Non-Provisional Design patent application Ser. No. 29/777,334, filed on 5 Apr. 2021, C. wherein U.S. Non-Provisional Design patent application Ser. No. 29/777,334 is a Continuation-In-Part claiming the benefit of U.S. Non-Provisional Design patent application Ser. No. 29/777,331, filed on 5 Apr. 2021, and D. wherein U.S. Non-Provisional Design patent application Ser. No. 29/777,331 is a Continuation-In-Part claiming the benefit of U.S. Non-Provisional Design patent application Ser. No. 29/777,270, filed on 5 Apr. 2021, each of which are incorporated herein by reference.

TECHNICAL FIELD

The present invention relates to a resealable lid and cap combination for a container, including the structure, method of manufacturing, and method of use thereof. In general, the resealable lid is designed to be assembled to a container such as an aluminum can or container, a paper can or container, a plastic can or container, etc. for uses such as packaging of beverages, food, snacks, coffee grinds, pet food, pharmaceuticals (including prescription, non-prescription, *cannabis*, etc.), paint, personal and beauty products, household items, consumer goods, and the like. The container cap is removed from the container lid and assembled to the container lid by a rotational motion provided by a consumer to open and reseal the container. The rotational movement of the container cap is converted into a linear motion by an interaction between one or more rotational translative elements provided on an interior surface of a cavity formed in the container lid and a mating one or more rotational translative elements formed on an exterior surface of the container cap to effect an opening/sealing action. In a condition where an opening or passage is provided through the container lid, the container cap can be removed for access to and/or consumption of contents stored within the container and the container cap can be reassembled to the container lid to reseal the opened container. The container, container lid, and container cap are designed to be efficiently conveyed and transported during the manufacturing and product filling processes, and be compatible with existing container, container lid, and container cap manufacturing, conveyance, transport, and filling infrastructure.

BACKGROUND OF THE PRESENT INVENTION

The can industries have long sought to create a can that is both economical to produce and convenient for use by consumers. Cans or containers can be used for packaging of comestible and non-comestible products. In the past, beverage cans were provided with a "ring pull" which the consumer would grab by a ring, and pull until the pull tab was removed from the can. This created a problem in that the pull tab became disposable waste for which the consumer was responsible to ensure proper disposal. Often the consumer failed to properly dispose of the pull tab, thereby creating not only litter, but also a safety issue, in that the pull tabs could be swallowed by small children. Moreover, the edges of the pull tab were sharp enough that they could, if mishandled, cut the fingers or hands of the consumer or anyone else who handled a loose pull tab. Pull tabs were commonly disposed of by throwing the removed pull tabs onto the ground. This exposed people walking barefoot to foot injuries. Environmental consequences were also created when wildlife ate or became injured by the improperly disposed pull tabs. As a result of these problems, the industry moved in the direction of a tab that stayed on the can after opening, thereby preventing both litter and any sharp edges from coming into contact with consumers.

The present state of the art is to have a "stay-on" tab that remains attached to the can lid by a rivet formed in the can lid next to the opening. The opening is formed by a score line, or frangible "kiss cut" which breaks when the pull tab is pulled up by the consumer. The score line, when broken, produces a hinged tear panel, wherein the opened tear panel remains connected to the can lid, but the tear panel is positioned inside the can.

Beverage cans with stay-on tabs suffer from a number of deficiencies. First, they are not resealable, so that once the consumer opens the beverage; the contents are subject to loss of carbonation, product oxidation, and the influx of foreign material due to the contents being open to the surrounding environment. Secondly, in order to form the rivet which is used to secure the stay-on tab to the beverage lid, the container lid needs to be made of a different material, typically an aluminum alloy that is stronger than the aluminum alloy used to make the sides and bottom of the can. Additionally, the tab itself is typically made of a different alloy than the sides and lid, reflecting the need for a still stronger, typically stiffer material. As a result, recycling of the aluminum beverage can is problematic because the different materials need to be separated, or virgin aluminum needs to be added to reconstitute the required alloy. The use of three (3) different materials also tends to add complexity and expense to the finished container and inhibits creating a new can completely out of recycled cans.

Other solutions, such as a container seal commonly used for nuts, coffee containers, and the like utilize a flexible plastic cover that snaps over an upper brim of the container. This arrangement provides a reasonable seal, but one that is not sufficient to maintain an air tight seal, a liquid tight seal, and/or internal pressure. Additionally, the seal lacks any safety features, enabling anyone of any age to access the contents within the container.

Other solutions, such as aluminum bottles, add external threading for receiving a cap for resealability. This arrangement provides a suitable air tight seal, a liquid tight seal, and support for internal pressure, but require complex and expensive manufacturing. One impact of this design is that the bottles require additional material thickness for strength, which adds costs and impacts the environment. Another impact of this design is that the shape of the aluminum bottles creates inefficiencies when transporting empty aluminum bottles and caps from the manufacturing facility to the product filling facilities due to their inability to nest together during transport; essentially, the shipments include a large volume of air space.

Other solutions, such as aluminum can lids with resealing mechanisms, utilize various valve designs configured to provide a means to reseal the container. Some of these arrangements provide suitable air and liquid tight seal, and internal pressure, while others only provide protection against spillage. However, many of these arrangements incorporate the use of plastic components in the resealing mechanisms that are not compatible with recycling infrastructure, are expensive, and are not intuitive to use by the consumer.

A need exists for improved containers that are resealable, cost effective to produce, and "sustainable" in terms of avoiding waste and facilitating the recycling of aluminum cans and other containers. Concurrently, a need exists for improved methods for manufacturing containers, lids, and closures (caps) for manufacturing of resealable containers that result in faster production time, lower production costs, compatibility with existing can manufacturing infrastructure, and improved consumer benefits. It is preferred that the container, the container lid, and the container design would be capable of sustaining an air tight seal, a liquid tight seal, and internal pressure formed within the container when the closure (cap) is assembled to the container lid. It would also be beneficial for designs that provide efficient transportation of the containers, the container lids, and/or the closures (caps) to transport from the manufacturing facilities to the product filling facilities. It would also be beneficial that the designs of the containers, the container lids, and/or the closures (caps) remain compatible with the other aspects of can manufacturing, filling, distribution, and recycling infrastructure.

BRIEF DESCRIPTION OF THE PRESENT INVENTION

A container has a sidewall and integrally formed bottom. The container is preferably a beverage container, but could be adapted to any suitable container, such as a container for food, snacks, and the like; a paint can; a pharmaceutical container; a container for personal and beauty products; a container for household products; a container for consumer goods; and the like. A top lid includes a socket integrally formed therein; the socket including a tubular sidewall and a bottom wall. The container lid can include an opening or a method of creating an opening, such as a score line formed in a bottom wall. The score line would define a tear panel designed to create an opening through the container lid providing access to contents packaged within the container when the score line is fractured and the tear panel is bent inward or removed. A cap is fitted to the socket. The container lid includes a lid translative motion guide feature designed to engage with a mating cap translative motion guide feature formed on the container cap. The container lid translative motion guide feature is formed in the sidewall of the container lid, preferably as a boss extending radially inward. The container cap translative motion guide feature is formed in a sidewall of the container cap. The container cap translative motion guide feature can be formed as a boss, extending radially outward from the sidewall of the container cap or as a recess extending radially inward, formed as an indentation in the sidewall of the container cap. In a thin walled design, the cap translative motion guide feature can extend radially outward from the sidewall of the container cap as a boss or the cap translative motion guide feature can extend radially inward as a deboss or the recess formed into the sidewall of the container cap. Either configuration can work with the radially inwardly extending translative motion guide feature of the container lid.

In an alternative arrangement, the translative motion guide feature of the container lid can be formed as a deboss or the recess formed into the sidewall of the container lid. In this arrangement, the translative motion guide feature of the container cap is preferably formed as a boss, extending radially outward from the sidewall of the container cap.

The mating pair of translative motion guide features formed in the container lid and cap can be formed as a projection and a cam, a first threaded feature and a mating, second threaded feature, a first linear threaded feature and a mating, second linear threaded feature, a first non-linear threaded feature and a mating, second non-linear threaded feature, a first linear threaded feature and a mating, second non-linear threaded feature, a first non-linear threaded feature and a mating, second linear threaded feature, a projection and a groove, a projection and a ramp, a first ramp and a second, mating ramp, or any other suitable translative interface where the translative motion guide feature interface translates a rotational motion of a first respective object to a second respective object into an axial motion between the first respective object and the second respective object.

In one example, cam surfaces, formed as grooves or slots on the cap, cooperate with bosses or detents formed in the generally cylindrical sidewall of the socket or sidewall of the container lid. The design of the cam surfaces and associated bosses translate the rotational motion of the container cap into linear, axial motion. This translative motion can be used to provide a liquid and gas impervious seal formed between the container cap and the container lid. It is preferred that the seal be capable of withstanding pressure within the container. The pressure supporting capability of the seal can be enhanced by incorporating features in the design of the container cap and/or the design of the container lid to aid in the container capable of retaining a pressure within the container.

Once opened, the container cap can be re-fitted into the socket, so that the translative motion guide feature of the container cap engages with the translative motion guide feature of the container lid. As the container cap is rotated respective to the container lid, the rotational motion is translated into an axial motion. The axial motion draws the container cap and lid towards one another forming a seal therebetween. The formed seal protects the contents of the container from an ambient atmosphere. This will result in the prevention of spillage, the loss of carbonation, exposure to oxygen, and the prevention of foreign objects from entering the container. The user can opt to discard, recycle, or reuse the container cap and/or container once the entire contents of the container are consumed.

In one example, the container is a beverage container, commonly referred to as a "can". The same principals described herein could be adapted for use on other types of containers, including bottles made of various materials, including plastic, paper, metal (such as aluminum, tin, steel, and stainless steel), cartons, cups, glasses, etc. In one particularly preferred embodiment, the container can be an aluminum can with a body manufactured of an aluminum alloy material, and a container lid being manufactured of the same aluminum alloy material as the container. The container cap can be made of the same aluminum alloy material as the container and container lid, or of a material such as metal, plastic, molded paper pulp, glass, or any other suitable material of sufficient hardness that the surfaces of the translative motion guide feature do not deform during opening and closing operations.

In accordance with one embodiment of the present invention, the invention consists of a resealable container assembly comprising:

a generally vertical lid sidewall having a tubular frustum shape extending between an upper peripheral edge and a lower peripheral edge;

a chuck shoulder extending annularly about and extending radially outward from the generally vertical lid sidewall upper peripheral edge;

a lid container joining formation peripherally formed about and extending upward and radially outward from a peripheral outer edge of the chuck shoulder, the container lid and container joining formation being adapted to assemble the container lid to a joining formation of a container body, the container body comprising a tubular sidewall extending upward from a container body closed bottom wall; and a container lid translative motion guide feature integral with the generally vertical lid sidewall, the container lid translative motion guide feature extending radially inward from a radially interior surface of the generally vertical lid sidewall, wherein the container lid and the generally vertical lid sidewall and container joining formation are unitarily formed of the same material, wherein the container lid translative motion guide feature is adapted to engage with a mating translative motion guide feature of a container cap to guide and retain the container cap in a position providing a seal between the container lid and container cap.

Container Body—General Design

In a second aspect, the container body is substantially tubular and the bottom wall is integrally formed with the sidewall.

In yet another aspect, the container body is substantially tubular and the bottom wall is contiguous with the sidewall.

In yet another aspect, the container body is generally tubular and the bottom wall is integrally formed with the sidewall.

In yet another aspect, the container body is generally tubular and the bottom wall is contiguous with the sidewall.

In yet another aspect, the container body includes a frustum shape and the bottom wall is integrally formed with the sidewall.

In yet another aspect, the container body includes a frustum shape and the bottom wall is contiguous with the sidewall.

In yet another aspect, the container body includes a frustum shape and is designed to fit withing the cavity of an adjacent container body.

In yet another aspect, the joining formation is a rolled annular bead on the peripheral upper edge.

In yet another aspect, the joining formation is a rolled annular bead on the peripheral upper edge adapted to accept a snap-on container lid.

In yet another aspect, the joining formation is a rolled annular bead on the peripheral upper edge adapted to accept a snap-on container cap.

In another aspect, the joining formation of the container body is formed having a diameter that is smaller than a diameter of the container body.

In another aspect, the joining formation of the container body is formed having a diameter that is larger than a diameter of the container body.

In yet another aspect, the bottom wall of the container body includes a domed shape feature.

In yet another aspect, the bottom wall of the container body includes a domed shape feature, wherein the domed shaped feature extends upwards, extending into an interior volume of the container body.

In yet another aspect, the bottom wall of the container body includes a boss shape feature.

In yet another aspect, the bottom wall of the container body includes a boss shape feature, wherein the boss shaped feature extends upwards, extending into an interior volume of the container body.

In another aspect, the joining formation of the container body is designed to be rolled together with the lid container joining formation to create a container body and lid assembly seam (alternatively referred to as a double-seam).

In another aspect, the joining formation of the container body is formed having an annular or circular shape and the container body is formed having any cross sectioned shape.

In another aspect, the joining formation of the container body is formed having an annular or circular shape and the container body is formed having a circular cross sectioned shape.

In another aspect, the joining formation of the container body is formed having an annular or circular shape and the container body is formed having a non-circular cross sectioned shape.

In another aspect, the joining formation of the container body is formed having an annular or circular shape and the container body is formed having a spiral cross sectioned shape.

In another aspect, the joining formation of the container body is formed having an annular or circular shape and the container body is formed having a rectangular cross sectioned shape.

In another aspect, the joining formation of the container body is formed having an annular or circular shape and the container body is formed having a square cross sectioned shape.

In another aspect, the joining formation of the container body is formed having an annular or circular shape and the container body is formed having a polygonal cross sectioned shape.

In another aspect, the joining formation of the container body is formed having an annular or circular shape and the container body is formed having a segmented cross sectioned shape.

In yet another aspect, the container body includes annular demarcations to delineate certain volumes within the container cavity.

In yet another aspect, the container body includes annular reinforcement features to aid in stiffening the container sidewall.

In yet another aspect, the container body includes a stacking feature.

In yet another aspect, the container body includes a stacking feature, the stacking feature being defined by an inverted frustum shape proximal the bottom wall of the container body

Container Body—Sealing

In yet another aspect, the container body includes a sealing surface.

In yet another aspect, the container body includes a sealing surface, wherein the sealing surface is designed to engage with a mating sealing surface of the container cap.

In yet another aspect, the container body includes a sealing surface, wherein the sealing surface is formed as an annular ring about a surface of a rolled annular ring of the container body.

In yet another aspect, the container body includes a sealing surface, wherein the sealing surface is provided as an annular ring about a radially inward facing surface of the double seam of the container lid and container body assembly.

Lid—General Design

In another aspect, the container lid additionally includes a container lid bottom wall extending in a substantially radial direction inward respective to the generally vertical lid sidewall;

In yet another aspect, the container lid includes a container lid bottom wall, a sidewall extending generally perpendicular to and circumscribing a peripheral edge of the bottom wall, and a seaming panel (alternatively referred to as a lid joining formation) formed about a free end of the sidewall.

In yet another aspect, the container lid sidewall is contiguous with the peripheral edge of the container lid bottom wall.

In yet another aspect, the container lid includes a countersink formed between the container lid bottom wall and the container lid sidewall.

In yet another aspect, the container lid translative motion guide features are formed in the container lid sidewall.

In yet another aspect, the container lid includes a chuck shoulder formed between the container lid sidewall and the seaming panel.

In yet another aspect, the container lid includes the chuck shoulder formed as a substantially radial element and a chuck wall formed as a generally vertical element.

In yet another aspect, the chuck shoulder and the chuck wall include a small radial transition section extending therebetween.

In yet another aspect, the chuck shoulder is located closer to an upper edge of the container lid compared to the container lid translative motion guide features.

In yet another aspect, the chuck shoulder is located about an upper edge of the container lid sidewall.

In yet another aspect, the chuck shoulder is located about the upper edge of the container lid sidewall, whereas the container lid translative motion guide features are formed in the container lid sidewall.

In yet another aspect, the container lid is fabricated from a single sheet of planar material.

In yet another aspect, the container lid is fabricated from two (2) portions of planar material, the container lid being fabricated from the first portion of the sheet of planar material and a Stay-On-Tab (SOT) being fabricated from the second portion of the sheet of planar material.

In another aspect, the bottom wall, the sidewall and the container lid are all made of a same material.

In yet another aspect, the bottom wall, the sidewall and the container lid are all fabricated from one planar sheet of material.

In yet another aspect, the bottom wall, the sidewall and the container lid are all fabricated from one planar sheet of material, wherein the material is a metal.

In yet another aspect, the material is selected from a group of materials, the group of materials comprising:

a. Metal,
b. Aluminum alloy,
c. Steel alloy,
d. Tin,
e. Plastic,
f. Nylon,
g. Polyvinyl chloride (PVC),
h. Polyethylene terephthalate (PETE or PET),
i. Thermoplastic elastomer (TPE),
j. High-Density Polyethylene (HDPE),
k. Polypropylene (PP),
l. Polycarbonate.

In yet another aspect, the bottom wall and the sidewall of the container lid are all fabricated from one planar sheet of material, wherein the material is aluminum.

In yet another aspect, at least one of the bottom wall, the sidewall, the seaming panel, and the container lid is made of an aluminum alloy.

In yet another aspect, the bottom wall, the sidewall, the seaming panel and the container lid are all made of the aluminum alloy.

Lid—Sealing

In yet another aspect, the container lid includes a sealing surface.

In yet another aspect, the container lid includes a sealing surface, wherein the sealing surface is designed to engage with a mating sealing surface of the container cap.

In yet another aspect, the container lid includes a sealing surface, wherein the sealing surface is formed as an annular ring on a top surface of the bottom wall of the container lid.

In yet another aspect, the container lid includes a sealing surface, wherein the sealing surface is formed as an annular ring about a surface of the sidewall adjacent to the chuck wall of the container lid.

In yet another aspect, the container lid includes a sealing surface, wherein the sealing surface is formed as an annular ring about a surface of the sidewall adjacent to the chuck shoulder of the container lid.

In yet another aspect, the container lid includes a sealing surface, wherein the sealing surface is provided as an annular ring about an upper surface of the seaming panel of the container lid.

In yet another aspect, the container lid includes a sealing surface, wherein the sealing surface is provided as an annular ring about an upper surface of the double seam of the container lid and container body assembly.

In yet another aspect, the container lid includes a sealing surface, wherein the sealing surface is provided as an annular ring about a radially inward facing surface of the double seam of the container lid and container body assembly.

In yet another aspect, the container lid includes a sealing surface, wherein the sealing surface is formed as an annular ring about a surface of a lower portion of the sidewall of the container lid.

In yet another aspect, the container lid includes a sealing surface, wherein the sealing surface is formed as an annular ring about a surface proximate the countersink of the container lid.

In yet another aspect, the container lid includes a sealing surface, wherein the sealing surface is formed as an annular ring about a surface of a rolled annular end ring of the container lid.

In yet another aspect, the container lid includes a sealing surface, wherein the sealing surface is formed as an annular ring about a surface of a rolled annular end ring formed at a lower edge of the sidewall of the container lid.

In yet another aspect, the container lid includes a sealing surface, wherein the sealing surface is formed as an annular ring about at least one of (a) an upper surface of a rolled annular end ring formed at a lower edge of the sidewall of the container lid and (b) a radially inner surface of the rolled annular end ring formed at the lower edge of the sidewall of the container lid.

Lid—Socket

In yet another aspect, the container lid includes a socket extending downwardly into an interior space of the container body, the socket including a sidewall and a bottom wall. The container cap including a sidewall and a bottom wall, and wherein the container cap is adapted to fit into the socket.

In yet another aspect, the socket of the container lid is formed within the planar base panel of the container lid.

In yet another aspect, the socket of the container lid is located proximate a circumferential edge of the container lid.

In yet another aspect, the entire peripheral edge of the socket of the container lid is concentrically located respective to the seaming panel or the circumferential edge of the container lid.

In yet another aspect, a peripheral edge wall of the socket of the container lid is located between a seaming panel and a peripheral countersink.

In yet another aspect, the peripheral edge wall of the socket of the container lid is arranged being generally vertically oriented.

In yet another aspect, the peripheral edge wall of the socket of the container lid is arranged being generally vertically oriented, the peripheral edge wall further comprising at least one lid translative motion guide feature.

In yet another aspect, the peripheral edge wall of the socket of the container lid is arranged being generally vertically oriented; the peripheral edge wall further comprising two (2) lid translative motion guide features.

In yet another aspect, the peripheral edge wall of the socket of the container lid is arranged being generally vertically oriented; the peripheral edge wall further comprising three (3) lid translative motion guide features.

In yet another aspect, the peripheral edge wall of the socket of the container lid is arranged being generally vertically oriented; the peripheral edge wall further comprising four (4) lid translative motion guide features.

In yet another aspect, the peripheral edge wall of the socket of the container lid is arranged being generally vertically oriented; the peripheral edge wall further comprising five (5) lid translative motion guide features.

In yet another aspect, the peripheral edge wall of the socket of the container lid is arranged being generally vertically oriented; the peripheral edge wall further comprising six (6) lid translative motion guide features.

In yet another aspect, the peripheral edge wall of the socket of the container lid is arranged being substantially vertically oriented.

In yet another aspect, the peripheral edge wall of the socket of the container lid is arranged being substantially vertically oriented, the peripheral edge wall further comprising at least one lid translative motion guide feature.

In yet another aspect, the socket additionally includes an assembly element for assembling and retaining a secondary component to the container lid.

In yet another aspect, the assembly element formed within the socket is located within the sidewall of the socket.

In yet another aspect, the assembly element formed within the sidewall of the socket is provided in a form of a lid translative motion guide feature.

In yet another aspect, the assembly element formed within the sidewall of the socket is provided in a form of a cam track.

In yet another aspect, the assembly element formed within the sidewall of the socket is provided in a form of a cam engaging projection.

In yet another aspect, the assembly element formed within the sidewall of the socket is provided in a form of a segment of a helical thread.

In yet another aspect, the assembly element formed within the sidewall of the socket is provided in a form of a projection for engaging with a segment of a helical thread.

In yet another aspect, the assembly element formed within the sidewall of the socket is provided in a form of a segment of a groove.

In yet another aspect, the assembly element formed within the sidewall of the socket is provided in a form of a projection for engaging with a segment of a groove.

In yet another aspect, the translative motion guide feature includes a leading end and a trailing end.

In yet another aspect, the leading end of the translative motion guide feature includes an angled lead in formation.

In yet another aspect, the trailing end of the translative motion guide feature includes a rotational locking formation.

In yet another aspect, the trailing end of the translative motion guide feature includes a rotational locking formation includes a detent feature, wherein the detent feature engages with the mating translative motion guide feature.

In yet another aspect, the container lid sidewall and the socket sidewall are distinct from one another.

In yet another aspect, the container lid sidewall and the socket sidewall are the same.

In yet another aspect, the container lid sidewall is formed having a frustum shape extending between the upper peripheral edge and the lower peripheral edge, wherein the frustum shape has a sidewall angle enabling nesting between two container lids.

In yet another aspect, the container lid sidewall is formed having a frustum shape extending between the upper peripheral edge and the lower peripheral edge, wherein the frustum shape has a sidewall angle enabling nesting between two container lids, wherein an interior surface of each lid translative motion guide feature nests against an exterior surface of the sidewall of a second container lid inserted into the first container lid.

In yet another aspect, the container lid sidewall is formed having a frustum shape extending between the upper peripheral edge and the lower peripheral edge, wherein the frustum shape has a sidewall angle enabling nesting between two container lids, wherein an interior surface of each lid translative motion guide feature nests against an exterior surface of the sidewall of a second container lid inserted into the first container lid, wherein a bottom surface of a container lid bottom wall of the second container lid is located proximate to an upper surface of a bottom wall of the first container lid.

In yet another aspect, the container lid sidewall is formed having a frustum shape extending between the upper peripheral edge and the lower peripheral edge, wherein the frustum shape has a sidewall angle enabling nesting between two container lids, wherein an interior surface of each lid translative motion guide feature nests against an exterior surface of the sidewall of a second container lid inserted into the first container lid, wherein a bottom surface of a container lid bottom wall of the second container lid is located proximate to an upper surface of a stay-on tab of the first container lid.

In yet another aspect, the container lid sidewall is formed having a frustum shape extending between the upper peripheral edge and the lower peripheral edge, wherein the frustum shape has a sidewall angle enabling nesting between two container lids, wherein an interior surface of each lid translative motion guide feature nests against an exterior surface of the sidewall of a second container lid inserted into the first container lid, wherein a top, exterior surface of a seaming panel (joining formation) of the first container lid is located proximate to an interior (underside) surface of a seaming panel (joining formation) of the second container lid.

In yet another aspect, the container lid additionally includes a countersink formed about a periphery of the lower peripheral edge of the container lid.

In yet another aspect, the container lid additionally includes a countersink formed about a periphery of the lower peripheral edge of the container lid, the countersink extending between a first, radially outer edge of the countersink and a second, radially inner edge, the first, radially outer edge being contiguous with a lower edge of the container lid sidewall and the second, radially inner edge being contiguous with the radial bottom surface of the container lid.

In yet another aspect, the container lid additionally includes a countersink formed about a periphery of the lower peripheral edge of the container lid, wherein the countersink is formed having a U-shaped bottom.

In yet another aspect, the container lid additionally includes a countersink formed about a periphery of the lower peripheral edge of the container lid, wherein the countersink is formed having a v-shaped bottom.

In yet another aspect, the container lid additionally includes a countersink formed about a periphery of the lower peripheral edge of the container lid, wherein the countersink is formed having a chamfered bottom.

In yet another aspect, the container lid additionally includes a countersink formed about a periphery of the lower peripheral edge of the container lid, wherein the countersink is formed having a chamfered bottom, wherein the chamfered bottom includes a radial bottom surface, a first 45 degree chamfered wall segment extending between a first, radially outer edge of the radial bottom surface and the sidewall and a second 45 degree chamfered wall segment extending between a second, radially inner edge of the radial bottom surface and the bottom wall.

Lid—Stay-on Tab (SOT) Design

In yet another aspect, the container lid can include a currently commercially available Stay-On Tab (SOT) design.

In yet another aspect, the container lid can include a currently commercially available Stay-On Tab (SOT) design includes a Stay-On Tab (SOT) secured to the bottom wall of the container lid.

In yet another aspect, the container lid can include a currently commercially available Stay-On Tab (SOT) design includes a Stay-On Tab (SOT) secured to the bottom wall of the container lid by a rivet.

In yet another aspect, the container lid can include a currently commercially available Stay-On Tab (SOT) design includes a Stay-On Tab (SOT) secured to the bottom wall of the container lid by a rivet formed in the bottom wall of the container lid.

In yet another aspect, the container lid can include a currently commercially available Stay-On Tab (SOT) design includes a Stay-On Tab (SOT) secured to the bottom wall of the container lid by a rivet integrally formed in the bottom wall of the container lid.

In yet another aspect, the container lid can include a currently commercially available Stay-On Tab (SOT) design, wherein the Stay-On Tab (SOT) works in conjunction with a score line formed in an upper surface of the bottom wall of the container lid.

In yet another aspect, the container lid can include a currently commercially available Stay-On Tab (SOT) design, wherein the Stay-On Tab (SOT) works in conjunction with a score line formed in an upper surface of the bottom wall of the container lid, wherein the score line is provided in a shape creating a tear panel.

In yet another aspect, the container lid can include a currently commercially available Stay-On Tab (SOT) design, wherein the Stay-On Tab (SOT) works in conjunction with a score line formed in an upper surface of the bottom wall of the container lid, wherein the score line is provided in a shape creating a tear panel and a hinge for the tear panel.

In yet another aspect, the tear panel is formed to further include a tear panel reinforcement section.

In yet another aspect, the container lid bottom wall can include reinforcing formations to maintain a desired shape.

In yet another aspect, the tear panel portion of the container lid bottom wall can include reinforcing formations to maintain a desired shape.

In yet another aspect, the container lid can include a currently commercially available Stay-On Tab (SOT) design, which additionally includes at least one reinforcing element formed in the bottom wall of the container lid.

In yet another aspect, the container lid can include a currently commercially available Stay-On Tab (SOT) design, which additionally includes a finger clearance formed in the bottom wall of the container lid.

In yet another aspect, the container lid bottom wall can include formations to improve ergonomic accessibility to at least one feature.

In yet another aspect, the container lid bottom wall can include formations to improve ergonomic accessibility to the tab.

In yet another aspect, the container lid can include a reinforced section formed surrounding the currently commercially available Stay-On Tab (SOT) design.

Lid—Open Lid Design

In yet another aspect, the container lid can include a rolled annular end ring.

In yet another aspect, the container lid can include a rolled annular end ring, wherein the rolled annular end ring is formed by rolling the material at the lower edge of the sidewall in an outward direction.

In yet another aspect, the rolled annular end ring is formed having a circular cross section shape.

In yet another aspect, the rolled annular end ring is formed having a non-circular cross section shape.

In yet another aspect, the rolled annular end ring is formed having an elliptical cross section shape.

In yet another aspect, the container lid can include a rolled annular end ring forming a passageway.

In yet another aspect, the rolled annular end ring is formed having a semi-circular cross section shape.

In yet another aspect, the rolled annular end ring is formed having a semi-circular cross section shape, wherein the rolled annular end ring is formed by rolling the material at the lower edge of the sidewall in an outward direction at least 180 degrees.

In yet another aspect, the rolled annular end ring is formed having a semi-circular cross section shape, wherein the rolled annular end ring is formed by rolling the material at the lower edge of the sidewall in an outward direction at least 270 degrees.

In yet another aspect, the rolled annular end ring is formed having a semi-circular cross section shape, wherein the rolled annular end ring is formed by rolling the material at the lower edge of the sidewall in an outward direction to approximately 360 degrees.

Lid—Peel Off Foil Design

In yet another aspect, the container lid can include a currently commercially available peel off foil design.

In yet another aspect, the container lid can include an opening or passageway accessing contents within the container.

In yet another aspect, the opening or passageway of the container lid can be defined by a sheared edge of a bottom wall of the container lid.

In yet another aspect, the opening or passageway of the container lid can be defined by a rolled edge along a lower portion of a sidewall of the container lid.

In yet another aspect, the container lid can include an opening or passageway accessing contents within the container, the passageway being covered and sealed by a peel off foil member.

In yet another aspect, the container lid can include a currently commercially available peel off foil design includes an actuation tab hingeably formed with a peel off foil body.

In yet another aspect, the container lid can include a currently commercially available peel off foil design includes the actuation tab hingeably formed with the peel off foil body, wherein the actuation tab is unitarily formed with the peel off foil body.

In yet another aspect, the peel off foil member includes an actuation tab hingeably formed with a peel off foil body.

In yet another aspect, the peel off foil member is initially sealed to an upper surface of the container lid.

In yet another aspect, the peel off foil member is initially sealed to an upper surface of the container lid using an adhesive.

In yet another aspect, the peel off foil member is initially sealed to an upper surface of the container lid using an adhesive, wherein the adhesive is formulated to reside on the foil when the foil is removed from the container lid.

In yet another aspect, the peel off foil member is initially sealed to an upper region of the rolled edge of the container lid.

In yet another aspect, the peel off foil member is initially sealed to an upper surface of the bottom wall of the container lid.

In yet another aspect, the peel off foil member can be fabricated of an aluminum sheet.

In yet another aspect, the peel off foil member can be fabricated of any suitable material, wherein the suitable material provides Oxygen and a moisture barrier.

In yet another aspect, the peel off foil member can be fabricated of any suitable material, including an aluminum sheet, a stainless steel sheet, a copper sheet, a plastic sheet, a waxed paper sheet, polyethylene (PE), high-density polyethylene (HDPE), polyethylene terephthalate (PET), polypropylene (PP) and polyvinyl chloride (PVC), a heat induction sealing material, or any other suitable material.

Lid—Translative Motion Guide Feature

In yet another aspect, the container lid further comprising a socket adapted to receive the container cap and a lid translative motion guide feature, wherein the lid translative motion guide feature includes elements formed on opposing generally cylindrical surfaces of the socket.

In yet another aspect, the container lid further comprising a socket adapted to receive the container cap and a lid translative motion guide feature, wherein the lid translative motion guide feature extends radially inward from the sidewall of the container In yet another aspect, the lid translative motion guide feature can be a boss feature that slideably engages with a cam surface, multiple boss features that slideably engages with multiple cam surfaces, a ramp surface engaging with a mating surface, multiple ramp surfaces engaging with one or more surfaces, a first ramp surface engaging with a second ramp surface, multiple first ramp surfaces engaging with multiple second ramp surfaces, a first threaded surface engaging with a second threaded surface, a pair of first threaded surfaces engaging with a pair of second threaded surfaces, a plurality of first threaded surfaces engaging with a like plurality of second threaded surfaces, and the like.

In yet another aspect, the threaded surfaces can be formed having a helical thread shape.

In yet another aspect, each translative motion guide feature is formed on an outer cylindrical surface of the container cap, and projections are formed on the inner cylindrical surface of the socket, wherein each translative motion guide feature is adapted to engage the projections whereby rotational movement of the container cap imparts translational movement to the container cap.

In yet another aspect, the first drive system for driving the container cap into operable engagement with the tear panel, thereby pushing the tear panel into the can to form an opening in the container lid; and a second drive system, operable in response to the first drive system, to increase the engagement between the container cap and the tear panel, wherein the container cap includes a sharp projection formed in a center of the bottom wall of the container cap, and the socket includes a score line formed in a center of the bottom wall of the socket, in juxtaposition to the sharp projection when the container cap is positioned in the socket.

In yet another aspect, the second drive means includes a second linear motion drive mechanism, capable of converting rotational motion of the container cap into a separation force applied upon the tear panel.

In yet another aspect, the first linear motion drive mechanism includes first and second cam structures, formed respectively on the container cap cylindrical sidewall and socket cylindrical sidewall.

In yet another aspect, the second linear motion drive mechanism includes third and fourth cam structures, formed respectively on the container cap bottom wall and the socket bottom wall.

In yet another aspect, the first cam structure includes a groove formed in the container cap cylindrical sidewall, and the second cam structure includes at least one projection formed on the socket cylindrical sidewall.

In yet another aspect, the third cam structure includes at least one cap ramp and the fourth cam structure includes at least one socket ramp in sliding engagement with the at least one cap ramp.

In yet another aspect, the at least one cap ramp includes three ramps arranged peripherally around the container cap bottom wall, in sliding engagement with the at least one socket ramp.

In yet another aspect, the container cap second linear drive mechanism element is a first series of ramps, and the mating socket second linear drive mechanism element is a second series of ramps, wherein each ramp of the first series of ramps and each associated ramp of the second series of ramps are in sliding engagement with one another.

In yet another aspect, at least a portion of the ramp is configured to be an embossed feature, extending downward from the bottom surface of the container cap.

In yet another aspect, at least a portion of the ramp is configured to be a debossed feature, extending upward from the bottom surface of the container cap.

In yet another aspect, at least a portion of the ramp is configured to be an embossed feature, extending downward from the bottom surface of the container cap.

In yet another aspect, at least a portion of the ramp is configured to be an embossed feature, extending downward from the bottom surface of the container cap and a second portion of the ramp is configured to be a debossed feature, extending upward from the bottom surface of the container cap.

In yet another aspect, the opening process includes a mechanism enabling the container cap to distally separate from the container lid upper surface, thus separating the sealing element from the upper surface of the container cap receiving socket bottom wall, eliminating any friction between the sealing element and the associated mating surface.

In yet another aspect, separation of the sealing element and the associated mating surface enables depressurization of the pressurized contents within container to eliminate missiling.

In yet another aspect, the lid translative motion guide feature can be formed using an elastomer applied to the container lid.

In yet another aspect, the lid translative motion guide feature can be formed using the elastomer applied to the socket wall of the container lid.

In yet another aspect, the lid translative motion guide feature can be formed using the elastomer applied to the socket wall of the container lid, wherein the socket wall is the sidewall.

In yet another aspect, the lid translative motion guide feature can be formed by dispensing the elastomer onto the socket wall of the container lid.

In yet another aspect, the lid translative motion guide feature can be formed by dispensing the elastomer onto the socket wall of the container lid, wherein the socket wall is the sidewall.

In yet another aspect, the lid translative motion guide feature can be formed by dispensing the elastomer onto the socket wall of the container lid and using a mating lid translative motion guide feature of the container cap to shape the dispensed elastomer into a desired shape creating the lid translative motion guide feature. The formed elastomer remains bonded to the socket sidewall of the container lid.

In yet another aspect, the lid translative motion guide feature can be formed by dispensing the elastomer onto the socket wall of the container lid and using a mating lid translative motion guide feature of the container cap to shape the dispensed elastomer into a desired shape creating the lid translative motion guide feature. The formed elastomer remains bonded to at least a portion of a countersink, the socket sidewall, a chuck wall, and/or at least a portion of the seaming panel of the container lid.

In yet another aspect, the lid translative motion guide feature can be formed by dispensing the elastomer onto the socket wall of the container lid and using a mating lid translative motion guide feature of the container cap to shape the dispensed elastomer into a desired shape creating the lid translative motion guide feature, wherein the lid translative motion guide feature has a thread shape.

In yet another aspect, the lid translative motion guide feature can be formed by dispensing the elastomer onto the socket wall of the container lid and using a mating lid translative motion guide feature of the container cap to shape the dispensed elastomer into a desired shape creating the lid translative motion guide feature, wherein the lid translative motion guide feature includes a plurality of like threaded shapes.

In yet another aspect, the elastomer can be dispensed onto any existing container lid, including a currently commercially available Stay-On Tab (SOT) design, ring-pull design, full panel ring-pull easy open design, and foil peel-off membrane design.

Lid—Score Line

In yet another aspect, the score line is adapted to define a pathway for initiating and propagating a fracture defining a tear panel from the container lid planar based bottom or socket bottom wall.

In yet another aspect, the score section is formed upon the container lid planar base bottom.

In yet another aspect, the score section is formed upon an exterior (exposed) surface of the container lid planar base bottom.

In yet another aspect, the score section is formed upon an interior (concealed) surface of the container lid planar base bottom.

In yet another aspect, the score section is formed upon at least one of an exterior surface of the container lid planar base bottom and an interior surface of the container lid planar base bottom.

In yet another aspect, the score section is formed upon a socket bottom wall, wherein the socket is formed within the container lid planar base bottom.

In yet another aspect, the score section is concentric with respect to the container lid socket sidewall.

In yet another aspect, the score section is located off-center with respect to the container lid socket sidewall.

In yet another aspect, the score section is formed having a pair of score grooves; the pair of score grooves is arranged substantially parallel to one another.

In yet another aspect, the score section is formed having a pair of score grooves; the pair of score grooves is joined to one another at one end.

In yet another aspect, the score section is formed having a pair of score grooves; the pair of score grooves is joined to one another at one end by a loop formation.

In yet another aspect, the score line is shaped initiating at a looped segment and having a pair of line segments extending from each end of the looped segment, the pair of line segments extending in a like direction generally following a peripheral edge of the socket bottom wall.

In yet another aspect, the score line is shaped initiating at a looped segment and having a pair of line segments extending from each end of the looped segment, the pair of line segments extending in a like direction generally following a peripheral edge of the socket bottom wall, wherein the pointed projection is in alignment with a center of the looped segment of the score line.

In yet another aspect, the score line is formed in an "S" shape.

In yet another aspect, the score line is formed in an "S" shape, defining a pair of tear panels.

In yet another aspect, the score line is formed in an "S" shape, defining a pair of tear panels, wherein each end of the score line defines a respective hinge for the respective tear panel.

In yet another aspect, the score line is adapted to define a hinge section.

In yet another aspect, the container lid further comprising a hinge section defined by ends of the score line, wherein the hinge section extends between the tear panel and the annular surface maintaining attachment of the tear panel to the planar member when the score line is fractured.

In yet another aspect, the score line is formed using a single score forming step.

In yet another aspect, the score line is formed using multiple score forming steps.

In yet another aspect, the score line is formed using multiple score forming steps, wherein an intersection between ends of the first score segment formed by the first score forming step and the second score segment formed by a subsequent score forming step is facilitated by including an enlarged score area located at the intersection between the first score segment and the second score segment.

In yet another aspect, the enlarged score area adjoining two (2) separately formed score line segments is employed to perform at least one function of initiating and propagating the fracture of the score line.

In yet another aspect, the multiple score line process employs registration features formed within the container lid to maintain registration accuracy between the first score forming step and each subsequent score forming step.

In yet another aspect, the score line can be reinforced by applying a sealant material on at least one side of the material having the score line. The reinforced score line can be formed partially extending through the score receiving substrate or extend completely through the score receiving substrate.

In yet another aspect, the enlarged score area adjoining two (2) separately formed score line segments, includes a thinned material fracture section located upon a same surface as the score line, and a broader compression formed concave surface located on an opposite side of the score receiving substrate, wherein the combination ensures a desired movement of material during the forming process. The process is adapted to form the scoring fracture initiation or propagation section by the traversing displacement of the material.

In yet another aspect, the enlarged score area adjoining two (2) separately formed score line segments can be of any suitable shape, including circular, oval, oblong, square, rectangular, diamond, hexagonal, octagonal, or any other suitable shape.

In yet another aspect, at least one end of the score line includes an outward arched segment, wherein the outward arched segment is adapted to direct any additional fracturing away from the hinge formation.

In yet another aspect, both ends of the score line include outward arched segments, wherein the outward arched segments are adapted to direct any additional fracturing away from the hinge formation.

In yet another aspect, the score line can be arranged providing a counter-clockwise driven opening, having score line fracture initiating location on a left side of the tear panel and a hinge located on a right side.

In yet another aspect, the score line can be arranged providing a clockwise driven opening, having score line fracture initiating location on a right side of the tear panel and a hinge located on a left side.

In yet another aspect, the container lid includes at least one score line, wherein the score line is of a shape that defines a tear panel.

In yet another aspect, the container lid includes at least one score line, wherein the score line is of a shape that defines a hinge associated with the tear panel.

In yet another aspect, the container lid includes at least one score line, wherein the score line is of a shape that enables removal of the tear panel.

In yet another aspect, the container lid includes at least one score line, wherein the score line is of a shape that circumscribes a peripheral edge of the container lid bottom wall, enabling removal of the tear panel, wherein the tear panel is a majority or the entire bottom wall.

Lid—Reinforcement Section

In yet another aspect, the container lid further comprising a reinforcement section formed within a bottom wall of the socket of the container lid.

In yet another aspect, the container lid further comprising a reinforcement structure located about a peripheral edge of the container lid planar base bottom.

In yet another aspect, the container lid further comprising a reinforcement structure that is formed as an embossed feature extending upward into a void within the socket cavity.

In yet another aspect, the container lid further comprising a reinforcement structure that is formed as a debossed feature extending downward away from the void within the socket cavity.

In yet another aspect, the container lid further comprises a reinforcement structure that is formed having both the embossed feature extending upward into the void within the socket cavity and the debossed feature extending downward away from the void within the socket cavity.

In yet another aspect, the container lid further comprises a reinforcement structure that is formed on the planar base bottom, outward of the score line.

In yet another aspect, the container lid further comprises a reinforcement structure that is formed on the container lid planar base bottom, outward of the score line.

In yet another aspect, the reinforcement structure includes features that are employed for translation of a radial motion into at least one of an axial motion and an axial force.

In yet another aspect, the reinforcement structure includes features that are employed to induce a torsional force upon the tear panel to rotate or bend the tear panel away from the container lid planar base bottom.

In yet another aspect, the reinforcement structure is adapted to distribute the fracturing force applied by the container cap onto the tear panel to propagate the bifurcation fracturing of the score line.

In yet another aspect, the reinforcement structure can be employed for nesting of at least one feature provided on the container cap.

In yet another aspect, the container lid can include a reinforcement structure formed about the socket sidewall.

In yet another aspect, the container lid can include a reinforcement structure formed about an upper edge of the socket sidewall.

In yet another aspect, the container lid can include a reinforcement structure formed about the seaming panel of the container lid.

In yet another aspect, the container lid can include a reinforcement structure formed about a lower portion of the seaming panel of the container lid.

In yet another aspect, the container lid can include a reinforcement structure formed about the seaming panel of the container lid, wherein the reinforcement feature is employed to retain a cylindrical shape of the container lid sidewall.

In yet another aspect, the container lid can include a reinforcement structure formed about the lower portion of the seaming panel of the container lid, wherein the reinforcement structure is employed as a support for a respective seating feature of a seaming chuck.

In yet another aspect, the container lid can include a reinforcement structure formed about the lower portion of the seaming panel of the container lid, wherein the reinforcement structure is employed to provide planar support for the respective seating feature of the seaming chuck.

In yet another aspect, the container lid can include a reinforcement structure formed about a bottom edge of the socket sidewall.

In yet another aspect, the container lid can include a reinforcement structure formed about a bottom edge of the socket sidewall, wherein the reinforcement feature is a countersink.

In yet another aspect, the exclusion of the countersink enhances the ability of the container lid to funnel any residual beverage volume back towards an opened tear panel, returning the residual beverage volume to an interior of the container.

In yet another aspect, the replacement of the countersink with a frustum shaped transition between the cylindrical sidewall and the bottom wall of the container lid enhances the ability of the container lid to funnel any residual beverage volume back towards an opened tear panel, returning the residual beverage volume to an interior of the container.

Cap—General Design

In yet another aspect, the container cap is fabricated from a single sheet of planar material.

In yet another aspect, the container cap is fabricated using at least one metal forming process. The at least one metal forming process can include a stamping process, a sheering process, a drawing process, a wall ironing process, a metal pinching process, a rolling process, and the like.

In yet another aspect, the container cap is fabricated using at least one molding process. The at least one molding process can include an injection molding process, a vacuum molding process, a blow molding process, a thermoforming process, an over-molding process, a slush molding process, a transfer molding process, a pressure molding process, and the like.

In yet another aspect, the container cap is fabricated using a molding process. The molding process can include a wax or resin impregnated with the molding material.

In yet another aspect, the container cap is fabricated using a molding process. The molding process making a part that can include a wax or resin coating on the molded material.

In yet another aspect, the container cap is fabricated using a molding process. The molding process making a part that can include a plastic lining on the molded material.

In yet another aspect, the container cap is fabricated using a machining process.

In yet another aspect, the container cap is fabricated using a molding process.

In yet another aspect, the container cap is fabricated using a casting process.

In yet another aspect, a cap planar traversing wall, a sidewall, and a grip feature are all made of a same material.

In yet another aspect, the container cap planar traversing wall, the sidewall, and the grip feature are all fabricated from one planar sheet of material.

In yet another aspect, the material is selected from a group of materials, the group of materials comprising:

a. Metal,
b. Aluminum alloy,
c. Steel alloy,
d. Tin,
e. Plastic,
f. Nylon,
g. Polyvinyl chloride (PVC),
h. Polyethylene terephthalate (PETE or PET),
i. Thermoplastic elastomer (TPE),
j. High-Density Polyethylene (HDPE),
k. Polypropylene (PP),
l. Polycarbonate,
m. Waxed or resin impregnated paper/organic fiber pulp,
n. Waxed or resin coated paper/organic fiber pulp, and
o. Plastic lined paper/organic fiber pulp.

In yet another aspect, at least one of the container cap planar traversing wall, the sidewall, and the grip feature is made of an aluminum alloy.

In yet another aspect, the container cap planar traversing wall, the sidewall, and the grip feature are all made of the aluminum alloy.

In yet another aspect, the container cap can include at least one cap reinforcement structure.

In yet another aspect, the container cap reinforcement structure can be formed as a gripping element.

In yet another aspect, the container cap reinforcement structure can be formed as a sidewall.

In yet another aspect, the container cap reinforcement structure can be formed as a countersink.

In yet another aspect, the container cap reinforcement structure can be formed as at least one ramp.

In yet another aspect, the container cap reinforcement structure can be formed as a tamper indicator.

Cap—Grip

In yet another aspect, the container cap includes at least one grip.

In yet another aspect, the container cap further comprising a grip element formed in the upper end of the container cap.

In yet another aspect, the container cap further comprising at least one grip element formed about an exterior of the upper end of the container cap.

In yet another aspect, the container cap further comprising at least one grip element formed about a radially outward, exterior surface of the upper end of the container cap.

In yet another aspect, the container cap further comprising a series of grip elements formed about a radially outward, exterior surface of the upper end of the container cap.

In yet another aspect, the container cap further comprising a series of grip elements spatially formed about a radially outward, exterior surface of the upper end of the container cap.

In yet another aspect, the grip element is formed having an embossed shape, wherein the embossed shape extends radially outward from a container cap inverted countersink.

In yet another aspect, the grip element can include a series of grip enhancing features.

In yet another aspect, the grip enhancing features can be a series of axially oriented bosses.

In yet another aspect, the grip feature can be designed to receive at least one of:

- a tangential force (such as on an exterior surface of a cylindrical sidewall),
- a direct force (such as on a bar shaped grip), and
- a torsional force (such as on the pivoting grip feature).

In yet another aspect, a lid translative motion guide feature can be formed on an exterior surface of the grip cylindrical sidewall proximate a lower (free) edge thereof.

In yet another aspect, the container cap is designed to include a clearance for features of the container lid, the container lid features being located on the exterior side of the container lid.

In yet another aspect, the container cap is designed to include a clearance for features of the container lid; the container lid features being located on the exterior side of the container lid, features of the container lid can include the tab, the tab rivet, reinforcement formations, and the like.

In yet another, the container cap comprising the cylindrically shaped sidewall and the exterior (upper) surface of the container cap planar transversing surface defining a hollow interior, enables storage of goods therein, when the container cap is assembled to the container lid.

Cap—Tamper Feature

In yet another aspect, cap includes tamper evidence feature.

In yet another aspect, the tamper evidence feature of the container cap is provided as a frangible skirt circumscribing a peripheral edge of the container cap.

In yet another aspect, the container cap has an upper end having a peripheral edge, and the container cap includes a skirt formed along the peripheral edge, the skirt including an opened indicating feature for visually indicating when beverage container has been opened.

In yet another aspect, the opened indicating feature includes score lines formed radially outwardly at spaced intervals along the skirt, wherein the score lines are broken to allow movement of the skirt when the container cap moves downwardly.

In yet another aspect, the tamper indicator can be formed as an embossed dome shaped upward projection.

In yet another aspect, the embossed dome shaped upward projection operates by allowing a flexure in a direction opposite to the domed shape when unsupported. The flexibility enables the tamper indicator to report, similar to a clicking device.

In yet another aspect, the embossed dome shaped upward projection functions employing a mechanically supported configuration.

In yet another aspect, the embossed dome shaped upward projection can further include a downward projecting probe or operating element to provide support to the embossed dome shaped upward projection.

In yet another aspect, the downward projecting probe or operating element is adapted to contact the opposing surface of the container lid bottom wall. The downward projecting probe contacts the opposing surface of the container lid bottom wall. When the interior volume within the container is pressurized, the contained pressure stiffens the container lid bottom wall. Thus, in a sealed configuration, the downward projecting probe contacting the stiffened container lid bottom wall retains the tamper indicator in an upward shape. When the integrity of the container is compromised, the pressure is equalized within the interior volume of the container, thus no longer providing stiffness to the container lid bottom wall. Thus, in a compromised configuration, the downward projecting probe contacting the unsupported container lid bottom wall no longer retains the tamper indicator in an upward shape, enabling the tamper indicator to flex. The flexibility enables the tamper indicator to report, similar to a clicking device.

In yet another aspect, the embossed dome shaped upward projection functions employing a pneumatically supported configuration.

In yet another aspect, the pneumatically supported configuration employs a vacuum formed within the container. In a vacuum support configuration, the safety indicator is normally drawn towards the interior of the container.

In yet another aspect, the pneumatically supported configuration employs a pressure formed within the container. In a pressure support configuration, the safety indicator is normally forced away from the interior of the container.

In yet another aspect, the embossed dome shaped upward projection is concentrically located respective to a peripheral edge of the container cap.

In yet another aspect, the embossed dome shaped upward projection is located off centered respective to a peripheral edge of the container cap.

In yet another aspect, the tamper indicator would be formed using a fabrication process compatible with the method(s) used for manufacturing the container cap.

In yet another aspect, the downward projecting probe or operating element of the tamper indicator can alternatively be an upward projecting probe extending upward from the container cap receiving socket bottom wall of the container lid.

In yet another aspect, the container cap can be fabricated of a transparent or translucent material, enabling the user to visually inspect for a breach of the can tear panel from the bottom wall of the container lid.

In yet another aspect, the container cap can be fabricated of a transparent or translucent material, enabling the user to visually inspect for breach of the bottom wall of the container lid.

Cap and Lid Assembly—General Design

In accordance with another variant of a resealable container lid assembly in accordance with the present invention the resealable container lid assembly includes:

- a container lid comprising:
  - a frustum shaped sidewall having a generally cylindrical shape extending between an upper peripheral edge and a lower peripheral edge,
  - a seaming panel formed about the vertical sidewall upper peripheral edge, the seaming panel being adapted to assembly to the container lid to a container, a container lid rotational and axial translative guide feature integral with the vertical sidewall, and a container lid seal engaging surface;

a container lid sealing cap comprising:

a resealable container cap generally horizontally oriented traversing wall, a resealable container cap cylindrical sidewall arranged generally perpendicular to the resealable container cap generally horizontally oriented traversing wall, the resealable container cap exterior sidewall having a cylindrical shape, sized to rotationally engage with an interior surface of the container lid vertical sidewall, a grip feature adapted to receive a force to cause a rotational motion of the container lid sealing cap, a sealing cap rotational and axial translative guide feature integral with the container cap vertical sidewall, and a container cap seal engaging surface; and a sealing element arranged to provide a seal between the container lid seal engaging surface and the container cap seal engaging surface;

wherein the container cap is inserted into an interior volume defined by the container lid vertical sidewall, wherein the sealing element engages with the container lid seal engaging surface when the sealing cap rotational and axial guide feature is rotationally engaged with the container lid rotational and axial guide feature.

In another aspect, the sealing element is carried by the container lid.

In another aspect, the sealing element is carried by the container cap.

In another aspect, a first sealing element is carried by the container lid and a second sealing element is carried by the container cap.

In another aspect, the sealing cap rotational and axial guide feature is one of:

a) an at least one cam follower, and b) an at least one cam track; and wherein the container lid rotational and axial guide feature is the other of:

a) the at least one cam follower, and b) the at least one cam track.

In another aspect, the sealing cap rotational and axial guide feature is one of:

a) an at least one ramp, and b) an at least mating ramp; and wherein the container lid rotational and axial guide feature is the other of:

a) the at least one mating ramp, and b) the at least one ramp.

In another aspect, the sealing cap rotational and axial guide feature is one of:

a) an at least one ramp, and b) an at least projection designed to engage with the ramp; and wherein the container lid rotational and axial guide feature is the other of:

a) the at least one projection designed to engage with the ramp, and b) the at least one ramp.

In another aspect, the sealing cap rotational and axial guide feature is one of:

a) an at least one section of a helical thread, and b) an at least one mating section of a helical thread; and wherein the container lid rotational and axial guide feature is the other of:

a) the at least one mating section of a helical thread, and b) the at least one section of a helical thread.

In another aspect, the sealing cap rotational and axial guide feature is one of:

a) an at least one section of a helical thread, and b) an at least one projection designed to engage with the section of a helical thread; and wherein the container lid rotational and axial guide feature is the other of:

a) the at least one projection designed to engage with the section of a helical thread, and b) the at least one section of a helical thread.

In yet another aspect, wherein the container lid seal engaging surface is a frustum shaped surface formed within the container lid vertical sidewall, wherein the container cap sealing element is arranged having a frustum shaped surface adapted to engage with the frustum shaped surface of the container lid seal engaging surface.

In yet another aspect, the container lid sealing cap further comprises a tamper indicator, wherein the tamper indicator is adapted to inform a consumer when a resealable container assembly comprising the container lid has been breached.

In yet another aspect, the container cap sealing element is one of:

a) a sealing gasket carried by a bottom surface of the resealable container cap generally horizontally oriented traversing wall, b) a sealing gasket carried by an annular surface of the bottom surface of the resealable container cap generally horizontally oriented traversing wall, or c) a frustum shaped surface formed within the resealable container cap cylindrical sidewall.

Cap and Lid Assembly—Retention Features

In yet another aspect, the container lid includes a detent feature for securing the container cap in a first position associated with pre-opening, and a second position associated with post-opening.

In yet another aspect, the translative motion guide feature is provided in a form of a cam track, the cam track including a locking detent segment.

In yet another aspect, the locking detent segment is designed to retain the container cap from rotating in a reverse direction following an initial assembly of the container cap to the container cap receiving socket within the container lid.

In yet another aspect, the container cap is retained in a container pre-opened position by locating each socket sidewall cam engaging projections within each respective cam track, with each socket sidewall cam engaging projections being located following the respective embossed cam surface lower detent. Further rotation in an opening direction is hindered by an upward sloping cam groove surface segment.

In yet another aspect, the cam track includes features to retain the container cap within the container cap receiving cavity, while enabling an opening sequence, a dispensing configuration, as a sealing configuration. This can be accomplished by including a downward directed segment at an opposite end of the cam track.

In yet another aspect, the cam track can include at least one of an upper detent and a downward directed segment at an upper distal end thereof, wherein the at least one of an upper detent and a downward directed segment is adapted to curtail any further rotational motion of the container cap, thus retaining the container cap within the container cap receiving cavity of the container lid.

In yet another aspect, the detent feature is associated with the cam feature.

In yet another aspect, the pre-opening position is associated with functions of storage and transport, and the post-opening position is associated with resealing.

In yet another aspect, the detent feature includes at least a portion of the lid translative motion guide feature.

In yet another aspect, the sealing element is secondarily employed as a retention element to retain a rotational relationship between the container cap and the container lid.

Cap and Lid Assembly—Sealing Formation

In yet another aspect, a seal is formed between the container lid and the container cap, more specifically; the seal is formed between an annular seal provided on a bottom surface of the container cap and a respective sealing surface located on the upper surface of the container lid bottom wall.

In yet another aspect, the sealing feature provided on the container cap is concentrically located respective to a peripheral edge of the container cap.

In yet another aspect, a seal is formed between the container lid and the container cap, more specifically; the seal is formed between an annular seal element carried by an annular surface circumscribing a peripheral edge of the planar traversing wall of the container cap and a mating surface formed on the container lid. The mating section is formed on an annular surface circumscribing a peripheral edge of the socket bottom wall of the container lid.

In yet another aspect, a seal is formed between the container lid and the container cap, more specifically; the seal is formed between an annular seal element carried by an annular surface circumscribing a peripheral edge of the planar traversing wall of the container cap and a mating surface formed on the container lid. The mating section is formed on an annular surface circumscribing a peripheral edge of the socket bottom wall of the container lid, wherein the socket includes the container lid sidewall.

In yet another aspect, a seal is formed between the container lid and the container cap, more specifically; the seal is formed between an annular seal provided on a frustum shaped surface circumscribing an outer peripheral edge of the container cap and a mating section formed on the container lid. The mating section is formed having a frustum shape and is located interposed between the container lid seaming panel and the vertical socket sidewall.

In yet another aspect, the container lid contains a frustum shaped sidewall section, the frustum shaped sidewall section extending between the chuck shoulder and the seaming panel.

In yet another aspect, the container lid contains a frustum shaped sidewall section, the frustum shaped sidewall section extending between the chuck shoulder and the vertical socket sidewall.

In yet another aspect, the container lid contains a frustum shaped cap seal engaging annular section, the frustum shaped cap seal engaging annular section extending between the peripheral edge of the bottom wall and a lower edge of the vertical socket sidewall.

In yet another aspect, the container cap and lid form a seal between the seating arrangement of the socket and the lower surface of the container cap.

In yet another aspect, the container cap and lid form a seal between an upper surface of the substantially planar member and a contacting surface of a flange extending radially outward from a peripheral edge about the container cap.

In yet another aspect, the container cap fits substantially within the socket, and the translative motion guide feature comprises earn surfaces formed in one of the cylindrical sidewalls of the socket and the container cap, and at least one projection formed in the other of the cylindrical sidewalls of the socket and the container cap.

In yet another aspect, the translative motion guide feature is formed as at least one of: a ramp, a cam, a portion of a helical thread.

In yet another aspect, a pliant sealing element can be carried by one of the container cap or the container lid.

In yet another aspect, the pliant sealing element can be located between the container cap and the container lid.

In yet another aspect, the pliant sealing element can be an independent component of the container lid assembly, wherein the pliant sealing element would be located between the container cap and the container lid.

In yet another aspect, the container cap includes a substantially axially extending pliant annular seal that is designed to engage with an interior surface of the countersink of the container lid.

In yet another aspect, the container cap includes a substantially axially extending pliant annular seal that is designed to engage with an interior surface of the countersink of the container lid, wherein the pliant property of the material enables the substantially axially extending pliant annular seal to flex and create a reliable seal.

In yet another aspect, the substantially axially extending pliant annular seal is integral with the container cap.

In yet another aspect, the container cap includes a generally radially extending pliant annular seal that is designed to engage with an outer peripheral surface of the bottom wall of the container lid, wherein the pliant property of the material enables the generally radially extending pliant annular seal to flex and create a reliable seal.

In yet another aspect, the generally radially extending pliant annular seal extends in a radially inward direction from the container cap, In yet another aspect, the generally radially extending pliant annular seal is integral with the container cap.

In yet another aspect, the container cap includes the substantially axially extending pliant annular seal and the generally radially extending pliant annular seal.

In yet another aspect, the substantially axially extending pliant annular seal and the generally radially extending pliant annular seal are integral with the container cap.

In yet another aspect, the container cap includes a generally axially extending pliant annular seal that is designed to engage with a frustum shaped interior surface of the peripheral edge of bottom wall of the container lid.

In yet another aspect, the container lid comprising the frustum shaped interior surface is exclusive of a countersink.

In yet another aspect, the generally axially extending pliant annular seal extends from the container cap in a slightly radially inward direction.

In yet another aspect, the generally axially extending pliant annular seal extends axially, with a change in direction, where a distal segment extends in a slightly radially inward direction.

In yet another aspect, the container cap includes a generally axially extending pliant annular seal that is designed to engage with an interior surface of the countersink of the container lid, wherein the pliant property of the material enables the substantially axially extending pliant annular seal to flex and create a reliable seal.

In yet another aspect, the substantially axially extending pliant annular seal is integral with the container cap.

In yet another aspect, the container cap further comprises at least one radial sealing ring formed circumscribing an exterior cylindrical sidewall of the container cap.

In yet another aspect, each of the at least one radial sealing ring is formed extending partially radially outward from the exterior cylindrical sidewall of the container cap.

In yet another aspect, each of the at least one radial sealing ring is integrally fabricated with the container cap.

In yet another aspect, each of the at least one radial sealing ring is integrally fabricated with the container cap, wherein the container cap is of a moldable material.

In yet another aspect, each of the at least one radial sealing ring is integrally fabricated with the container cap, wherein the container cap is of a moldable material, the moldable material being one of: plastic, nylon, rubber, silicone, and the like.

In yet another aspect, wherein the material used to fabricate the at least one radial sealing ring and the material used to fabricate the container cap can be different from one another.

In yet another aspect, each of the at least one radial sealing ring is integrally fabricated with the container cap, wherein the container cap is of a moldable material, wherein plastic properties of the material enable flexure of the at least one radial sealing ring.

In yet another aspect, each of the at least one radial sealing ring is integrally fabricated with the container cap, wherein the container cap is of a molded plastic.

In yet another aspect, each of the at least one radial sealing ring is integrally fabricated with the container cap, wherein the container cap is of a molded plastic, wherein plastic properties of the material enable flexure of the at least one radial sealing ring.

In yet another aspect, each of the at least one radial sealing ring is formed extending partially axially from the exterior cylindrical sidewall of the container cap in a direction towards a bottom of the container cap.

In yet another aspect, the container cap further comprises a series of radial sealing rings formed circumscribing the exterior cylindrical sidewall of the container cap.

In yet another aspect, the container cap further comprises a series of radial sealing rings formed circumscribing the exterior cylindrical sidewall of the container cap, wherein one radial sealing ring partially overlaps an adjacent radial sealing ring.

In yet another aspect, the at least one radial sealing ring seal engages with a generally axially oriented interior surface of the container lid.

In yet another aspect, the at least one radial sealing ring seal engages with an interior surface of the seaming panel of the container lid.

In yet another aspect, the at least one radial sealing ring seal engages with an interior of the chuck wall of the container lid.

In yet another aspect, the at least one radial sealing ring seal engages with an interior of the cylindrical sidewall of the container lid.

In yet another aspect, an elastomer is disposed within the countersink.

In yet another aspect, a lower edge of the container cap engages with the elastomer disposed within the countersink to seal the container.

In yet another aspect, engagement between the elastomer disposed upon the interior surface of the cylindrical sidewall of the container lid and the threaded exterior sidewall of the container cap forms a seal.

In yet another aspect, an elastomeric sealant material is disposed upon a bottom surface of the container cap; a peripheral edge of the elastomeric sealant material forms an annular sealing feature, wherein the annular sealing feature engages with a peripheral edge of the bottom wall of the container lid.

In yet another aspect, wherein the elastomeric sealant material is applied to the container cap, adhesively bonded to the container cap, overmolded into the container cap, mechanically retained in position, and the like.

In yet another aspect, the elastomeric sealant material is disposed upon the entire bottom surface of the container cap.

In yet another aspect, the container cap further comprises a generally radially directed peripheral seal adapted to seal against the container lid cylindrical sidewall to deter dust and other contaminants from collecting within the threaded area of the container lid and the container lid countersink.

In yet another aspect, the elastomeric sealant material is formed including at least one fin-like or annular projection.

In yet another aspect, the elastomeric sealant material is formed including a plurality of fin-like or annular projections.

Cap and Lid Assembly—Container Body Seaming

In yet another aspect, the seaming panel of the container lid is joined or seamed to an upper, free edge of the container body.

In yet another aspect, the seaming panel of the container lid is joined or seamed to an upper, free edge of the container body using a two operation progressive roller that circumscribes the seaming panel.

In yet another aspect, the seaming process employs a two operation progressive roller and a seaming chuck.

In yet another aspect, the first operation roller creates a cover hook, where the seaming panel of the container lid hooks around the upper and outer edge of the container body seaming panel or flange (upper free edge), initiating the seam.

In yet another aspect, the second operation roller compresses the rolled, initiated seaming panel, finalizing the seaming process.

In yet another aspect, the seaming chuck seats against chuck wall and chuck shoulder of the container lid. The chuck wall is formed in a generally axial direction. The chuck shoulder is formed in a generally radial direction.

In yet another aspect, the seaming chuck is designed to exclusively contact the container lid.

In yet another aspect, the seaming chuck is designed to exclusively contact the container lid, wherein the seaming chuck includes a cavity which provides clearance between the seaming chuck and features of the container cap, when the container cap is assembled to the container lid during the seaming process.

In yet another aspect, the seaming chuck is designed to properly located and retain the container lid in position on the container body throughout the seaming process.

In yet another aspect, the seaming chuck provides a radial registration with the seaming chuck and the container body by contact between the seaming chuck and the generally axially directed sidewall of the container body (or container cap when included) throughout the seaming process.

In yet another aspect, the seaming chuck provides an axial registration with the seaming chuck and the container body by contact between the seaming chuck and the chuck shoulder of the container body (or container cap when included) throughout the seaming process.

In yet another aspect, the seaming chuck is employed as an anvil for the seaming roller throughout the seaming process.

In yet another aspect, the seaming chuck is designed to contact the container cap, wherein the forces respective to the seaming chuck are passed through the container cap onto the container lid.

In yet another aspect, the seaming roller includes a clearance for the container cap.

In yet another aspect, the seaming roller is designed to provide a seaming function exclusive of any contact with the container cap.

In yet another aspect, the container lid seaming panel is assembled to the container body seaming flange.

In yet another aspect, the container lid seaming panel is assembled to the container body seaming flange using a roll forming process.

In yet another aspect, the container lid seaming panel is assembled to the container body seaming flange using a roll forming process in conjunction with a compression process. The roll forming process can be completed using any suitable roll forming process. In one exemplary method, at least one roller is rotated about a stationary assembly. In a second exemplary method, the assembly is rotated about at least one stationary roller. In a third exemplary method, the assembly is rotated about at least one rotating roller.

In yet another aspect, the container lid seaming panel is assembled to the container body seaming flange using a step of applying an axial compression force to the container lid. The axial compression force application process can be completed using any suitable roll forming process.

In yet another aspect, the container lid seaming panel is assembled to the container body seaming flange using a step of applying an axial compression force to the container lid using a frustum shaped mating surface between a seaming chuck and the container lid seaming panel.

In yet another aspect, the container lid seaming panel is assembled to the container body seaming flange using a step of applying an axial compression force to the container lid by applying a compression force from the respective seating feature provided on the seaming chuck and a seaming chuck shoulder formed about an interior surface of the container lid sidewall. The respective seating feature can alternatively be referred to as a planar driving surface.

In yet another aspect, the seaming chuck can further comprise a cavity formed extending inward from a seaming chuck bottom surface, wherein the seaming chuck bottom surface cavity provides clearance for features of the container lid assembly.

In yet another aspect, the seaming chuck can further comprise a cavity formed extending inward from a seaming chuck bottom surface, wherein the seaming chuck bottom surface cavity provides clearance for features of the container lid assembly, which includes the container lid and the container cap.

In yet another aspect, the container lid seaming panel can be assembled to the container body seaming flange using a bonding process.

In yet another aspect, the container lid is adapted for deformation during subjection to and resulting from a retort process.

In yet another aspect, a tamper indicator actuator (or similar feature) ensures and maintains sufficient separation between the resealable container cap substantially horizontally oriented traversing wall (more specifically, the incisor) and the container cap receiving socket bottom wall to avoid premature fracturing of the score line during subjection to the retort process.

In yet another aspect, during the retort process, the vertical sidewall of the container lid deforms inward, pinching the cam tracks against the respective cam followers of the resealable container cap. This configuration retains the container cap within cap receiving socket of the container lid while subjected to the retort process.

Cap and Lid Assembly—Accessories

In yet another aspect, the container cap can include a child's sip cup top configuration, enabling the beverage container be converted into a child's sip cup.

In yet another aspect, the container cap can include a baby bottle "nipple" formation to convert the beverage container into a baby bottle.

In yet another aspect, the container cap can include a baby bottle "nipple" formation to convert the beverage container into a baby bottle. In accordance with this variant, the contents of the container could be infant formula.

In yet another aspect, the container cap can include an axially actuated resealable sports bottle dispensing mechanism to convert the beverage container into a sports bottle.

In yet another aspect, the container cap can include an axially actuated resealable sports bottle dispensing mechanism to convert the beverage container into a sports bottle, wherein an axial motion of a cap along a spout opens and closes the container.

In yet another aspect, the container cap can include an axially actuated resealable sports bottle dispensing mechanism to convert the beverage container into a sports bottle, wherein an axial motion of a cap along a spout opens and closes the container, wherein a top of the spout is positioned in an extended position, the container is open allowing dispensing of contents from within the container and wherein a top of the spout is positioned in an retracted position, the container is closed retaining contents within the container.

In yet another aspect, the axially actuated resealable sports bottle dispensing mechanism can include an axially oriented dispensing tube comprising a passageway, wherein the passageway is opened and sealed by an axial movement of a spout cap.

In yet another aspect, the axially actuated resealable sports bottle dispensing mechanism can include an axially oriented dispensing tube comprising a passageway, wherein the passageway is opened and sealed by an axial movement of a spout cap, the spout cap comprising a fluid passageway, wherein the cap fluid passageway is in fluid communication with the dispensing tube passageway when the cap is placed in an open position and fluid communication between the cap fluid passageway and the dispensing tube passageway is blocked when the cap is placed in a closed position.

In yet another aspect, the axially actuated resealable sports bottle dispensing mechanism can include an axially oriented dispensing tube comprising at least one passageway, wherein the passageway is opened and sealed by an axial movement of a spout cap.

In yet another aspect, the axially actuated resealable sports bottle dispensing mechanism can include an axially oriented dispensing tube comprising a passageway, wherein the passageway is opened and sealed by an axial movement of a spout cap, the spout cap comprising a fluid passageway, wherein the cap fluid passageway is in fluid communication with the dispensing tube passageway when the cap is placed in an open position and fluid communication between the cap fluid passageway and the dispensing tube passageway is blocked when the cap is placed in a closed position.

In yet another aspect, the axially actuated resealable sports bottle dispensing mechanism can include an axially oriented dispensing tube comprising at least one passageway, wherein the passageway is opened and sealed by an axial movement of a spout cap.

In yet another aspect, the container cap can include a pivotally actuated resealable bottle dispensing mechanism. The pivotally actuated resealable bottle dispensing mechanism can be provided in a form factor of a spout.

In yet another aspect, the container cap can include a pivotally actuated resealable fluid dispensing mechanism to convert the beverage container into a fluid dispensing bottle, wherein the rotational motion of a spout opens and closes the container.

In yet another aspect, the pivotally actuated resealable fluid dispensing mechanism includes a valve located at a pivoting end of the spout, wherein when the spout is oriented in a retracted position, the valve is closed, retaining fluid within the container and when the spout is oriented in a dispensing position, the valve is open, enabling dispensing of fluid from the container.

In yet another aspect, the pivotally actuated resealable fluid dispensing mechanism can include at least one fluid dispensing passageway.

In yet another aspect, the pivoting spout of the pivotally actuated resealable fluid dispensing mechanism can include at least one fluid dispensing passageway.

In yet another aspect, the pivoting spout of the pivotally actuated resealable fluid dispensing mechanism can include at least one fluid dispensing passageway, wherein the fluid dispensing passageway extends from the valve to a dispensing port.

In yet another aspect, the pivoting spout of the pivotally actuated resealable fluid dispensing mechanism can include at least one fluid dispensing passageway, wherein the fluid dispensing passageway extends from the valve to a dispensing port, wherein the dispensing port is located at a distal, free end of the pivoting spout.

In yet another aspect, the pivotally operated valve includes at least one fluid dispensing passageway extends from a valve end of the spout to a dispensing port of the spout, wherein the valve end of the dispensing passageway on the spout aligns with a dispensing port of a cap when the spout is pivotally moved into a dispensing position and a seal located adjacent to the valve end of the dispensing passageway on the spout seals the dispensing port of the cap when the spout is pivotally moved into a sealed position.

In yet another aspect, the spout can be seated within a recess formed within the cap when pivotally moved into a sealed position.

In yet another aspect, the container cap can include a slideably actuated resealable bottle dispensing mechanism. The slideably actuated resealable bottle dispensing mechanism can be provided in a form factor of a spout.

In yet another aspect, the container cap can include a slideably actuated resealable bottle dispensing mechanism. The slideably actuated resealable bottle dispensing mechanism can be provided in a form factor of a spout, wherein when the spout is slideably positioned in a first position, the container is open allowing dispensing of contents from within the container and wherein when the spout is slideably positioned in an second position, the container is closed retaining contents within the container.

In yet another aspect, the slideably actuated resealable bottle dispensing mechanism includes a dispensing passageway formed through the spout. A second valve member is located on the container cap and is designed to be in fluid communication with the dispensing passageway of the spout when the spout is slid into an open position and provides a fluid barrier between the second valve member and the dispensing passageway of the spout when the spout is slid into a closed position. The second valve member includes an aperture that is in alignment with the dispensing passageway of the spout when the spout is slid into an open position and a closure that is in alignment with the dispensing passageway of the spout when the spout is slid into a closed position.

In yet another aspect, the container cap can include a rotationally actuated resealable bottle dispensing mechanism. The rotationally actuated resealable bottle dispensing mechanism can be provided in a form factor of a spout or any other dispensing formation.

In yet another aspect, the container cap can include a rotationally actuated resealable bottle dispensing mechanism. Operation of the rotationally actuated resealable bottle dispensing mechanism can be accomplished by rotating an element comprising the spout into a first or open position where a passageway of the spout is in alignment with an aperture of a second valve member enabling dispensing of contents from within the container and rotating the element comprising the spout into a second or closed position where a passageway of the spout is in alignment with a sealing portion of the second valve member inhibiting dispensing of contents from within the container.

In yet another aspect, the container cap can include a pump dispensing mechanism. The pump dispensing mechanism can be of any suitable pump dispensing mechanism known by those skilled in the art. Commercially available examples include soap dispensers, shampoo dispensers, cleaning composition dispensers, etc. The contents of the container can be drawn through a tubular member to the pump dispensing mechanism.

In yet another aspect, the container cap can include a spray dispensing mechanism. The spray dispensing mechanism can be of any suitable spray dispensing mechanism known by those skilled in the art. Commercially available examples include water spray bottles, cleaning composition dispensers, insecticide sprayers, weed kill sprayers, etc. The contents of the container can be drawn through a tubular member to the spray dispensing mechanism.

In yet another aspect, the container cap can include a spray dispensing mechanism, wherein a trigger of the spray dispensing mechanism can be located adjacent a spray dispensing mechanism neck, wherein the user would grip the spray dispensing mechanism neck and draw the trigger towards the spray dispensing mechanism neck to actuate the spray dispensing mechanism.

In yet another aspect, the container cap can include a spray dispensing mechanism, wherein a trigger of the spray dispensing mechanism can be located adjacent the container body, wherein the user would grip the container body and draw the trigger towards the container body to actuate the spray dispensing mechanism.

In yet another aspect, the container cap can include a straw gasket for retaining a straw within a sealed cap. The container cap can be a two piece configuration (resembling a Mason jar styled two piece cap) enabling a straw aperture to remain in a rotational relationship with the dispensing aperture during assembly of the container cap to the container lid.

In yet another aspect, the container cap includes the straw gasket for retaining a straw within a sealed cap includes a pliant straw retention and sealing element. The pliant straw retention and sealing element is preferably designed having an elongated, tubular shape.

In yet another aspect, the container cap includes a projection that is adapted to extend into the dispensing aperture of the breached container lid.

In yet another aspect, the container cap includes a projection that is adapted to extend into the dispensing aperture of the breached container lid.

In yet another aspect, the container cap includes a concentric projection that is adapted to extend into the dispensing aperture of the breached container lid.

In yet another aspect, the container cap includes an off-centered projection that is adapted to extend into the dispensing aperture of the breached container lid.

In yet another aspect, the straw or any other tubular projection of the accessory can include an angled fluid collection end, wherein the angled fluid collection end enables the straw to puncture a seal provided covering the container.

In yet another aspect, the off-centered projection can be employed to maintain a rotational position of the two piece cap center component respective to the container lid during assembly of the two piece cap to the container lid.

Cap and Lid Assembly—Accessories—Two (2) Piece Closure

In yet another aspect, each accessory can include a one piece closure member.

In yet another aspect, each accessory can include a two piece closure subassembly.

In yet another aspect, each accessory can include a two piece closure subassembly comprising an outer member and an inner member.

In yet another aspect, each accessory can include a two piece closure subassembly comprising an outer member and an inner member, wherein the outer member includes at least one feature provided to engage with the at least one translative motion guide feature provided on the container lid.

In yet another aspect, each accessory can include a two piece closure subassembly comprising an outer member and an inner member, wherein the outer member includes at least one feature provided to engage with the at least one translative motion guide feature provided on the container lid and the inner member rotates independently of the outer member.

In yet another aspect, each accessory can include a two piece closure subassembly comprising an outer member and an inner member, wherein the outer member includes at least one feature provided to engage with the at least one translative motion guide feature provided on the container lid and the inner member rotates independently of the outer member, wherein the inner member is desired to remain stationary upon contact with the container while the outer member continues to rotate about the container.

In yet another aspect, the two piece configuration includes a lid translative motion guide feature disposed therebetween, wherein the lid translative motion guide feature translates a rotation of the outer member of the two piece cap configuration ring into an axial motion of the inner, non-rotating (stationary) inner member or central sealing component of the two piece cap configuration. The axial motion engages and maintains a seal between the container cap and the container lid.

In yet another aspect, one accessory can include the inner member of the two piece closure subassembly, wherein the inner member would be interchangeable with one outer member. In certain scenarios the outer member can be provided with the resealable container subassembly.

Cap and Lid Assembly—Miscellaneous Features

In yet another aspect, at least one of the container lid and the container cap include indicia presenting operating instructions for operating the container lid and cap assembly.

In yet another aspect, the operating indicia includes instructions for at least one of opening, dispensing, and closing the container cap upon the container lid.

The container cap may be included with the container or offered as a separate implement, being sold separately from the beverage container, and re-useable after washing.

In yet another aspect, the shape of the tubular container body sidewall could be one of any number of shapes including:

a. Cylindrical,
b. Spherical,
c. Conical,
d. Polygonal, or
e. Contoured tubular (examples of contoured tubular sidewalls include: COKE CONTOUR bottle/BUDWEISER BOWTIE can/HEINEKEN Keg can).

In yet another aspect, a safety ring can be provided circumscribing the peripheral edge of the inverted countersink of the container cap, wherein the safety ring rotates independent of the container cap until pressure is applied to a predetermined direction to engage the safety ring with the container cap. This acts as a child proof barrier to the contents of the container.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the various views of the drawings.

DETAILED DESCRIPTION OF THE PRESENT INVENTION

Figure 1:
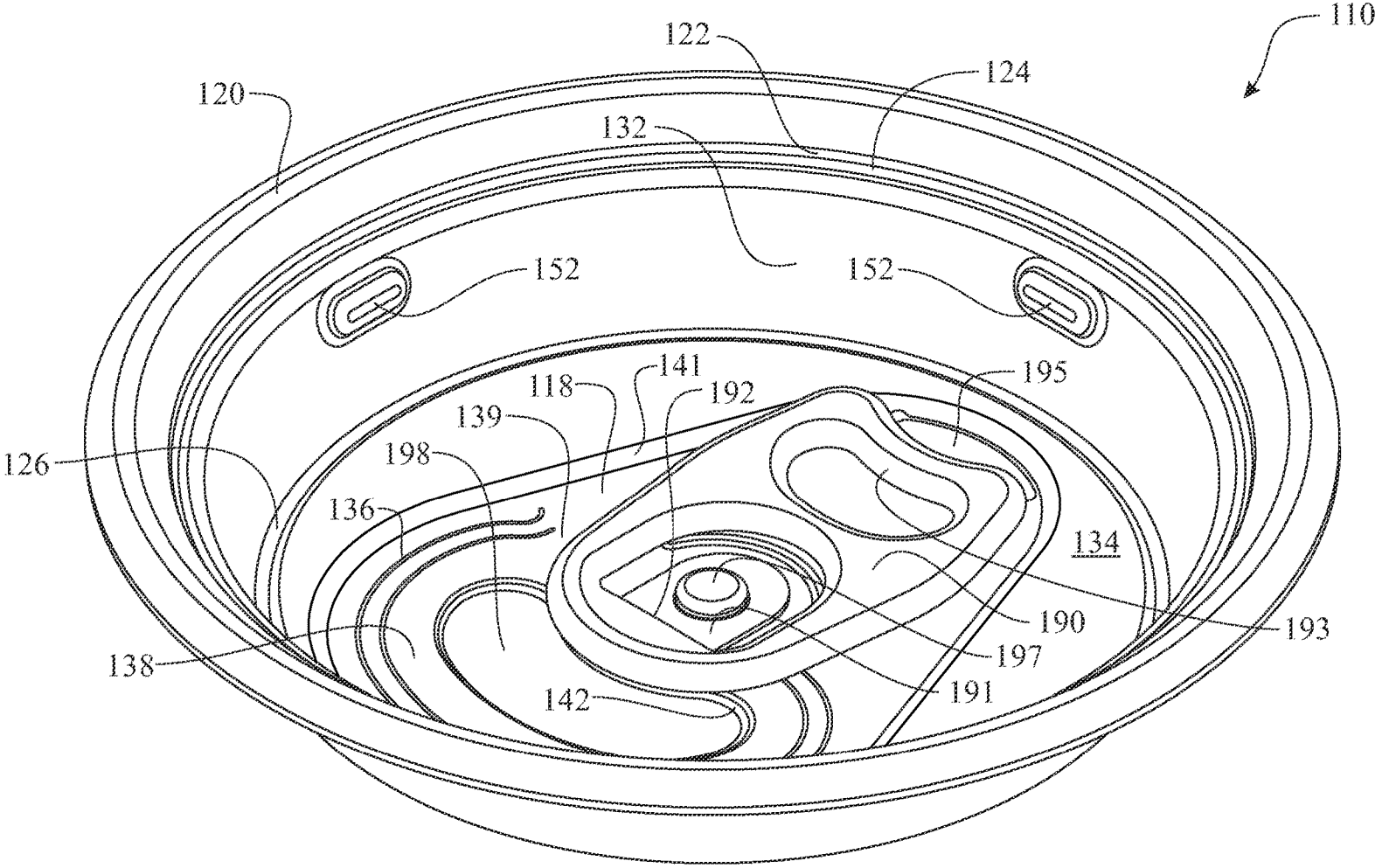
FIG. 1 presents a top, side isometric view introducing a first exemplary container lid in accordance with the present invention, wherein the first exemplary container lid includes a plurality of lid translative motion guide features integral within a frustum shaped sidewall and a Stay-On-Tab (SOT) arrangement provided on a lid bottom wall.
Figure 2:
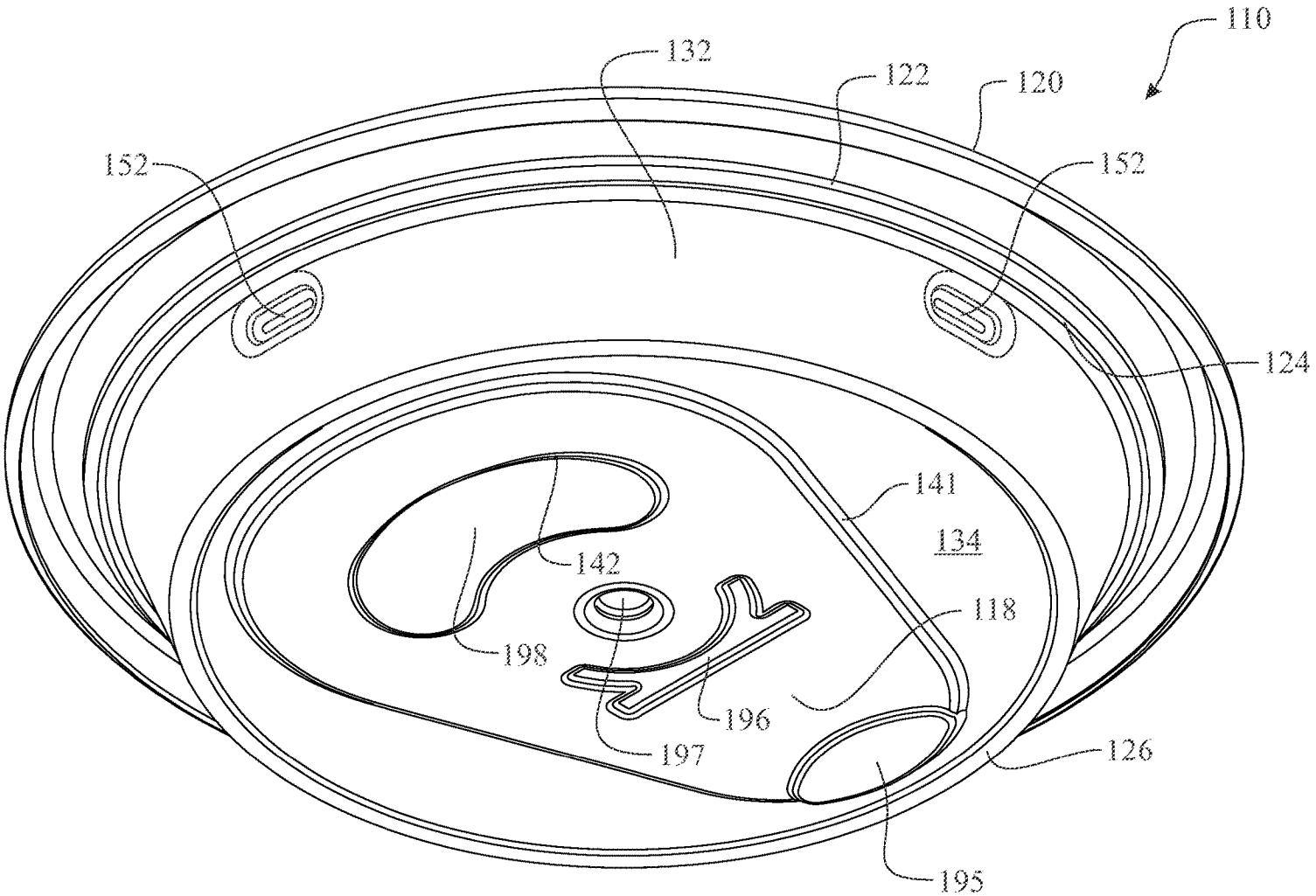
FIG. 2 presents a bottom, side isometric view of the first exemplary container lid originally introduced in FIG. 1.
Figure 3:
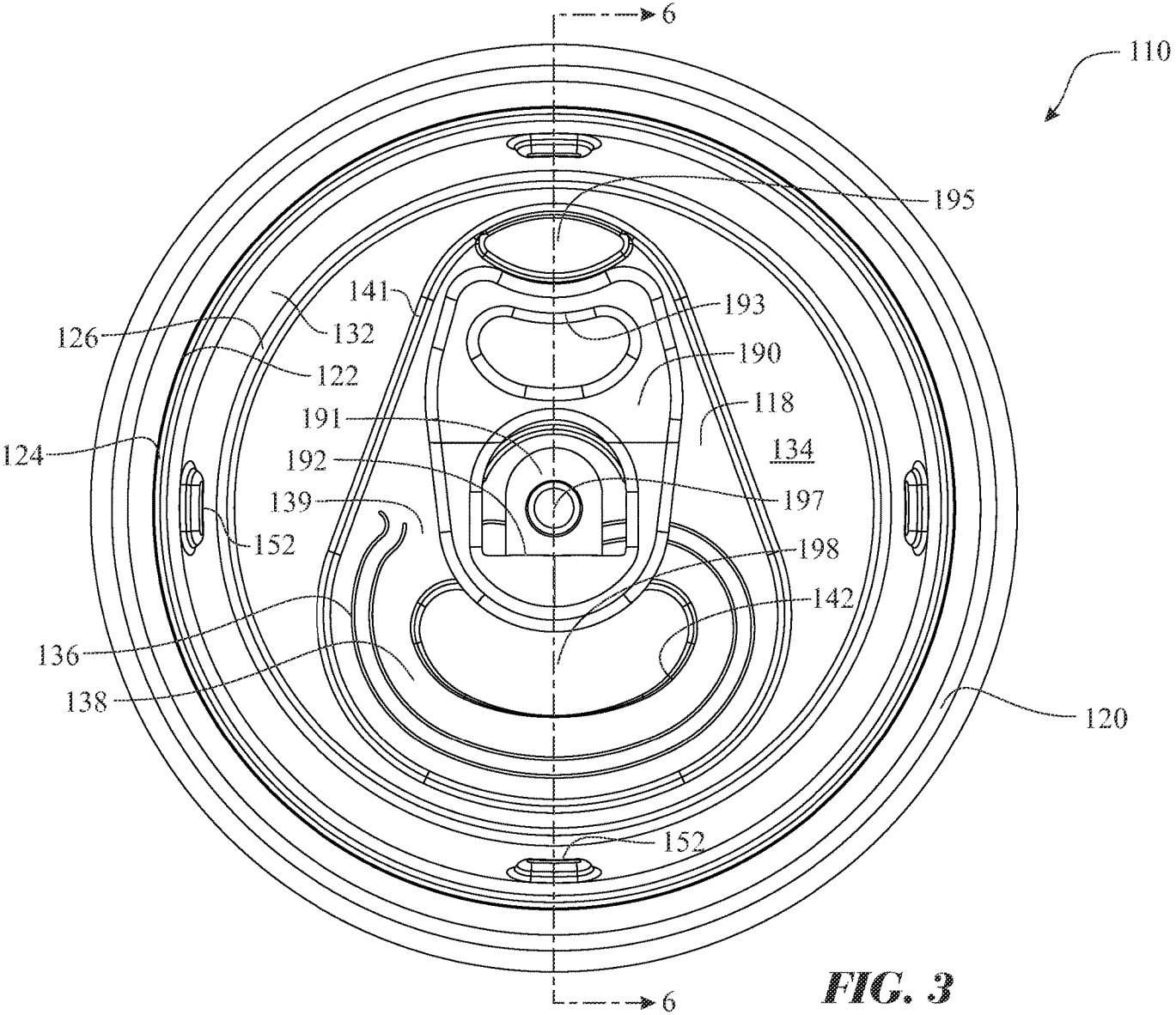
FIG. 3 presents a top, plan view of the first exemplary container lid originally introduced in FIG. 1, wherein the illustration provides a detailed view of elements associated with the Stay-On-Tab (SOT) arrangement.
Figure 4:
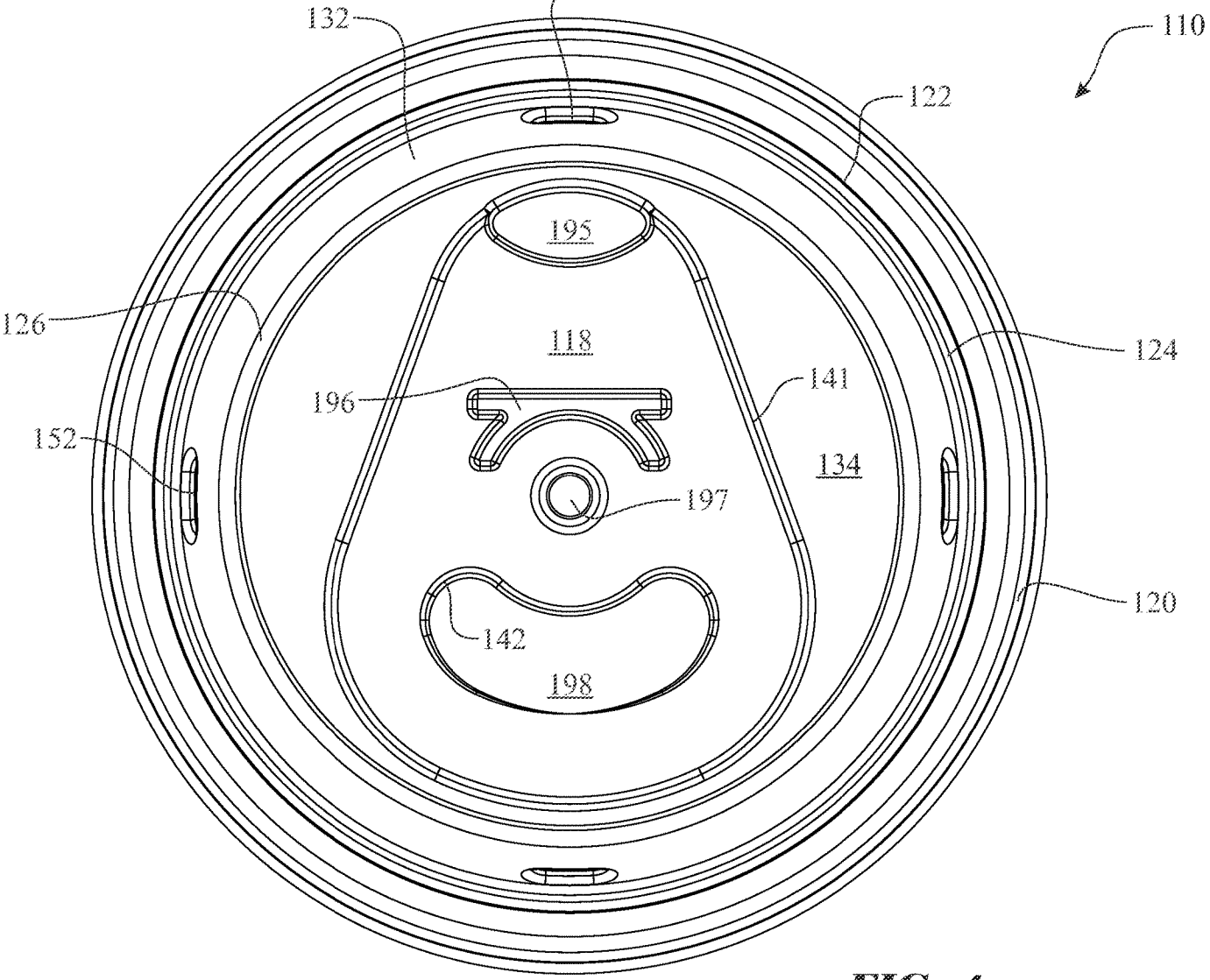
FIG. 4 presents a bottom, plan view of the first exemplary container lid originally introduced in FIG. 1, wherein the illustration provides a detailed view of formations in the bottom wall associated with the Stay-On-Tab (SOT) arrangement.
Figure 5:
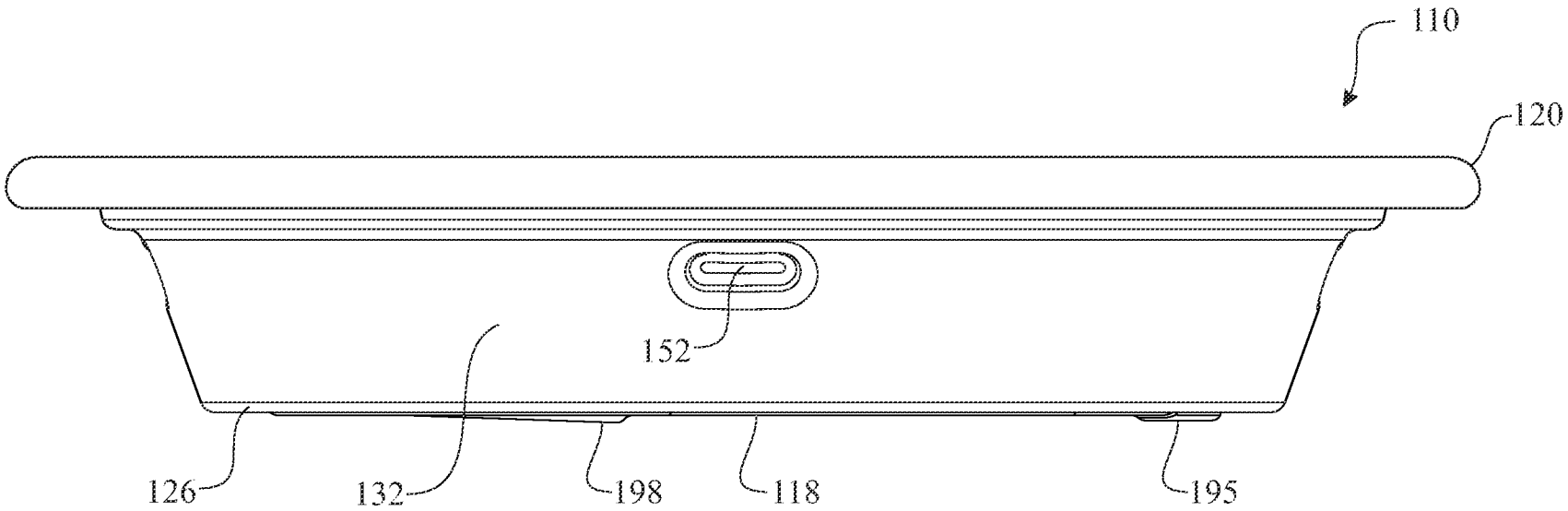
FIG. 5 presents a side elevation view of the first exemplary container lid originally introduced in FIG. 1.
Figure 6:
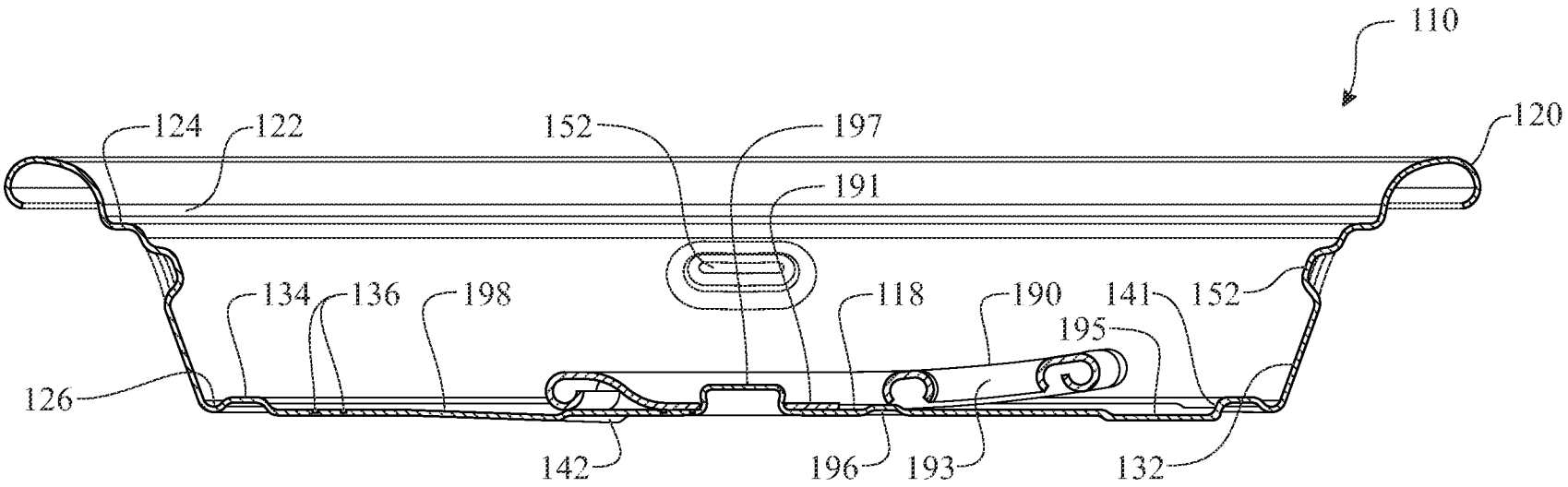
FIG. 6 presents a cross sectioned side elevation view of the first exemplary container lid originally introduced in FIG. 1, the section view taken along section line 6-6 of FIG. 3.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

A resealable container assembly 100 includes a resealable container lid 110 assembled to a resealable container body 101 and a resealable container cap 160 removably assembled to the resealable container lid 110, as illustrated in FIGS. 15 through 22. Details of the resealable container lid 110 are illustrated in FIGS. 1 through 7. Details of the resealable container cap 160 are illustrated in FIGS. 8 through 14.

A container body 101 includes a container body closed bottom wall 104 contiguous with a lower edge of the container body tubular sidewall 102. A container body sidewall seaming flange 106 is formed at an upper edge of the container body tubular sidewall 102. The container body cylindrical sidewall seaming flange 106 is preferably annular in shape and extending radially outward from the container body tubular sidewall 102. The container body tubular sidewall 102 can be any shape or size desired by the packaging company. The illustrated exemplary container body tubular sidewall 102 is cylindrical in shape. The container body tubular sidewall 102 can have any reasonable and/or creative cross section shape. The shape of the container body tubular sidewall 102 can be distinct to provide a unique association between the shape of the container body tubular sidewall 102 and the product itself. Examples of container body tubular sidewalls 102 having contoured tubular sidewalls include: COKE CONTOUR bottle, BUDWEISER BOWTIE can, and a HEINEKEN Keg Can. The container body tubular sidewall 102 can be formed having other sidewall shapes, including spherical, conical, polygonal, and the like. The container body tubular sidewall 102 is preferably fabricated of a metal or a metal alloy. Any known fabrication process, such as stamping, spinning, drawing, wall ironing, and the like or any combination thereof can be used for fabrication of the container body tubular sidewall 102. Alternatively, the container body tubular sidewall 102 can be fabricated of a plastic, paper based product, bamboo, or any other suitable material. The material would be selected based upon the target packaged product and the associated manufacturing processes, the manufacturing environment, the transportation conditions, the shelf life of the product, and any other considerations.

The resealable container lid 110, detailed in FIGS. 1 through 7, includes a lid frustum shaped sidewall 132 extending between an upper (top) edge and a lower (bottom) edge. The upper edge is preferably annular in shape. Similarly, the lower edge is preferably annular in shape. A lid bottom wall 134 extends across a lower end of the lid frustum shaped sidewall 132, providing a lower seal for the resealable container assembly 100, when the resealable container lid 110 is assembled to the resealable container body 101. A lid annular countersink 126 can be formed between an outer edge of the lid bottom wall 134 and the lower edge of the lid frustum shaped sidewall 132. Although a commonly understood frustum shape includes a linear edge between a larger diameter upper portion and a smaller diameter lower portion, the frustum shaped sidewall included in the resealable container lid 110 can be arched (concave or convex) while enabling the same function as a frustum with a linear edge. The lid annular countersink 126 can be of any suitable shape. The lid annular countersink 126 is designed to enable flexure of the resealable container lid 110; more specifically, flexure of the lid bottom wall 134 to accommodate a buildup of pressure within an interior of the resealable container assembly 100. A region of the lid bottom wall 134 adjacent to the lid annular countersink 126 can be formed as a planar surface having at least an annular section that is uninterrupted enabling a seal between a mating sealing feature of the resealable container cap 160 and respective section of the lid bottom wall 134 of the resealable container lid 110. Increased pressure within the interior of the resealable container assembly 100 can be a result of any of number of conditions. The resealable container assembly 100 is commonly used for packaging of beverages. A significant number of packaged beverages are carbonated, including soft drinks, carbonated or soda (seltzer) water, beer, sparkling wine, carbonated alcoholic beverages, energy drinks, and the like, as well as nitrogen backfilled still beverages, including water, teas, coffee, juices, wines, and the like. Another contribution to increased internal pressure is a pre-pressurization during a canning process. Another contribution to increased internal pressure is an assisted pressurization during a canning process using a nitrogen backfill. Another contributor to an increased internal pressure is change in ambient temperature.

A seaming chuck receiving formation including a seaming chuck wall 122 and a seaming chuck shoulder 124 are formed as a transition between the upper edge of the lid frustum shaped sidewall 132 and a seaming panel 120. The seaming panel 120 is of a shape and size to receive the container body cylindrical sidewall seaming flange 106 of the resealable container body 101 and subsequently be seamed together using forming, rolling and compressing processes. The seaming panel 120 is preferably formed as an inverted countersink having an inverted U shape. Other details of the resealable container lid 110 will be discussed later in this disclosure.

Figure 20:
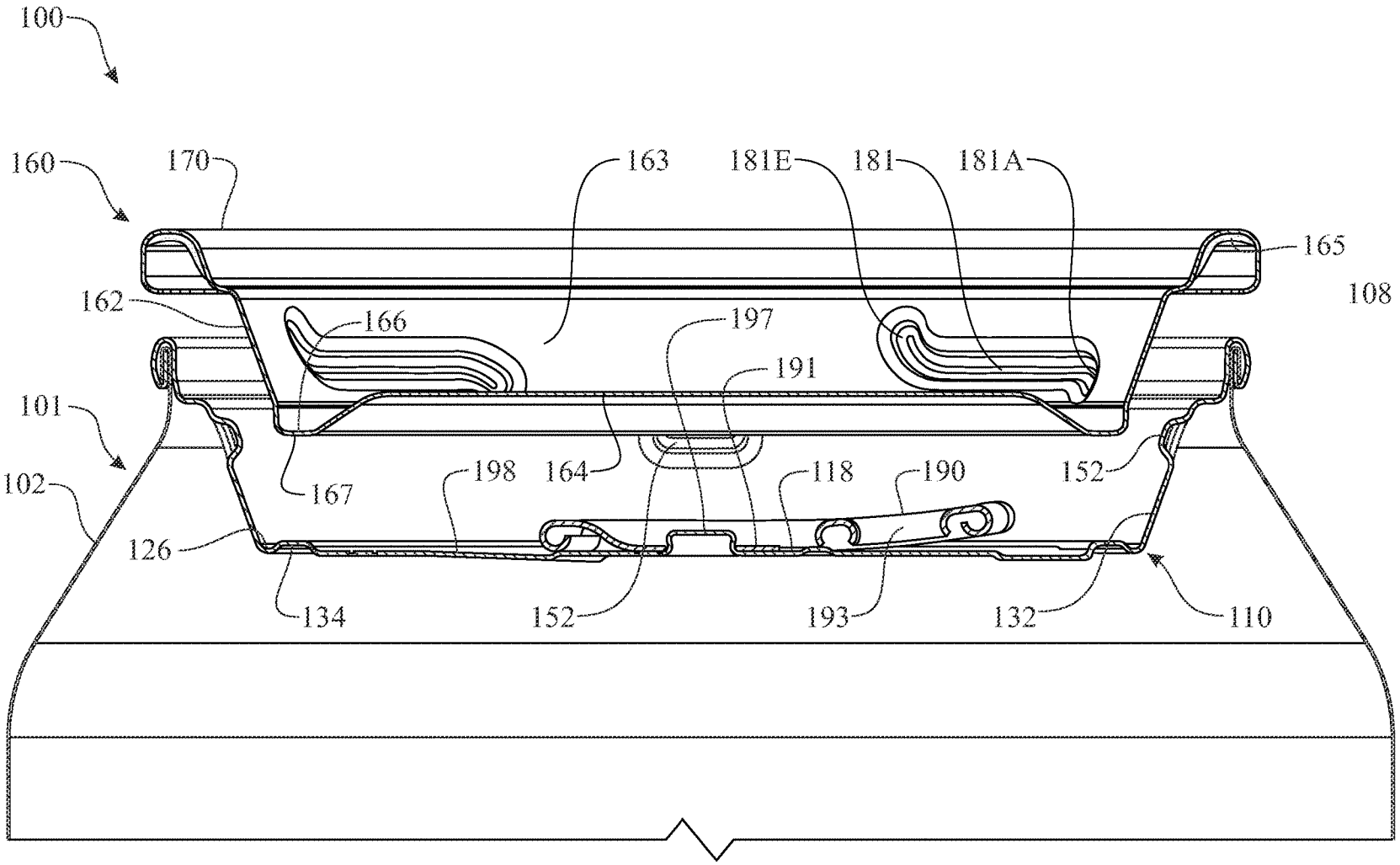
FIG. 20 presents an elevation partial assembly view of the container as illustrated in FIG. 19, introducing the first exemplary container cap originally introduced in FIG. 8, the illustration presenting the container cap staged for assembly to the container subassembly, the section of the container being representative of the section taken along section line 6-6 of FIG. 3.
Figure 21:
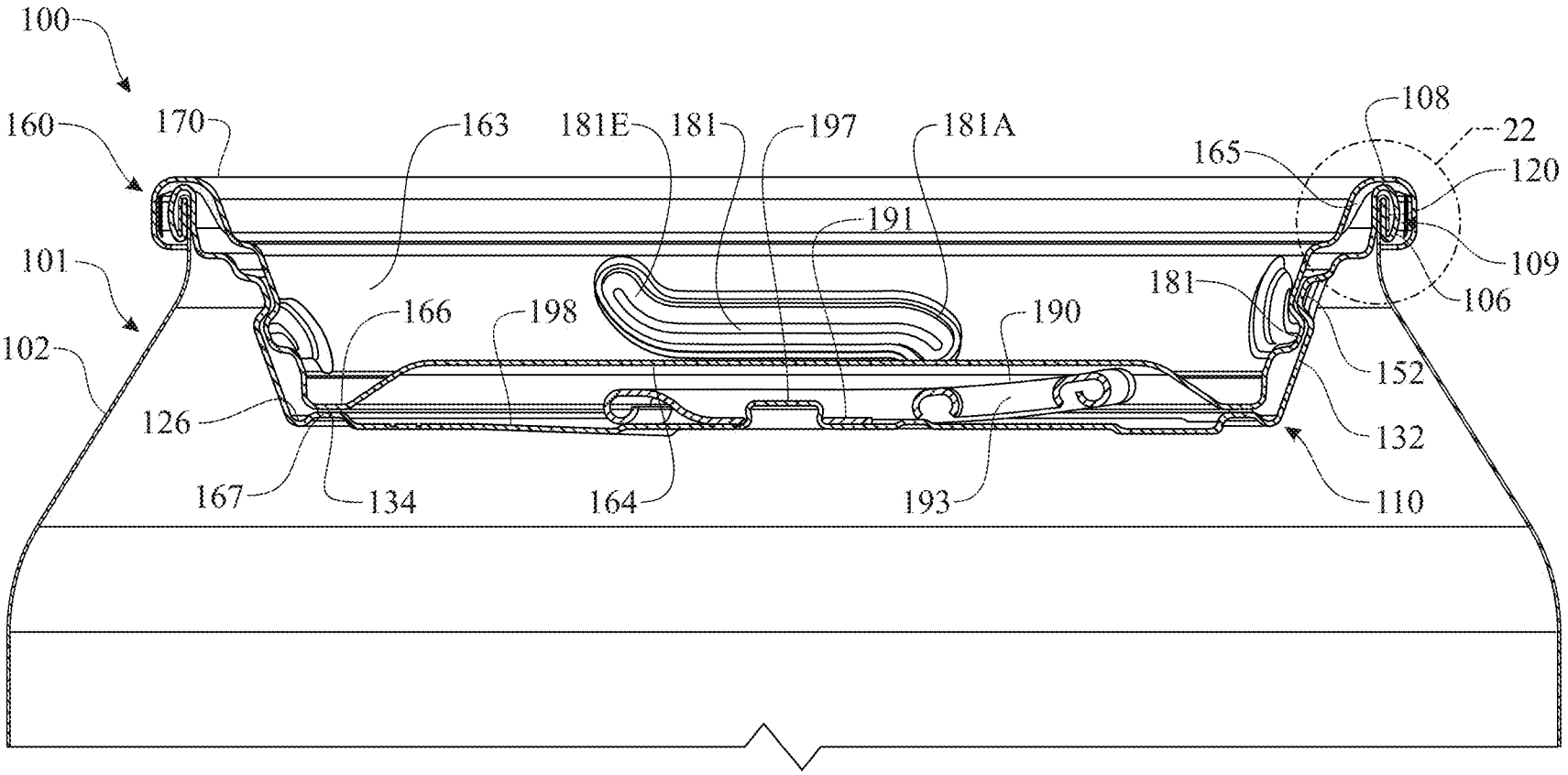
FIG. 21 presents an elevation assembly view of the container as illustrated in FIG. 19, the illustration presenting the container cap assembled to the container subassembly, the section of the container being representative of the section taken along section line 6-6 of FIG. 3.

The container body cylindrical sidewall seaming flange 106 of the resealable container body 101 is formed to receive and be seamed to a seaming panel 120 of the resealable container lid 110. Similarly, the seaming panel 120 is shaped having an inverted U shape (or similar) to aid in an initiation of the seaming process. A lower or seaming surface of the seaming panel 120 is seated against an upper or seaming surface of the container body cylindrical sidewall seaming flange 106. A lower surface of a seaming chuck is seated against the seaming chuck shoulder 124, with a side surface of the seaming chuck being seated against the seaming chuck wall 122. A downward force applied by the seaming chuck seats the lower or seaming surface of the seaming panel 120 against the upper or seaming surface of the container body cylindrical sidewall seaming flange 106. The resultant radially outward force applied to the seaming chuck wall 122 provides a resistive force to a radially inward force applied to the seaming panel by a seaming roller tooling. The radially outward force applied to the seaming chuck wall 122 additionally retains the annular shape of the container body and lid assembly seam 109. The seaming process is best illustrated in sectioned elevation views presented in FIGS. 18 and 19. Once the resealable container lid 110 and the resealable container body 101 are assembled to one another, the resealable container cap 160 can be assembled to the resealable container assembly 100, as illustrated in FIGS. 20 and 21 by rotationally engaging each cap translative motion guide feature 181 of the resealable container cap 160 and each respective lid translative motion guide feature 152 of the resealable container lid 110 with one another. A cap translative motion guide feature leader end 181A of the cap translative motion guide feature 181 initially engages the cap translative motion guide feature 181 with the lid translative motion guide feature 152. As the resealable container cap 160 is rotated respective to the resealable container lid 110, the cap translative motion guide feature 181 continues to engage with the lid translative motion guide feature 152 until a cap translative motion guide feature locking end 181E of the cap translative motion guide feature 181 engages with the lid translative motion guide feature 152. Upon engagement of the cap translative motion guide feature locking end 181E with the lid translative motion guide feature 152, the cap translative motion guide feature locking end 181E includes at least one feature that increases a force required to either continue to rotate the resealable container cap 160 respective to the resealable container lid 110 in a closing direction or an increase in force to at least initially rotate the resealable container cap 160 respective to the resealable container lid 110 in an opening direction. A finished container body and lid assembly seam 109 formed between the container body cylindrical sidewall seaming flange 106 and the seaming panel 120 of the resealable container lid 110, wherein the resealable container cap 160 has subsequently been assembled to the resealable container lid 110 is best illustrated in an enlarged sectioned assembly view illustrated in FIG. 22. The arrangement of the resealable container lid 110, as illustrated, can be referred to as a plug receiving lid. More specifically, the arrangement of radially inward extending translative motion guide features 152 on a resealable container lid 110 define a plug receiving configuration. Similarly, the arrangement of the resealable container cap 160, as illustrated, can be referred to as a plug styled cap. More specifically, the arrangement of radially outward extending translative motion guide features 181 on a resealable container cap 160 define a plug styled closure.

At least one lid translative motion guide feature 152 is included in the lid frustum shaped sidewall 132 of the resealable container lid 110. Similarly, at least one cap translative motion guide feature 181 is included in the resealable container cap frustum shaped exterior sidewall 162 of the resealable container cap 160. In a preferred arrangement, one lid translative motion guide features 152 would be provided for each cap translative motion guide feature 181 respectively. Each of the at least one lid translative motion guide feature 152 would be shaped based upon a design of a respective cap translative motion guide feature 181 of the resealable container cap 160. The shapes of the lid translative motion guide feature 152 and the mating cap translative motion guide feature 181 would provide a function which translates a rotational motion between the resealable container cap 160 and the resealable container lid 110 into an axial translating motion between the resealable container cap 160 and the resealable container lid 110. When rotated in a first direction, the resealable container cap 160 is drawn into the resealable container lid 110 and when rotated in a second, opposite direction, the resealable container cap 160 is driven out of the resealable container lid 110.

The lid translative motion guide feature 152 is preferably formed in the lid frustum shaped sidewall 132 during a process of fabricating the resealable container lid 110. The resealable container lid 110 can include a single, long lid translative motion guide feature 152, a pair of lid translative motion guide features 152 (preferably located at opposite quadrants of the lid frustum shaped sidewall 132), three (3) lid translative motion guide features 152 (preferably equidistantly spaced between one another), four (4) lid translative motion guide features 152 (preferably equidistantly spaced between one another with one lid translative motion guide feature 152 located at each of four (4) quadrants), six (6) lid translative motion guide features 152 (preferably equidistantly spaced between one another), or any other suitable number of lid translative motion guide features 152.

In the exemplary illustrations, each cap translative motion guide feature 181 is formed as a cam track. Each lid translative motion guide feature 152 is formed as a horizontally oriented geometric stadium (rectangle with rounded ends) shaped protrusion or emboss. The lid translative motion guide feature 152 can be other suitable shapes, such as a circular protrusion, an oval protrusion, an elliptical protrusion, a cam shaped protrusion, or any other suitable shape that is compatible with the cam track. In another example, the cap translative motion guide feature 181 can be shaped in a formation of a section of a helical thread. In this example, the lid translative motion guide feature 152 can be formed having any of the above described shapes utilized with the lid translative motion guide feature 152 for the cam track, or the lid translative motion guide feature 152 can be formed having a shape of a mating section of a helical thread, a ramp, or any other shape compatible with a portion of a helical thread. The cap translative motion guide feature 181 and the lid translative motion guide feature 152 can be any suitable shape enabling the desired translative function. The cap translative motion guide feature 181 can additionally include a detent feature, where an additional force is required to overcome the detent and enable the rotational motion between the resealable container cap 160 and the resealable container lid 110.

The resealable container cap 160, detailed in FIGS. 8 through 14, is formed having a resealable container cap frustum shaped radially interior sidewall 163 extending between an upper edge and a lower edge. The resealable container cap frustum shaped radially interior sidewall 163 is preferably formed having a frustum shape, wherein the upper edge has a first diameter and the lower edge has a second diameter; the first diameter being larger than the second diameter. A resealable container cap planar transversing surface 164 extends across a bottom region of the resealable container cap 160, providing a seal across the lower edge of the resealable container cap frustum shaped radially interior sidewall 163. The resealable container cap planar transversing surface 164 can include a countersink shape cap annular countersink formation 166. A lower surface of the cap annular countersink formation 166 can be shaped to provide a cap lower annular sealing member 167. An elastomer can be provided upon the lower surface of the cap annular countersink formation 166 (the cap lower annular sealing member 167) to increase a quality of the seal between the resealable container cap 160 and the resealable container lid 110. The elastomer additionally increases friction between the resealable container cap 160 and the resealable container lid 110, thus reducing a potential for the resealable container cap 160 to become dislodged from the resealable container lid 110. It is noted that the elastomer can be applied to any mating surface where a seal is formed between any version of the container cap and any respective version of the container lid.

The cap annular countersink formation 166 additionally raises a central region of the resealable container cap planar transversing surface 164. The elevated region of the resealable container cap planar transversing surface 164 provides a clearance for components assembled to the lid bottom wall 134 and/or other formations provided in the lid bottom wall 134 of the resealable container lid 110.

The resealable container cap 160 preferably includes a grip element. In the exemplary illustrations, the grip element is provided as a series of resealable container cap grip elements 174 equi-spatially arranged about a resealable container cap grip element base 171. In the exemplary illustrations, the series of resealable container cap grip elements 174 are created by creating formations within the material of the cylindrical sidewall inverted countersink 170. A sidewall to inverted countersink transition segment 169 provides a transition between the resealable container cap frustum shaped radially interior sidewall 163 and the cylindrical sidewall inverted countersink 170. The resealable container cap grip elements 174 can be formed as a recess (as illustrated), a boss, a knurl, or a combination of both within the cylindrical sidewall inverted countersink 170. Alternatively, the resealable container cap grip elements 174 can be a material applied to the cylindrical sidewall inverted countersink 170. The number, size and shape of resealable container cap grip elements 174 are considerations for the designer.

Regarding manufacturing of the resealable container lid 110 and the resealable container cap 160, each of the illustrated resealable container lid 110 and the resealable container cap 160 are fabricated from a single planar sheet of formable material, such as a thin sheet of metal. The resealable container lid 110 and the resealable container cap 160 can be fabricated using at least one metal forming process. The at least one metal forming process can include a stamping process, a sheering process, a drawing process, a re-drawing process, turning, spinning, a wall ironing process, a metal pinching process, a rolling process, and the like.

Alternatively, the resealable container lid 110 and/or the resealable container cap 160 can be fabricated using a molding process. The molding process can be any suitable molding process, utilize any material suitable for molding and determined based upon the product being packaged. The molded material can include plastic, a wax or resin impregnated molding material, a wax or resin coating on the molded material, a plastic lining on the molded material, or any other process to provide a protective container surface. In another consideration for manufacturing, the resealable container lid 110 and/or the resealable container cap 160 can be fabricated using a machining process, a casting process, a vacuum forming process, an additive manufacturing process (3D printing), any other suitable manufacturing process, or any combination thereof.

The resealable container lid 110 and/or the resealable container cap 160 can be fabricated of a material selected from a group of materials, the group of materials comprising:

a. Metal,
b. Aluminum alloy,
c. Steel alloy,
d. Tin,
e. Plastic,
f. Nylon,
g. Polyvinyl chloride (PVC),
h. Polyethylene terephthalate (PETE or PET),
i. Thermoplastic elastomer (TPE),
j. High-Density Polyethylene (HDPE),
k. Polypropylene (PP),
l. Polycarbonate,
m. Waxed or resin impregnated paper/organic fiber pulp,
n. Waxed or resin coated paper/organic fiber pulp, and
o. Plastic lined paper/organic fiber pulp.

Once the resealable container lid 110 and/or the resealable container cap 160 are fabricated, they can be further processed after forming. For example, a coating can be applied to the formed resealable container lid 110 and/or resealable container cap 160, wherein the coating provides protection to the material and a barrier between the material of the resealable container lid 110 and/or the resealable container cap 160 and the contents packaged within the resealable container assembly 100. For example, it is undesirable to expose food and/or drinks to aluminum. When aluminum is utilized as a component for the resealable container assembly 100, the surfaces which contact the packaged comestibles is coated with a plastic material, wherein the plastic material provides a barrier between the metal surface of the resealable container lid 110 and/or the resealable container cap 160 and the packaged comestibles. The plastic coating can be applied using a spray process, a dipping process, or any other suitable application process. Similarly, an elastomer or other sealant material can be applied to one or more of the sealing surfaces of the resealable container lid 110 and/or the resealable container cap 160. The elastomer can be sprayed upon the surface, applied using a dipping process, applied using a dispenser, applied using a printing process, applied using a transfer printing process, applied using a molding process, or applied using any other suitable process. Since one or more contact surfaces may be employed to create a seal between the resealable container lid 110 and the resealable container cap 160, the sealant material can be applied onto the one or more contact surfaces. The protective coating can alternatively be any suitable protective coating, including the plastic coating (as described above), an epoxy lacquer, a BPA-free coating, and the like.

The exemplary resealable container lid 110 additionally includes any currently commercially available Stay-On Tab (SOT) design or a modified version of the currently commercially available Stay-On Tab (SOT) design. A tab 190 is fabricated of a sheet of material, preferably of a material that is compatible with the material of a body of the resealable container lid 110. The tab 190 would be formed using any known and appropriate manufacturing steps and processes. The tab 190 would be fabricated including features, such as an aperture for passing a rivet 197 therethrough, a tab retention bracket 191, a tab bracket hinge 192, and a tab lightening hole 193.

A number of features are formed in the lid bottom wall 134. A lid bottom panel tear panel 138 is defined by a lid bottom panel score line 136. The lid bottom panel score line 136 is preferably formed having a pair of parallel score lines, preferably being connected to one another at a first end and open or unconnected at a second end. A tear panel hinge 139 is created at the open or unconnected, second end of the lid bottom panel score line 136. A socket bottom wall to reinforcement formation transition 141 is formed to enhance rigidity of the Stay-On Tab (SOT) design during a process of opening the lid bottom panel tear panel 138. A tear panel reinforcing formation 198 can be formed within the lid bottom panel tear panel 138, wherein the tear panel reinforcing formation 198 is created by forming a tear panel 138 to tear panel reinforcing formation transition 142 within the lid bottom panel tear panel 138. The tear panel reinforcing formation 198 enhances a rigidity of the lid bottom panel tear panel 138. The design of the tear panel reinforcing formation 198 provides significant rigidity to a contact area of the tab 190 when the tab 190 applies an opening force to the lid bottom panel tear panel 138, enabling the tab 190 to fracture the lid bottom panel score line 136, continue to propagate separation along the lid bottom panel score line 136 and fold the lid bottom panel tear panel 138 along a tear panel hinge 139 into a product volume of the resealable container 100. The resealable container lid bottom wall reinforcement formation 118 is created by forming a lid bottom wall to reinforcement formation transition 141 within the lid bottom wall 134. It is preferred that the resealable container lid bottom wall reinforcement formation 118 is formed as a recess within the lid bottom wall 134. A tab stabilizing formation 196 can be formed in the resealable container lid bottom wall reinforcement formation 118 at a location underneath a distal or finger grip end of the tab 190. The tab stabilizing formation 196 would provide support for the distal or finger grip end of the tab 190 when the tab 190 is in an initial, packaged position.

A finger access depression 195 is formed in the resealable container lid bottom wall reinforcement formation 118 at a location proximate a gripping end of the tab 190. The finger access depression 195 provides a clearance for a user's finger easing access to an underside of the tab 190 when initializing the process for fracturing the lid bottom panel score line 136 and opening the resealable container assembly 100. The tab 190 can be curled at the distal free gripping end to further facilitate a user's finger access to an underside of the tab 190 when initializing the process for fracturing the lid bottom panel score line 136.

A rivet 197 is formed in the lid bottom wall 134 at a location to position the opening end of the tab 190 at the appropriate location respective to the lid bottom panel score line 136 and lid bottom panel tear panel 138. The tab 190 is assembled to the body of the resealable container lid 110 by inserting the rivet 197 through the aperture of the tab retention bracket 191, then the rivet 197 is compressed, expanding the exposed end and entrapping the tab retention bracket 191 between the expanded portion of the rivet 197 and the facing surface of the resealable container lid bottom wall reinforcement formation 118.

Returning to the process of assembling the resealable container cap 160 onto the resealable container lid 110; the resealable container cap 160 would be assembled to the resealable container lid 110 by orienting the cap translative motion guide features 181 offset from the restive lid translative motion guide features 152. The resealable container cap 160 would be inserted into a socket created in the resealable container lid 110 by the lid frustum shaped sidewall 132 as illustrated in FIG. 20. The resealable container cap 160 would be rotated, engaging each cap translative motion guide feature 181 with each respective lid translative motion guide feature 152. As the resealable container cap 160 is rotated respective to the resealable container lid 110, engagement between each cap translative motion guide feature 181 and each respective lid translative motion guide feature 152 translates the rotational motion to an axial motion, drawing a sealing surface of the resealable container cap 160 and a mating sealing surface of the resealable container lid 110 and resealable container cap 160 together, until a sufficient seal is created between the cap lower annular sealing member 167 of the resealable container cap 160 and a mating sealing surface 134 of the resealable container lid 110 as illustrated in FIG. 21. As mentioned earlier, an elastomer or other sealant material can be provided between the lid bottom wall 134 and the cap lower annular sealing member 167.

A cap upper annular sealing member 165 can be provided as an alternative for (or in addition to) the cap lower annular sealing member 167. The cap upper annular sealing member 165 would be formed within an interior portion of the cylindrical sidewall inverted countersink 170. The cap upper annular sealing member 165 is preferably fabricated of a pliant material, such as an elastomer, molded plastic, polymer, an organic sealing material, cellulose pulp, cork material, a formation that is integral with the resealable container cap 160, or any other suitable material or combination thereof. The shaping of the cap upper annular sealing member 165 is preferably designed to engage with a container body and lid assembly seam chine (top surface) 108 of the container body and lid assembly seam 109, an interior radially inward facing surface 122 of the container body and lid assembly seam 109, an exterior radially surface of the container body and lid assembly seam 109, or any combination thereof. This can include a cap upper annular sealing member 165 having any suitable cross sectional shape, such as a linear surface, one or more fin shaped surfaces, one or more angled fin shaped surfaces, a wedge cross sectional shape, or any combination thereof.

Figure 7:
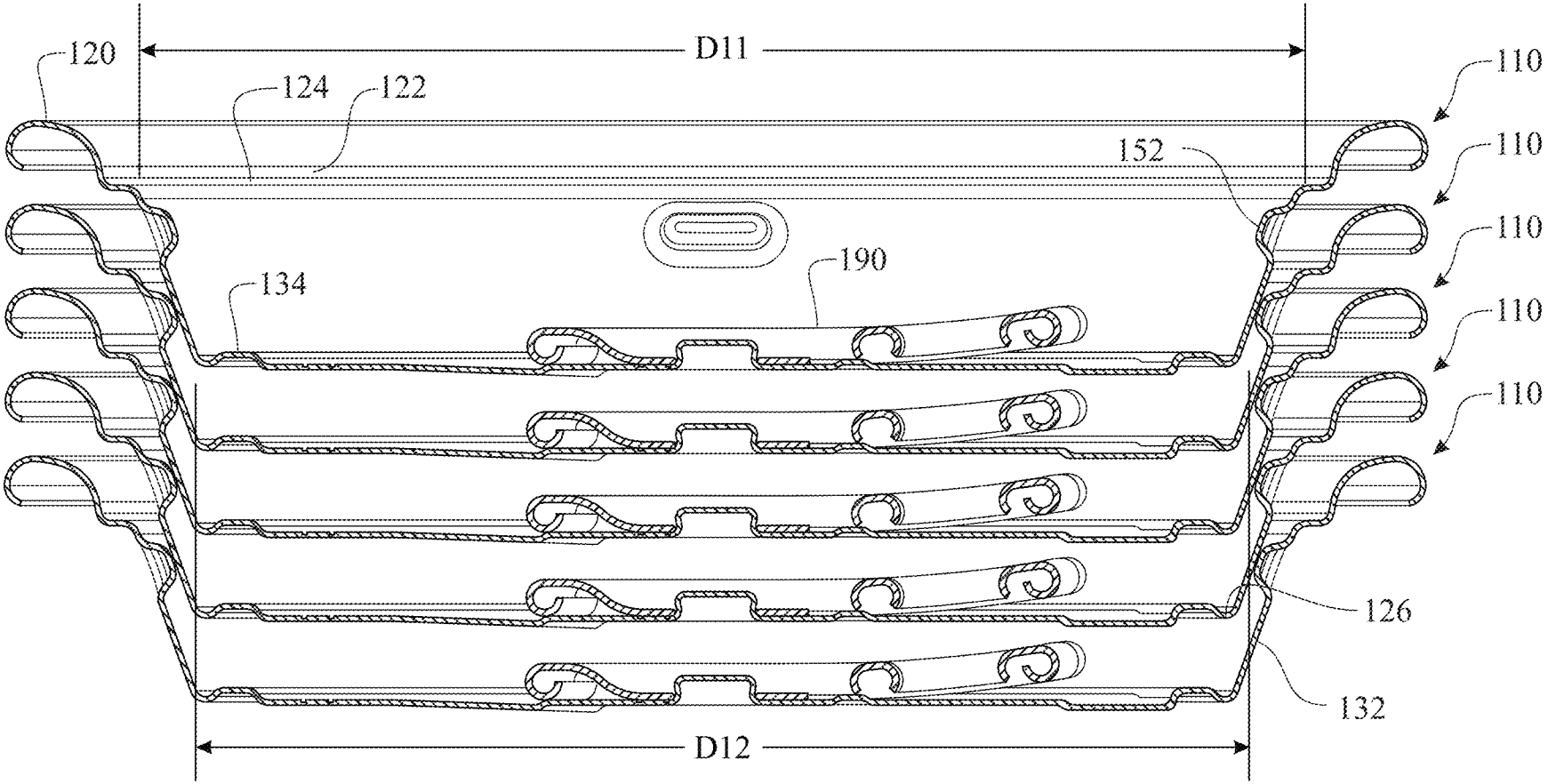
FIG. 7 presents a cross sectioned side elevation view of the first exemplary container lid originally introduced in FIG. 1, the section view taken along section line 6-6 of FIG. 3, the illustration presenting a nesting capability of the first exemplary container lid.
Figure 8:
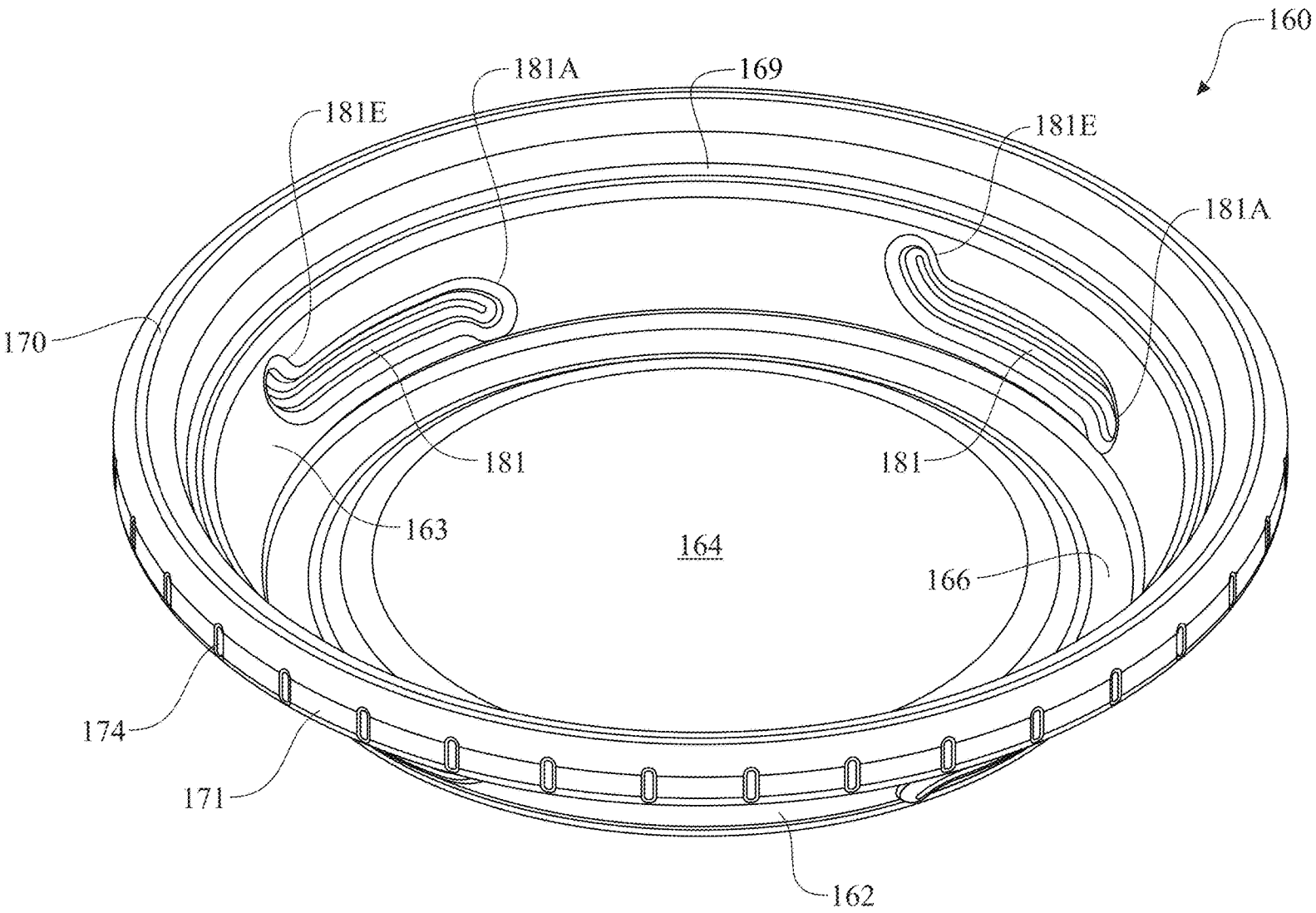
FIG. 8 presents a top, side isometric view introducing a first exemplary container cap in accordance with the present invention, wherein the first exemplary container cap includes a plurality of cap translative motion guide features integral within a frustum shaped sidewall and a countersink arrangement provided circumscribing a cap bottom wall.
Figure 9:
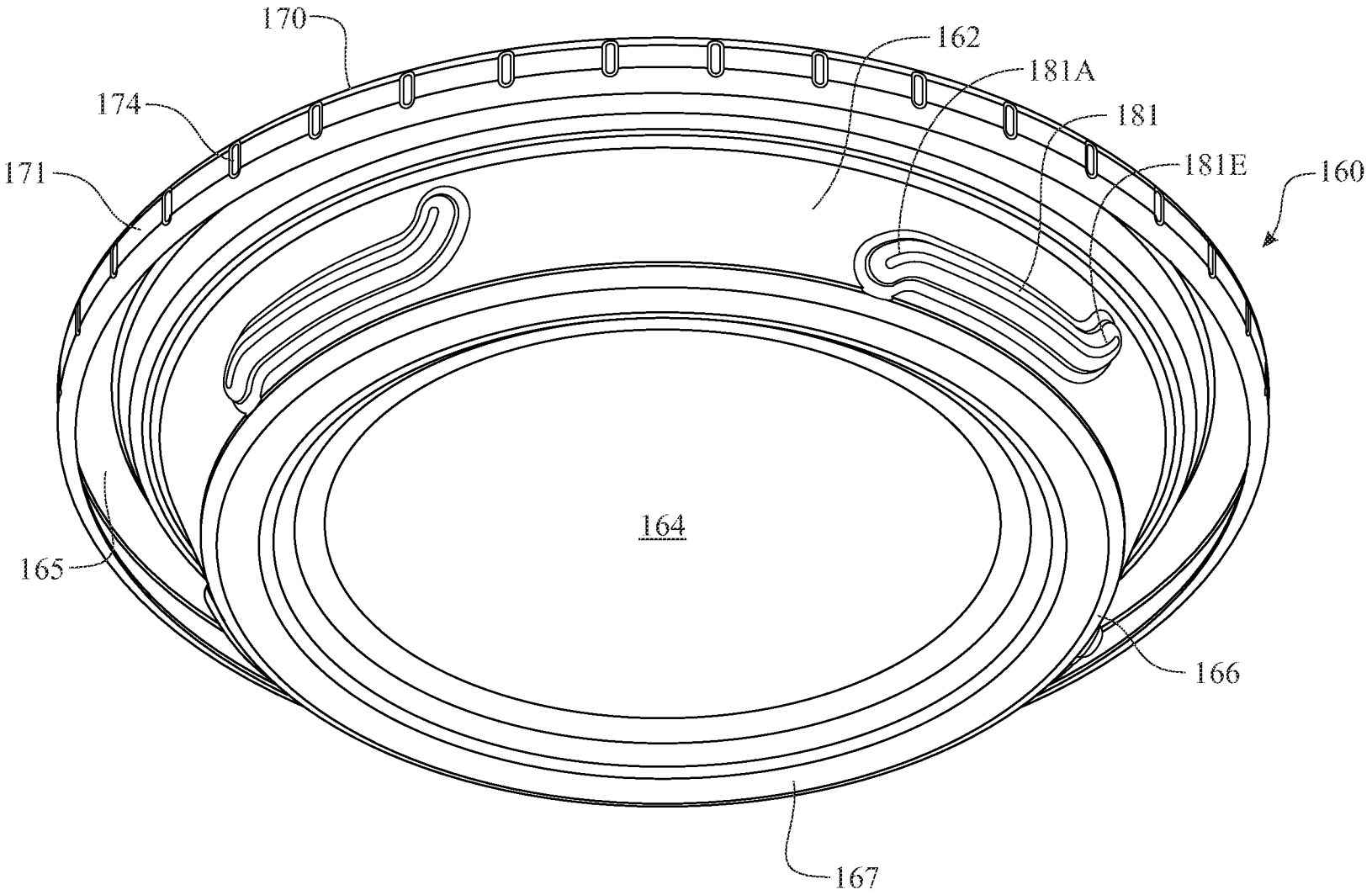
FIG. 9 presents a bottom, side isometric view of the first exemplary container cap originally introduced in FIG. 8.
Figure 10:
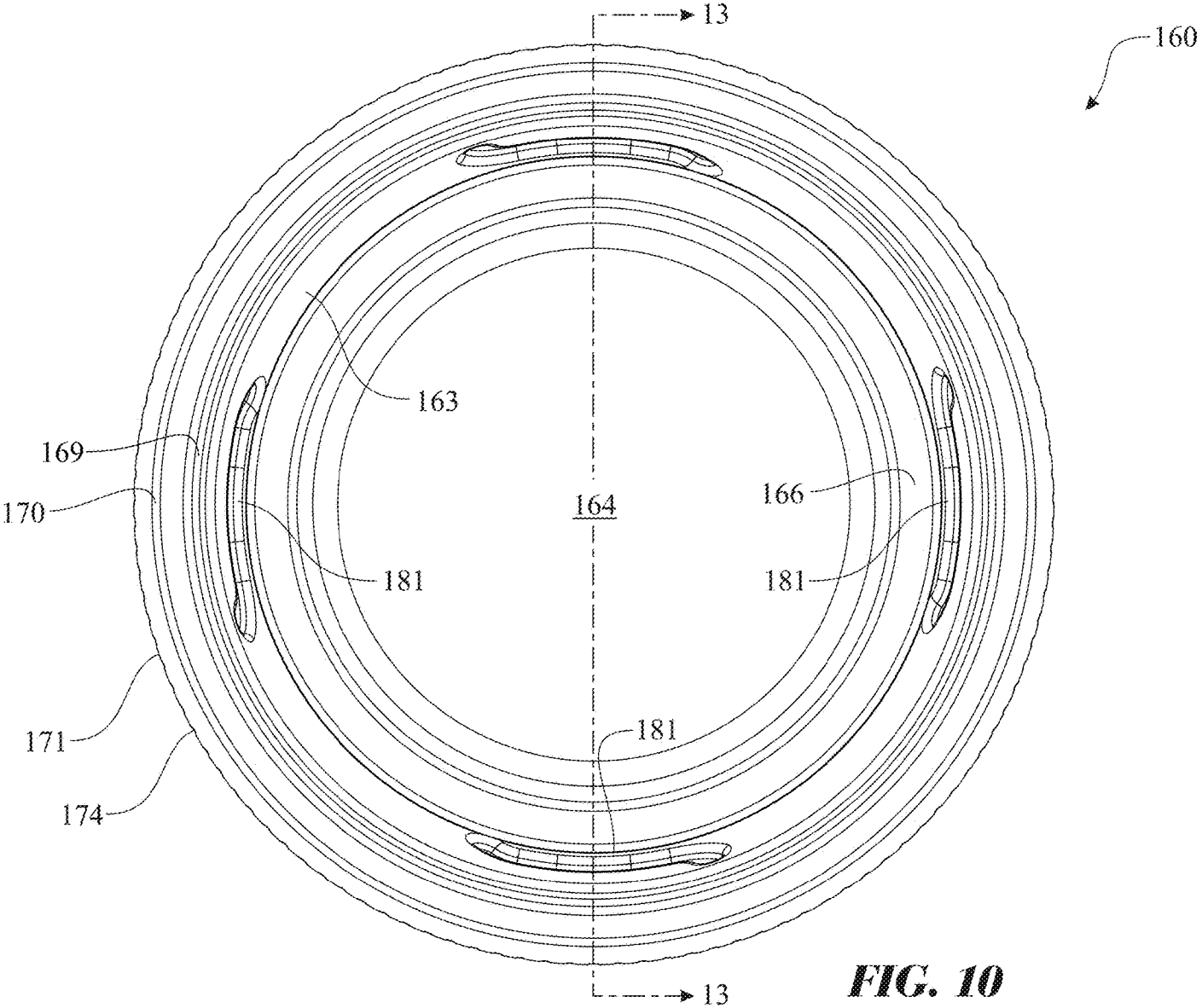
FIG. 10 presents a top, plan view of the first exemplary container cap originally introduced in FIG. 8.
Figure 11:
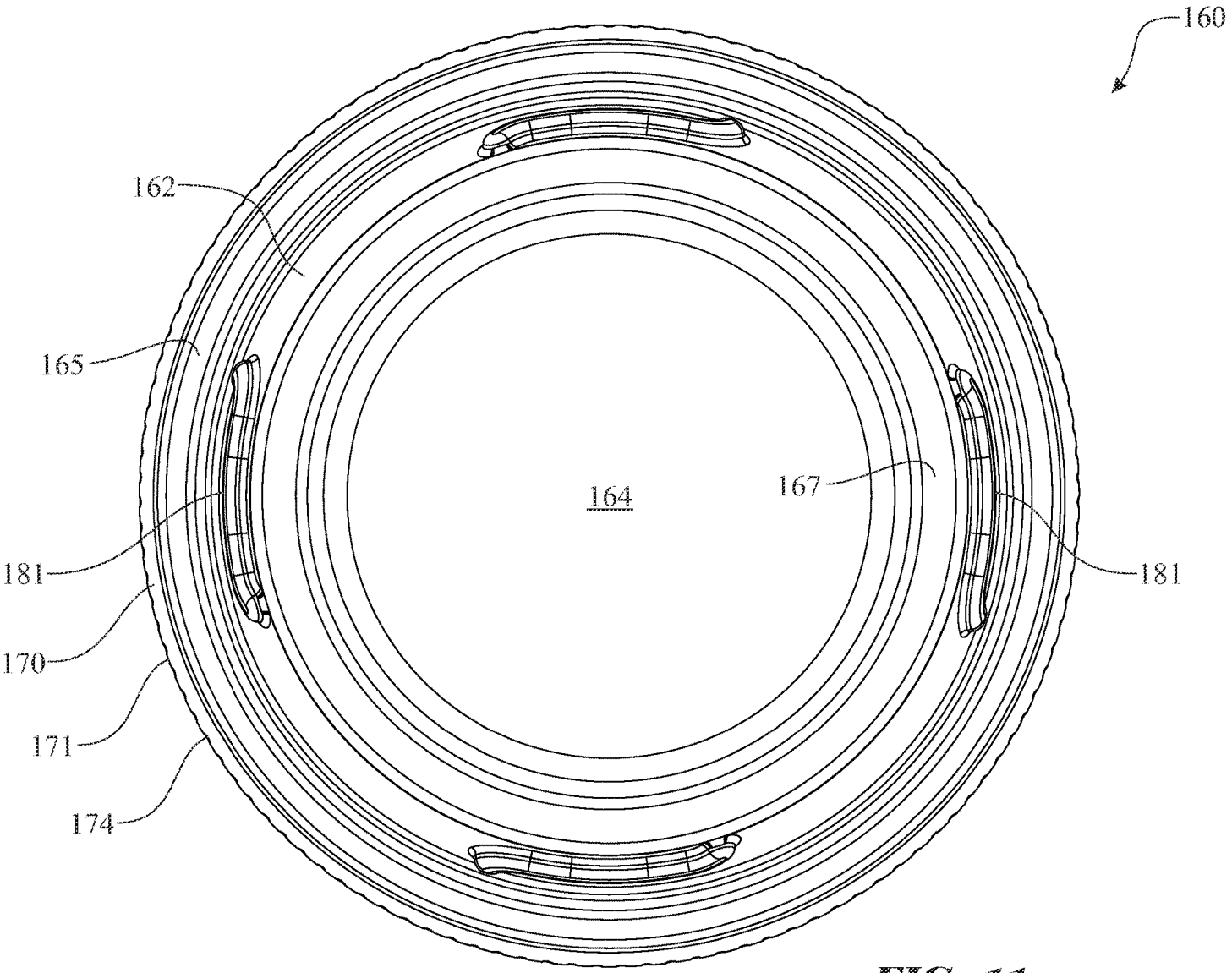
FIG. 11 presents a bottom, plan view of the first exemplary container cap originally introduced in FIG. 8.
Figure 12:
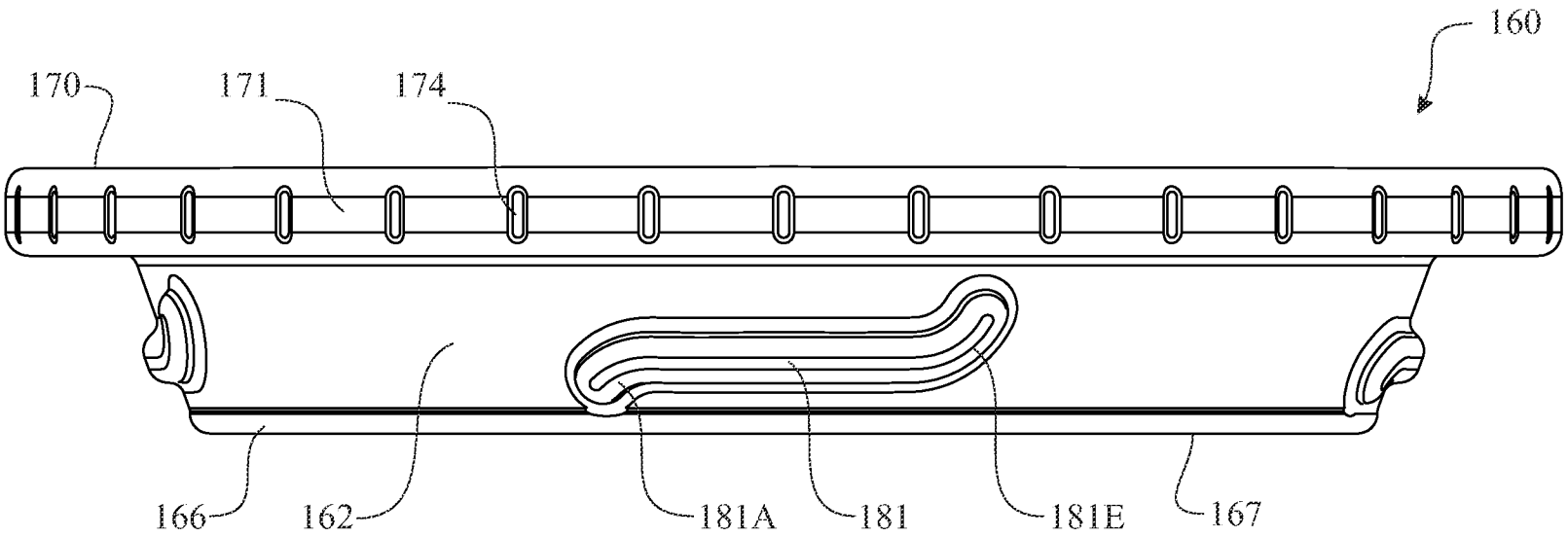
FIG. 12 presents a side elevation view of the first exemplary container cap originally introduced in FIG. 8, the illustration detailing a shape of an exemplary cap translative motion guide feature provided in a form of a cam and a plurality of grip elements formed in an inverted countersink.
Figure 13:
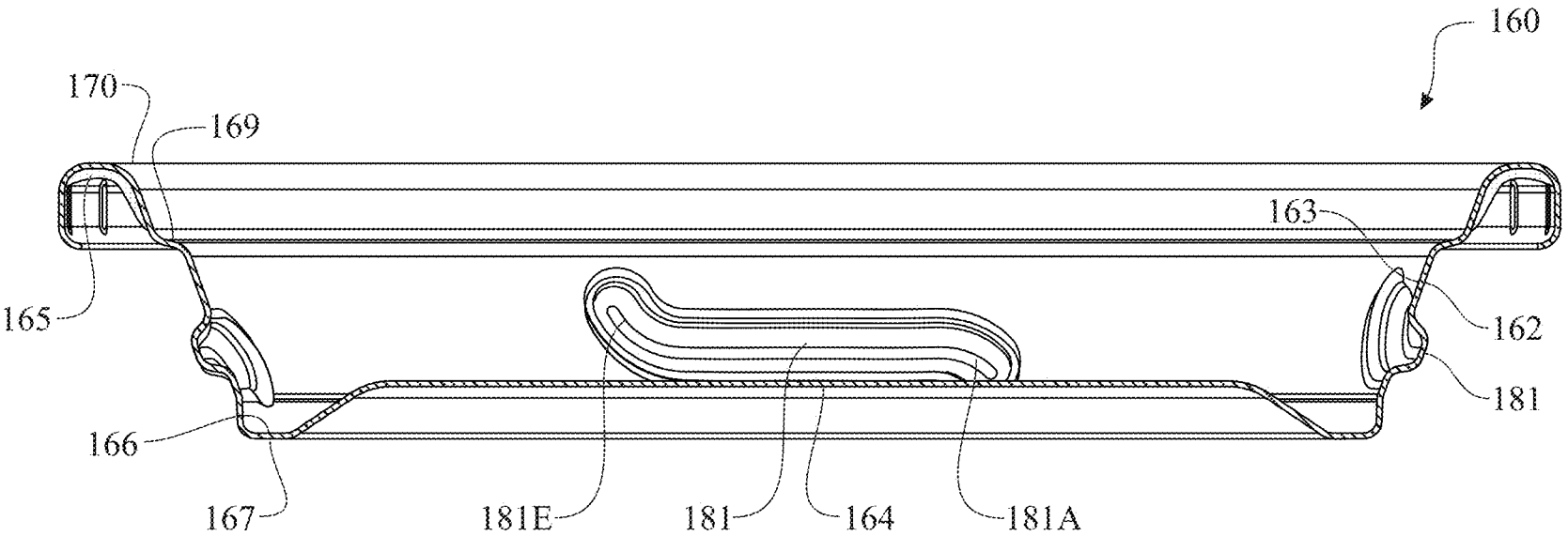
FIG. 13 presents a cross sectioned side elevation view of the first exemplary container cap originally introduced in FIG. 8, the section view taken along section line 13-13 of FIG. 10.
Figure 14:
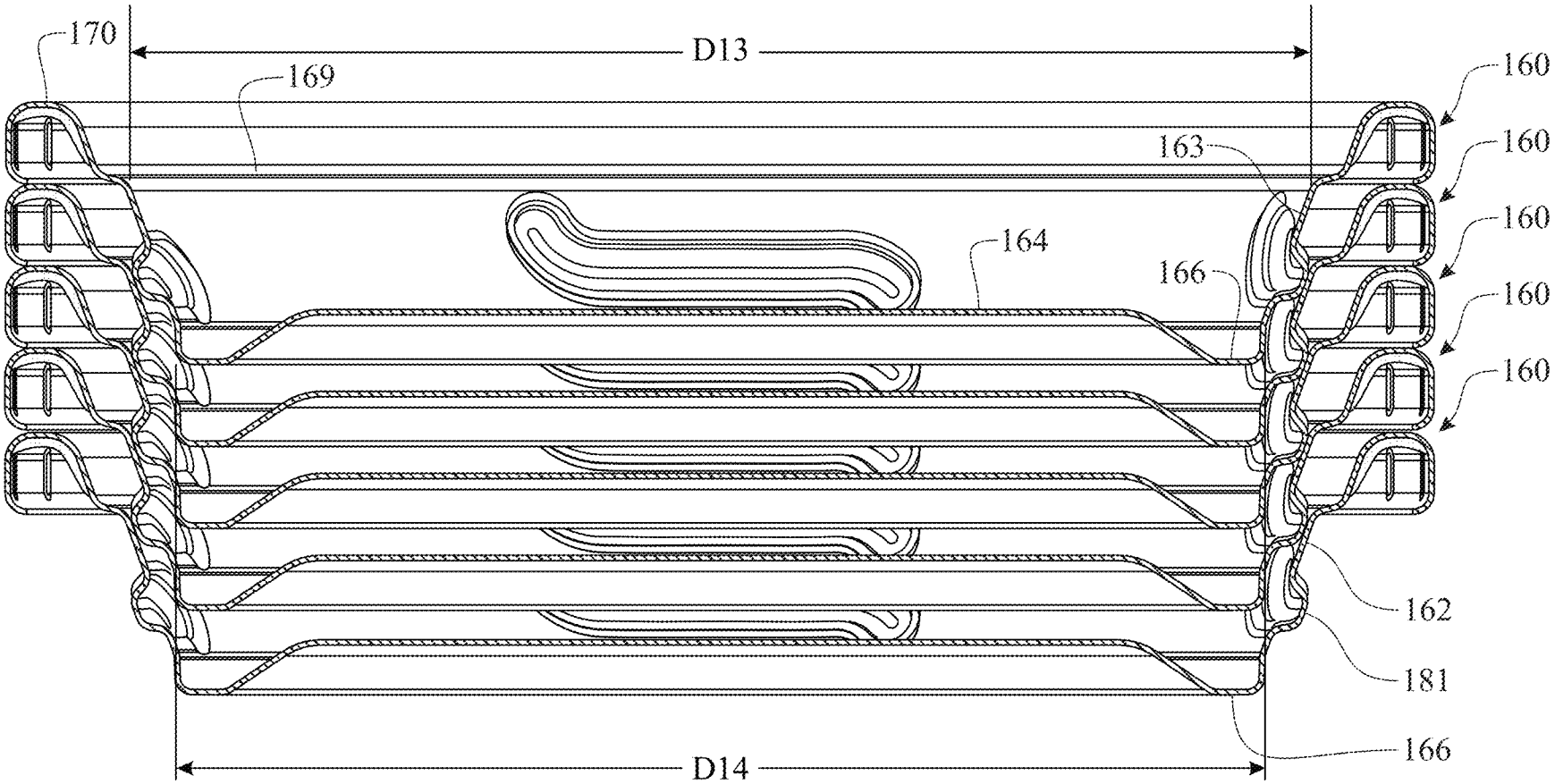
FIG. 14 presents a cross sectioned side elevation view of the first exemplary container cap originally introduced in FIG. 8, the section view taken along section line 13-13 of FIG. 10, the illustration presenting a nesting capability of the first exemplary container cap.
Figure 15:
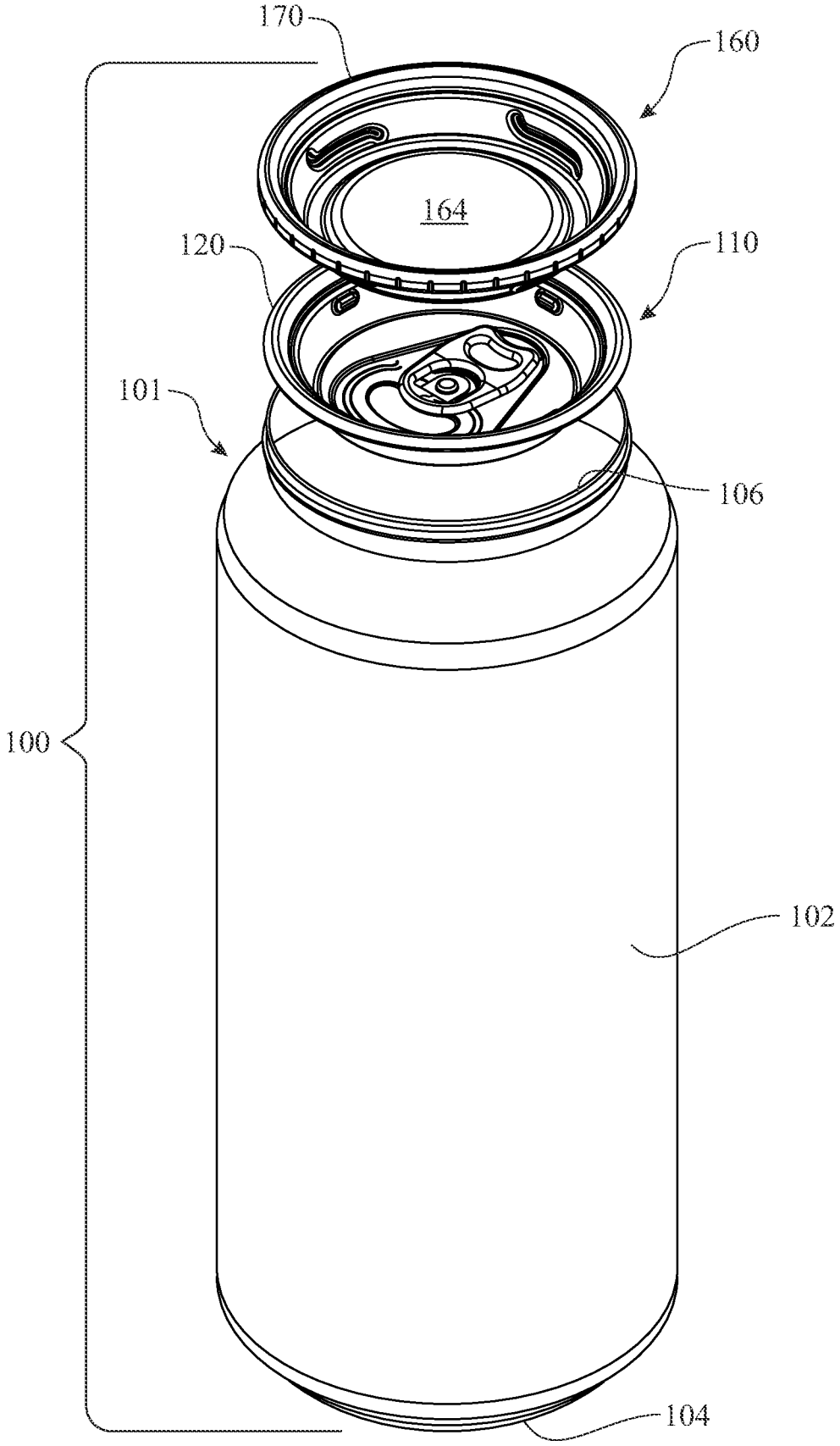
FIG. 15 presents a front, top isometric exploded assembly view of a container comprising the first exemplary container lid originally introduced in FIG. 1 and the first exemplary container cap originally introduced in FIG. 8, the illustration presenting the container lid and a container body awaiting seaming to one another and the container cap staged for assembly thereto.
Figure 16:
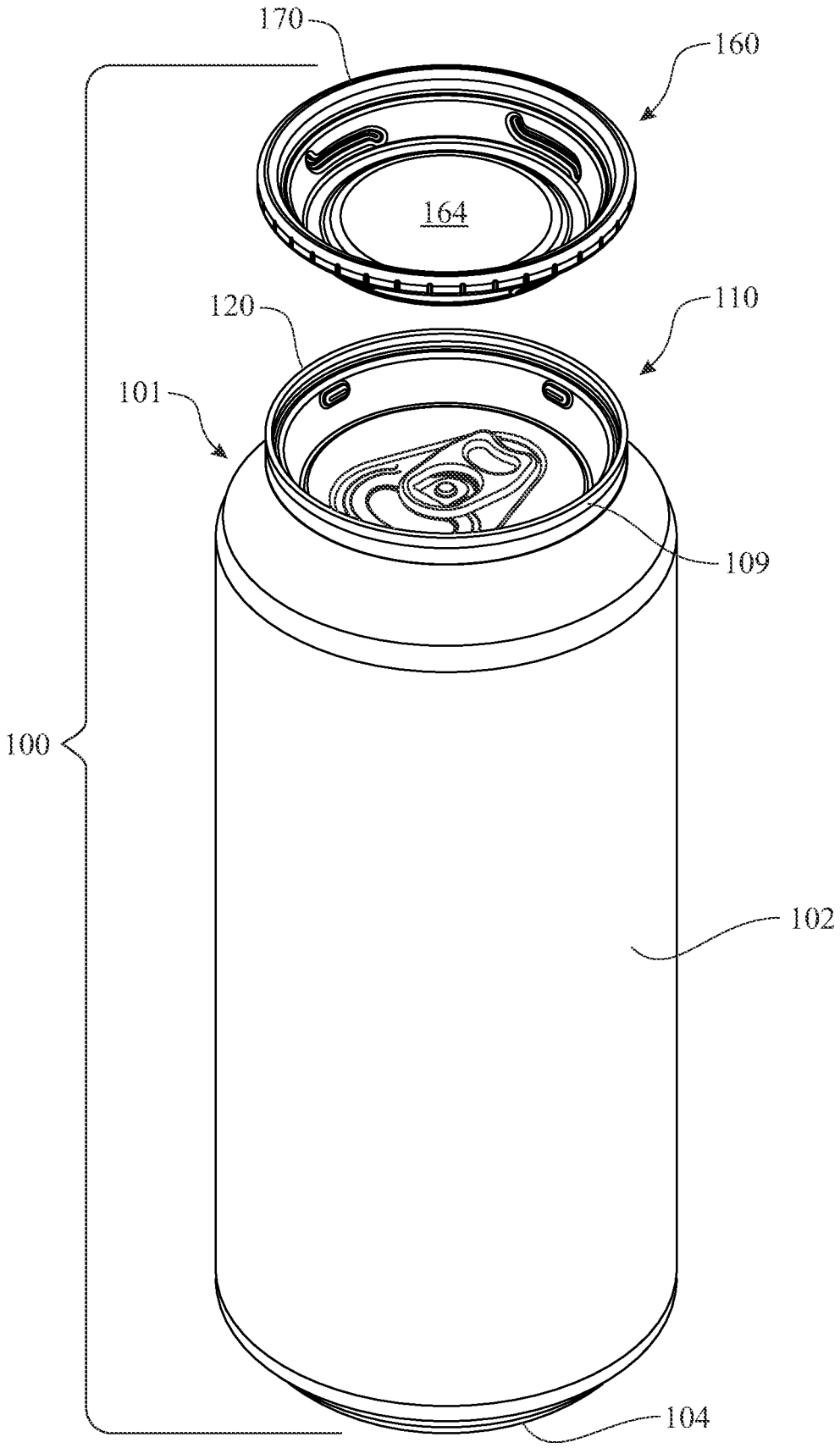
FIG. 16 presents a front, top isometric partially assembled view of the container originally introduced in FIG. 15, the illustration presenting the container lid seamed to the container body and the container cap staged for assembly thereto.
Figure 17:
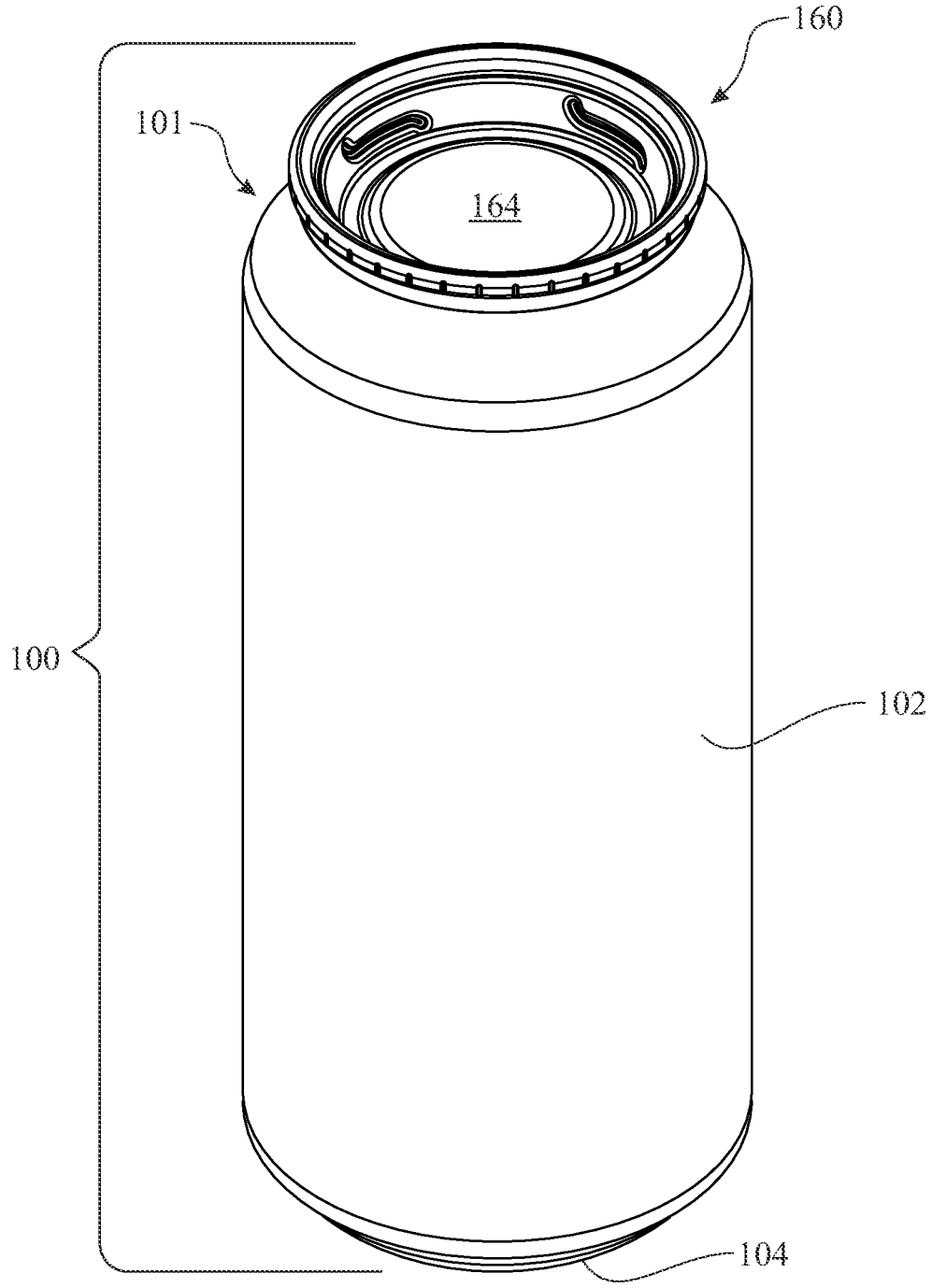
FIG. 17 presents a front, top isometric partially assembled view of the container originally introduced in FIG. 15, the illustration presenting the container cap assembled to the container lid and body subassembly.
Figure 18:
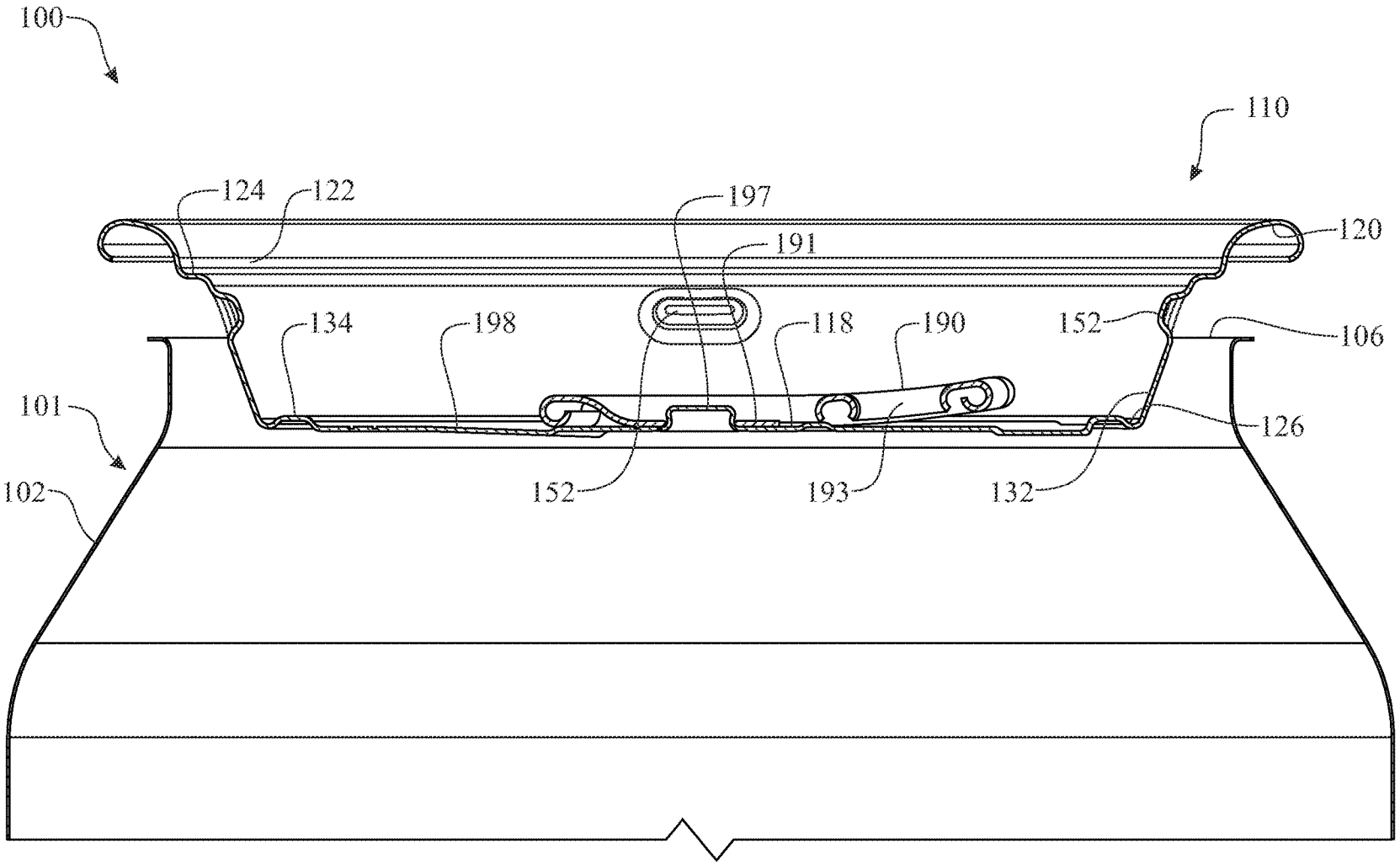
FIG. 18 presents an elevation exploded assembly view of the container originally introduced in FIG. 15 comprising the first exemplary container lid originally introduced in FIG. 1, the illustration presenting a relationship between a seaming panel of the container lid and a joining edge of the container body prior to execution of a seaming process, the section of the container being representative of the section taken along section line 6-6 of FIG. 3.
Figure 19:
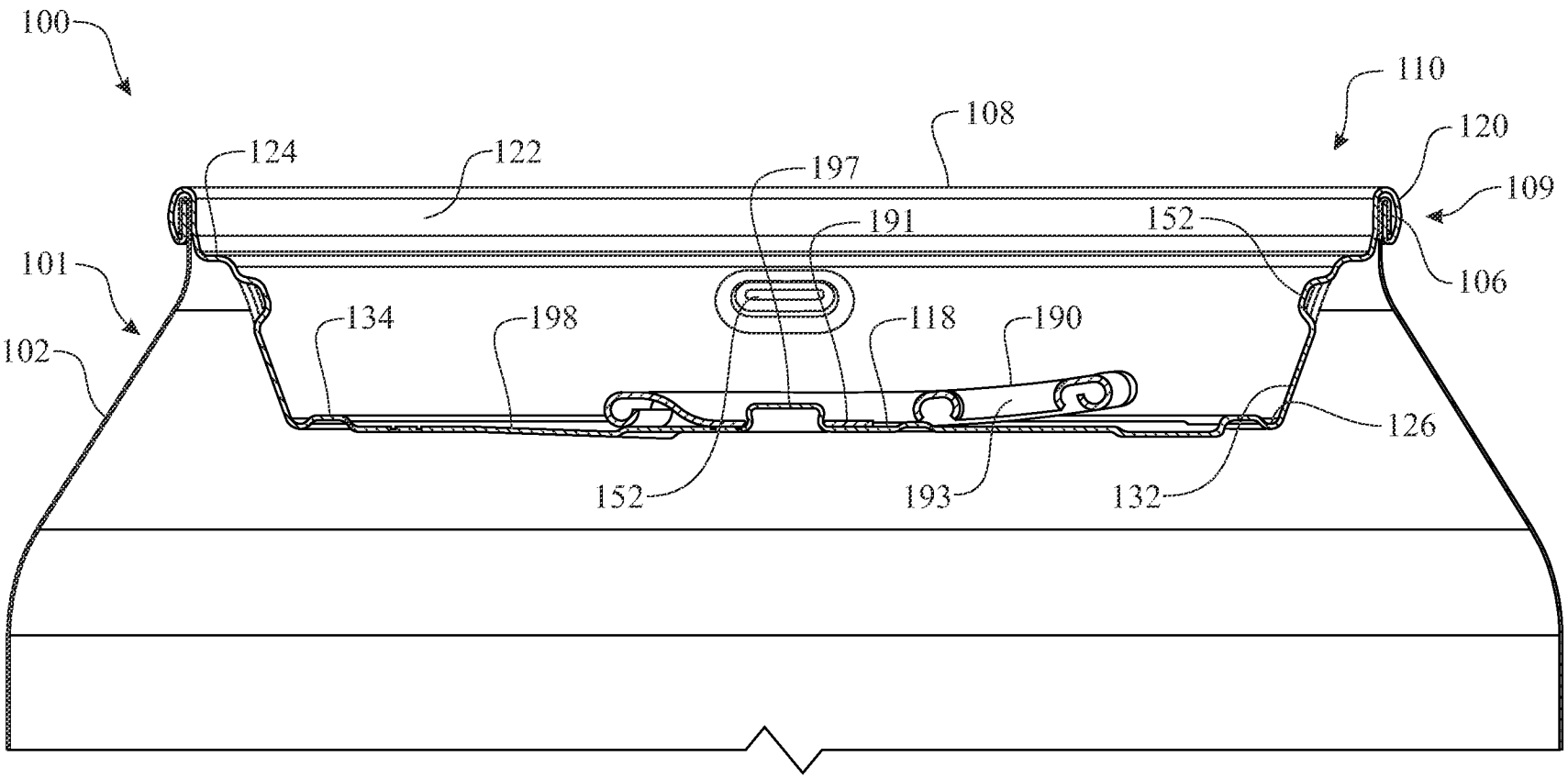
FIG. 19 presents an elevation assembly view of the container originally introduced in FIG. 15 comprising the first exemplary container lid originally introduced in FIG. 1, the illustration presenting a seam formed between the seaming panel of the container lid and the joining edge of the container body, the section of the container being representative of the section taken along section line 6-6 of FIG. 3.

The frustum shape of the lid frustum shaped sidewall 132 in conjunction with the size and shape of the lid translative motion guide features 152 enables nesting of the resealable container lid 110, as illustrated in FIG. 7. A upper tubular sidewall radially inner diameter D11, measuring a diameter across an upper edge of the interior surface of the lid frustum shaped sidewall 132 is greater than a lower formation radially outermost diameter D12, measuring a diameter across a radially outermost dimension of an exterior surface of the lid annular countersink 126 enabling an upper placed resealable container lid 110 to seat within the lid frustum shaped sidewall 132 of a lower placed resealable container lid 110. When nesting, the interior surface of the lid translative motion guide feature 152 contacts the radially exterior surface of the lid frustum shaped sidewall 132. The resealable container lid 110 is designed where the point of contact between the radially interior surface of the lid translative motion guide feature 152 and the radially exterior surface of the lid frustum shaped sidewall 132 positions an exterior or lower surface of the lid bottom wall 134 proximate, but not contacting, the uppermost surface of elements extending upwards from the lid bottom wall 134, such as a top surface of the tab 190. The resealable container lid 110 is also designed where the point of contact between the radially interior surface of the lid translative motion guide feature 152 and the radially exterior surface of the lid frustum shaped sidewall 132 positions a lower edge of the seaming panel 120 of the resealable container lid 110 proximate, but not contacting, the uppermost surface of the seaming panel 120 of the lower resealable container lid 110.

The introduction of a translative motion guide system in conjunction with a frustum shaped sidewall 132 provides several benefits. The first benefit is the introduction of a translative motion guide system provided between an radially interior surface of the lid frustum shaped sidewall 132 of the resealable container lid 110 and the resealable container cap frustum shaped exterior sidewall 162 of the resealable container cap 160. The second benefit is an ability to nest a plurality of resealable container lids 110, thus reducing volume for storage, shipping, storage within the canning equipment, and the like. The design also ensures easy and proper pick up and release of each resealable container lid 110 from a stack of nested resealable container lids 110. Engagement of the two surfaces, as described, automatically centers the first resealable container lid 110 and the second resealable container lid 110 with one another, ensuring pickup at a repeated location of each resealable container lid 110 from a stack of resealable container lids 110, thus optimizing the manufacturing, conveyance, filling, seaming, and similar processes. The design of the resealable container lid 110, more specifically, the lid bottom wall 134, includes sufficient areas for vacuum pickup and placement of the resealable container lid 110. The design of the resealable container lid 110, more specifically, the seaming panel 170, includes sufficient areas for mechanical separation of the resealable container lid 110.

The resealable container cap 160 is designed with considerations similar to the nesting properties of the resealable container lid 110. An upper tubular sidewall radially inner diameter D13, measuring a diameter across an upper edge of the interior surface of the resealable container cap frustum shaped interior sidewall 163 is greater than a lower formation radially outermost diameter D14, measuring a diameter across a radially outermost dimension of an exterior surface of the cap annular countersink formation 166 enabling a first resealable container cap 160 to be inserted into a cavity of a second resealable container cap 160 as illustrated in FIG.

14. A radially exterior surface of the cap translative motion guide feature 181 would nest against the resealable container cap frustum shaped interior sidewall 163. A lower edge of the cylindrical sidewall inverted countersink 170 of the first resealable container cap 160 would rest against an upper surface of the cylindrical sidewall inverted countersink 170 of the second resealable container cap 160. A lower surface of the resealable container cap planar transversing surface 164 of the first resealable container cap 160 would be located proximate an upper surface of the resealable container cap planar transversing surface 164 of the second resealable container cap 160.

The use of frustum shaped sidewalls 132, 162 introduces another benefit. By drawing two (2) frustum shaped walls towards one another provides several opportunities for two facing surfaces to engage with one another creating a seal. In the illustrations presented in FIGS. 20 and 21, the cap lower annular sealing member 167 and the lid bottom wall 134 are drawn towards one another creating the seal. A sealing material can be provided between the two sealing surfaces to improve the seal. The illustrated versions present surfaces which are horizontal with one another. The cap lower annular sealing member 167 and the lid bottom wall 134 can be modified to include angled or frustum shaped facing surfaces, where the frustum shaped facing of the cap lower annular sealing member 167 and the frustum shaped facing surface of the lid bottom wall 134 would engage with one another forming a seal. The frustum shaped surfaces of the cap lower annular sealing member 167 and the lid bottom wall 134 would be one of (a) parallel to the frustum shaped surfaces of the lid frustum shaped sidewall 132 and the resealable container cap frustum shaped exterior sidewall 162 or (b) slightly more horizontally designed than the frustum shaped surfaces of the lid frustum shaped sidewall 132 and the resealable container cap frustum shaped exterior sidewall 162. When drawn together, the frustum shaped surface of the cap lower annular sealing member 167 and the frustum shaped surface lid bottom wall 134 would create a wedge between one another and improve the seal created between the lid frustum shaped sidewall 132 and the resealable container cap frustum shaped exterior sidewall 162 accordingly. The same concept can be applied to any sealing feature integral the resealable container lid 110 and the resealable container cap 160. This will become more apparent in subsequent variants presented herein.

Figure 22:
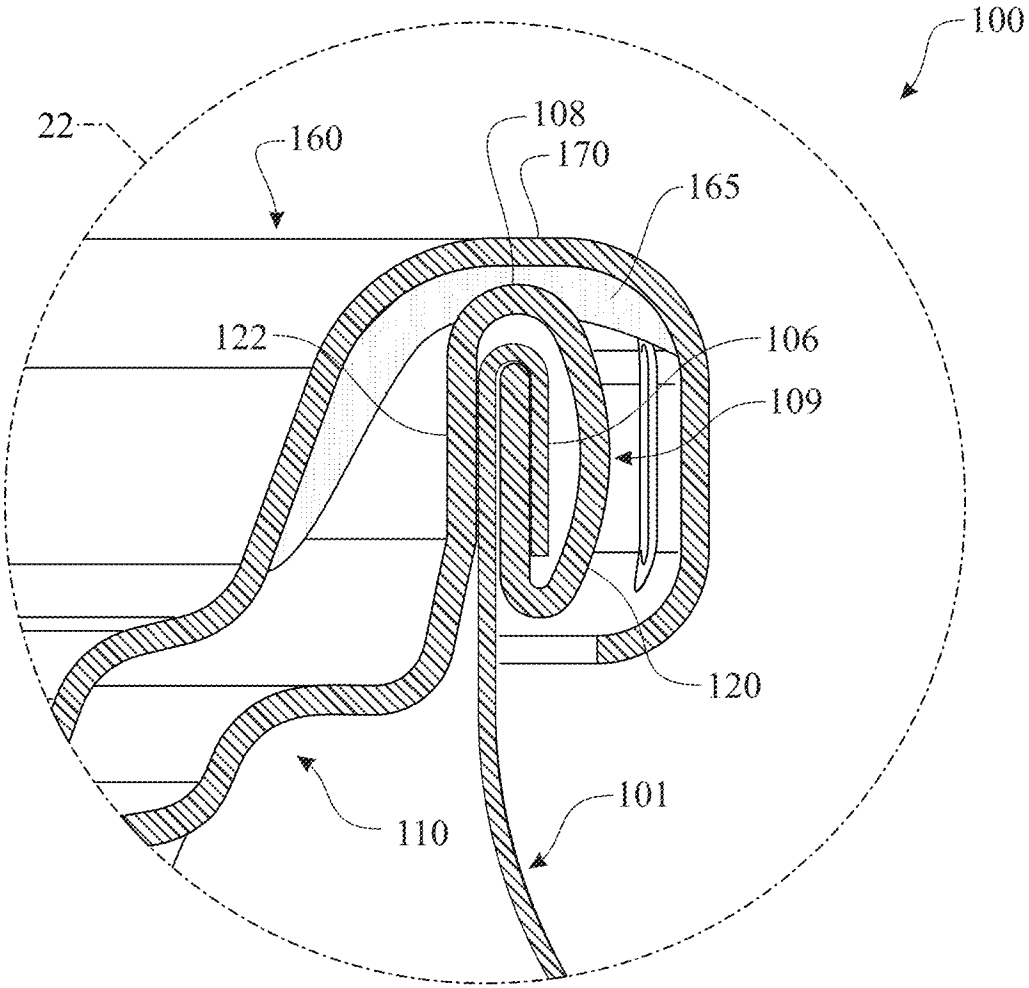
FIG. 22 presents an enlarged cross section view detailing a completed seam formed between the joining edge of the container lid originally introduced in FIG. 1 and the container body and the container cap originally introduced in FIG. 8 assembled to the container subassembly, is an enlarged detail view of area 22 circumscribed within FIG. 21.
Figure 23:
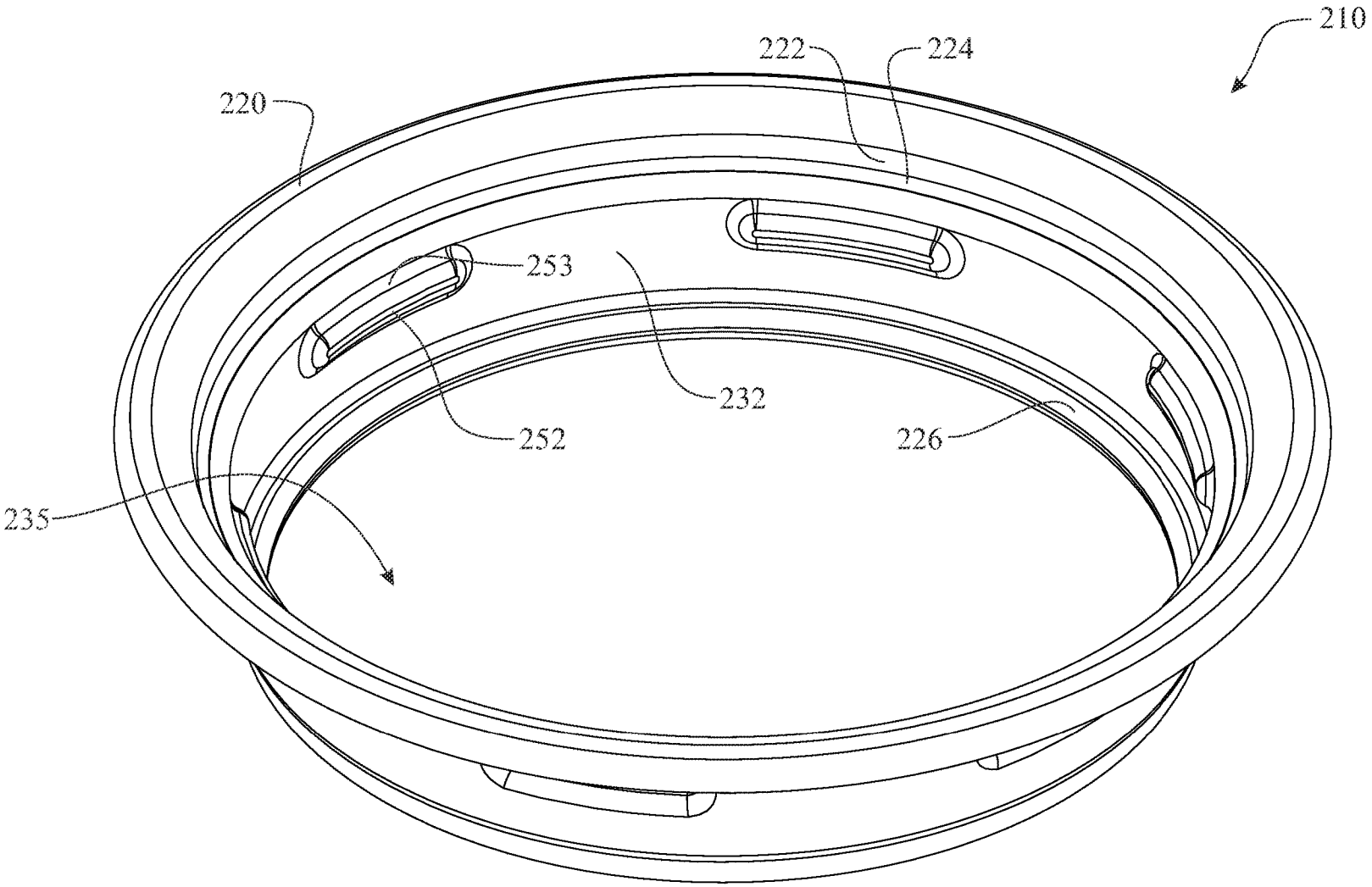
FIG. 23 presents a top, side isometric view introducing a second exemplary container lid in accordance with the present invention, wherein the second exemplary container lid includes a plurality of lid translative motion guide features integral within a frustum shaped sidewall and a lid rolled annular end ring arrangement provided at a lower edge of the frustum shaped sidewall.
Figure 24:
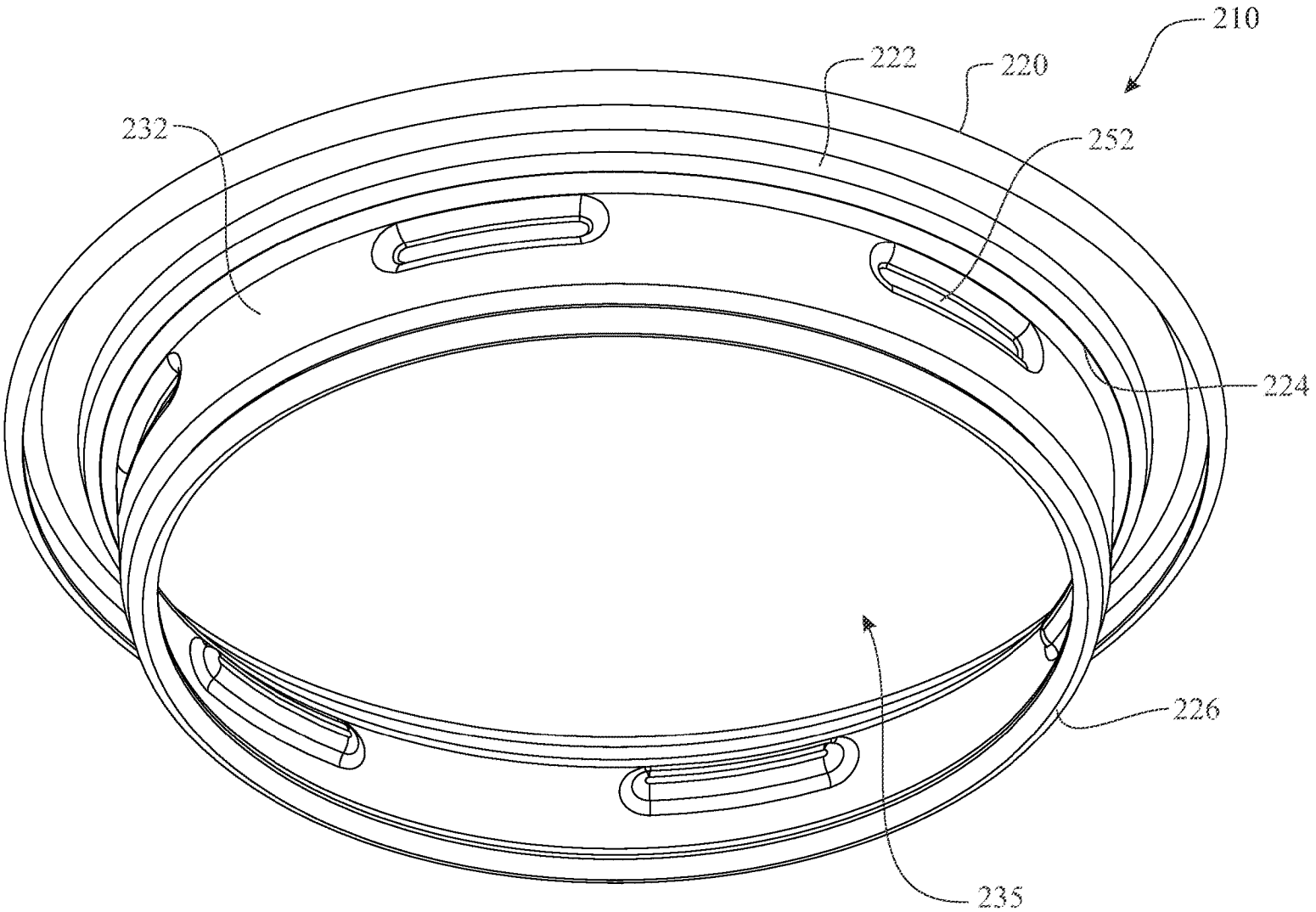
FIG. 24 presents a bottom, side isometric view of the second exemplary container lid originally introduced in FIG. 24.
Figure 25:
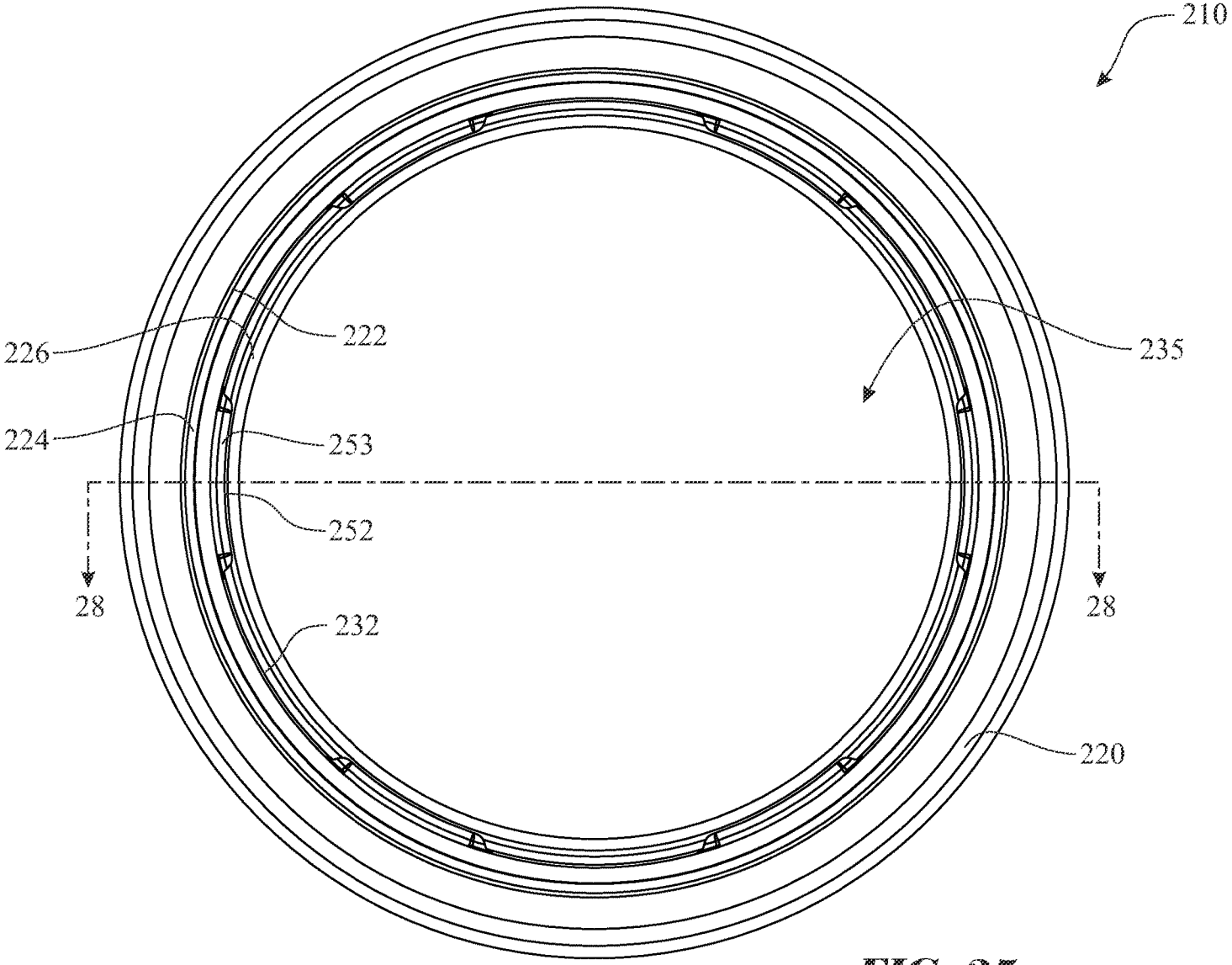
FIG. 25 presents a top, plan view of the second exemplary container lid originally introduced in FIG. 23.
Figure 26:
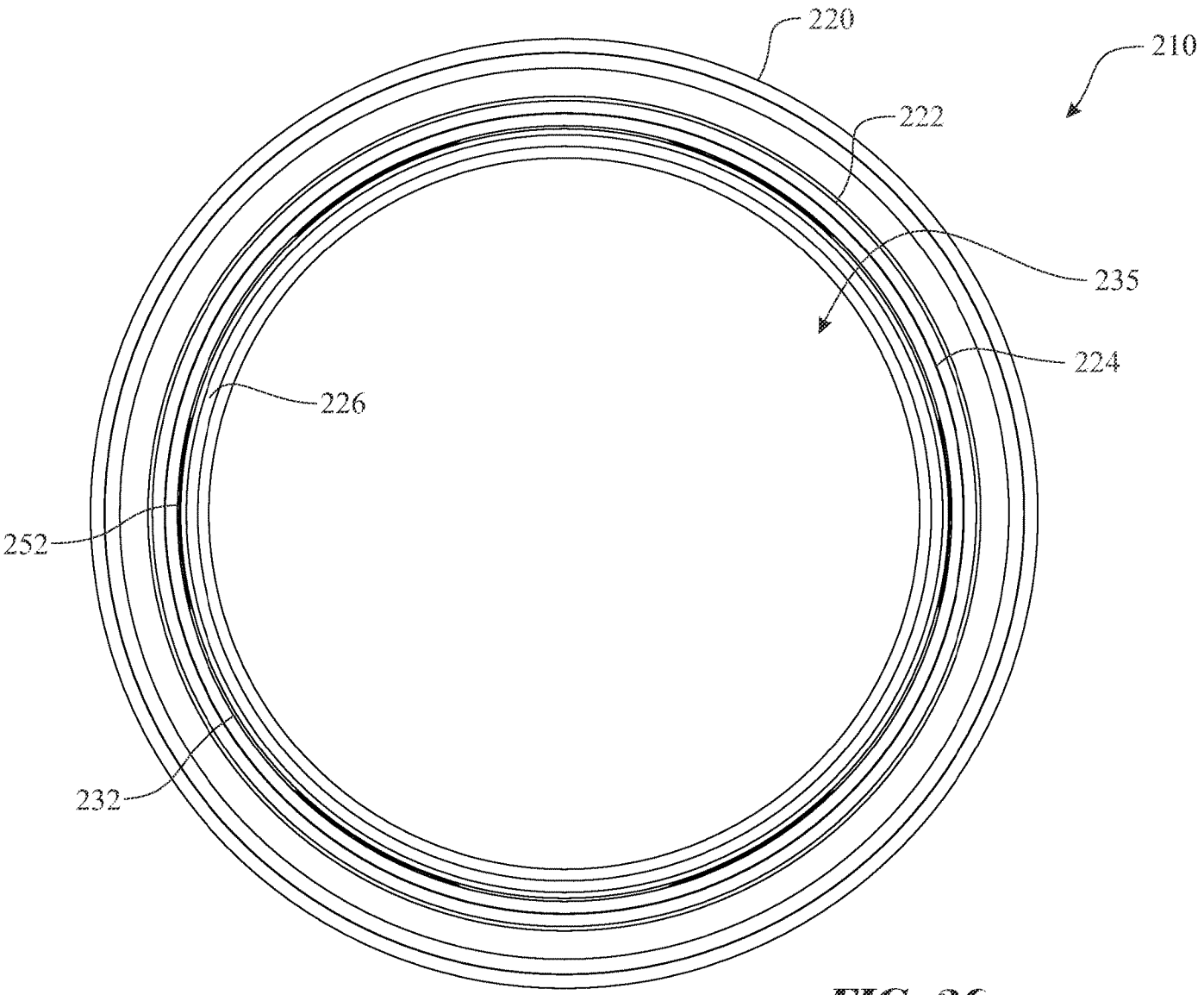
FIG. 26 presents a bottom, plan view of the second exemplary container lid originally introduced in FIG. 23.
Figure 27:
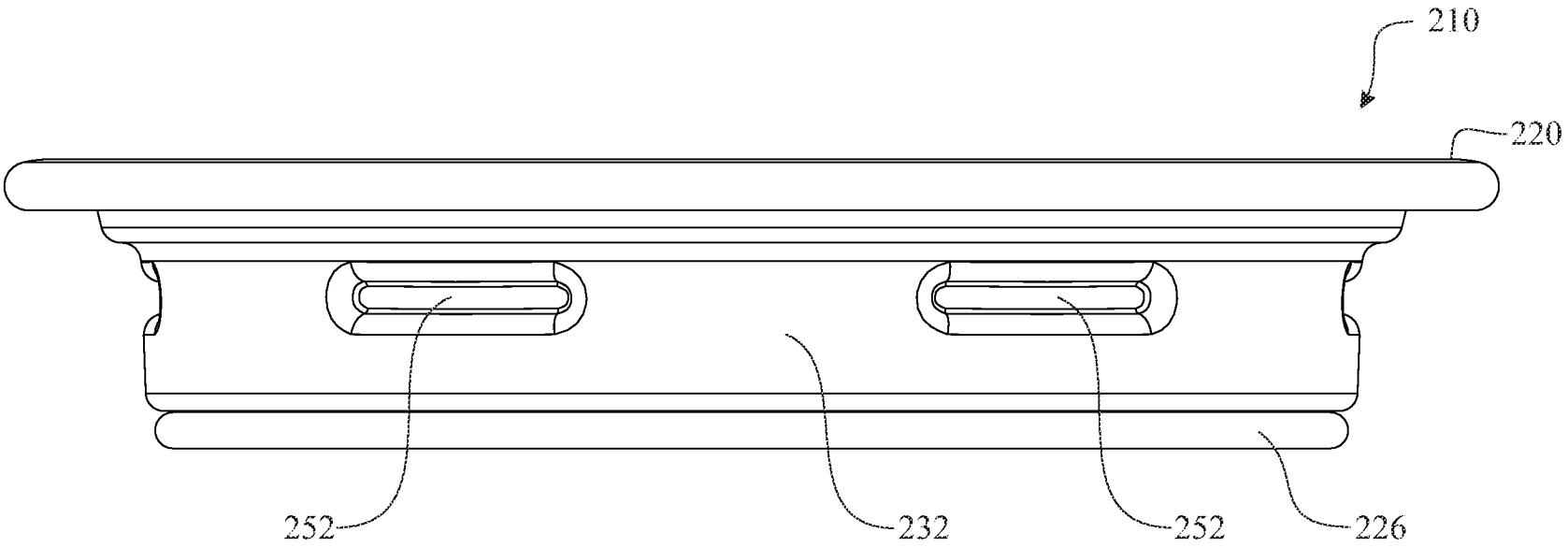
FIG. 27 presents a side elevation view of the second exemplary container lid originally introduced in FIG. 23.
Figure 28:
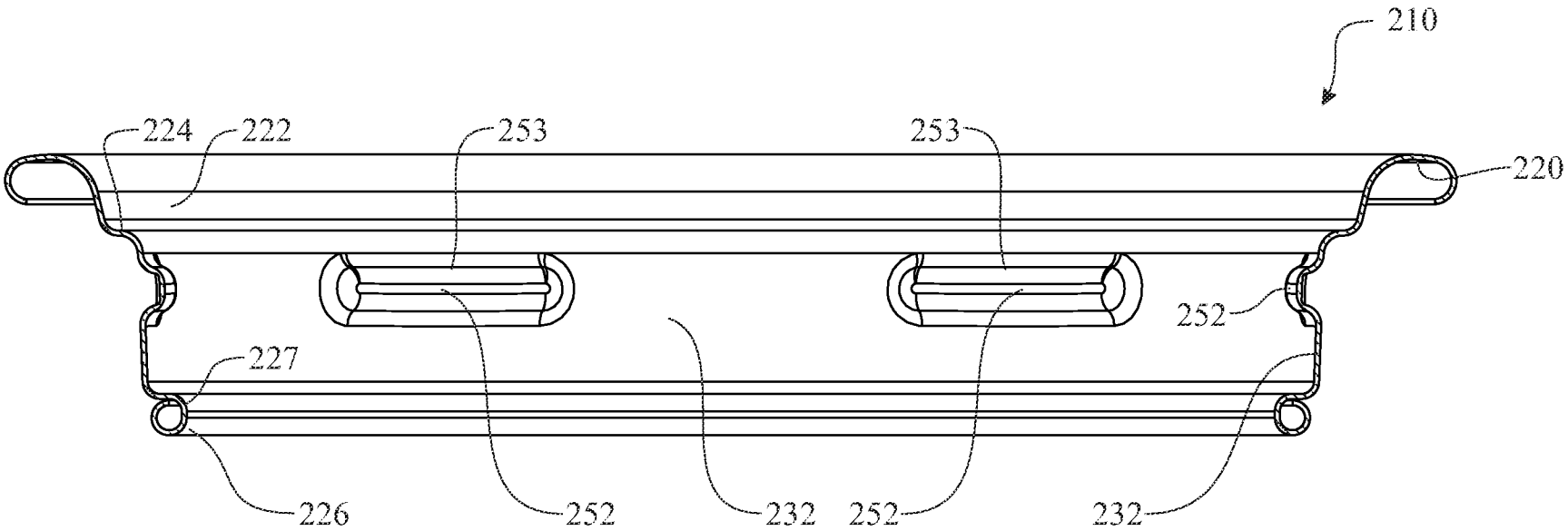
FIG. 28 presents a cross sectioned side elevation view of the second exemplary container lid originally introduced in FIG. 23, the section view taken along section line 28-28 of FIG. 25.

A second sealing interface can be provided between an interior surface of the cylindrical sidewall inverted countersink 170 of the resealable container cap 160 and an upper surface of the seaming panel 120 of the resealable container lid 110, as illustrated in FIG. 22. A shape of the cylindrical sidewall inverted countersink 170 enables flexure. The axial relational motion between the resealable container cap 160 and the resealable container lid 110 draws the interior (underside) surface of the cylindrical sidewall inverted countersink 170 of the resealable container cap 160 and the upper surface of the seaming panel 120 of the resealable container lid 110 towards one another. The axial relational motion between the resealable container cap 160 and the resealable container lid 110 would continue after the interior (underside) surface of the cylindrical sidewall inverted countersink 170 of the resealable container cap 160 and the upper surface of the seaming panel 120 of the resealable container lid 110 contacts one another, causing the cylindrical sidewall inverted countersink 170 to deform slightly. The deformation increases a normal force between the interior (underside) surface of the cylindrical sidewall inverted countersink 170 of the resealable container cap 160 and the exterior surface of the seaming panel 120 of the resealable container lid 110, thus improving the seal therebetween. A sealant material can be provided between the interior (underside) surface of the cylindrical sidewall inverted countersink 170 of the resealable container cap 160 and the exterior surface of the seaming panel 120 of the resealable container lid 110. It would be preferred that the sealant material is applied to and carried by an interior (underside) surface of the cylindrical sidewall inverted countersink 170, as the material may be removed from the exterior surface of the seaming panel 120 during the seaming process.

Figure 37:
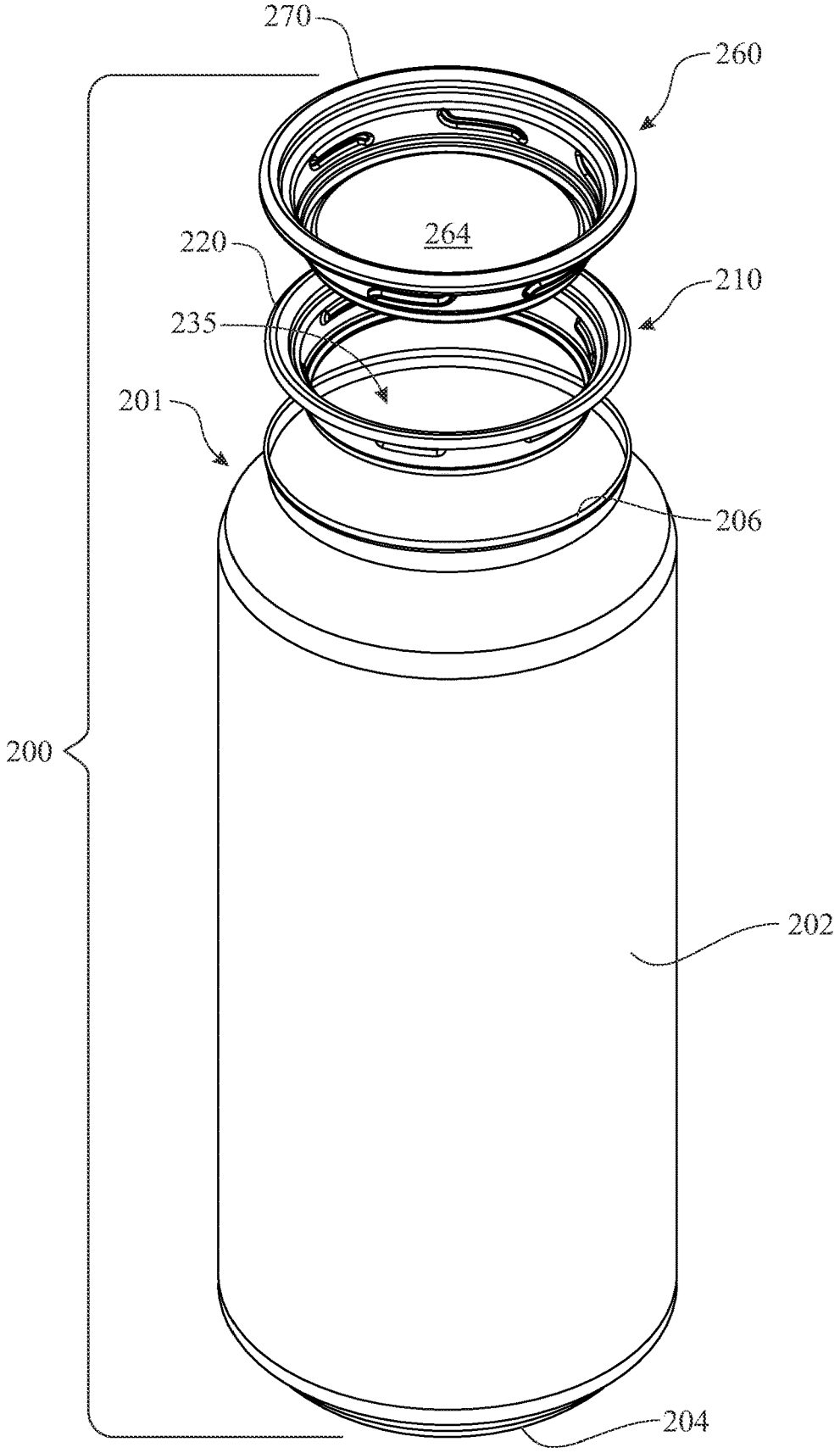
FIG. 37 presents a front, top isometric exploded assembly view of a container comprising the second exemplary container lid originally introduced in FIG. 23 and the first exemplary container cap originally introduced in FIG. 30, the illustration presenting the container lid and a container body awaiting seaming to one another and the container cap staged for assembly thereto.
Figure 38:
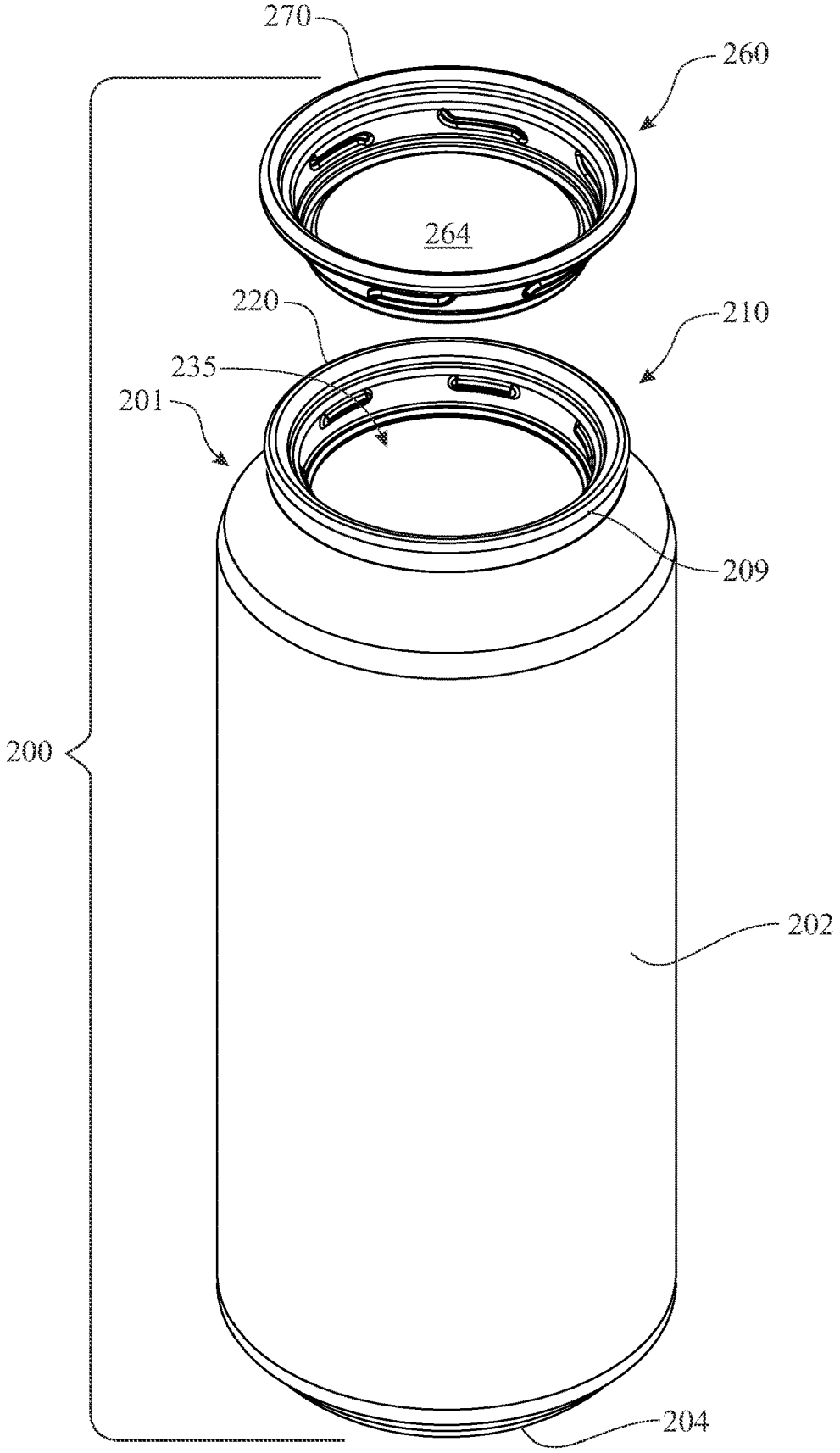
FIG. 38 presents a front, top isometric partially assembled view of the container originally introduced in FIG. 37, the illustration presenting the container lid seamed to the container body and the container cap staged for assembly thereto.
Figure 39:
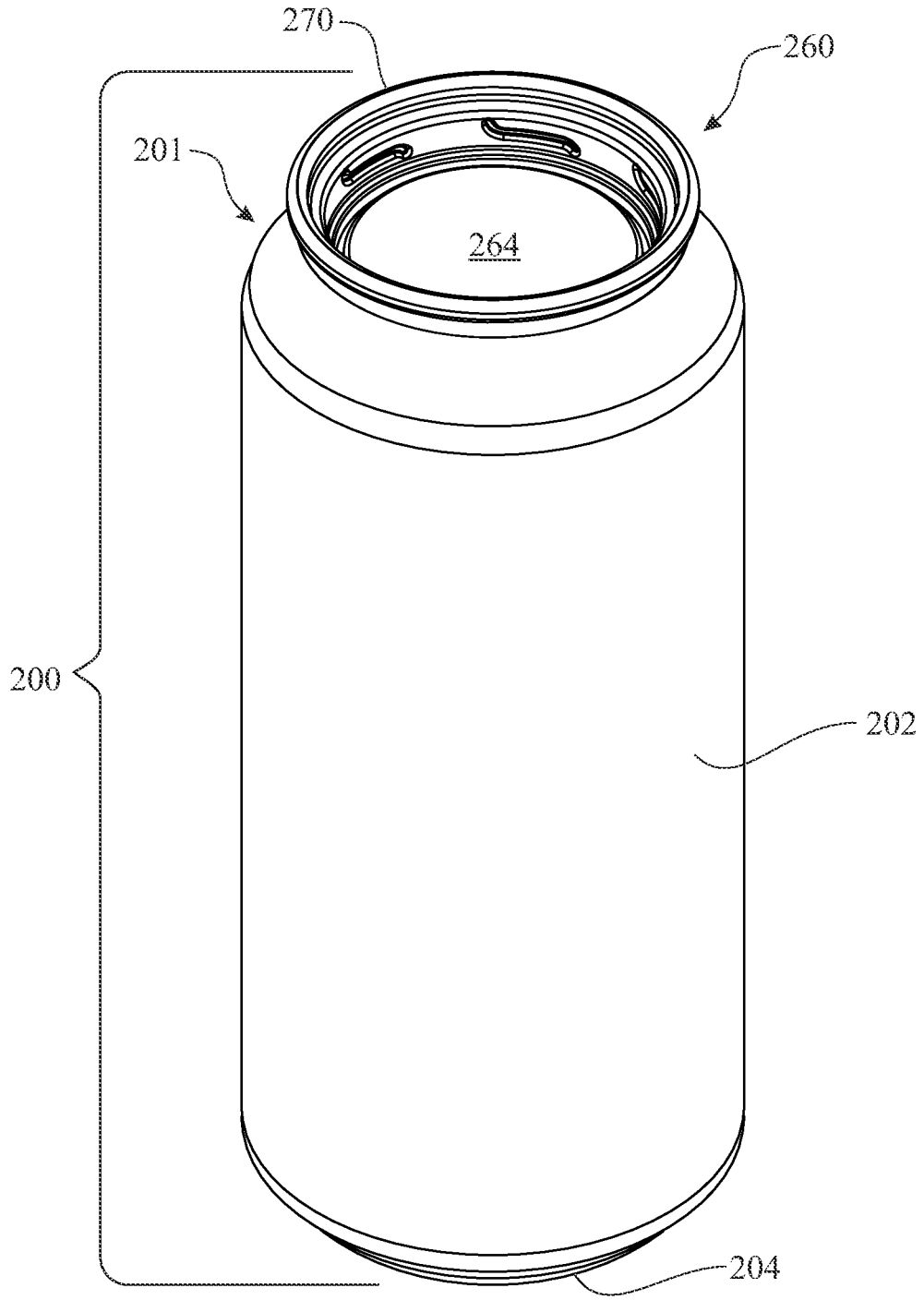
FIG. 39 presents a front, top isometric partially assembled view of the container originally introduced in FIG. 37, the illustration presenting the container cap assembled to the container lid and body subassembly.
Figure 40:
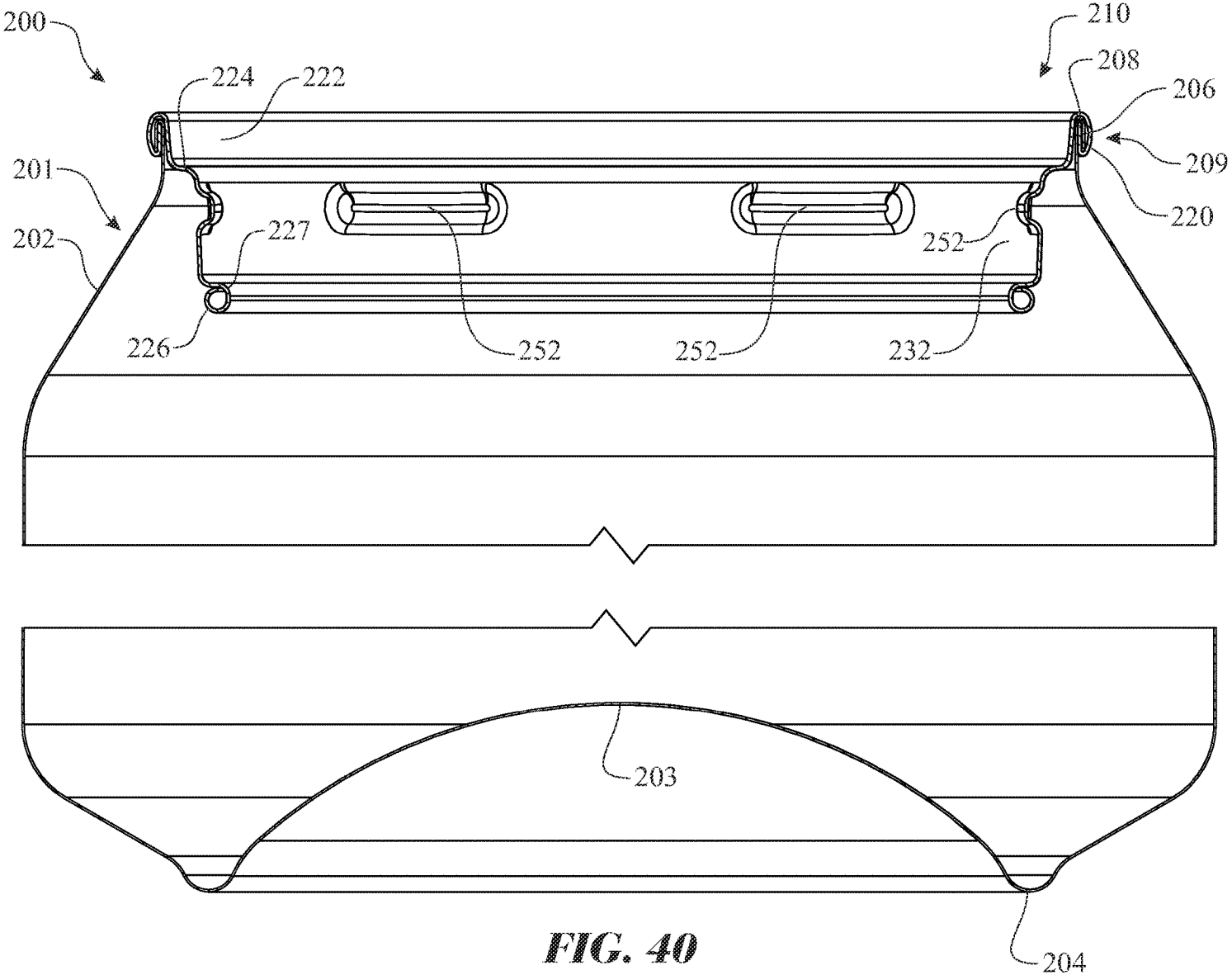
FIG. 40 presents an enlarged sectioned assembly view of the container originally introduced in FIG. 37 comprising the second exemplary container lid originally introduced in FIG. 23, the section of the container being representative of the section taken along section line 28-28 of FIG. 25.
Figure 41:
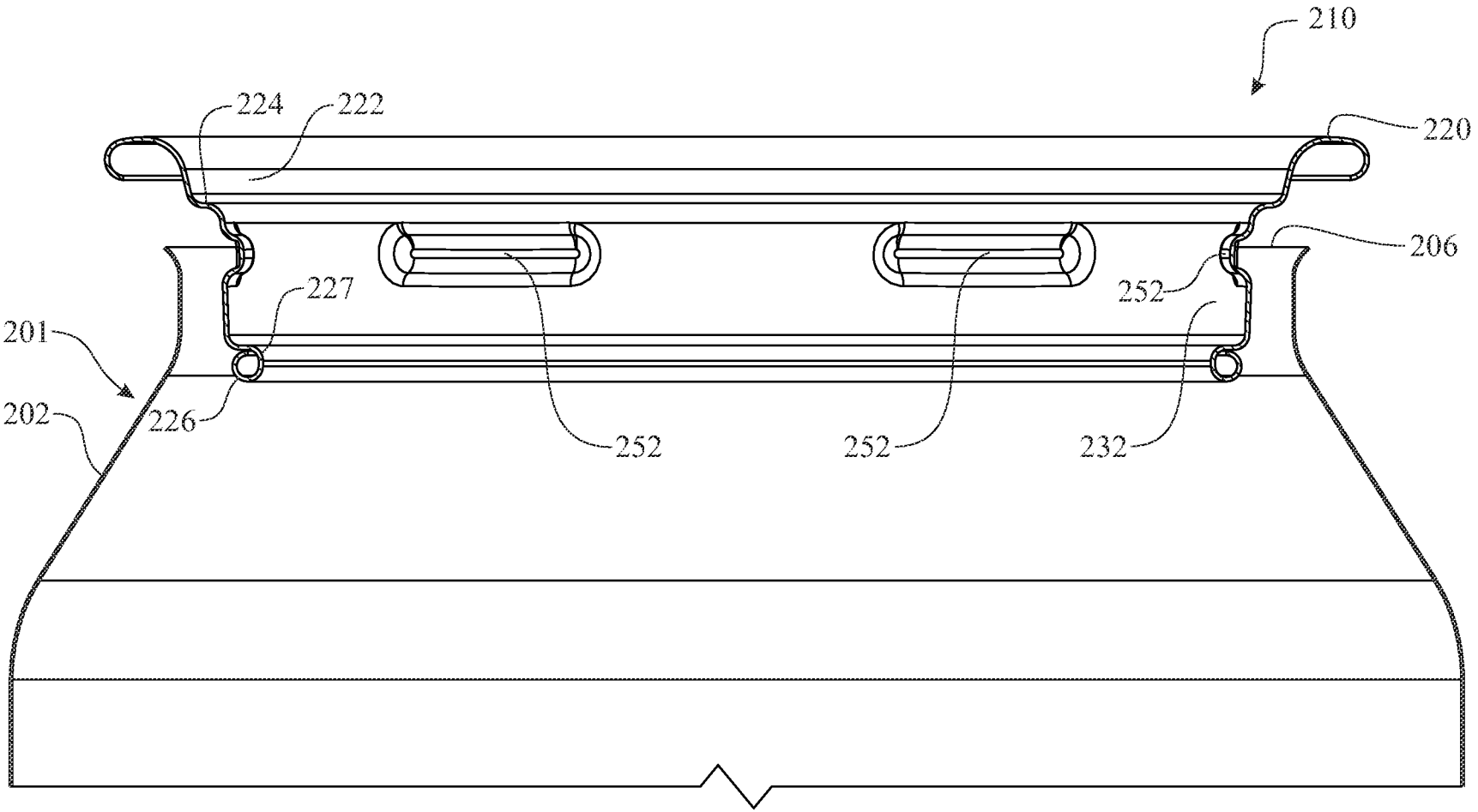
FIG. 41 presents a sectioned elevation exploded assembly view of the container originally introduced in FIG. 37 comprising the second exemplary container lid originally introduced in FIG. 23, the illustration presenting a relationship between a seaming panel of the container lid and a joining edge of the container body prior to execution of a seaming process, the section of the container being representative of the section taken along section line 28-28 of FIG. 25.
Figure 42:
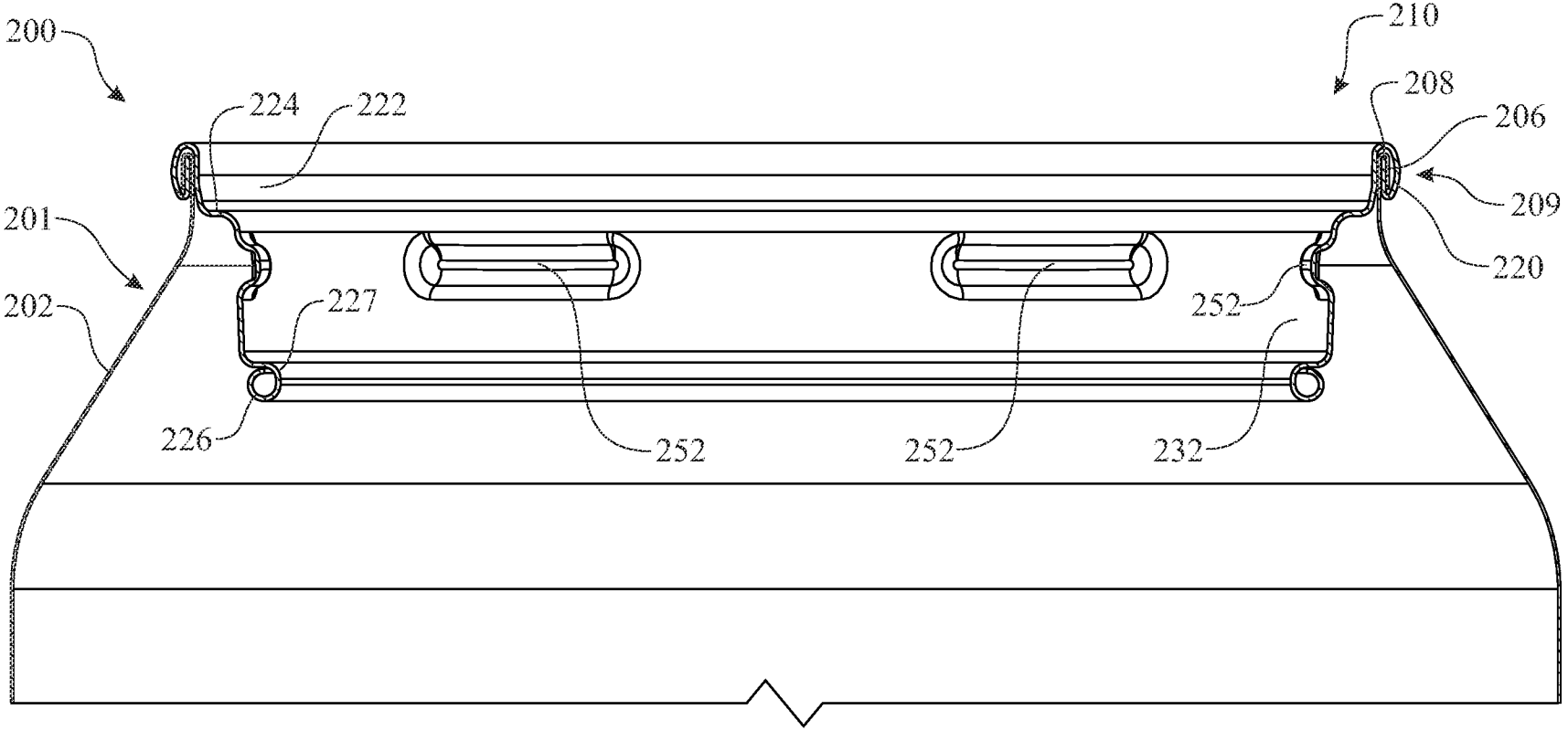
FIG. 42 presents a sectioned elevation assembly view of the container originally introduced in FIG. 41 comprising the first exemplary container lid originally introduced in FIG. 23, the illustration presenting a seam formed between the seaming panel of the container lid and the joining edge of the container body, the section of the container being representative of the section taken along section line 28-28 of FIG. 25.
Figure 43:
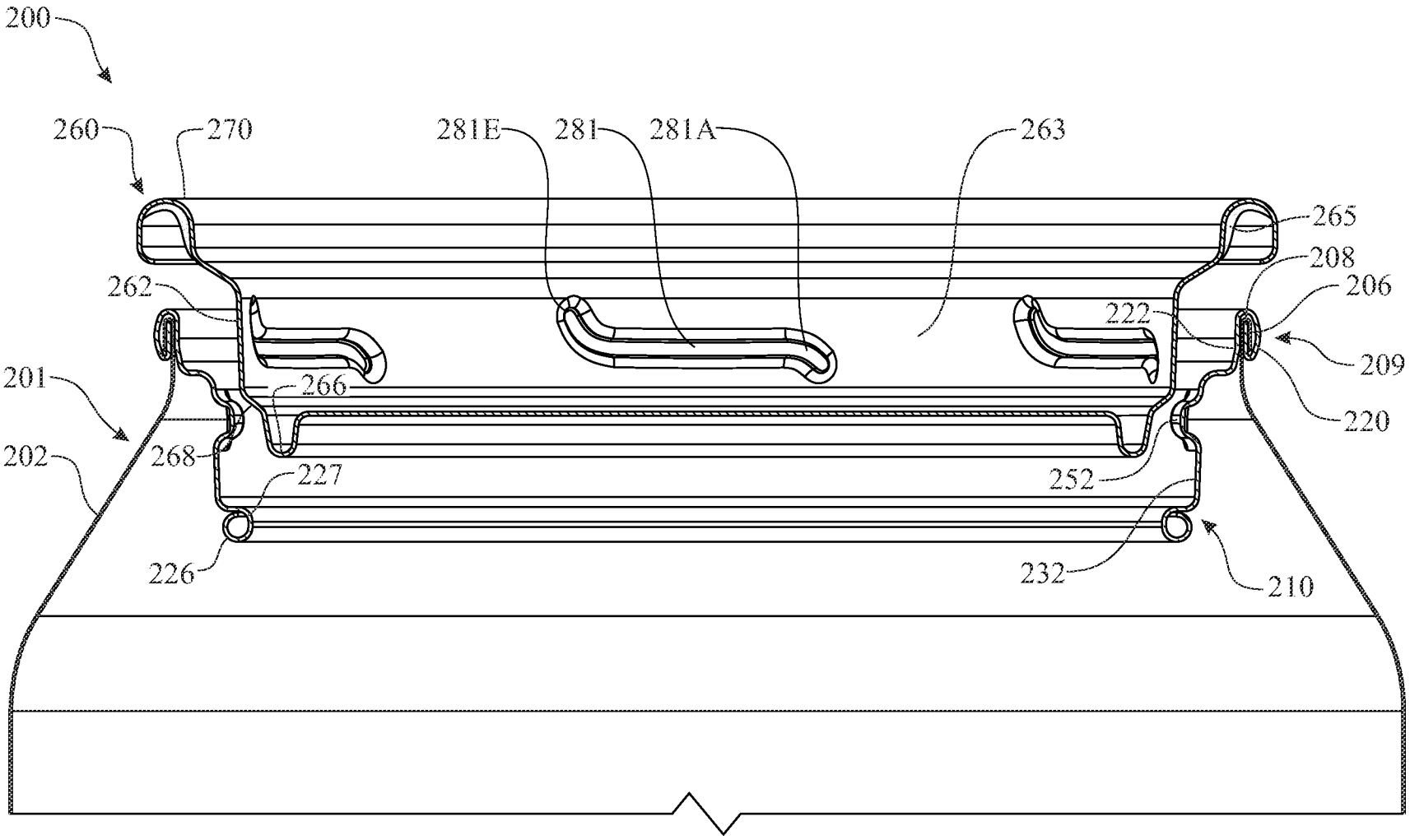
FIG. 43 presents a sectioned elevation partial assembly view of the container as illustrated in FIG. 41, introducing the second exemplary container cap originally introduced in FIG. 30, the illustration presenting the container cap staged for assembly to the container subassembly, the section of the container being representative of the section taken along section line 28-28 of FIG. 25.

Other sealing facing surfaces can be integrated into the resealable container lid 110 and the resealable container cap 160. One example of a variation is utilized in a resealable container assembly 200, illustrated in FIGS. 37, 38, and 39, with details being presented in FIGS. 40 through 49.

The exemplary resealable container assembly 200 and the exemplary resealable container assembly 100 include a number of like elements. Like elements of the resealable container assembly 100 and the resealable container assembly 200 are numbered the same, with the elements of the resealable container assembly 200 being referenced by numbers preceded by the numeral "2". Distinctions between the resealable container assembly 100 and the resealable container assembly 200 are described herein. In the exemplary illustrations, the resealable container body 201 and the resealable container body 101 are similar to one another. The distinctions are included in the resealable container annular component 210 and the resealable container cap 260. Illustrations presenting the resealable container body 101 lack any views detailing the container body closed bottom wall 104 of the resealable container body 101. The container body closed bottom wall 104 can be similar to the container body closed bottom wall 204. Illustrations presenting the resealable container body 201 introduce a shape of the bottom portion of the resealable container body 201. The exemplary bottom portion of the resealable container body 201, as illustrated, include a container body annular base 204 about a peripheral edge of a container body closed bottom wall 203. The container body closed bottom wall 203 can be coplanar with the container body annular base 204, or, as illustrated, the container body closed bottom wall 203 is preferably recessed from the container body annular base 204. The recessed design of the container body closed bottom wall 203 provides better support on a table, a wall that can resist upon pressure build up internal to the container with minimal effects upon the shape of the container body annular base 204, and other benefits. In the exemplary illustrations, the container body closed bottom wall 203 is domed in shape. Although the exemplary illustration presents a desirable domed shape container body closed bottom wall 203, the container body closed bottom wall 203 can be of any shaped recess. Details of the resealable container annular component 210 are illustrated in FIGS. 23 through 29. Details of the resealable container cap 260 are illustrated in FIGS. 30 through 36.

The resealable container lid 110 includes a lid bottom wall 134, wherein the resealable container lid 110 seals contents within the resealable container assembly 100. Contents are accessed when a portion of the lid bottom wall 134 is fractured and opened, such as a fracturing of the lid bottom panel score line 136 and an opening of the lid bottom panel tear panel 138 using the currently commercially available Stay-On Tab (SOT) design as described above. Conversely, the resealable container annular component 210 excludes the lid bottom wall 134, where a lower edge of a cap receiving annular component tubular sidewall 232 of the resealable container annular component 210 is open. The lower edge of the resealable container annular component 210 is rolled, forming a cap receiving annular component rolled annular end ring 226. The cap receiving annular component rolled annular end ring 226 creates a lid open passageway 235 passing through an interior of the resealable container annular component 210.

The exemplary resealable container lid 110 includes four (4) lid translative motion guide features 152. The exemplary resealable container annular component 210 includes six (6) cap receiving annular component translative motion guide features 252. The number and/or design of lid translative motion guide features 152, 252 would be determined by the designer of the container lid 110, annular ring component 210. Several features can be considered when determining the number and/or design of lid translative motion guide features 152, 252, including type of contents within the resealable container assembly 100, 200, anticipated maximum pressure within the resealable container assembly 100, 200, desired degree of rotation between the container cap 160, 260 and the container lid 110, annular ring component 210, desired axial relative motion between the container cap 160, 260 and the container lid 110, annular ring component 210, type and thickness of the sealant material, and any other consideration.

In the exemplary illustrations, the cap receiving annular component tubular sidewall 232 is more cylindrical (vertical) than the lid frustum shaped sidewall 132. This design provides a different nesting arrangement for the resealable container annular component 210 (illustrated in FIG. 29) compared to the nesting arrangement of the resealable container lid 110 (illustrated in FIG. 7).

Figure 29:
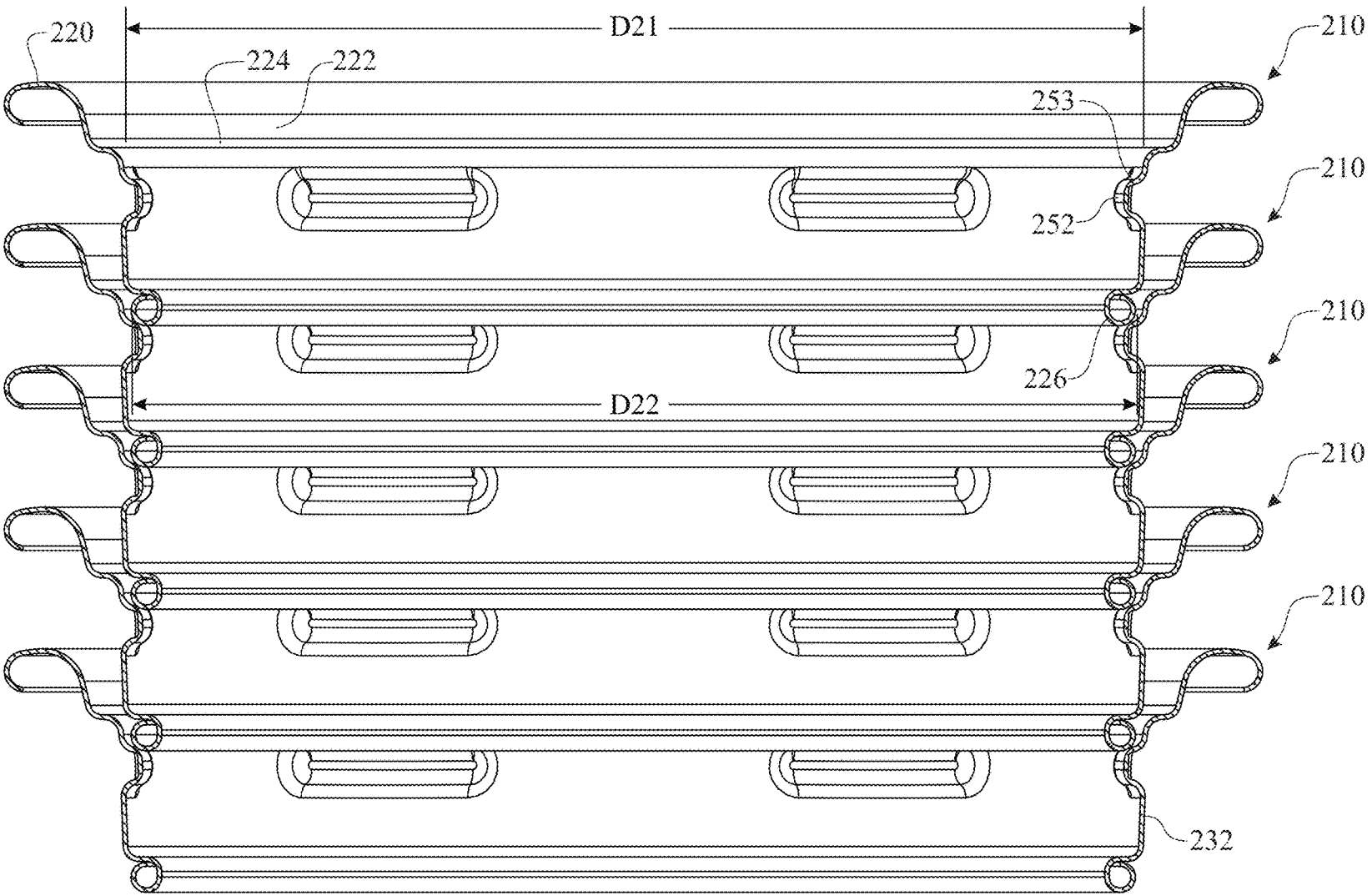
FIG. 29 presents a cross sectioned side elevation view of the second exemplary container lid originally introduced in FIG. 23, the section view taken along section line 28-28 of FIG. 25, the illustration presenting a nesting capability of the second exemplary container lid.
Figure 30:
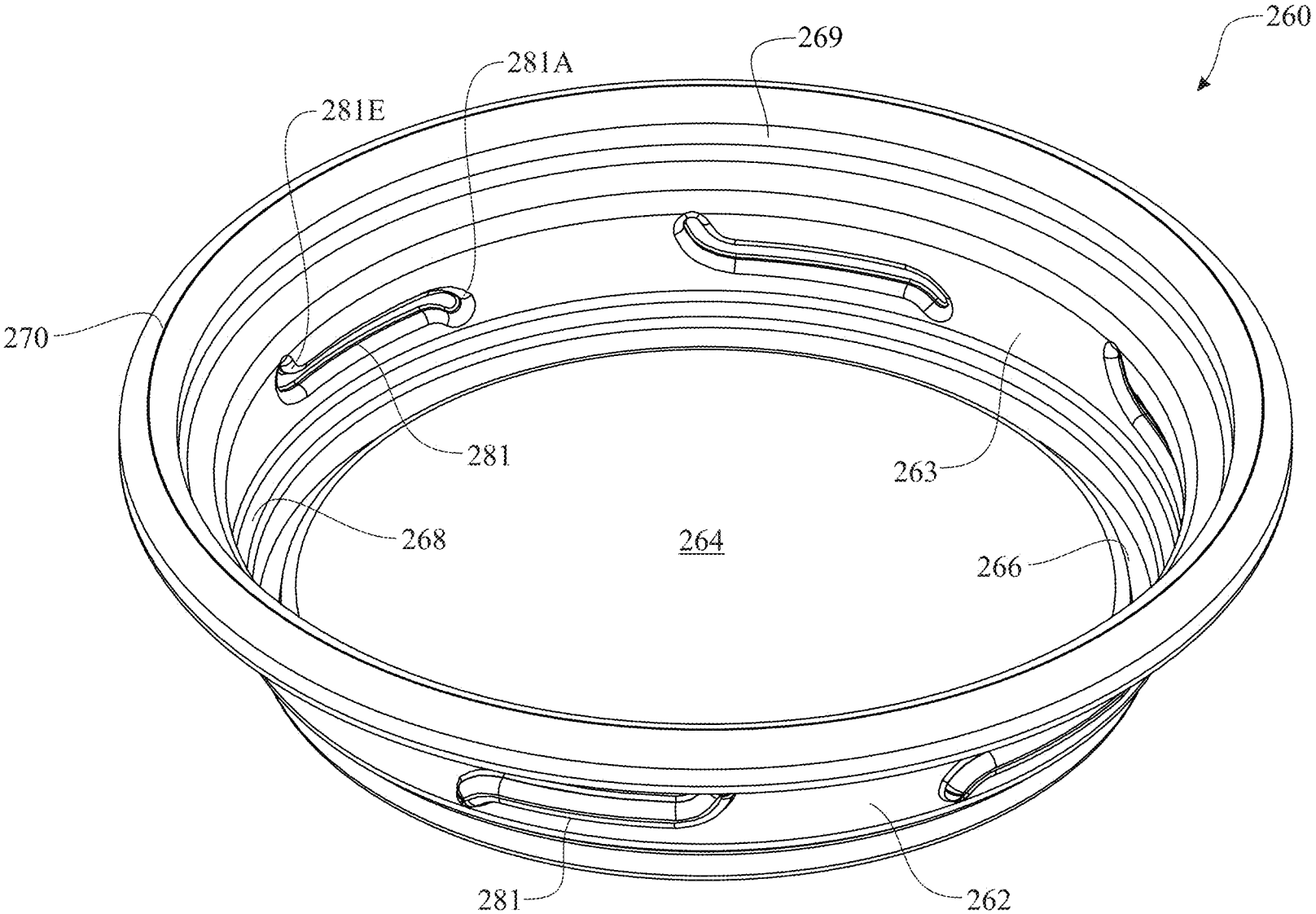
FIG. 30 presents a top, side isometric view introducing a second exemplary container cap in accordance with the present invention, wherein the second exemplary container cap includes a plurality of cap translative motion guide features integral within a frustum shaped sidewall and a countersink arrangement provided circumscribing a cap bottom wall.
Figure 31:
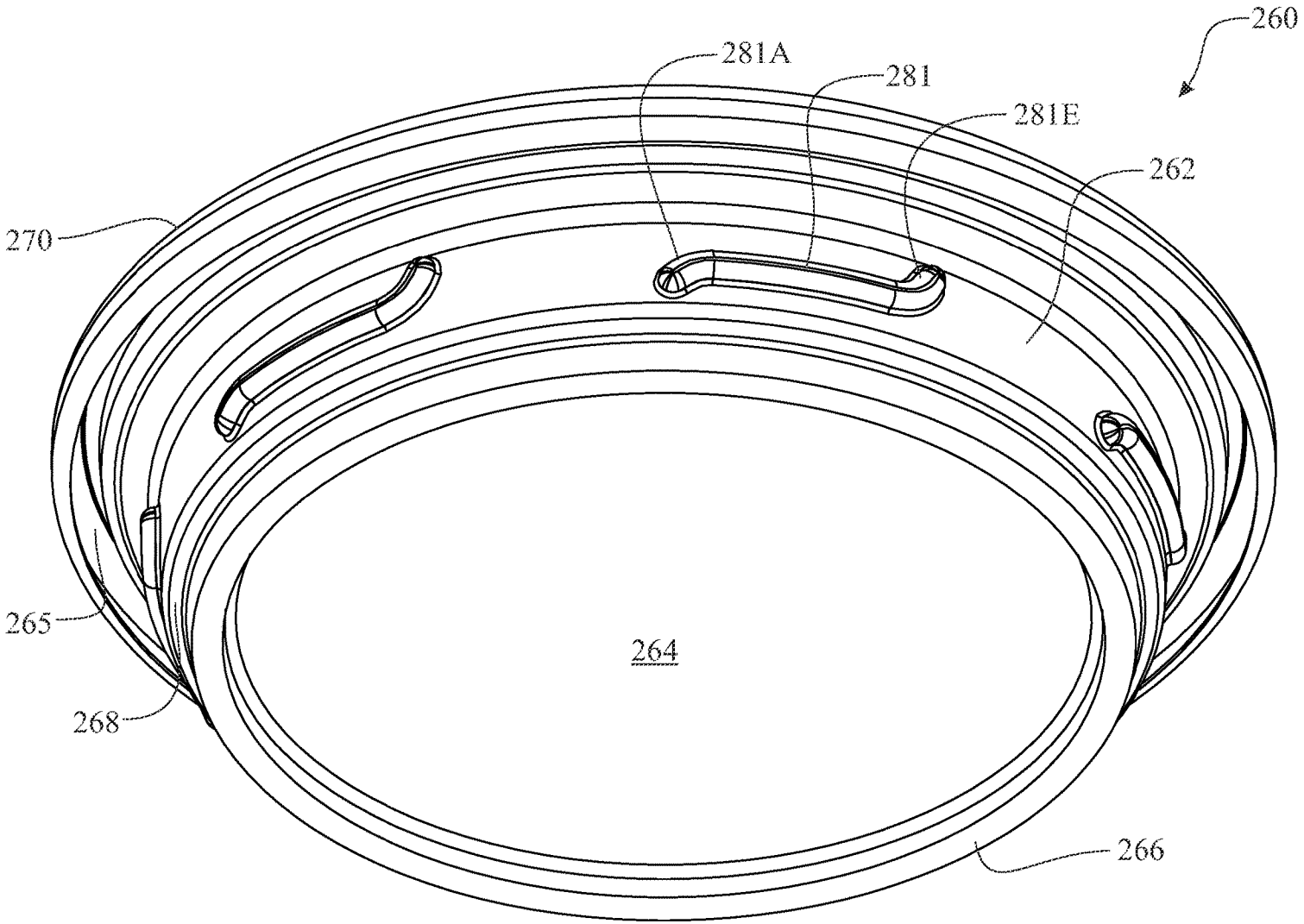
FIG. 31 presents a bottom, side isometric view of the second exemplary container cap originally introduced in FIG. 30.
Figure 32:
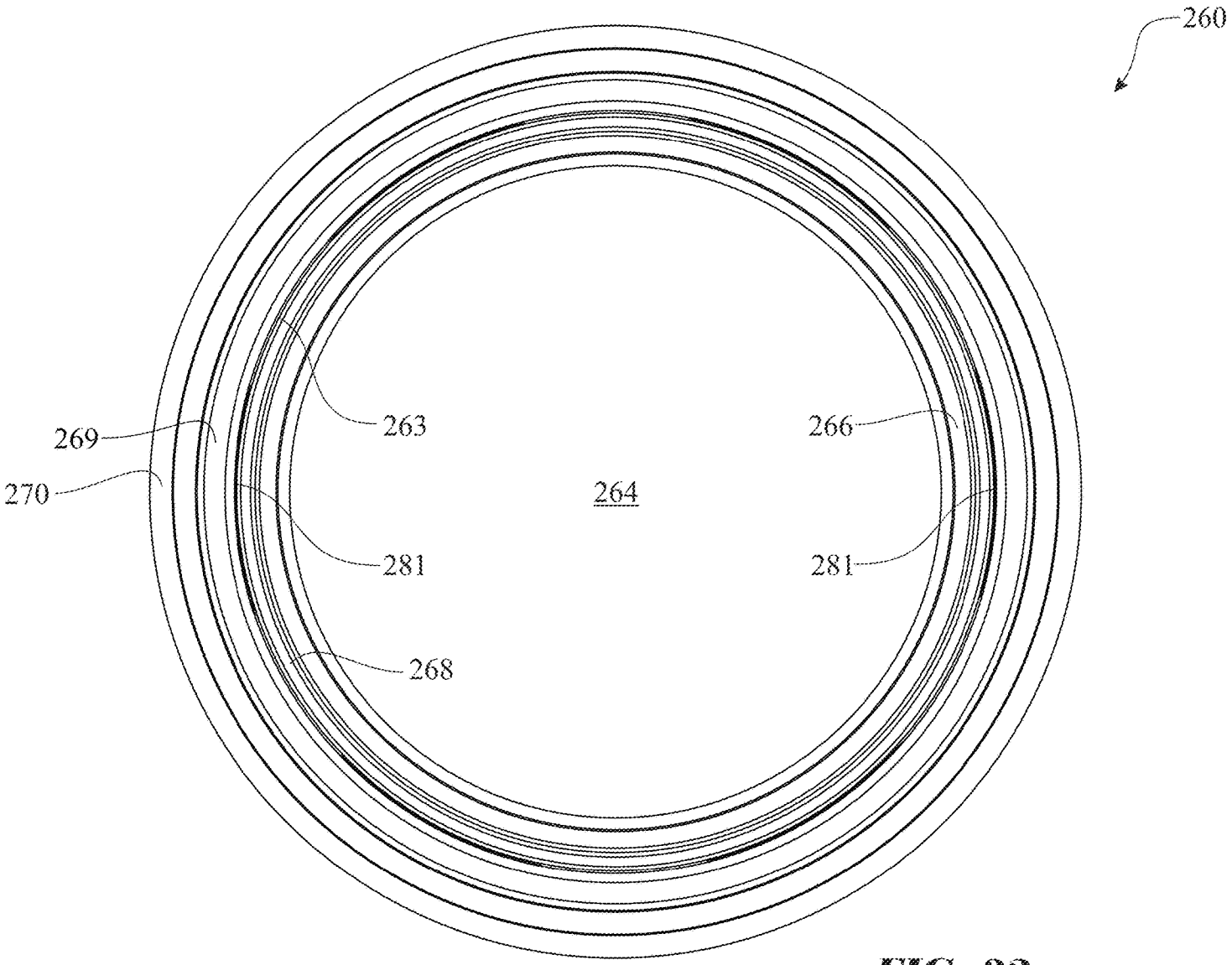
FIG. 32 presents a top, plan view of the second exemplary container cap originally introduced in FIG. 30.
Figure 33:
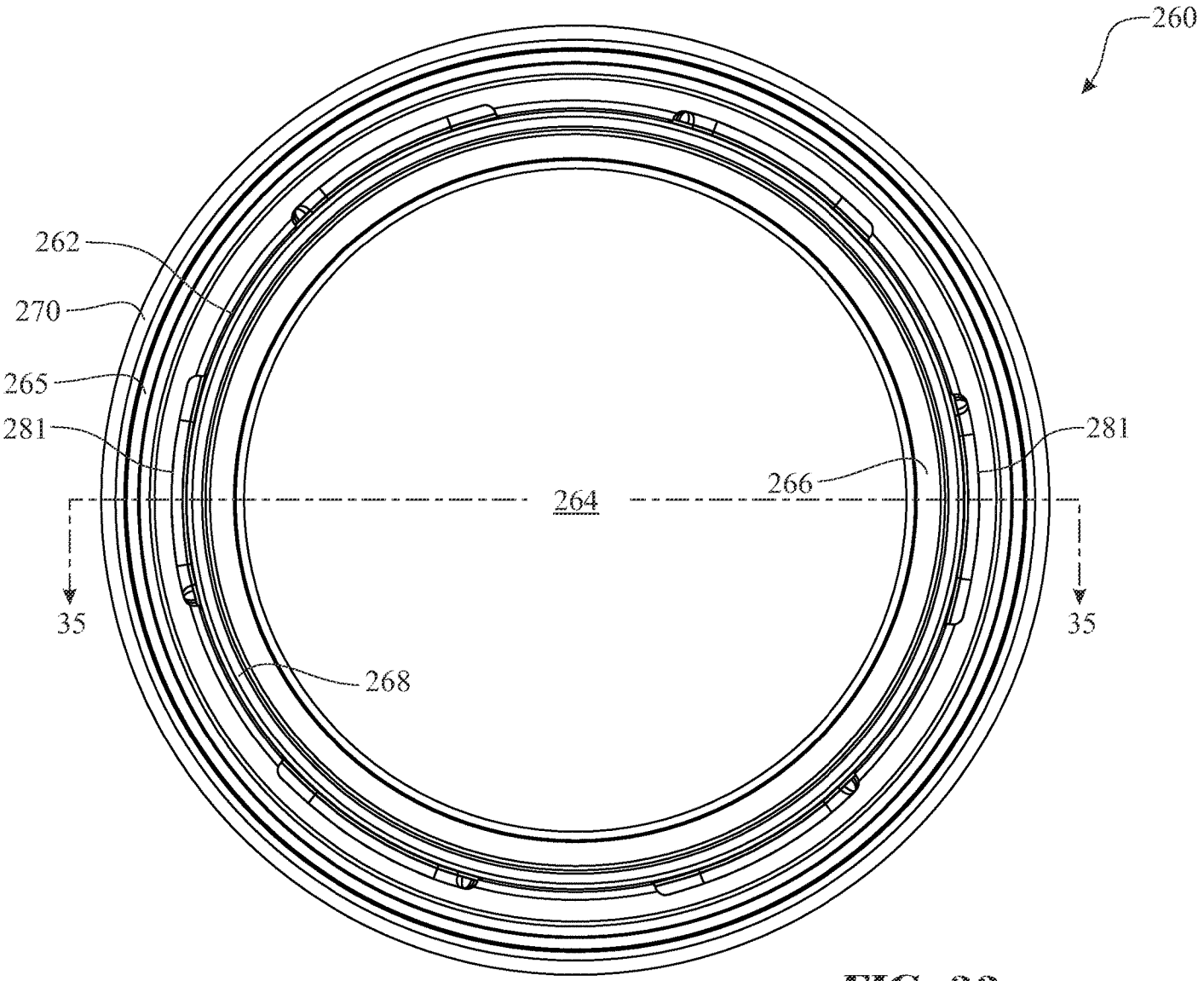
FIG. 33 presents a bottom, plan view of the second exemplary container cap originally introduced in FIG. 30.
Figure 34:
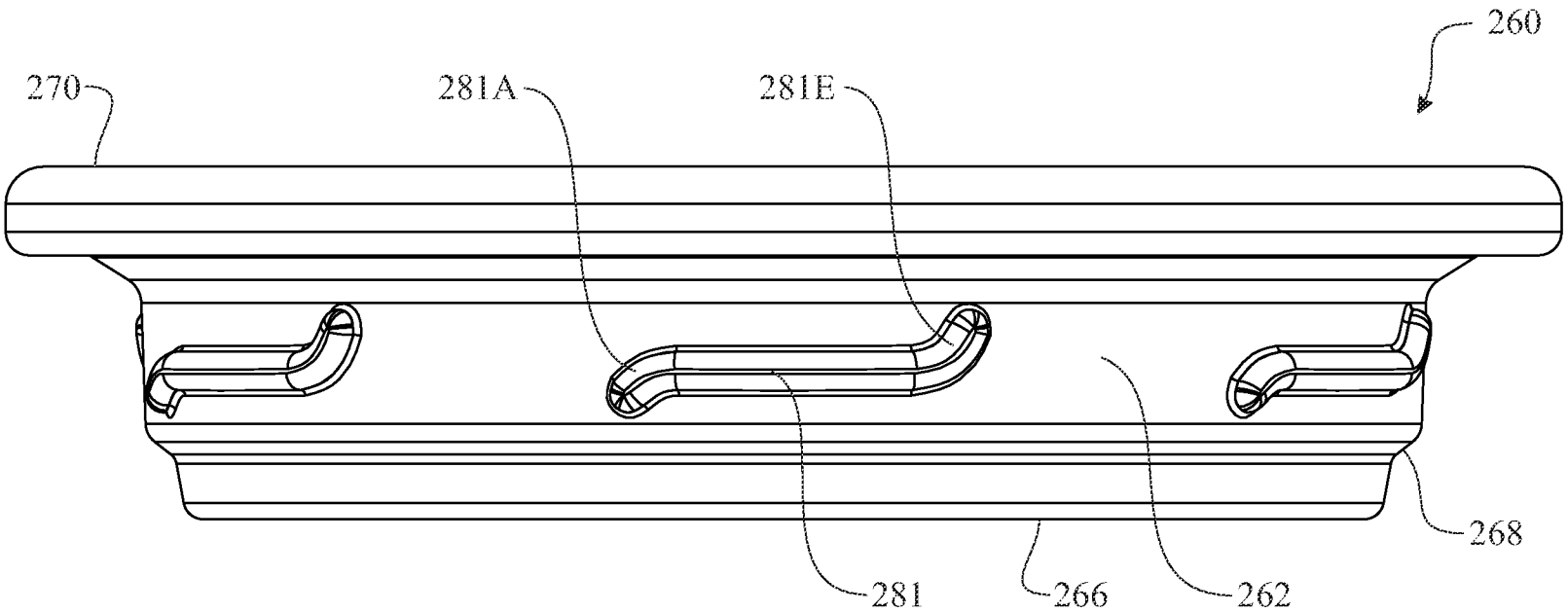
FIG. 34 presents a side elevation view of the second exemplary container cap originally introduced in FIG. 30, the illustration detailing a shape of an exemplary cap translative motion guide feature provided in a form of a cam.
Figure 35:
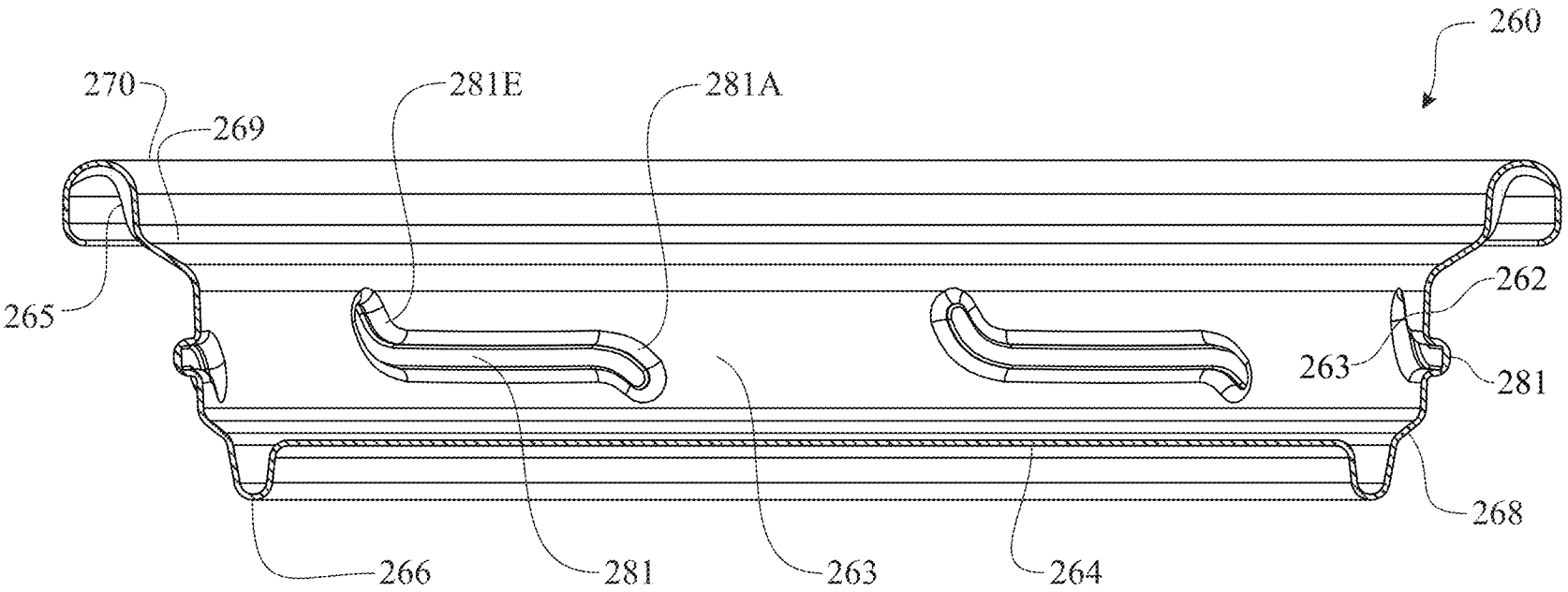
FIG. 35 presents a cross sectioned side elevation view of the second exemplary container cap originally introduced in FIG. 30, the section view taken along section line 35-35 of FIG. 32.

Nesting of a plurality of resealable container annular components 210 is arranged where a first resealable container annular component 210 is inserted into an interior of a second resealable container annular component 210. A upper tubular sidewall radially inner diameter D21, measuring a diameter across an upper edge of the interior surface of the lid tubular sidewall 232 is greater than a lower formation radially outermost diameter D22, measuring a diameter across a radially outermost dimension of an exterior surface of the cap receiving annular component rolled annular end ring 226 enabling an upper placed resealable container lid 210 to seat within the lid tubular sidewall 232 of a lower placed resealable container lid 210, as illustrated in FIG. 29. More specifically, a lower, outer surface of the cap receiving annular component rolled annular end ring 226 rests against a cap receiving annular component translative motion guide feature upper surface 253 of the cap receiving annular component translative motion guide feature 252, as illustrated in FIG. 29. The resealable container annular component 210 can be modified, where the cap receiving annular component tubular sidewall 232 has a more tapered or frustum shape. With this modification, the nesting of a plurality of resealable container annular components 210 can be arranged in accordance with the nesting arrangement of the resealable container annular component 110, where a radially exterior surface of the cap receiving annular component tubular sidewall 232 would rest against a radially interior surface of the cap receiving annular component translative motion guide feature 252.

Figure 36:
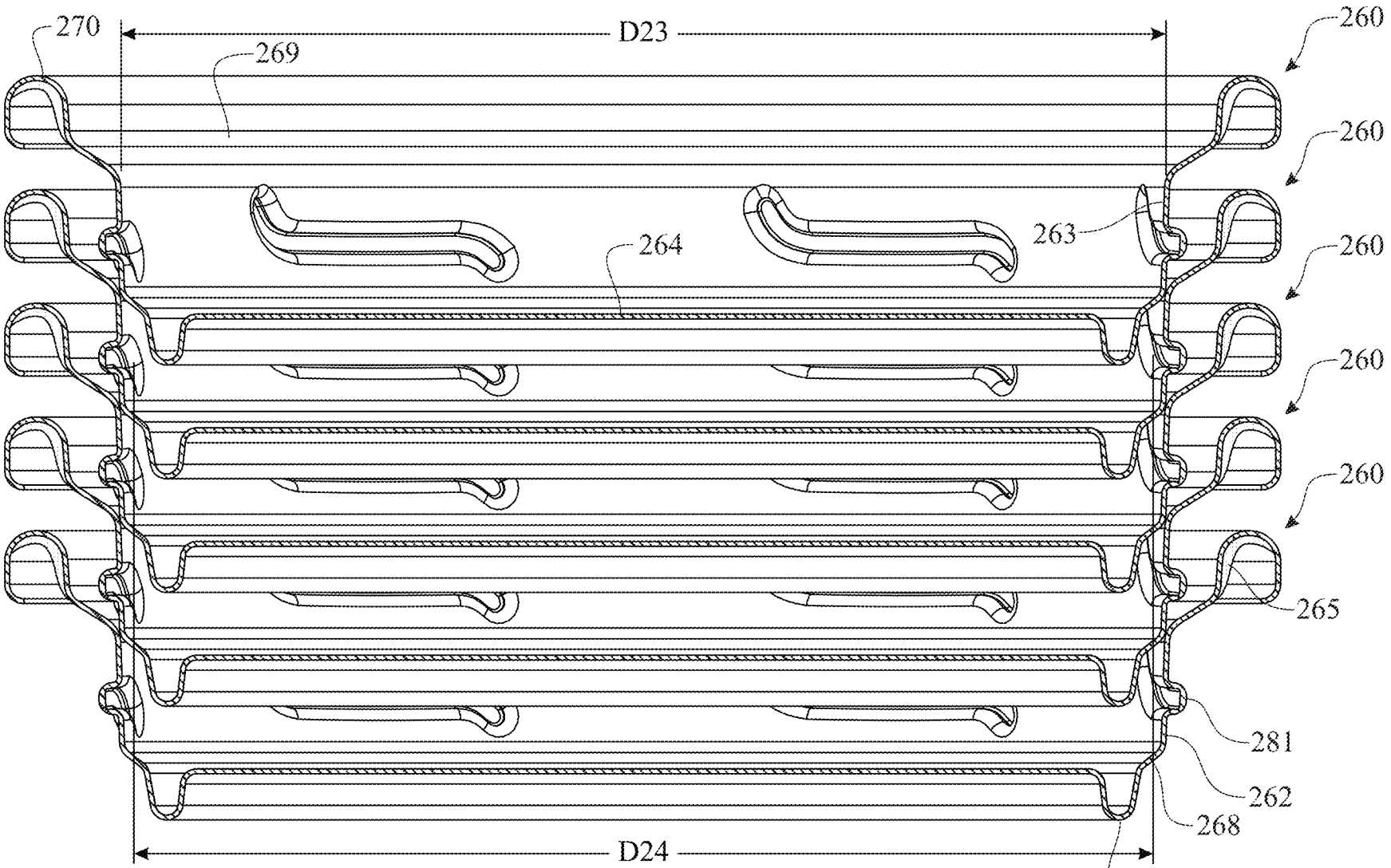
FIG. 36 presents a cross sectioned side elevation view of the second exemplary container cap originally introduced in FIG. 30, the section view taken along section line 35-35 of FIG. 32, the illustration presenting a nesting capability of the second exemplary container cap.

Nesting of a plurality of resealable container caps 260 is arranged where a first resealable container cap 260 is inserted into an interior of a second resealable container cap 260. An upper tubular sidewall radially inner diameter D23, measuring a diameter across an upper edge of the interior surface of the resealable container cap interior sidewall 263 is greater than a lower formation radially outermost diameter D24, measuring a diameter across a radially outermost dimension of an exterior surface of the cap annular countersink formation 266. This arrangement enables a lower, outer portion of the resealable container cap tubular radially exterior (product side) sidewall 262 of the first resealable container cap 260 rests against an upper portion of the resealable container cap tubular radially interior (public side) sidewall 263 of the second resealable container cap 260, as illustrated in FIG. 36. The resealable container cap 260 can be modified, where the tubular sidewall (exterior, product side) 262, (interior, public side) 263 has a more tapered or frustum shape. With this modification, the nesting of a plurality of resealable container caps 260 can be arranged in accordance with the nesting arrangement of the resealable container cap 160, where a radially exterior surface of the resealable container cap tubular exterior (product side) sidewall 262 would rest against a radially interior surface of the resealable container cap tubular interior (public side) sidewall 263. Alternatively, the resealable container cap 260 can be designed where a radially exterior surface of the cap translative motion guide feature 281 of the first or nesting resealable container cap 260 would rest against the resealable container cap tubular interior (public side) sidewall 263 of the second or adjacent resealable container cap 260.

The resealable container annular component 210 is seamed to a container body sidewall seaming flange 206 using the same seaming features and processes described above for the process of seaming the resealable container lid 110 to the container body cylindrical sidewall seaming flange 106. Details are presented in FIGS. 37 through 39 and section views presented in FIGS. 40 through 42. The resealable container cap 260 is inserted into a cavity defined by the cap receiving annular component tubular sidewall 232 of the resealable container annular component 210. The rotational and resulting translative axial motions of the resealable container cap 260 respective to the resealable container annular component 210 are the same as those of the resealable container cap 160 respective to the resealable container lid 110 as described above.

Figure 44:
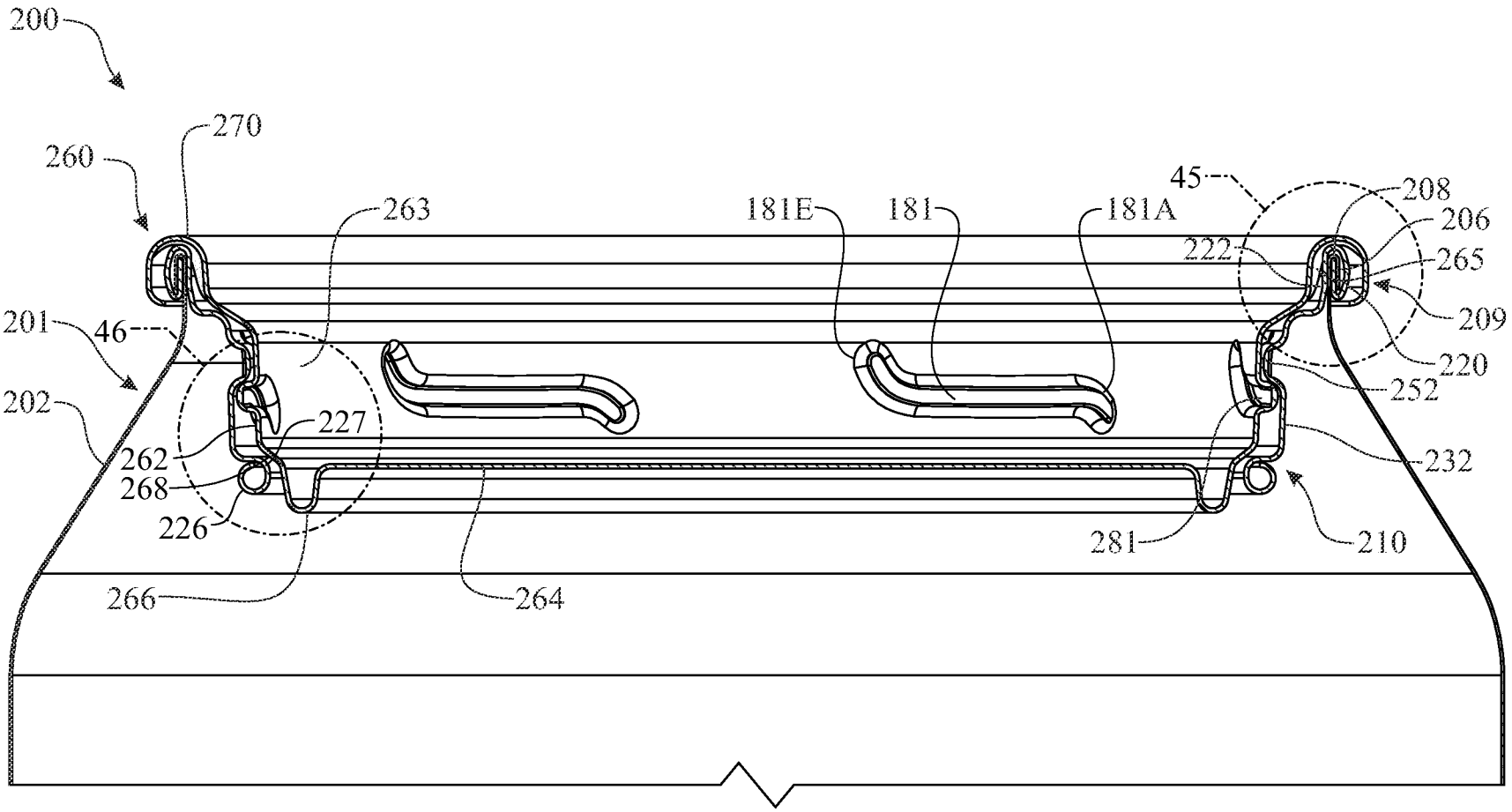
FIG. 44 presents a sectioned elevation assembly view of the container as illustrated in FIG. 41, the illustration presenting the container cap assembled to the container subassembly, the section of the container being representative of the section taken along section line 28-28 of FIG. 25.
Figure 45:
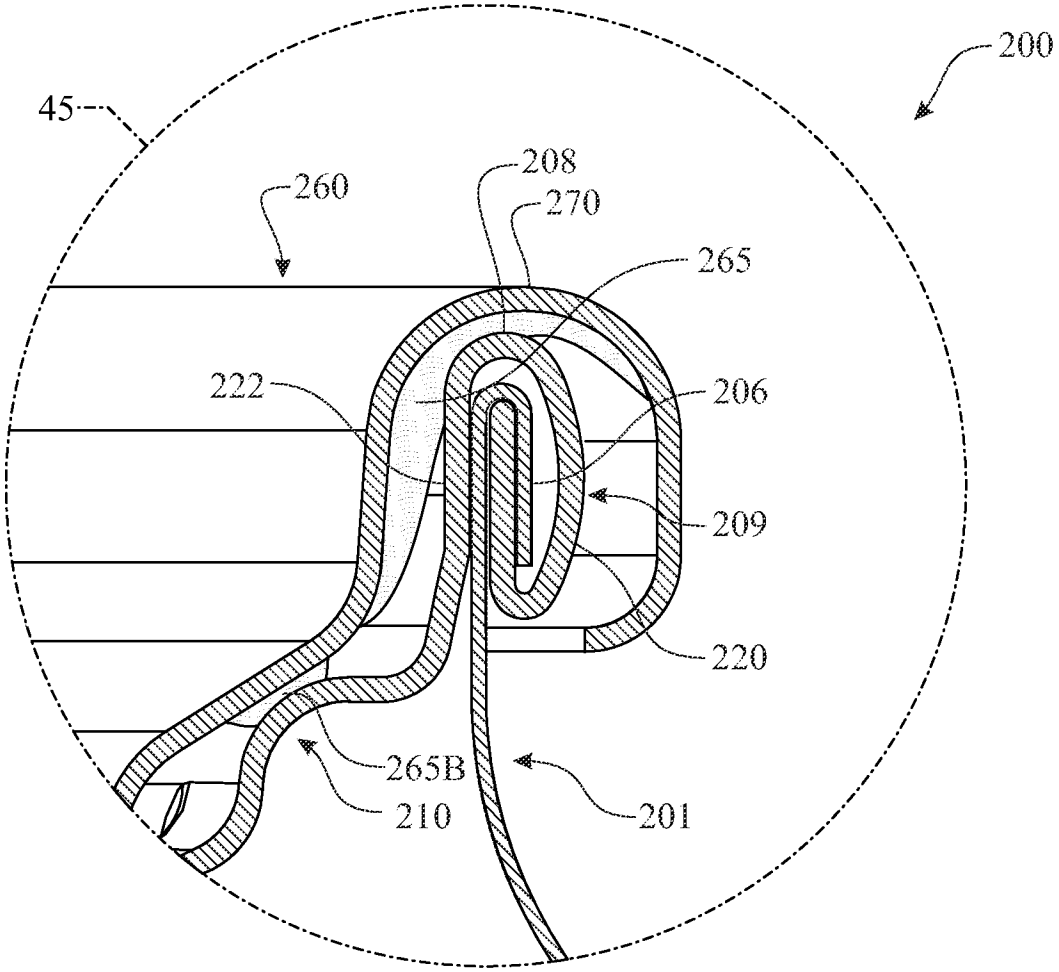
FIG. 45 presents an enlarged sectioned view detailing a completed seam formed between the joining edge of the container lid originally introduced in FIG. 23 and the container body originally introduced in FIG. 37, the illustration additionally presenting the container cap originally introduced in FIG. 30 assembled to the container subassembly, wherein the illustration is an enlarged detail view of area 45 circumscribed within FIG. 44.
Figure 46:
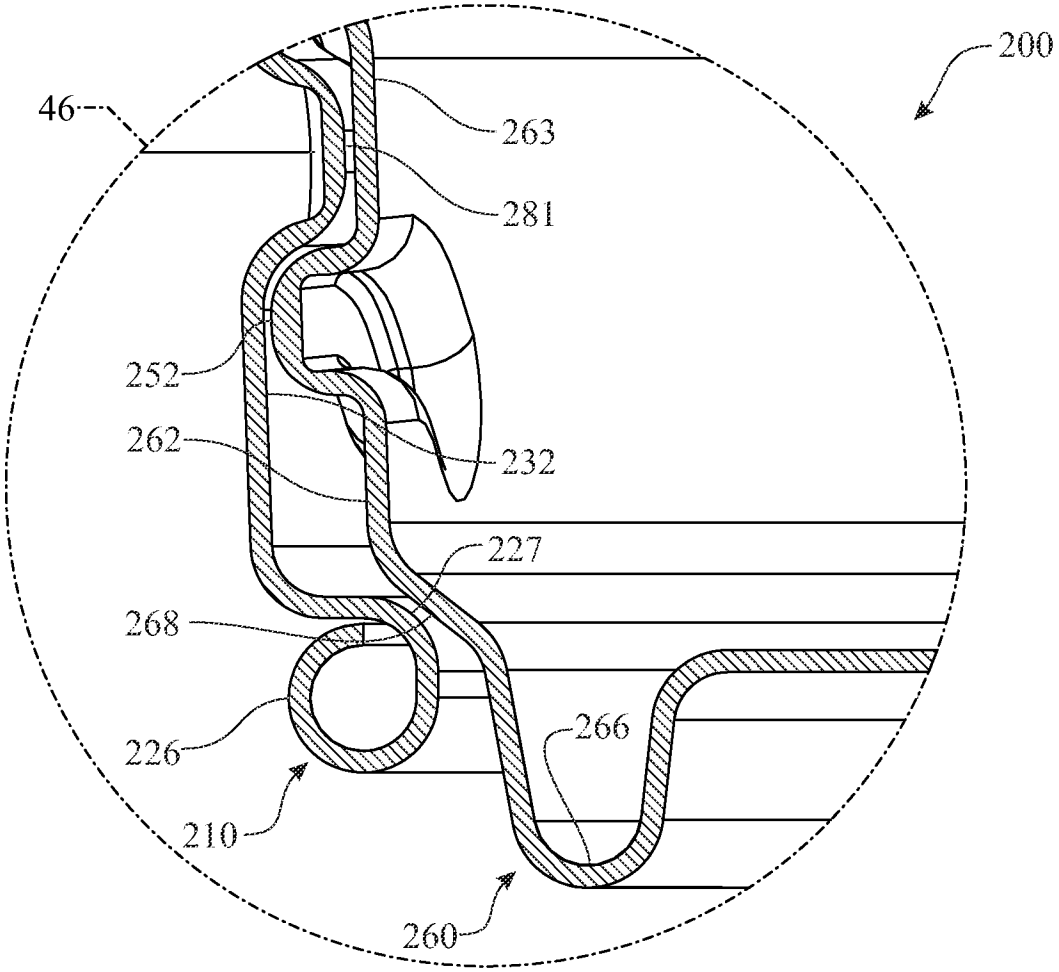
FIG. 46 presents an enlarged sectioned view detailing a seal formed between an annular sealing surface of the container cap originally introduced in FIG. 30 and a mating sealing surface of the lid rolled annular end ring of the container lid originally introduced in FIG. 23, wherein the illustration is an enlarged detail view of area 46 circumscribed within FIG. 44.
Figure 49:
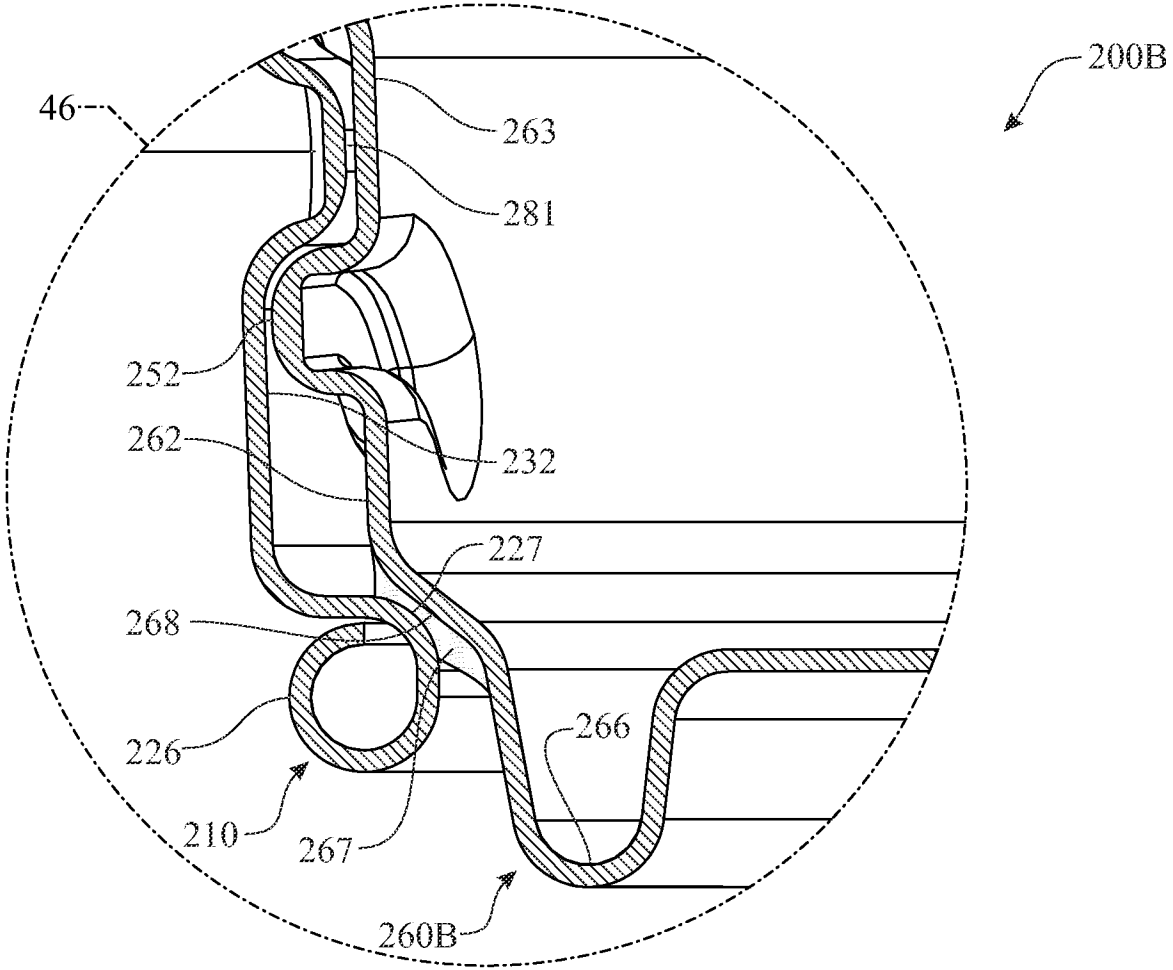
FIG. 49 presents an enlarged sectioned view illustrating a modified detail view of area 46 circumscribed within FIG. 44, the modification introduces a lower cap sealing ring.
Figure 50:
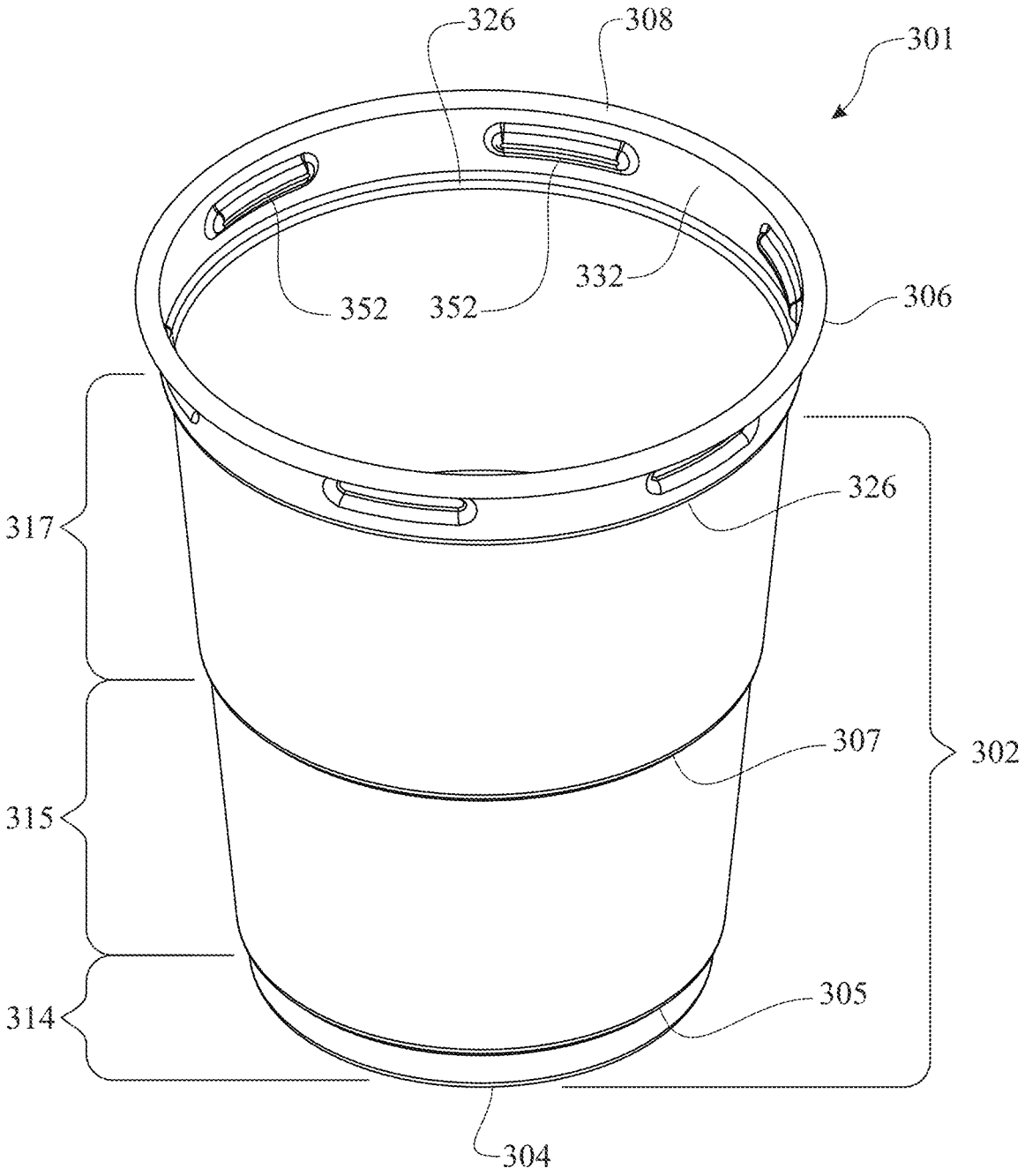
FIG. 50 presents a top, side isometric view introducing an exemplary nesting container body with integral cap receiving translative motion guide feature in accordance with the present invention, wherein the nesting container body with integral cap receiving translative motion guide feature includes a plurality of lid translative motion guide features integral within a frustum shaped container sidewall and a closed bottom wall contiguous with and extending across a lower edge of the frustum shaped container sidewall.
Figure 51:
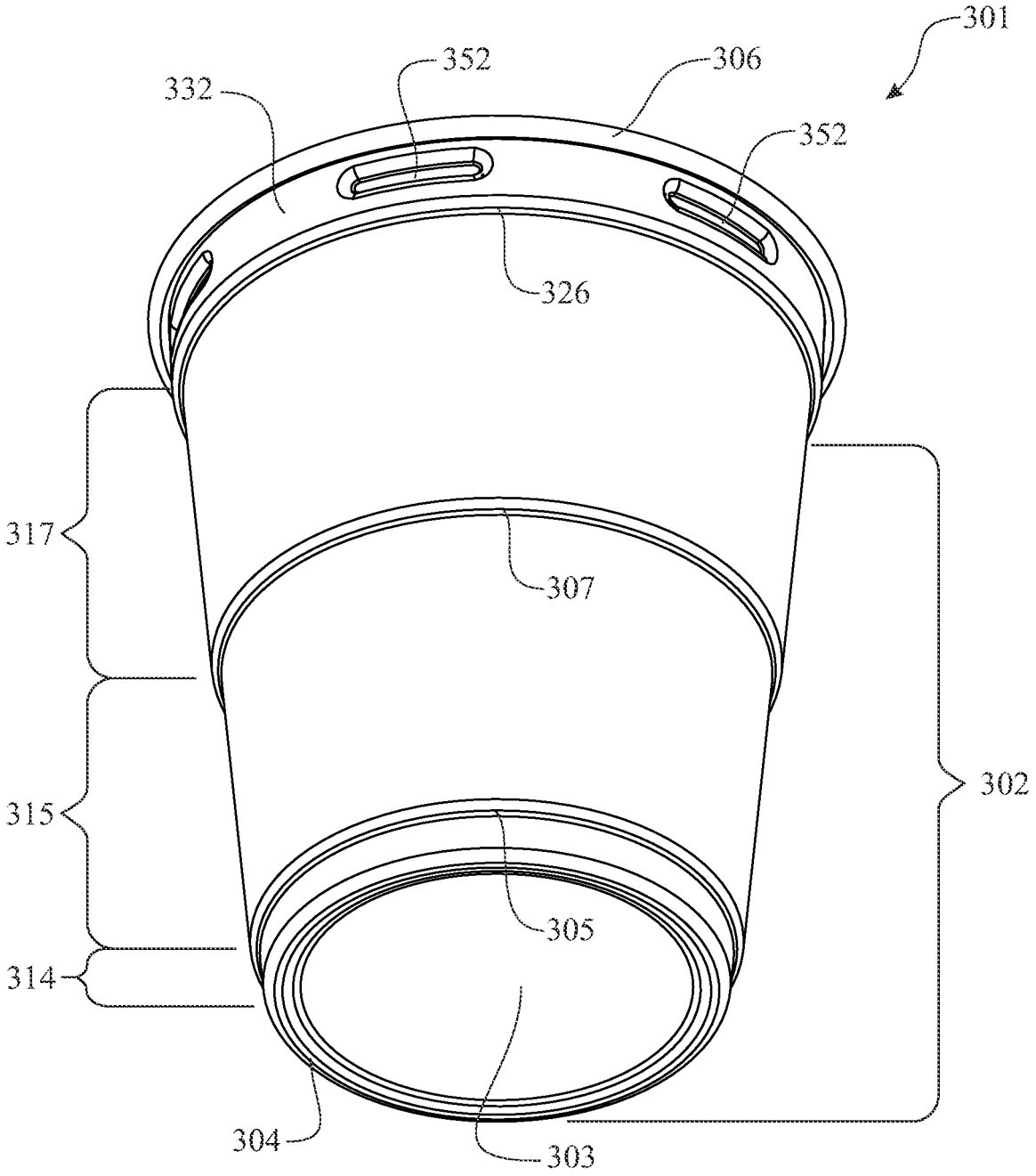
FIG. 51 presents a bottom, side isometric view of the exemplary nesting container body with integral cap receiving translative motion guide feature originally introduced in FIG. 50.
Figure 52:
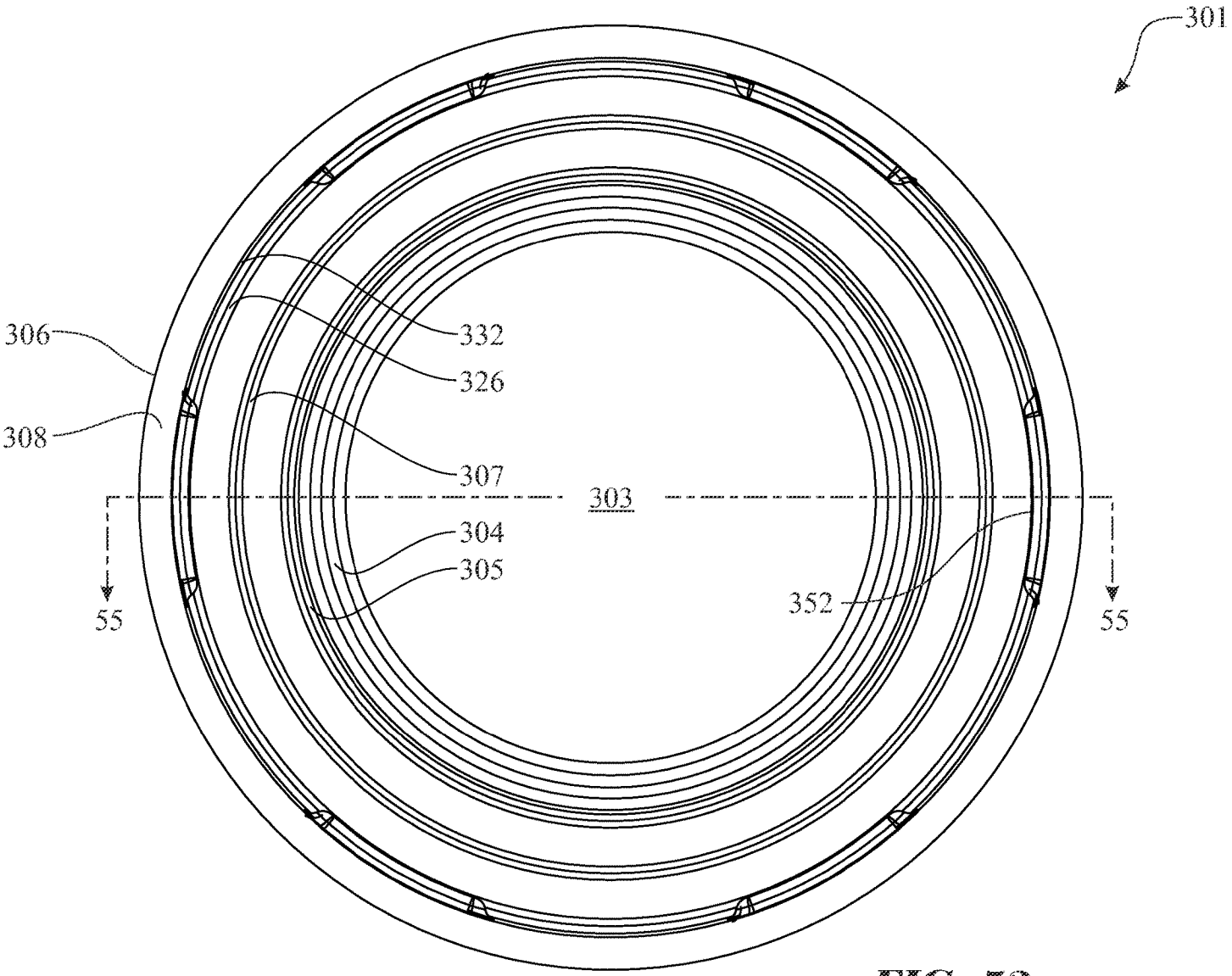
FIG. 52 presents a top, plan view of the exemplary nesting container body with integral cap receiving translative motion guide feature originally introduced in FIG. 50.
Figure 53:
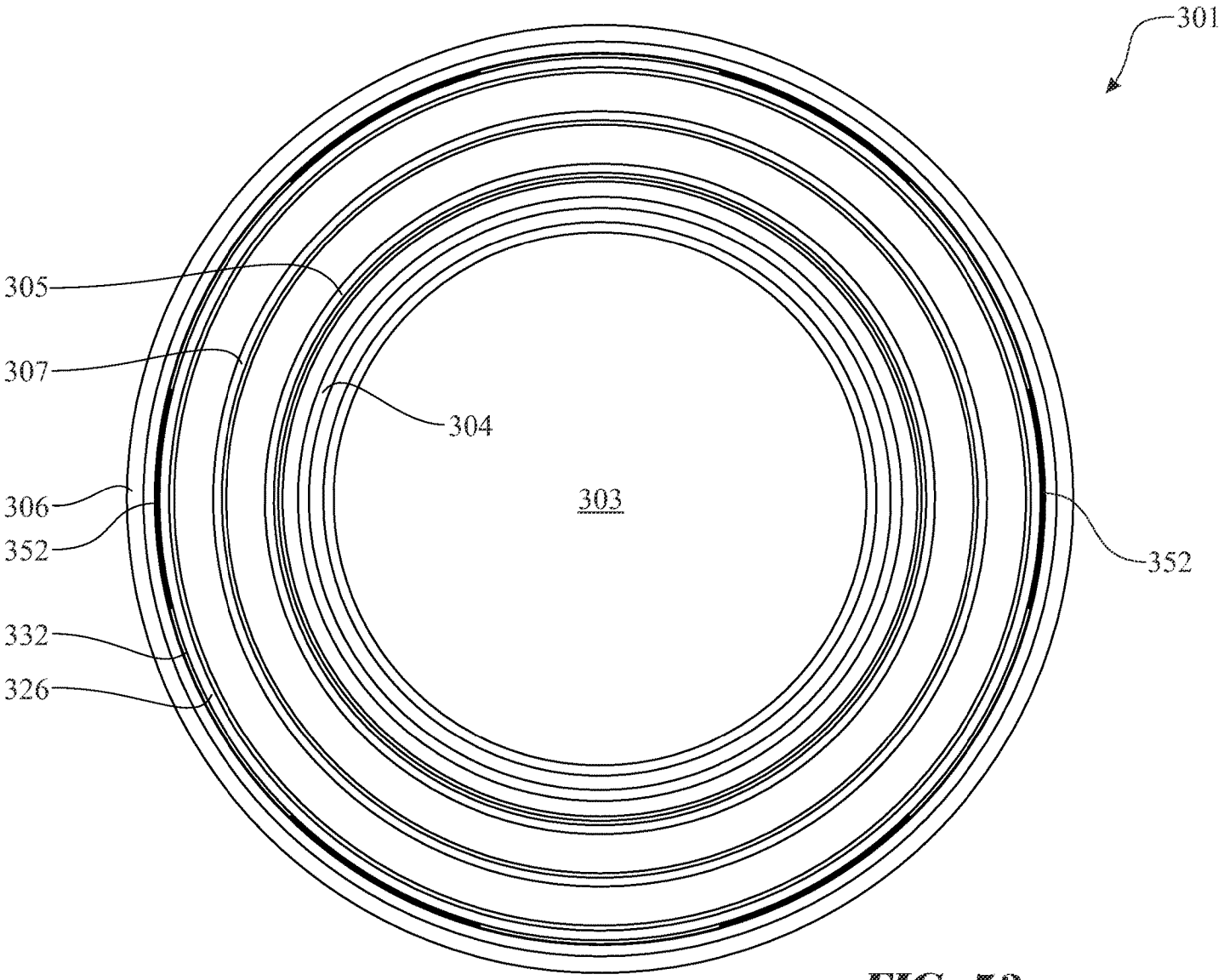
FIG. 53 presents a bottom, plan view of the exemplary nesting container body with integral cap receiving translative motion guide feature originally introduced in FIG. 50.
Figure 54:
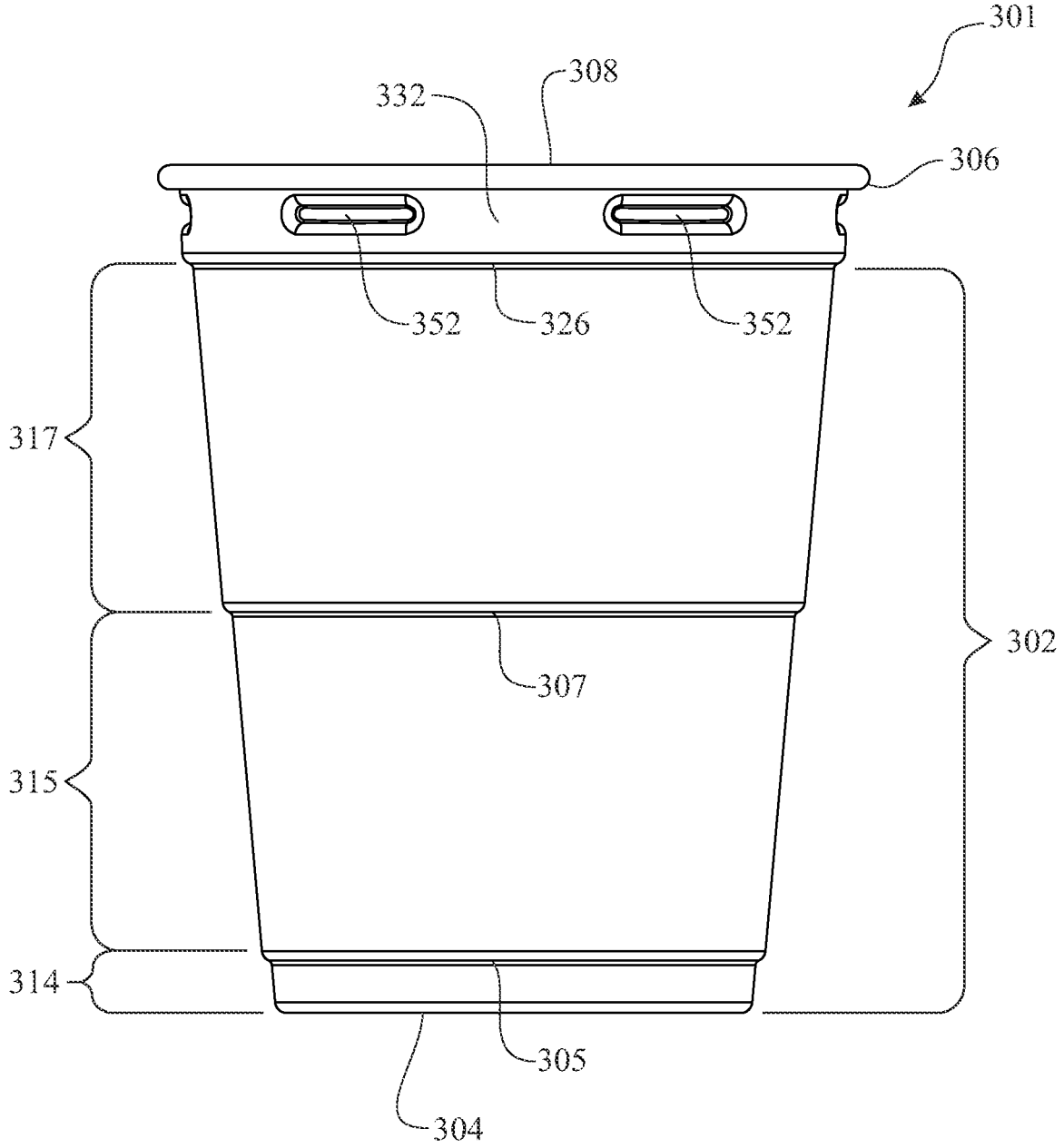
FIG. 54 presents a side elevation view of the exemplary nesting container body with integral cap receiving translative motion guide feature originally introduced in FIG. 50.
Figure 55:
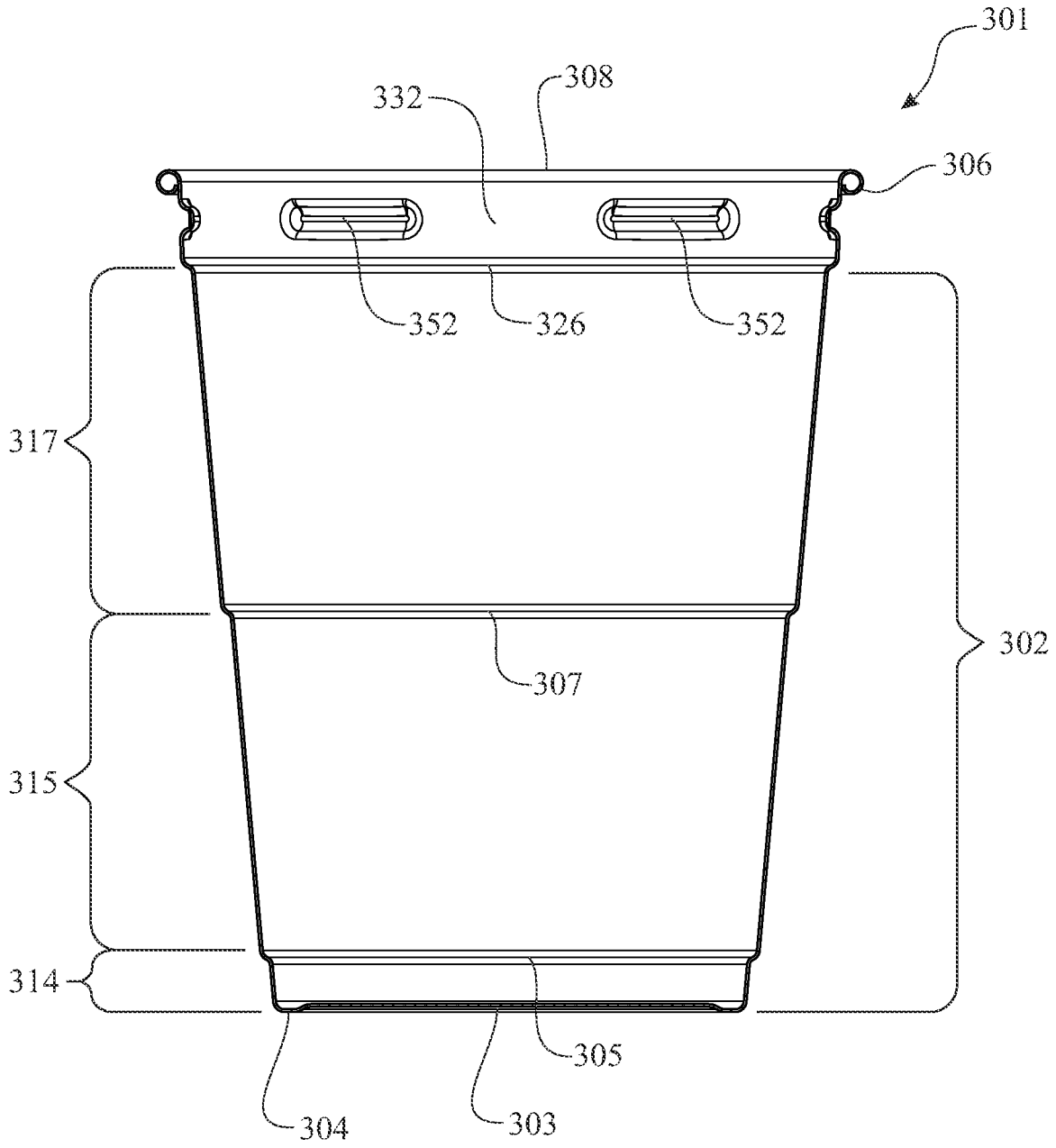
FIG. 55 presents a cross sectioned side elevation view of the exemplary nesting container body with integral cap receiving translative motion guide feature originally introduced in FIG. 50, the section view taken along section line 55-55 of FIG. 52.

As the resealable container cap 260 and the resealable container annular component 210 are drawn together, a cap sidewall transition 268 provided about a lower radially exterior surface of the cap annular countersink formation 266 is seated against a cap receiving annular component rolled bottom edge sealing surface 227 of the cap receiving annular component rolled annular end ring 226, as best illustrated in FIG. 44 and in the enlarged view illustrated in FIG. 46. The cap sidewall transition 268 is preferably formed having a frustum shape. The frustum shape of the cap sidewall transition 268 enhances the seal between the cap receiving annular component rolled bottom edge sealing surface 227 of the cap receiving annular component rolled inner edge 226 and cap sidewall transition 268 as the cap translative motion guide feature 281 and the cap receiving annular component translative motion guide feature 252 engage with one another during a rotational motion therebetween. A cap lower annular sealing member 267 can be provided between the cap receiving annular component rolled bottom edge sealing surface 227 of the cap receiving annular component rolled inner edge 226 and the cap sidewall transition 268 as illustrated in FIG. 49. The sealant material is preferably applied to the cap sidewall transition 268, but can be applied to the cap receiving annular component rolled bottom edge sealing surface 227, or both the cap sidewall transition 268 and the cap receiving annular component rolled bottom edge sealing surface 227. A protectant, such as the sealant material, coating, or any other suitable material, is preferably applied to the interior or product side surfaces of the resealable container annular component 210 and the resealable container cap 260 to isolate the base material of the resealable container annular component 210 and the resealable container cap 260 from the contents stored within the interior volume of the resealable container assembly 200. A cap upper annular sealing member 265 can additionally or alternatively be provided between an interior surface of a cylindrical sidewall inverted countersink 270 of the resealable container cap 260 and a facing, exterior surface of the seaming panel 220 the assembled resealable container annular component 210 as illustrated in FIG. 45. The cap upper annular sealing member 265 can be provided between the interior surface of the cylindrical sidewall inverted countersink 270 of the resealable container cap 260 and the facing, exterior surface of the seaming panel 220 of the assembled resealable container annular component 210 as illustrated in FIG. 45. It would be preferable to apply the cap upper annular sealing member 265 to the interior surface of the cylindrical sidewall inverted countersink 270, as illustrated in FIG. 45. A cap upper annular sealing member 265B can also additionally or alternatively be provided between a radially exterior surface proximate a transition between the resealable container cap tubular exterior sidewall 262 and the cylindrical sidewall inverted countersink 270 of the resealable container cap 260 and a facing, radially interior surface proximate a transition between the cap receiving annular component tubular sidewall 232 and the seaming chuck shoulder 224 of the seaming panel 220 of the assembled resealable container annular component 210 as illustrated in FIG. 45.

Figure 47:
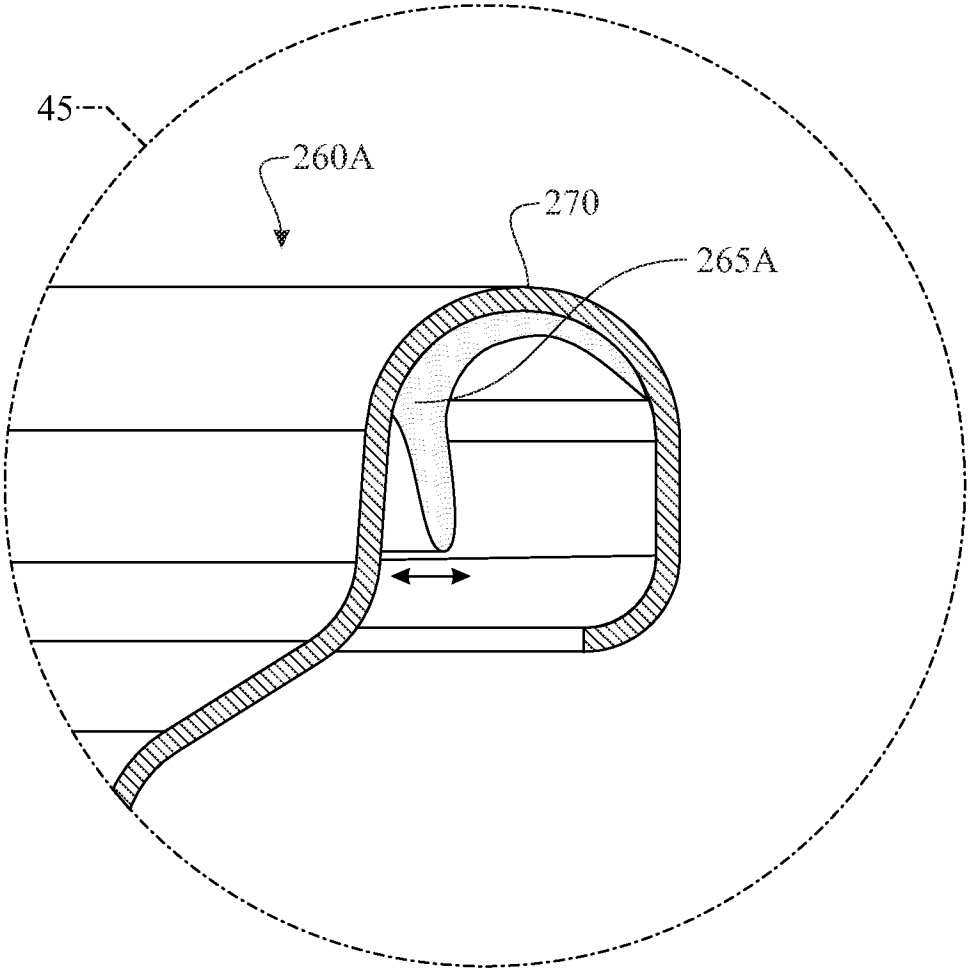
FIG. 47 presents an enlarged sectioned view illustrating a modified detail view of area 45 circumscribed within FIG. 44, the modification being an alternatively shaped cap sealing ring.
Figure 48:
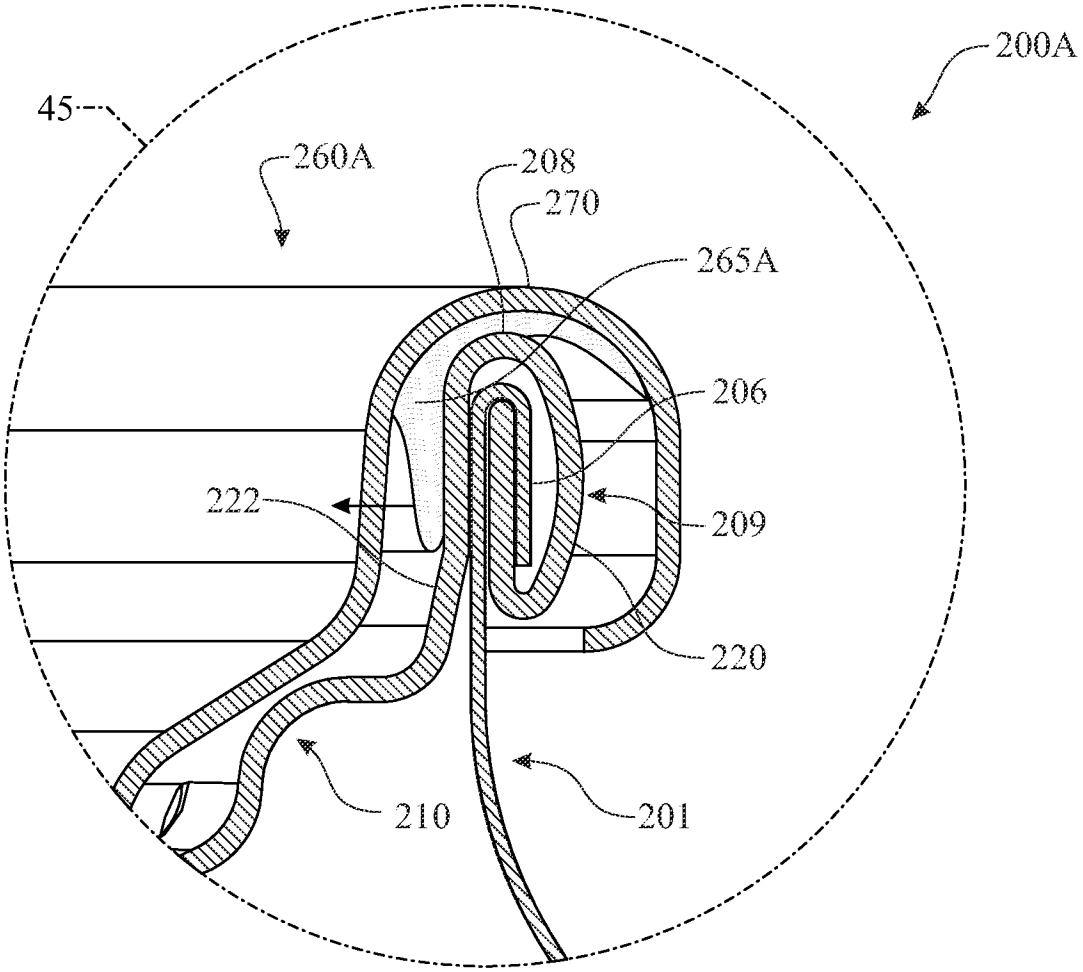
FIG. 48 presents an enlarged sectioned view detailing a completed seam formed between the joining edge of the container lid originally introduced in FIG. 23 and the container body and the container cap originally introduced in FIG. 30 assembled to the container subassembly, wherein the illustration is an enlarged modified detail view of area 45 circumscribed within FIG. 44, the modification being an alternatively shaped cap sealing ring.

The cap upper annular sealing member 265, cap upper annular sealing member 265B, and cap lower annular sealing member 267 are examples of various sealing members located between facing surfaces used to seal the resealable container 200. Other sealing members can be utilized between the resealable container annular component 210 and the resealable container cap 260. Each of the cap upper annular sealing member 265, cap upper annular sealing member 265A, and cap lower annular sealing member 267 utilize a compressible material to create the seal between facing surfaces. Examples of compressible materials suitable for use in sealing a container include: sprayed on or molded on elastomeric compounds, molded low or high durometer plastics, High-density polyethylene (HDPE), Low-density polyethylene (LDPE), polyethylene terephthalate (PET), polyethylene high-density (PEHD) cellulose compounds, polymer polypropylene, polyethylene, bio-sourced materials such as seaweed, mushroom, gelatin, cork, rubber, latex, and the like, and any combination thereof. One exemplary alternative is a cap upper annular sealing member 265A illustrated in FIGS. 47 and 48. The cap upper annular sealing member 265A introduces an alternative to a compression arrangement. The cap upper annular sealing member 265A introduces a displacement arrangement for the cap upper annular sealing member 265A, where a shape of the cap upper annular sealing member 265A is deflected radially inward when the resealable container annular component 210 and the resealable container cap 260A are drawn towards one another. An arrow in FIG. 47 represents a deflecting motion of the cap upper annular sealing member 265A. The cap upper annular sealing member 265 includes a projection portion extending freely from a base portion. The projection portion retains a general shape by the annular nature of the sealing ring 265A. When the container body and lid assembly seam 209 and the cylindrical sidewall inverted countersink 270 are drawn together by the interaction between the cap receiving annular component translative motion guide features 252 and the cap translative motion guide features 281, the shape of the seaming chuck wall 222 deflects the projection of the cap upper annular sealing member 265A as illustrated in FIG. 48. Additionally, the cap upper annular sealing member 265A presents a compression seal between facing surfaces of the container body and lid assembly seam chine 208 and the cylindrical sidewall inverted countersink 270.

In each of the previously described variants, the container body 101, 201 and the container lid 110, container annular ring 210 are separate elements that are seamed together. Cap receiving features of the container lid 110 and/or the container annular ring 210 can be integrally formed in an upper end of the container body 101, 201, such as an exemplary nesting container body with integral cap receiving translative motion guide feature 301, illustrated in FIGS. 50 through 56. The exemplary nesting container body with integral cap receiving translative motion guide feature 301 is formed as a cup comprising cap receiving features, such as a nesting container body upper edge cap receiving sidewall 332 and a nesting container body translative motion guide feature 352. A container or cup body of the nesting container body with integral cap receiving translative motion guide feature 301 includes a nesting container body closed bottom wall 303 circumscribed by a nesting container body annular base 304, wherein the nesting container body closed bottom wall 303 and the nesting container body annular base 304 collectively extend across a lower end of a nesting container body frustum shaped sidewall 302. The nesting container body closed bottom wall 303 extends upward from the nesting container body annular base 304. The upward shape of the nesting container body closed bottom wall 303 accommodates non-level surfaces.

A nesting container body frustum shaped sidewall upper, free edge 306 is formed at an upper end of the nesting container body with integral cap receiving translative motion guide feature 301, where the nesting container body frustum shaped sidewall upper, free edge 306 is formed as a rolled edge. The rolled formation provides a smooth, comfortable edge providing safety to the user. In certain designs, it may be beneficial to include an outwardly formed container body joining formation, such as the seaming flange 106, 206 of the container body 101, 201 in place of the nesting container body frustum shaped sidewall upper, free edge 306. One or more demarcations can be formed in the nesting container body frustum shaped sidewall 302. The exemplary illustration presents three demarcations, a nesting container body lower or first measurement demarcation 305, a nesting container body central or second measurement demarcation 307, and a nesting container body to cap receiving sidewall annular transition formation 326. The nesting container body first measurement demarcation 305 provides an upper reference for a nesting container body first measurement volume 314, the nesting container body central or second measurement demarcation 307 provides an upper reference for a nesting container body second measurement volume 315, and the nesting container body to cap receiving sidewall annular transition formation 326 provides an upper reference for a nesting container body third measurement volume 317. The nesting container body annular base 304 can include a centrally located recession, where the centrally located recession leaves an annular ring remaining proud from the recession. This aids in minimizing any rocking of the nesting container body with integral cap receiving translative motion guide feature 301 when placed on a suitable surface.

At least one nesting container body translative motion guide feature 352 is formed in a nesting container body upper edge cap receiving sidewall 332; the nesting container body upper edge cap receiving sidewall 332 being formed at an upper end of the nesting container body frustum shaped sidewall 302. In the exemplary illustration, the nesting container body to cap receiving sidewall annular transition formation 326 provides a transition between the nesting container body frustum shaped sidewall 302 and the nesting container body upper edge cap receiving sidewall 332. The nesting container body translative motion guide feature 352 can be of any suitable number, size and shape, similar to the lid translative motion guide feature 152 and the cap receiving annular component translative motion guide feature 252 as described above.

Figure 56:
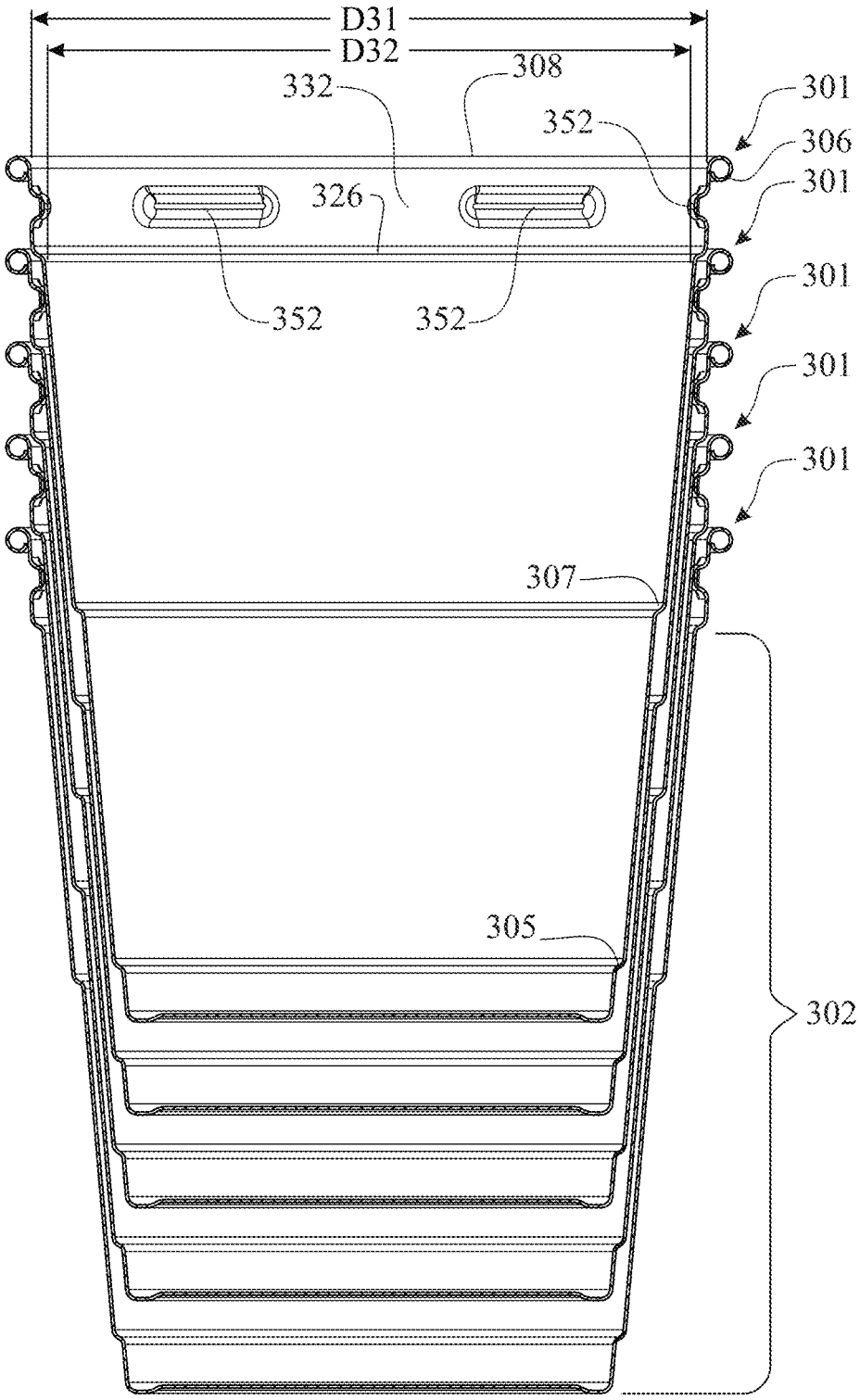
FIG. 56 presents a cross sectioned side elevation view of the exemplary nesting container body with integral cap receiving translative motion guide feature originally introduced in FIG. 50, the section view taken along section line 55-55 of FIG. 52, the illustration presenting a nesting capability of a plurality of exemplary nesting container bodies with integral cap receiving translative motion guide feature.
Figure 57:
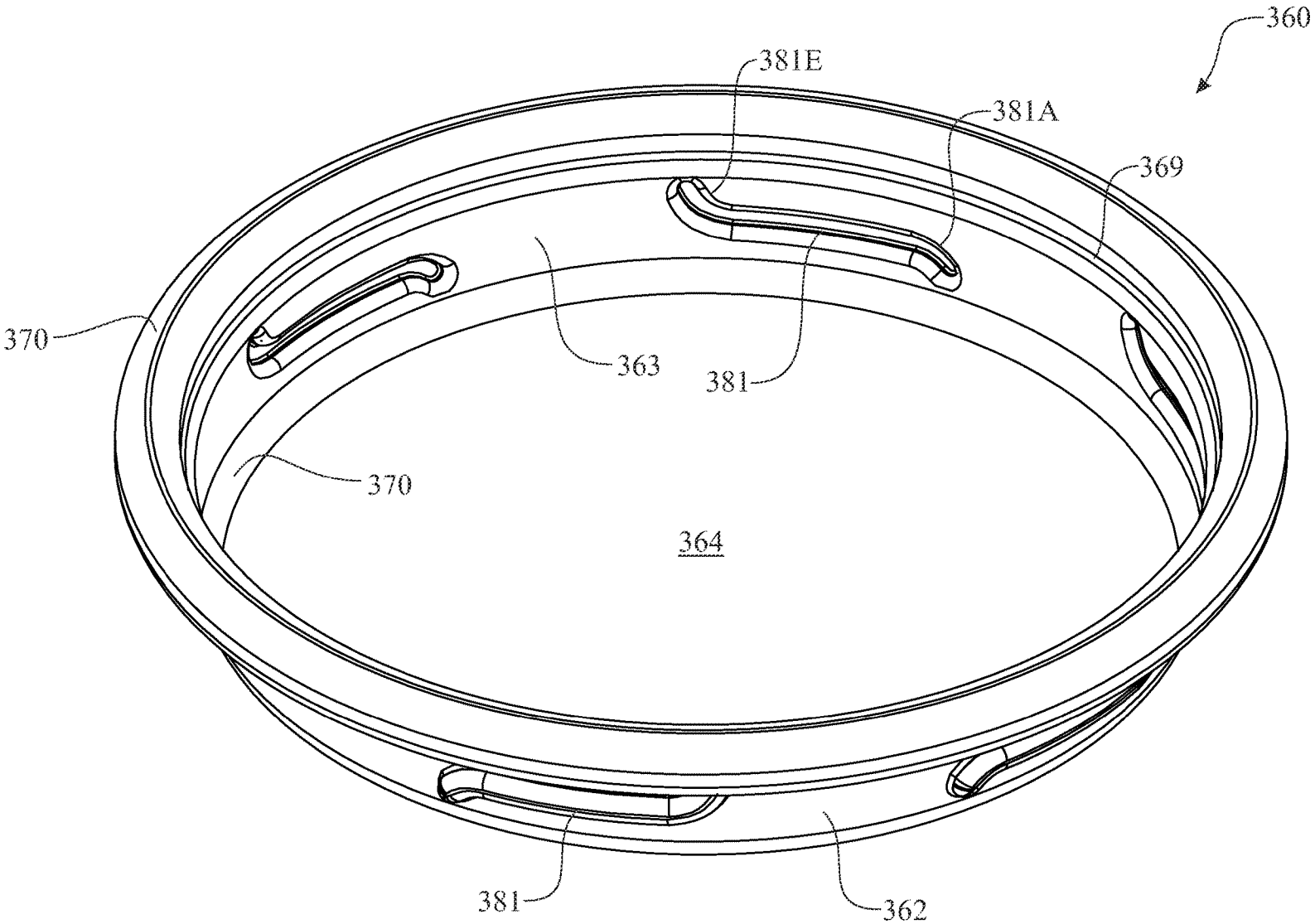
FIG. 57 presents a top, side isometric view introducing a second exemplary container cap in accordance with the present invention, wherein the second exemplary container cap includes a plurality of cap translative motion guide features integral within a frustum shaped sidewall and a countersink arrangement provided circumscribing a cap bottom wall.
Figure 58:
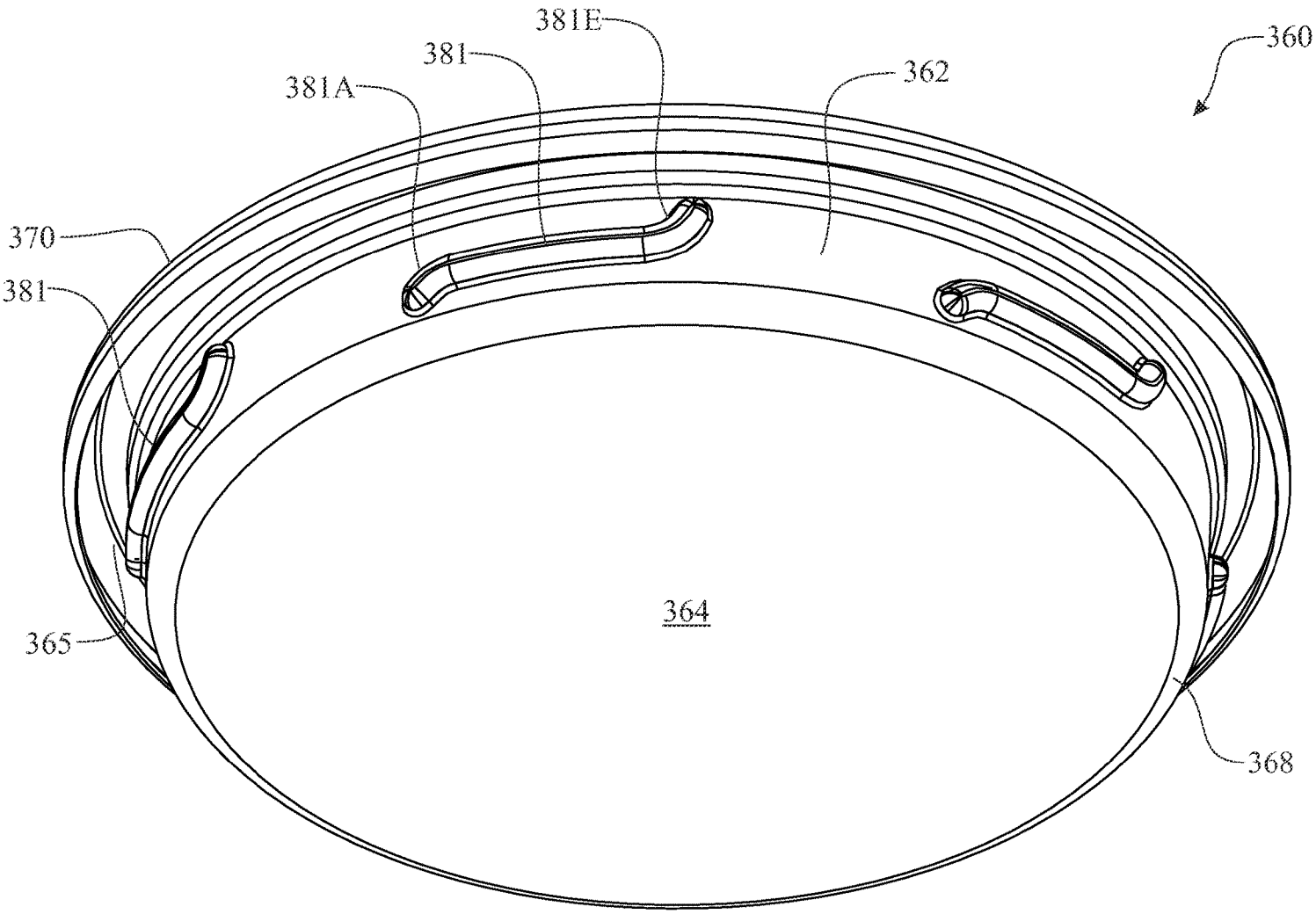
FIG. 58 presents a bottom, side isometric view of the third exemplary container cap originally introduced in FIG. 57.
Figure 59:
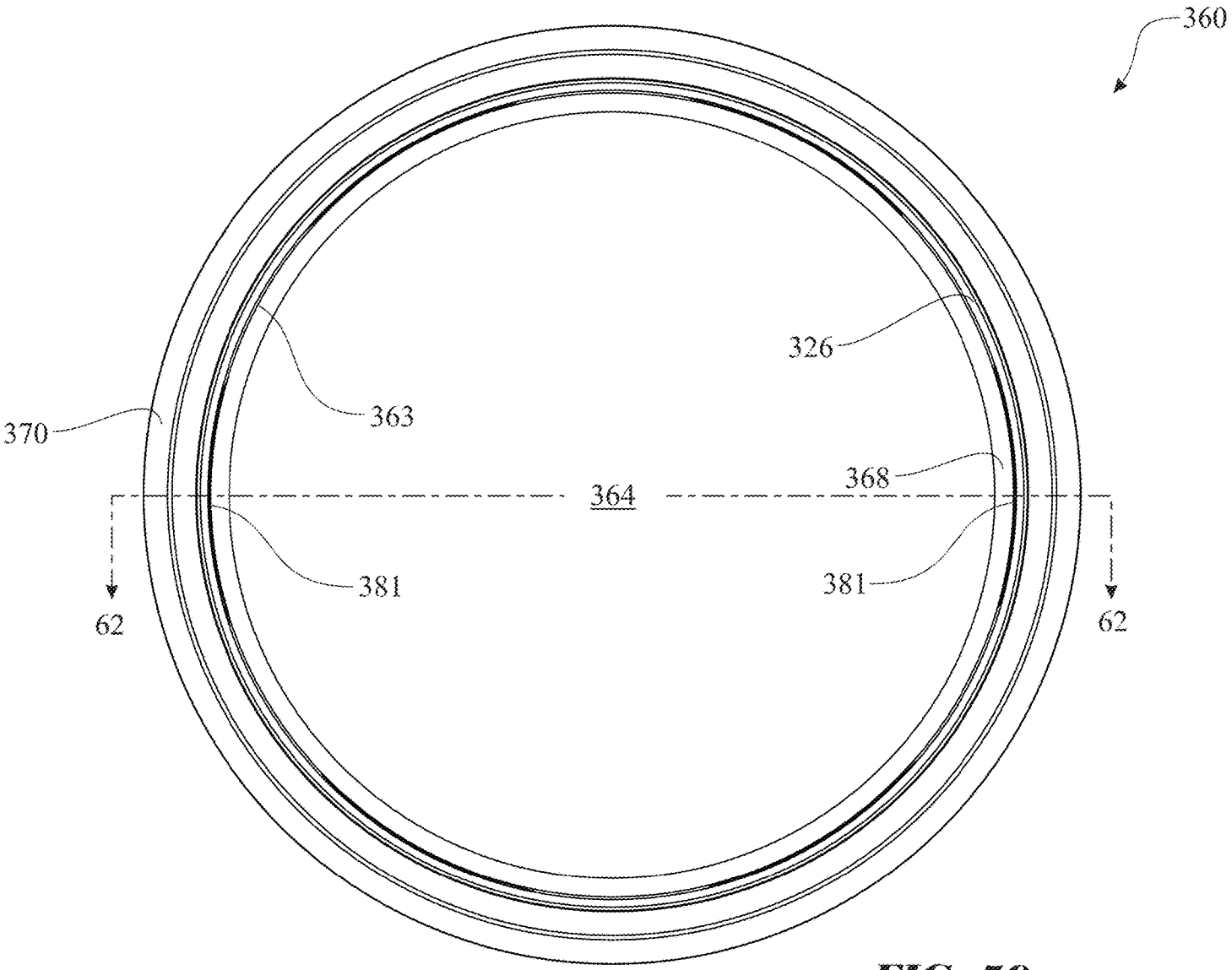
FIG. 59 presents a top, plan view of the third exemplary container cap originally introduced in FIG. 57.
Figure 60:
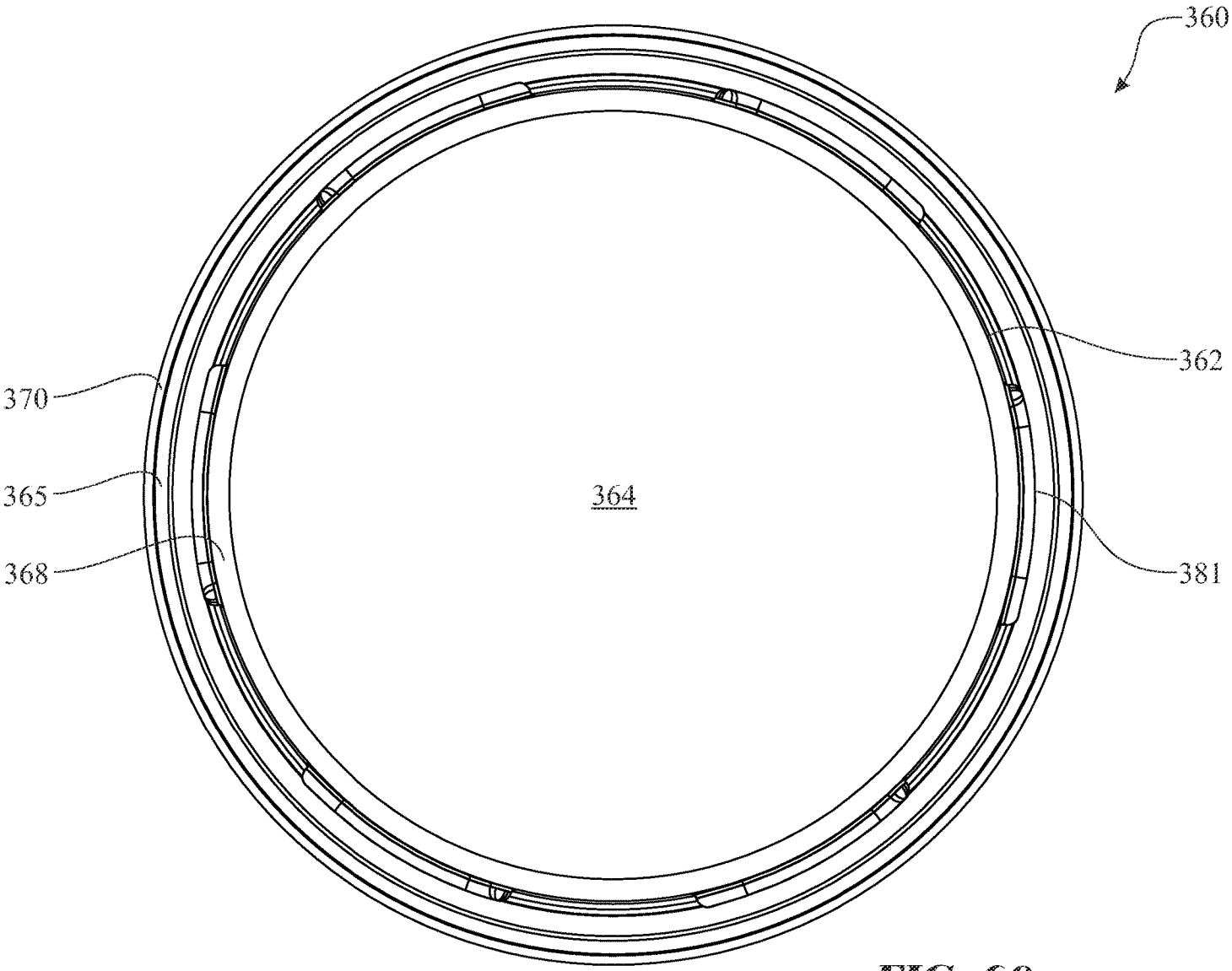
FIG. 60 presents a bottom, plan view of the third exemplary container cap originally introduced in FIG. 57.
Figure 61:
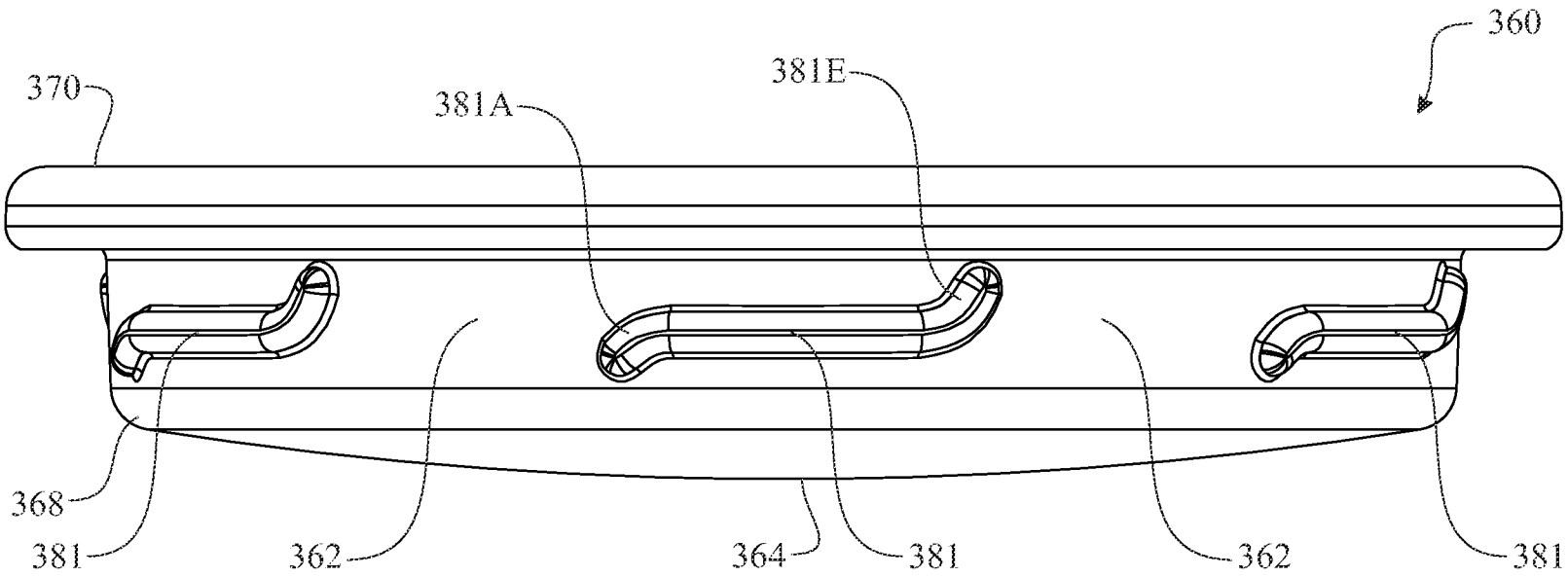
FIG. 61 presents a side elevation view of the third exemplary container cap originally introduced in FIG. 57, the illustration detailing a shape of an exemplary cap translative motion guide feature provided in a form of a cam.
Figure 62:
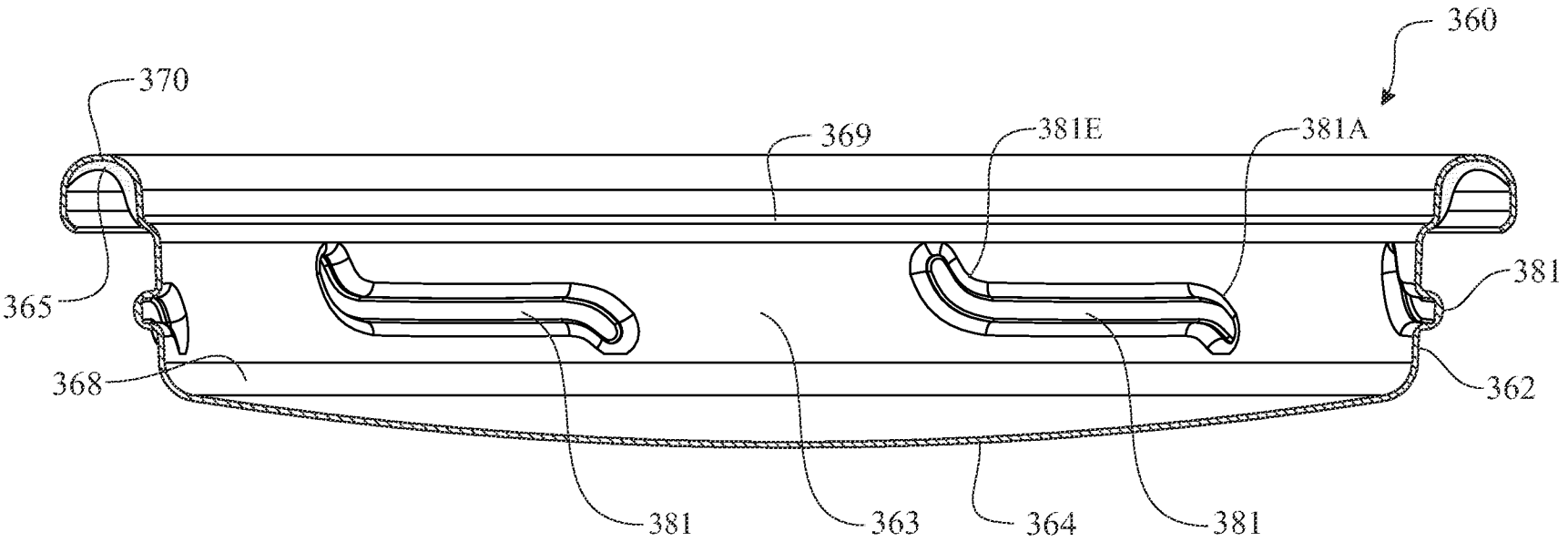
FIG. 62 presents a cross sectioned side elevation view of the third exemplary container cap originally introduced in FIG. 57, the section view taken along section line 62-62 of FIG. 59.

The nesting container body with integral cap receiving translative motion guide feature 301 is designed to enable nesting, as illustrated in cross section view presented in FIG. 56. The frustum shape of the nesting container body frustum shaped sidewall 302 enables nesting. An upper tubular sidewall radially inner diameter D31, measuring a diameter across an upper edge of the interior surface of the nesting container body tubular sidewall 332 is greater than a lower formation radially outermost diameter D32, measuring a diameter across a nesting container body third measurement volume 317 (lower formation having the largest diameter) enabling an upper placed resealable nesting container body 301 to seat below the nesting container body tubular sidewall 332 of a lower placed nesting container body 301, as illustrated in FIG. 56. In the exemplary illustration, the nesting container body upper edge cap receiving sidewall 332 remains proud of the nested sections of the nesting container body with integral cap receiving translative motion guide feature 301. The greater the angle of the frustum shape of the nesting container body frustum shaped sidewall 302, the deeper the nesting. The demarcations 305, 307, 326 would be formed and sized to support the nesting of adjacent nesting container body with integral cap receiving translative motion guide features 301. The nesting would be limited by the nesting container body translative motion guide feature 352 and the nesting container body frustum shaped sidewall upper, free edge 306.

The nesting container body upper edge cap receiving sidewall 332 can be generally cylindrical in shape and offset as illustrated to support optimal nesting. Alternatively, the nesting container body upper edge cap receiving sidewall 332 can have a frustum shape, similar to the lid frustum shaped sidewall 132 of the resealable container lid 110 and a limited offset to support optimal nesting. Although nesting container body upper edge cap receiving sidewall 332 is illustrated as a significantly cylindrical sidewall that enables nesting due to an offset provided by the cap receiving sidewall annular transition formation 326, in an alternative design, the nesting container body upper edge cap receiving sidewall 332 can be frustum shaped and continuous from the upper end of the nesting container body frustum shaped sidewall 302, effectively becoming a continuation of the nesting container body frustum shaped sidewall 302.

The nesting container body with integral cap receiving translative motion guide feature 301 can be fabricate of any suitable material and manufacturing processes, such as those described above for fabricating the container body 101, 201 and the container lid 110, container annular ring 210.

A resealable container cap 360, detailed in FIGS. 57 through 63 provides a removable seal to the nesting container body with integral cap receiving translative motion guide feature 301. The resealable container cap 260 and the resealable container cap 360 include a number of like elements. Like elements are numbered the same, wherein elements of the resealable container cap 360 are preceded by the numeral "3". The distinction between the resealable container cap 260 and the resealable container cap 360 is the design of the sealing surfaces and a resealable container cap transversing surface 364.

The exemplary resealable container cap transversing surface 364 illustrated in FIGS. 57 through 63 is formed as a downwardly or outwardly extending dome shaped wall. The resealable container cap transversing surface 364 can be of any suitable and/or functional shape. A cap sidewall lower transition 368 is provided between a lower edge of the sidewall (radially exterior or product side) 362, (radially interior or public side) 363 and the resealable container cap transversing surface 364. Although the exemplary illustration presents the resealable container cap transversing surface 364 as a downwardly extending domed panel, the resealable container cap transversing surface 364 can be provided as an upwardly extending domed panel, a planar panel, including one or more reinforcing formations, and the like. The cap sidewall lower transition 368 can be formed as an arched transition, a chamfered transition, a countersink design, and the like. The cap sidewall lower transition 368 and/or the resealable container cap transversing surface 364 can be shaped to create one or more features that function as a cap sealing surface, wherein the cap sealing surface is designed to engage with any surface of the nesting container body with integral cap receiving translative motion guide feature 301 suitable to be used as a sealing surface.

Figure 63:
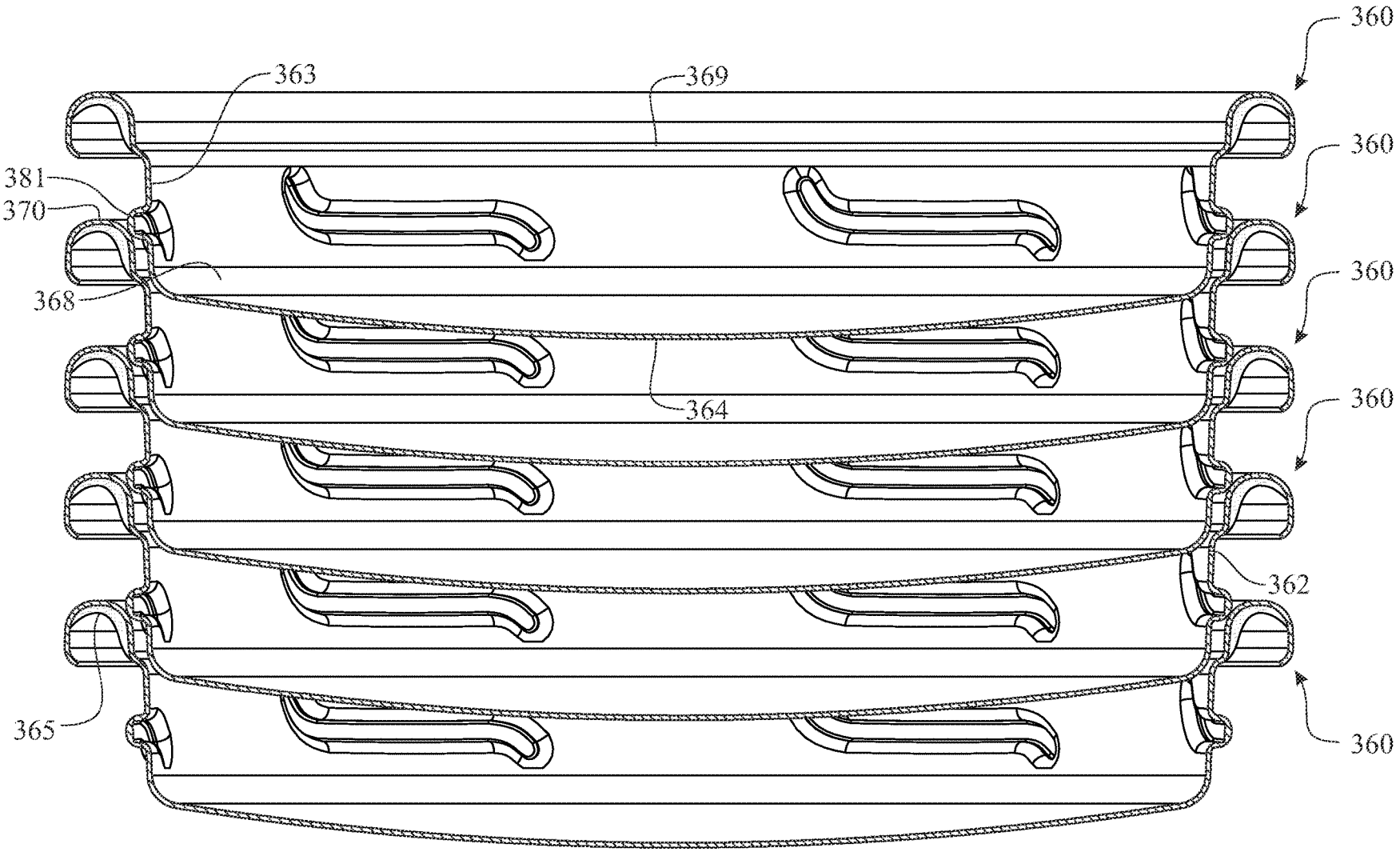
FIG. 63 presents a cross sectioned side elevation view of the third exemplary container cap originally introduced in FIG. 57, the section view taken along section line 62-62 of FIG. 59, the illustration presenting a nesting capability of the third exemplary container cap.
Figure 64:
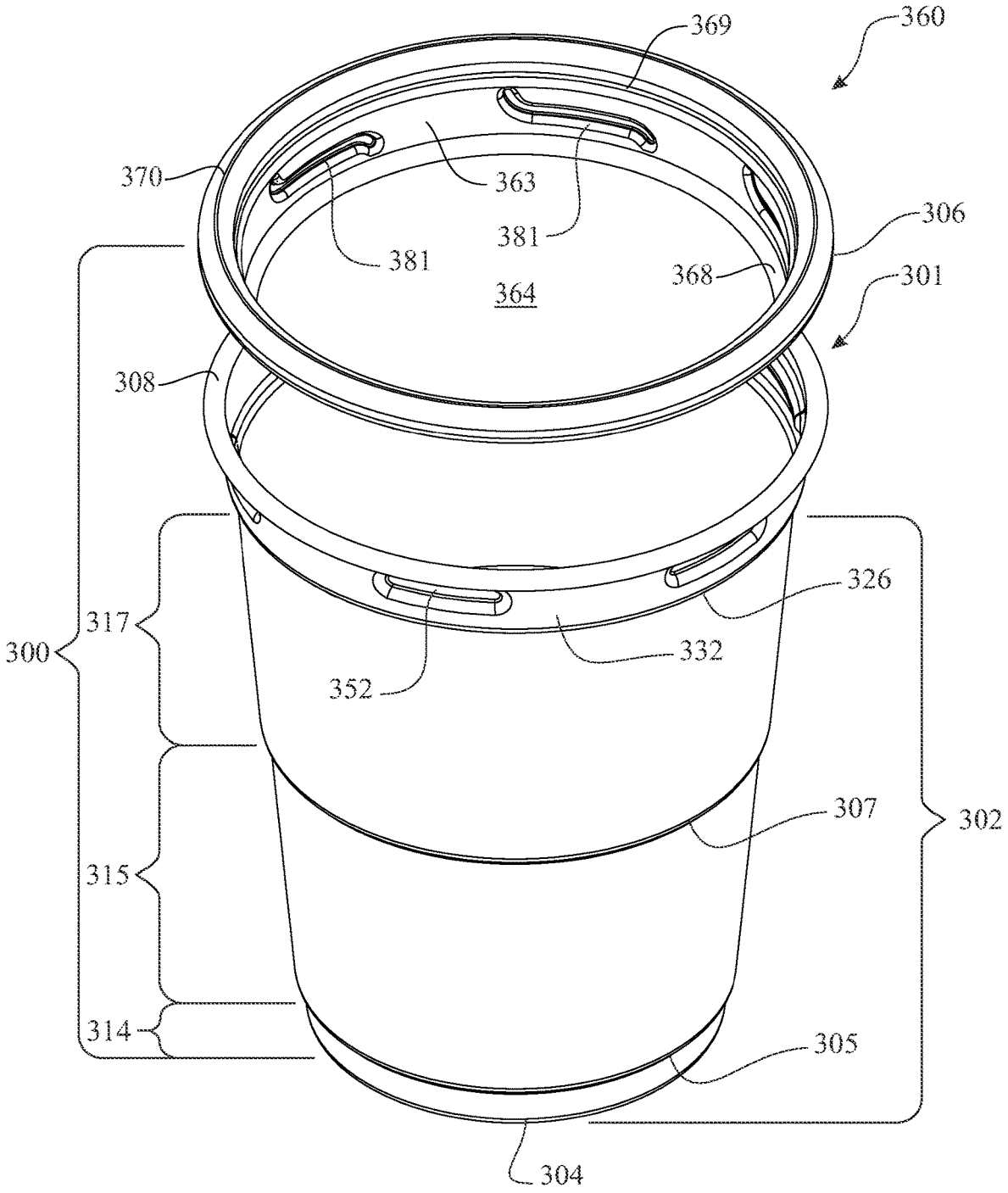
FIG. 64 presents a front, top isometric exploded assembly view of a container comprising the exemplary nesting container body with integral cap receiving translative motion guide feature originally introduced in FIG. 50 and the first exemplary container cap originally introduced in FIG. 57, the illustration presenting the container cap staged for assembly to the nesting container body employing the integral cap receiving translative motion guide feature.
Figure 65:
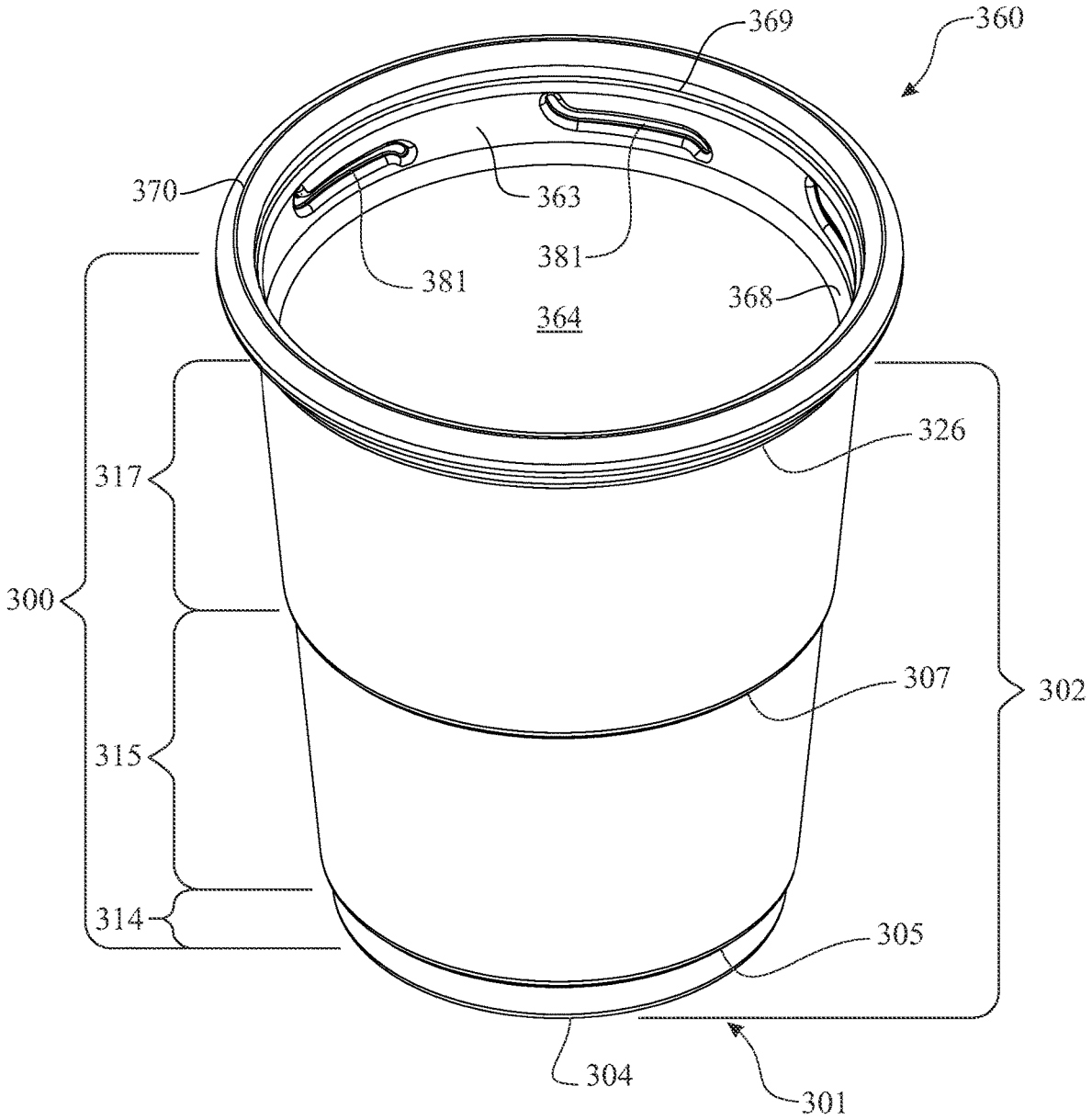
FIG. 65 presents a front, top isometric assembly view of the container comprising the exemplary nesting container body with integral cap receiving translative motion guide feature originally introduced in FIG. 50 and the third exemplary container cap originally introduced in FIG. 57, the illustration presenting the container cap assembled to the integral cap receiving translative motion guide feature of the nesting container body.
Figure 66:
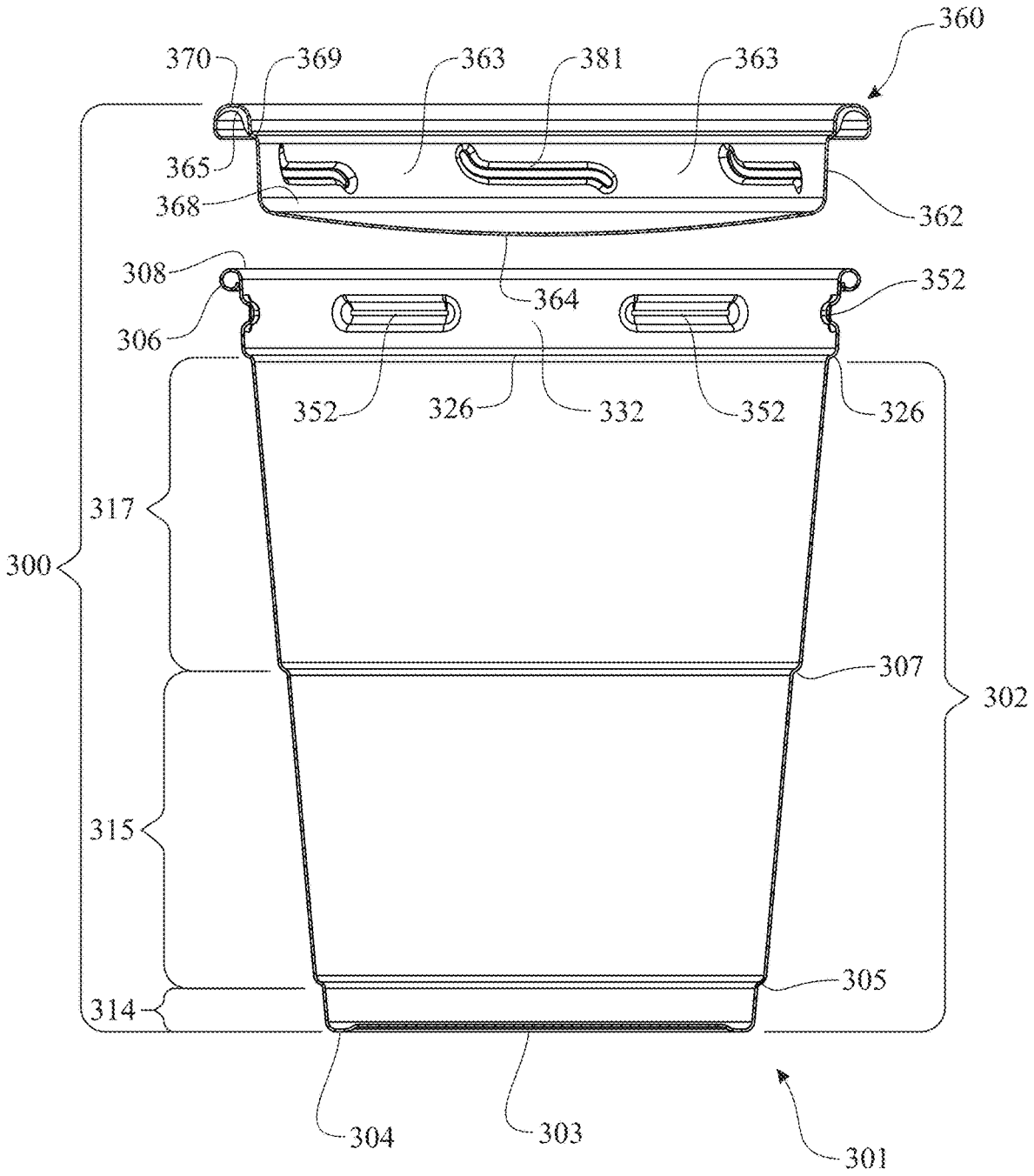
FIG. 66 presents a sectioned, front, elevation exploded assembly view of the resealable container assembly comprising the exemplary nesting container body with integral cap receiving translative motion guide feature originally introduced in FIG. 50 and the third exemplary container cap originally introduced in FIG. 57, the illustration presenting the container cap staged for assembly to the nesting container body employing the integral cap receiving translative motion guide feature.
Figure 67:
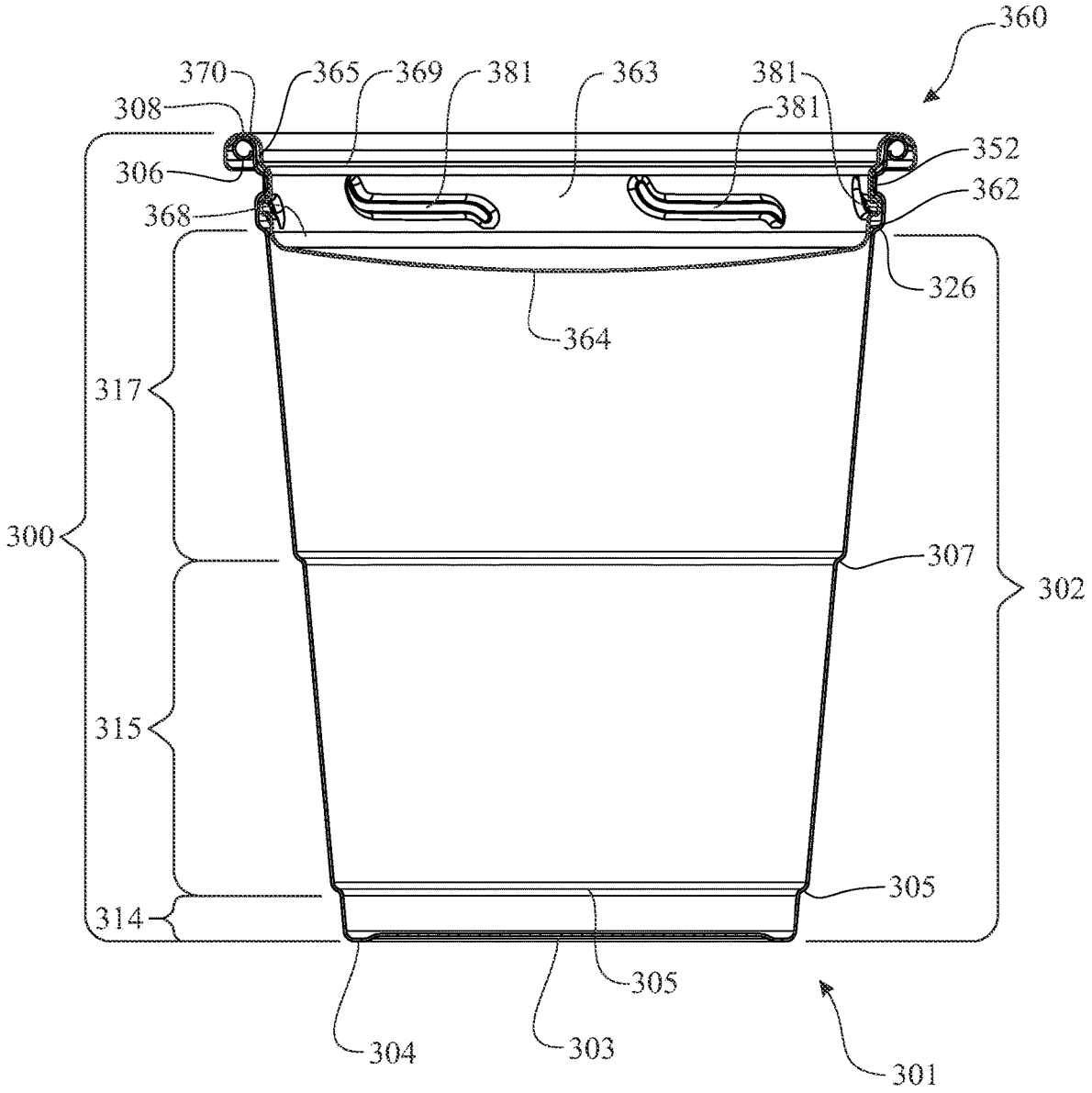
FIG. 67 presents a sectioned, front, elevation assembly view of the container comprising the exemplary nesting container body with integral cap receiving translative motion guide feature originally introduced in FIG. 50 and the third exemplary container cap originally introduced in FIG. 57, the illustration presenting the container cap assembled to the nesting container body employing the integral cap receiving translative motion guide feature.

The resealable container cap 360 is preferably of a design that enables nesting, as illustrated in FIG. 63. The radially exterior surface of the cap translative motion guide feature 381 would rest against the surface of the inner wall portion of the cylindrical sidewall inverted countersink 370, as illustrated, or the resealable container cap 360 can be designed enabling the exterior surface cap translative motion guide feature 381 to rest against the frustum sidewall to inverted countersink transition segment 369. In either condition, it is preferred that the resealable container cap transversing surface 364 is located extending below the frustum sidewall to inverted countersink transition segment 369.

The resealable container cap 360 would be assembled to the upper section of the nesting container body with integral cap receiving translative motion guide feature 301 in a manner similar to the assembly of the container cap 160, 260 to the container lid 110 and/or the container annular ring 210 as described above and as illustrated in FIGS. 64 through 67. More specifically, each at least one cap translative motion guide feature 381 would be rotationally engaging with a respective nesting container body translative motion guide feature 352 translating the rotational motion into an axial motion drawing an interior surface of the cylindrical sidewall inverted countersink 370 and a top surface of the nesting container body frustum shaped sidewall upper, free edge 306 against one another creating a seal therebetween. The resealable container cap 360 can be designed to include any formation that can be utilized as a cap upper annular sealing member 365 against a mating seal surface formed in the resealable container assembly 300. Collectively, a combination of the nesting container body with integral cap receiving translative motion guide feature 301 and resealable container cap 360 is referred to as a resealable container assembly 300.

The resealable container cap 360 can be designed to enable at least partial nesting, as illustrated in FIG. 63. Each resealable container cap 360 can be designed where a radially exterior surface of the cap translative motion guide feature 381 would rest against the frustum sidewall to inverted countersink transition segment 369 enabling the partial nesting. In a condition where the resealable container cap cylindrical exterior sidewall 362 has a frustum shape, similar to the resealable container cap frustum shaped exterior sidewall 162 of the resealable container cap 160. With this modification, the resealable container caps 360 can nest in a more compact arrangement, wherein a radially exterior surface of the cap translative motion guide feature 181 would seat against the resealable container cap frustum shaped interior sidewall 163.

Figure 68:
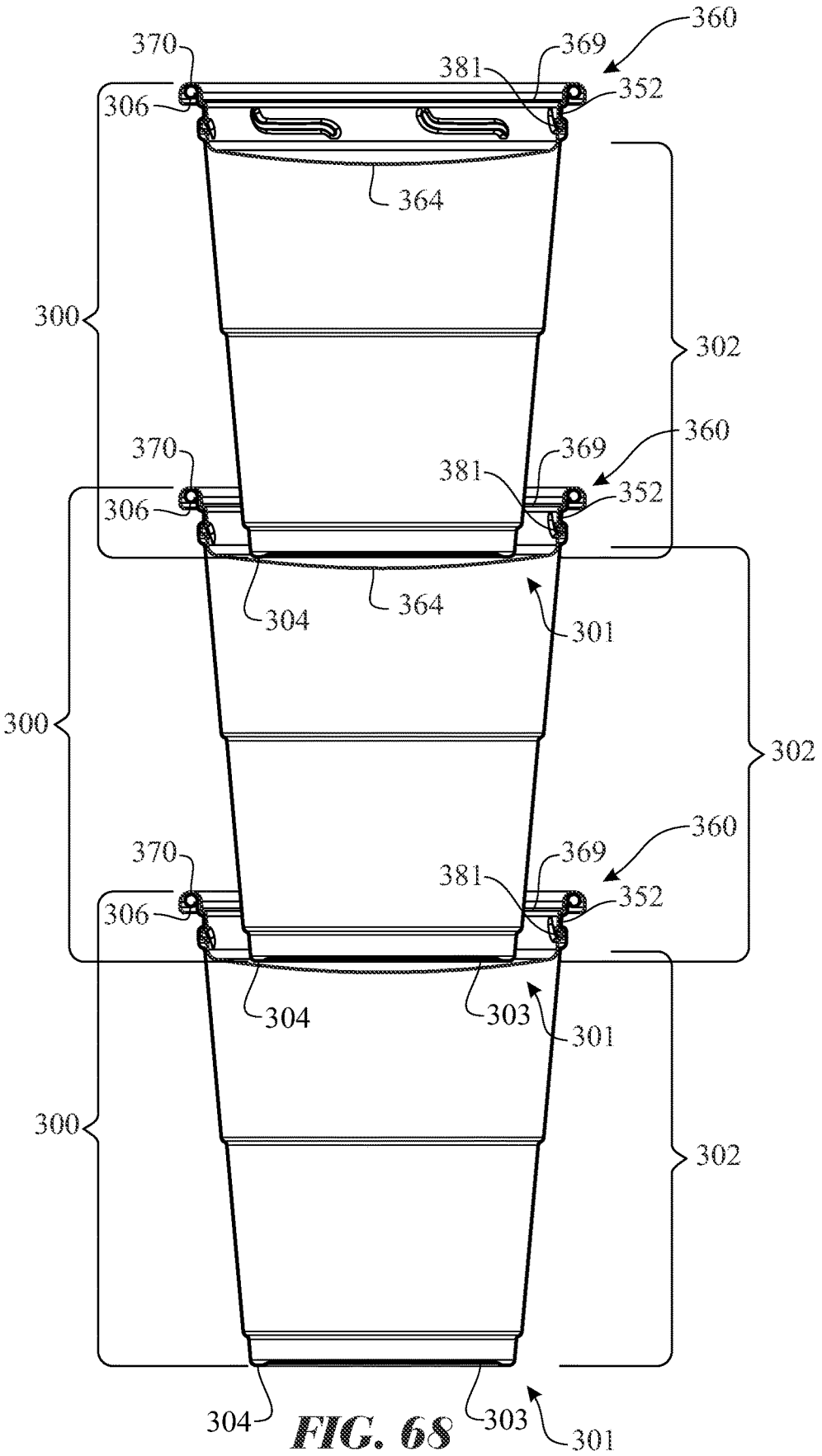
FIG. 68 presents a cross sectioned side elevation view of the exemplary resealable container assembly originally illustrated in an assembled configuration in FIG. 65, the illustration presenting a stacking capability of the exemplary resealable container assembly.

The resealable container 300 can include features to enable stacking and/or nesting. Examples of various stacking and/or nesting arrangements of a plurality of resealable containers 300 are illustrated in FIGS. 68 through 78. In a first example, the nesting container body annular base 304 would be placed upon an upper surface of the resealable container cap transversing surface 364, as illustrated in FIG. 68. The resealable container cap 360 would be designed of a material having a thickness and shape capable of supporting preferably several resealable containers 300 when each resealable container 300 is filled with the anticipated contents. This enables transport of multiple resealable containers 300 filled with contents. This would be focused for use in carry out scenarios, such as fast food restaurants, concerts, plays, sporting events, or other events.

Figure 69:
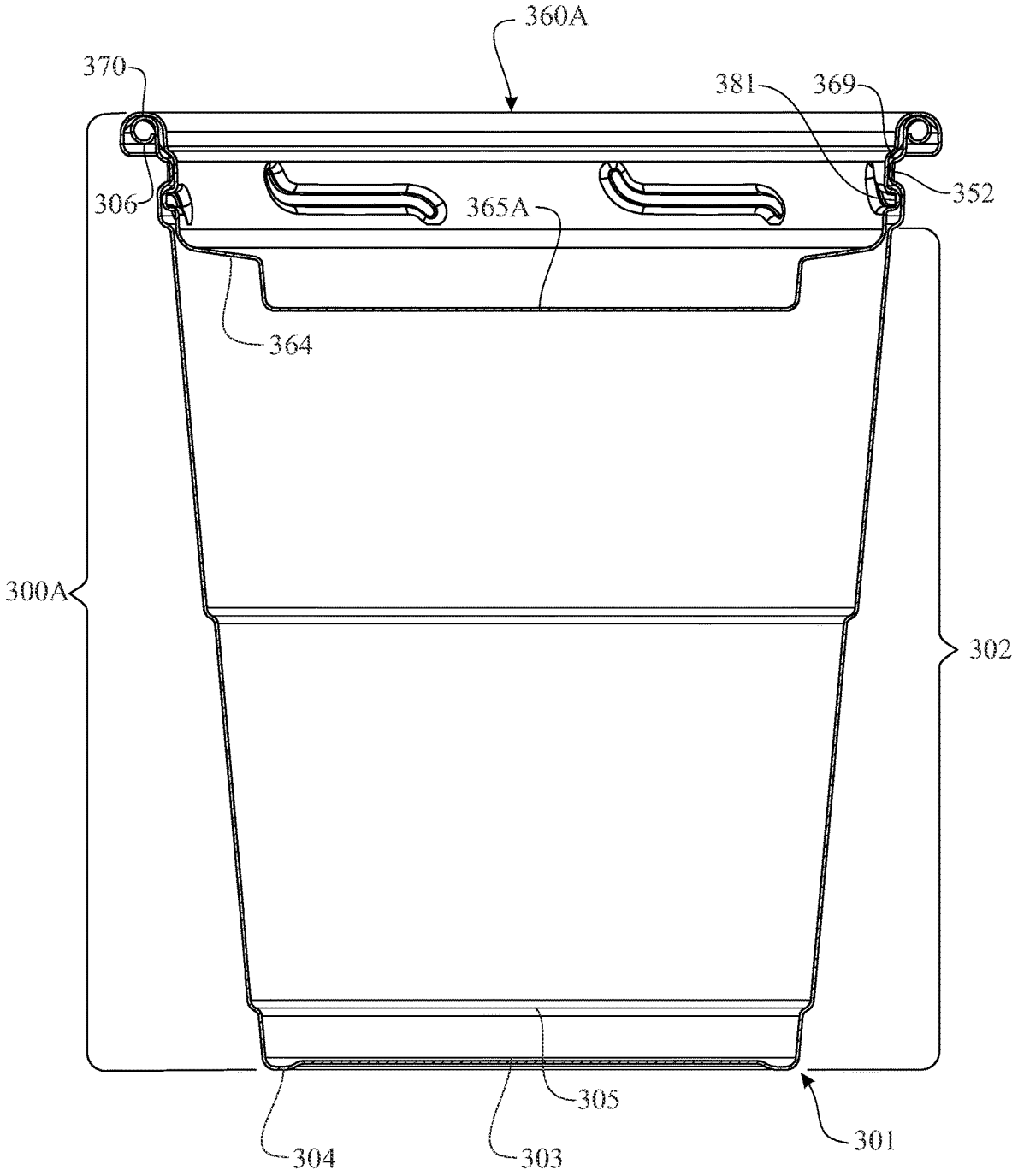
FIG. 69 presents a sectioned, front, elevation assembly view of the container comprising the exemplary nesting container body with integral cap receiving translative motion guide feature originally introduced in FIG. 50 and a first modified variant of the third exemplary container cap originally introduced in FIG. 57, the first variant comprising a recess enabling nesting, the illustration presenting the container cap assembled to the nesting container body employing the integral cap receiving translative motion guide feature.
Figure 70:
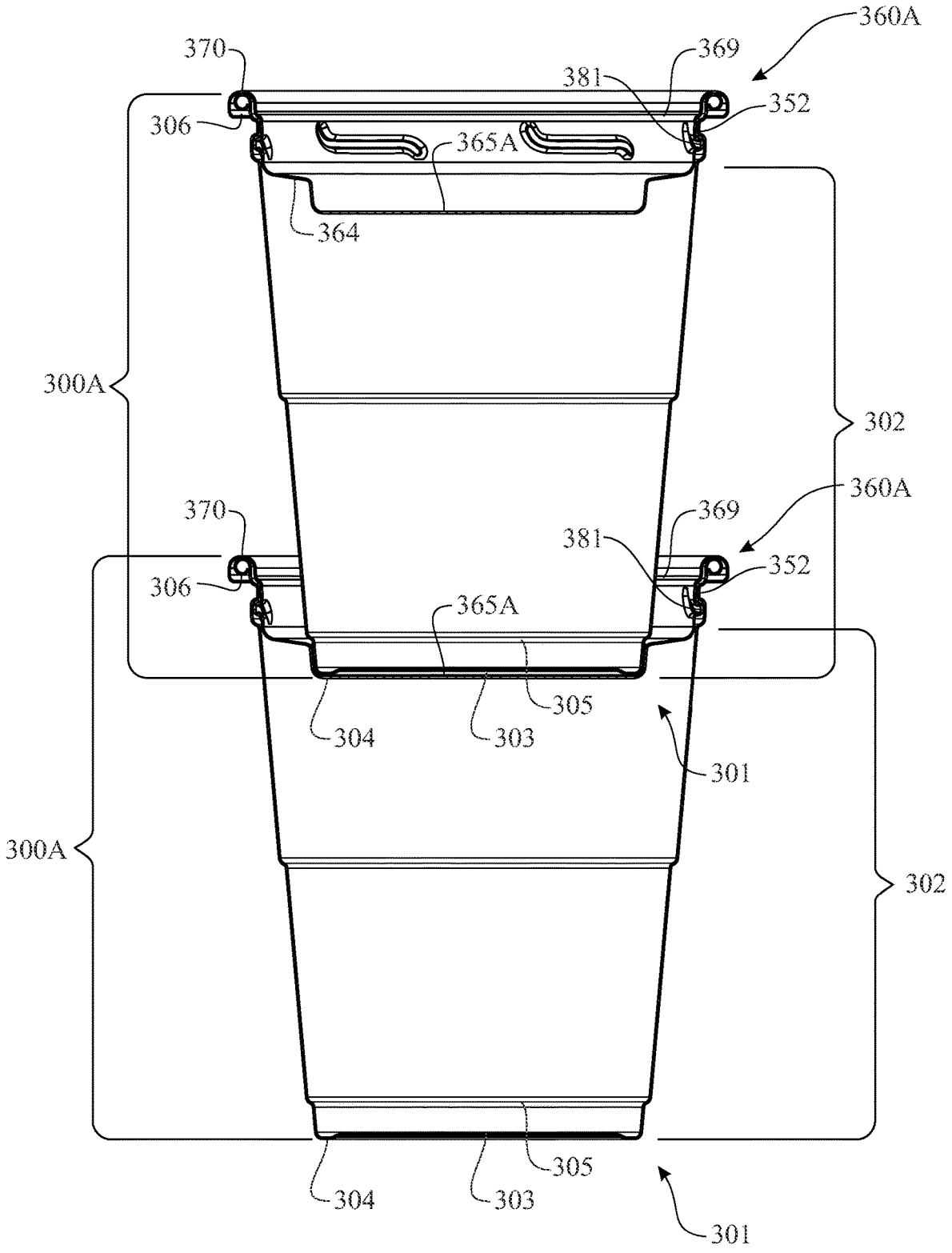
FIG. 70 presents a cross sectioned side elevation view of the first modified variant of the exemplary resealable container assembly originally illustrated in an assembled configuration in FIG. 69, the illustration presenting a nesting capability of the first modified variant of the exemplary resealable container assembly.

The resealable container 300 and/or the resealable container cap 360 can be modified to improve the stacking of the plurality of resealable containers 300. In a first example, the resealable container cap 360 is modified (referenced as a resealable container cap 360A), wherein assembly comprising the resealable container cap 360A and the nesting container body 301 are referred to as a resealable container assembly 300A, as illustrated in FIGS. 69 and 70. A resealable cap container nesting cavity 365A is formed within the resealable container cap transversing surface 364. The resealable cap container nesting cavity 365A includes a peripheral sidewall and a bottom wall having a size and shape to receive at least a portion of the nesting container body with integral cap receiving translative motion guide feature 301 defining the nesting container body first measurement volume 314 as illustrated in FIG. 70.

Figure 71:
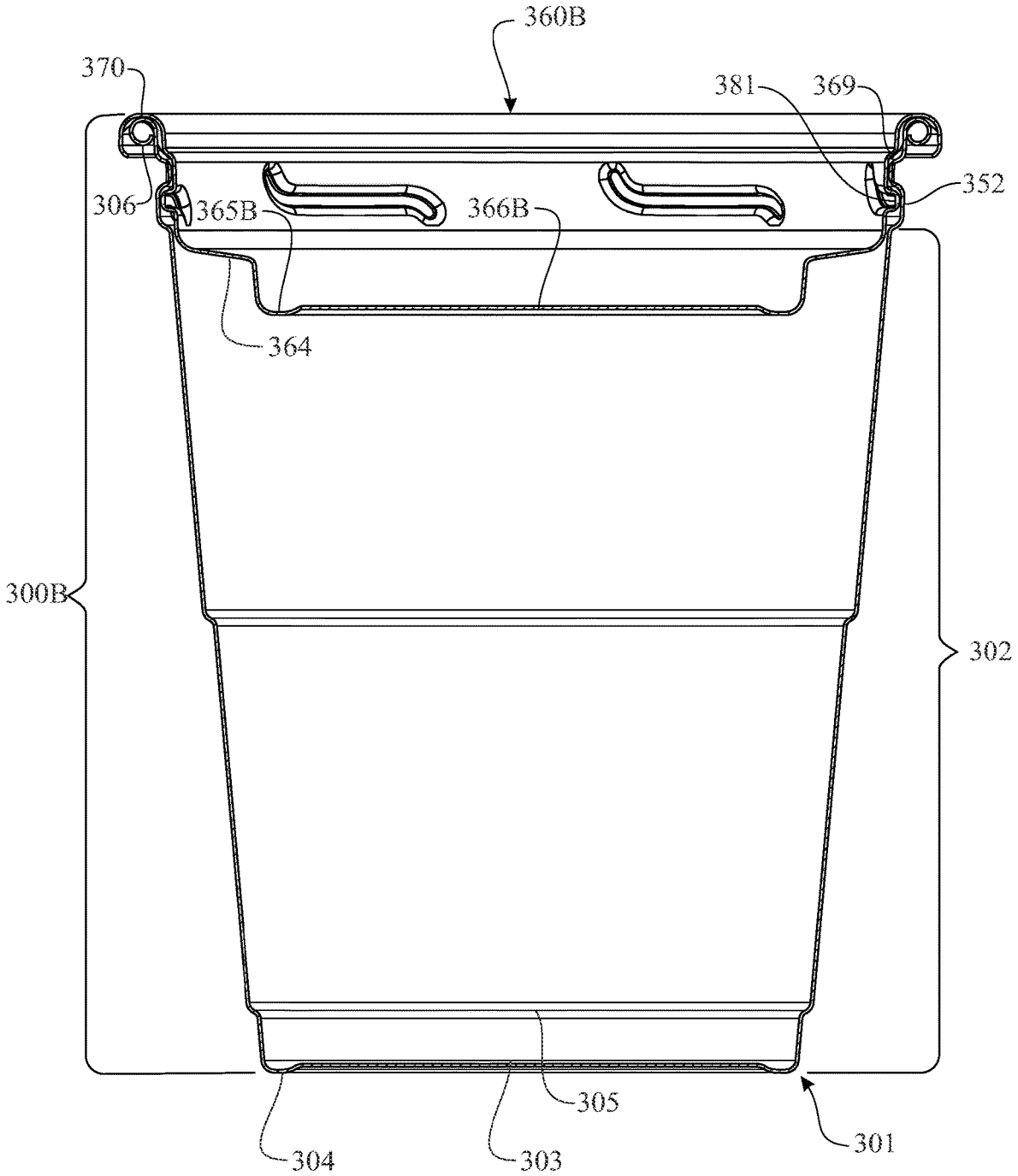
FIG. 71 presents a sectioned, front, elevation assembly view of the container comprising the exemplary nesting container body with integral cap receiving translative motion guide feature originally introduced in FIG. 50 and a second modified variant of the third exemplary container cap originally introduced in FIG. 57, the second variant comprising a recess and a secondary registration feature enabling nesting, the illustration presenting the container cap assembled to the nesting container body employing the integral cap receiving translative motion guide feature.
Figure 72:
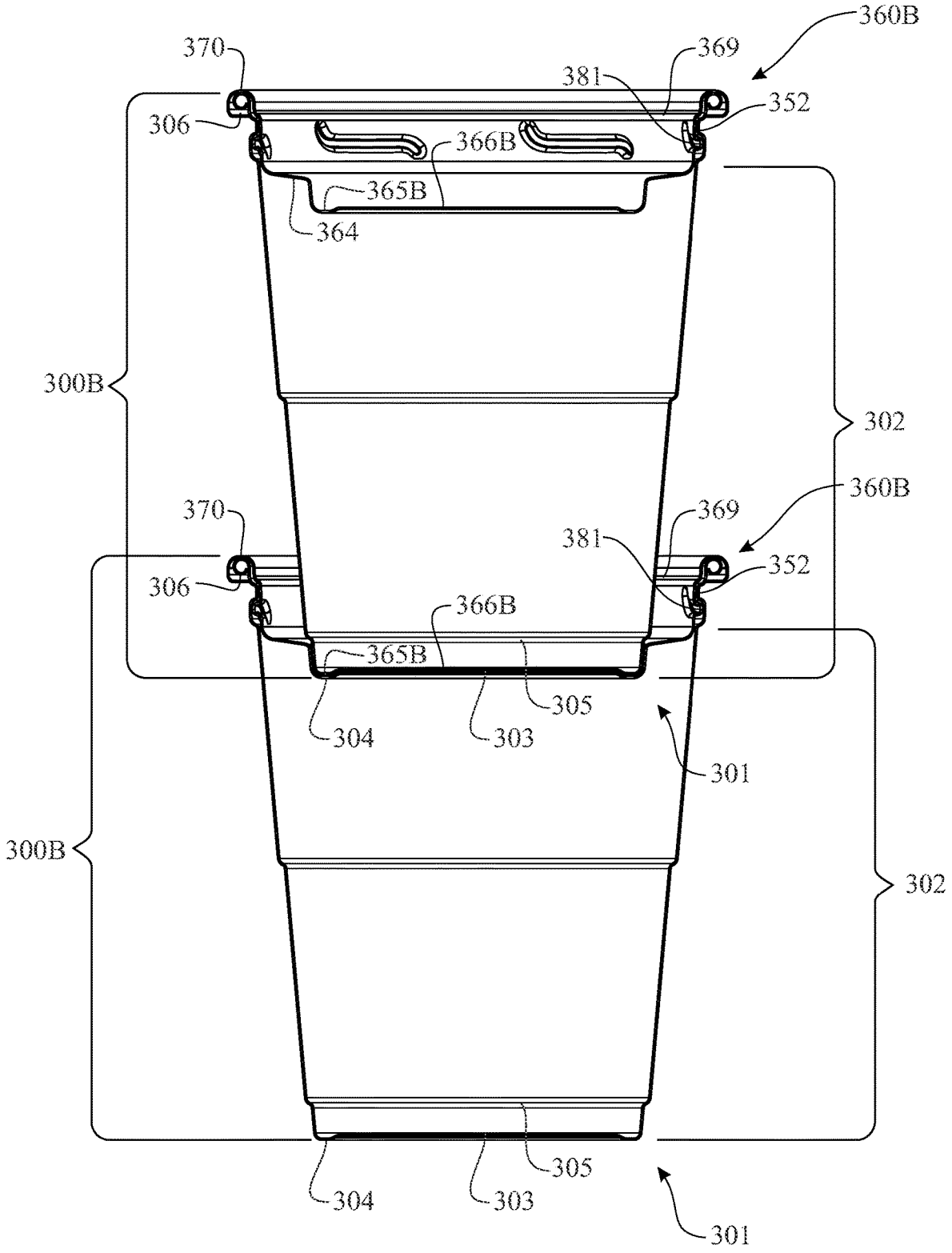
FIG. 72 presents a cross sectioned side elevation view of the second modified variant of the exemplary resealable container assembly originally illustrated in an assembled configuration in FIG. 71, the illustration presenting a nesting capability of the second modified variant of the exemplary resealable container assembly.

In a second example, the resealable container cap 360 is modified (referenced as a resealable container assembly 300B), wherein assembly comprising the resealable container cap 360B and the nesting container body 301 are referred to as a resealable container assembly 300B, as illustrated in FIGS. 71 and 72. A resealable cap container nesting cavity 365B is formed within the resealable container cap transversing surface 364. The resealable cap container nesting cavity 365B includes a peripheral sidewall and a bottom wall having a size and shape to receive at least a portion of the nesting container body with integral cap receiving translative motion guide feature 301 defining the nesting container body first measurement volume 314 as illustrated in FIG. 72. A resealable cap container stacking registration feature 366B extends upward from the resealable cap container nesting cavity 365B. The resealable cap container stacking registration feature 366B is preferably of a shape and size that follows a contour of a mating bottom surface of the nesting container body closed bottom wall 303, as illustrated in FIG. 72. The resealable cap container stacking registration feature 366B increases registration and retention between the nesting container body with integral cap receiving translative motion guide feature 301 and the resealable container cap 360B. The nesting container body closed bottom wall 303 would be seated within the resealable cap container nesting cavity 365B utilizing the resealable cap container stacking registration feature 366B to aid in registration and retention. Although the container body closed bottom wall 203 has an inwardly extending dome shape and the nesting container body closed bottom wall 303 is illustrated having a planar recess, the recess can be of any suitable shape.

Figure 73:
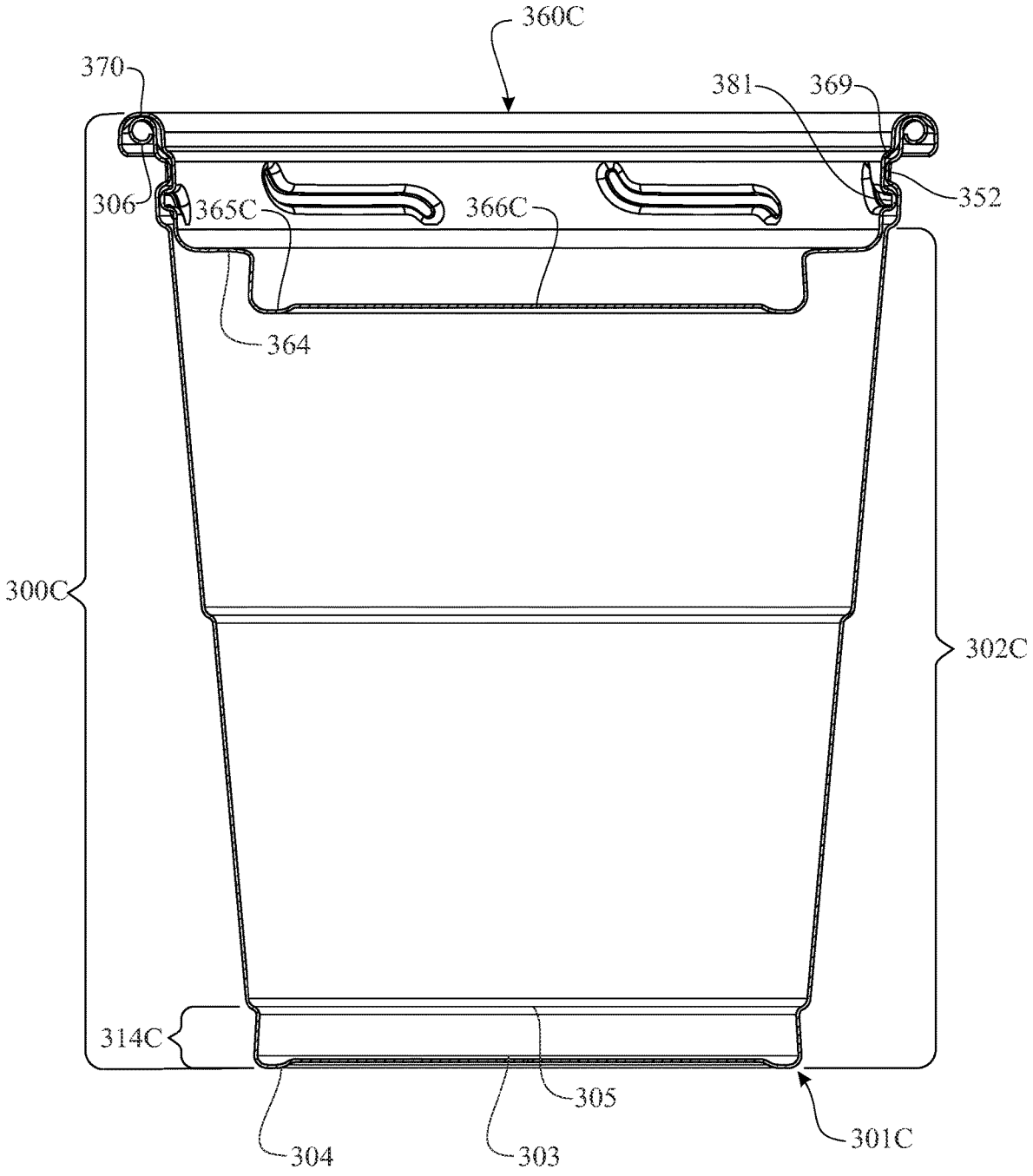
FIG. 73 presents a sectioned, front, elevation assembly view of a modified variant of the container comprising the exemplary nesting container body with integral cap receiving translative motion guide feature originally introduced in FIG. 50 and a third modified variant of the third exemplary container cap originally introduced in FIG. 57, the third variant comprising a recess having a retention interface and a secondary registration feature enabling nesting, the illustration presenting the third modified variant of the container cap assembled to the nesting container body employing the integral cap receiving translative motion guide feature.
Figure 74:
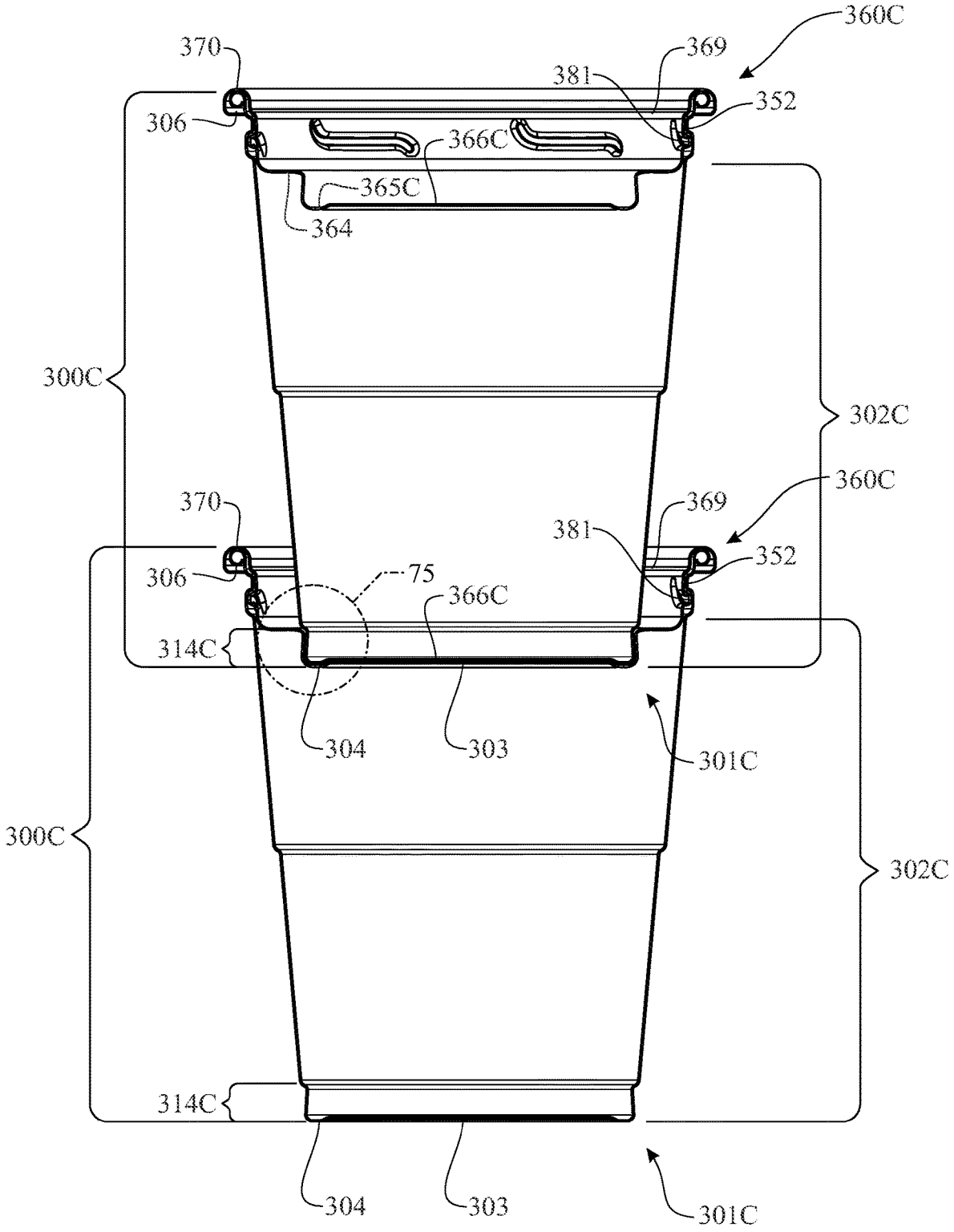
FIG. 74 presents a cross sectioned side elevation view of the third modified variant of the exemplary resealable container assembly originally illustrated in an assembled configuration in FIG. 73, the illustration presenting a nesting and retention capability of the third modified variant of the exemplary resealable container assembly.
Figure 75:
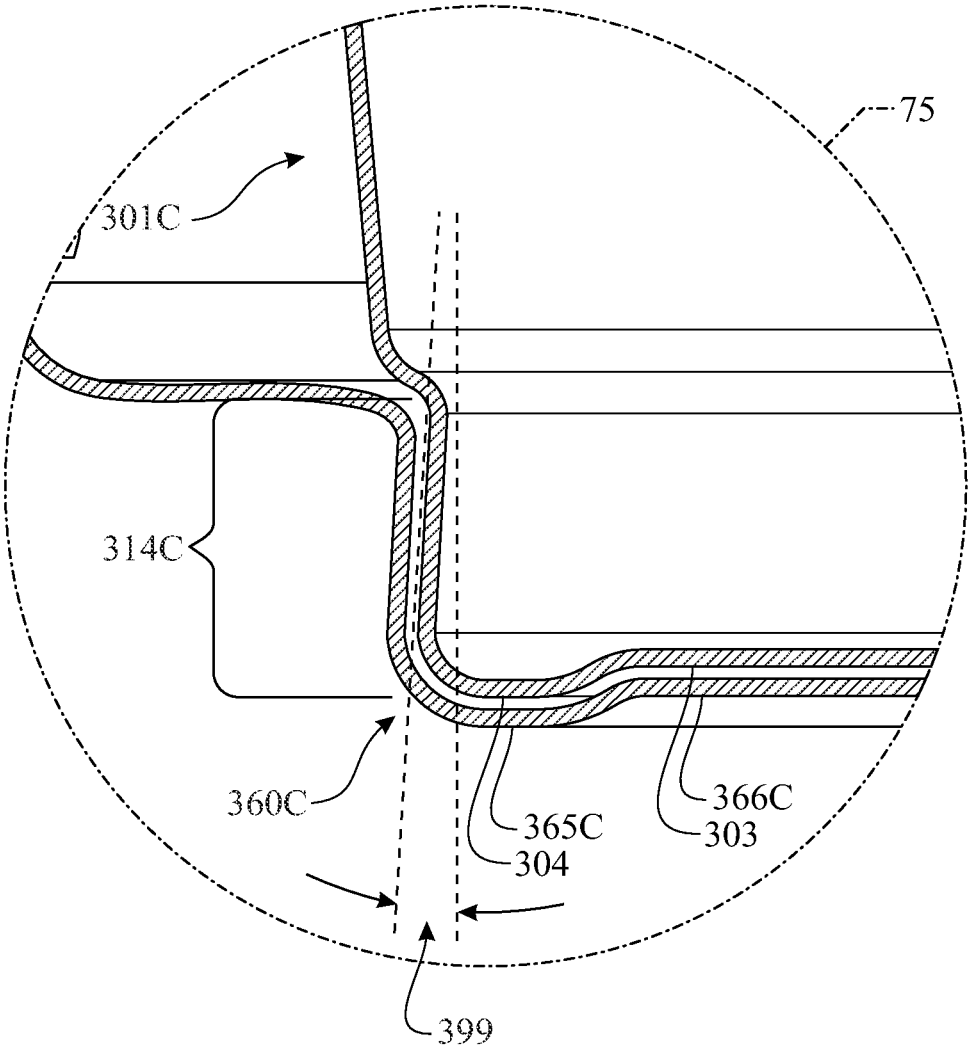
FIG. 75 presents an enlarged sectioned view detailing a nesting and retention interface provided between to nested exemplary resealable container assemblies, wherein the illustration is an enlarged detail view of area 75 circumscribed within FIG. 74.

In a third example, the resealable container cap 360 is modified (referenced as a 360C), as illustrated in FIGS. 73 through 75. In the third example, the portion defining the nesting container body first measurement volume 314 of the nesting container body with integral cap receiving translative motion guide feature 301 is modified (referenced as a nesting container body 301C), wherein assembly comprising the resealable container cap 360C and the nesting container body 301C are referred to as a resealable container assembly 300C, as illustrated in FIGS. 73 through 75. The portion of the nesting container body first measurement volume 314 of the nesting container body with integral cap receiving translative motion guide feature 301 has a frustum shape. Conversely, the portion of the nesting container body first measurement volume 314 (identified as a nesting container body first measurement volume 314C) of the nesting container body with integral cap receiving translative motion guide feature 301C has an inverted frustum shape (the exemplary frustum shape being referenced as having an interlocking frustum shaped sidewall angle 399 as illustrated in the enlarged view shown in FIG. 75). This inverted frustum shape between the nesting container body annular base 304 and the nesting container body lower reinforcing annular formation 305 provides an ability to snap adjacently nesting resealable container assemblies 300C to one another as illustrated in FIGS. 74 and 75.

A resealable cap container nesting cavity 365C is formed within the resealable container cap transversing surface 364. The resealable cap container nesting cavity 365C includes a peripheral sidewall having an inverted frustum shape and a bottom wall, wherein the resealable cap container nesting cavity 365C is of a size and shape to receive at least a portion of the nesting container body with integral cap receiving translative motion guide feature 301C defining the nesting container body first measurement volume 314C as illustrated in FIG. 73. An optional resealable cap container stacking registration feature 366C can extend upward from the resealable cap container nesting cavity 365C. The resealable cap container stacking registration feature 366C is preferably of a shape and size that follows a contour of a mating bottom surface of the nesting container body closed bottom wall 303, as illustrated in FIGS. 74 and 75. The optional resealable cap container stacking registration feature 366C increases registration and retention between the nesting container body with integral cap receiving translative motion guide feature 301C and the resealable container cap 360C. The resealable container cap 360C can be fabricated of a flexible material enabling insertion of the nesting container body first measurement volume 314C into the resealable cap container nesting cavity 365C. Alternatively, the nesting container body with integral cap receiving translative motion guide feature 301C can be fabricated of a flexible material enabling insertion of the nesting container body first measurement volume 314C into the resealable cap container nesting cavity 365C.

Figure 76:
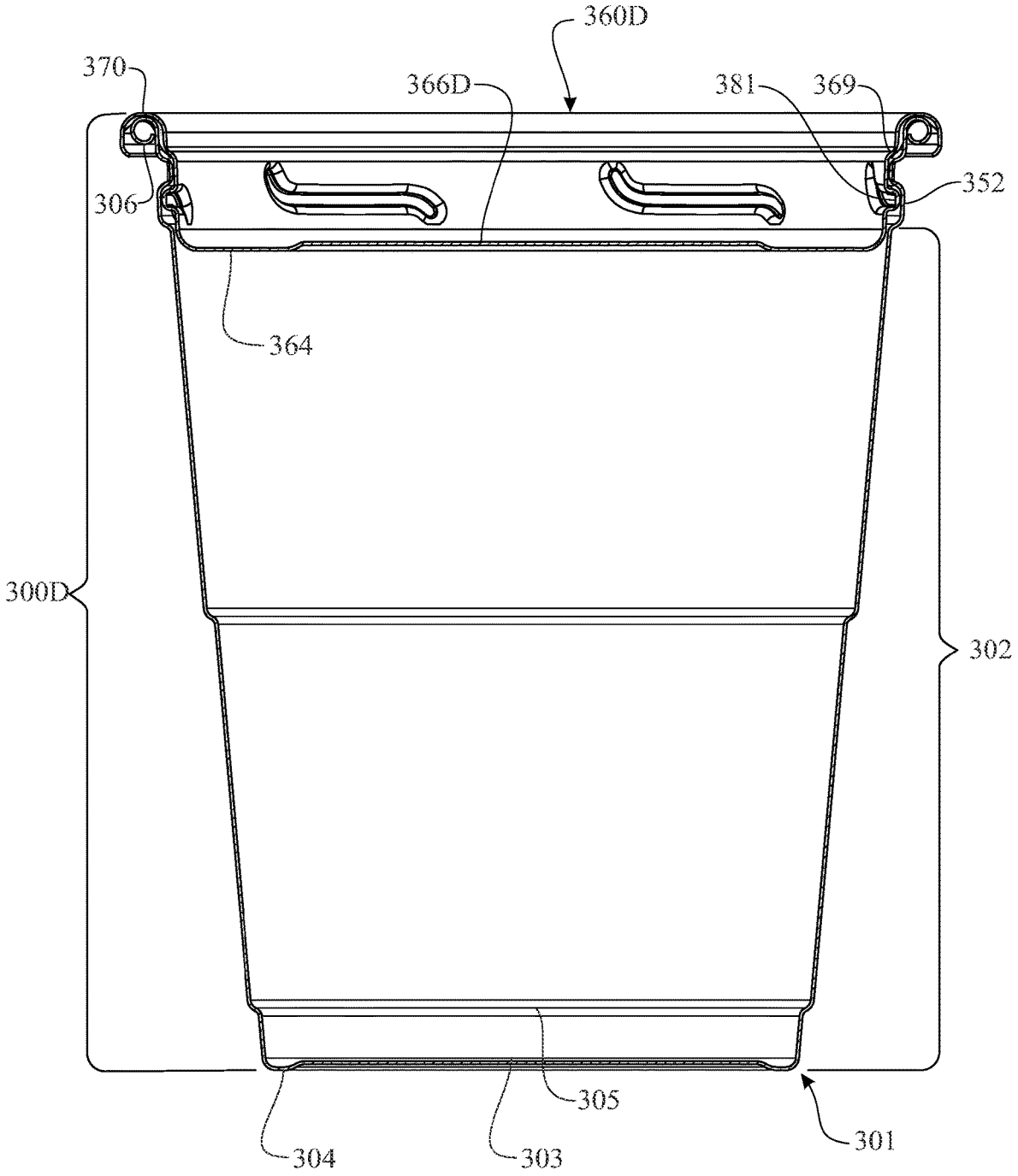
FIG. 76 presents a sectioned, front, elevation assembly view of the container comprising the exemplary nesting container body with integral cap receiving translative motion guide feature originally introduced in FIG. 50 and a fourth modified variant of the third exemplary container cap originally introduced in FIG. 57, the fourth variant comprising a boss registration feature supporting a stacking of resealable container assemblies, the illustration presenting the fourth modified variant of the container cap assembled to the nesting container body employing the integral cap receiving translative motion guide feature.
Figure 77:
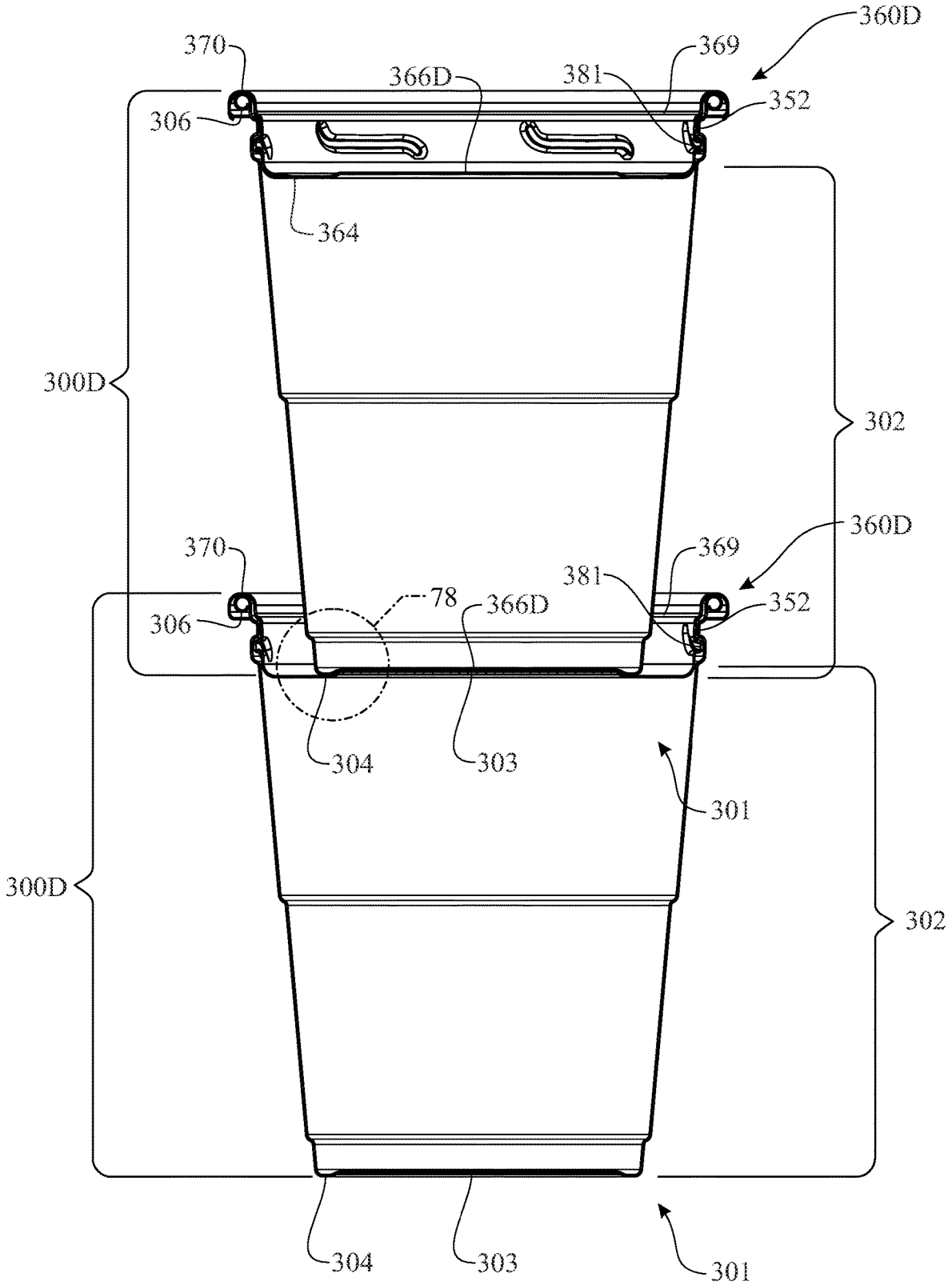
FIG. 77 presents a cross sectioned side elevation view of the fourth modified variant of the exemplary resealable container assembly originally illustrated in an assembled configuration in FIG. 76, the illustration presenting a nesting and retention capability of the fourth modified variant of the exemplary resealable container assembly.
Figure 78:
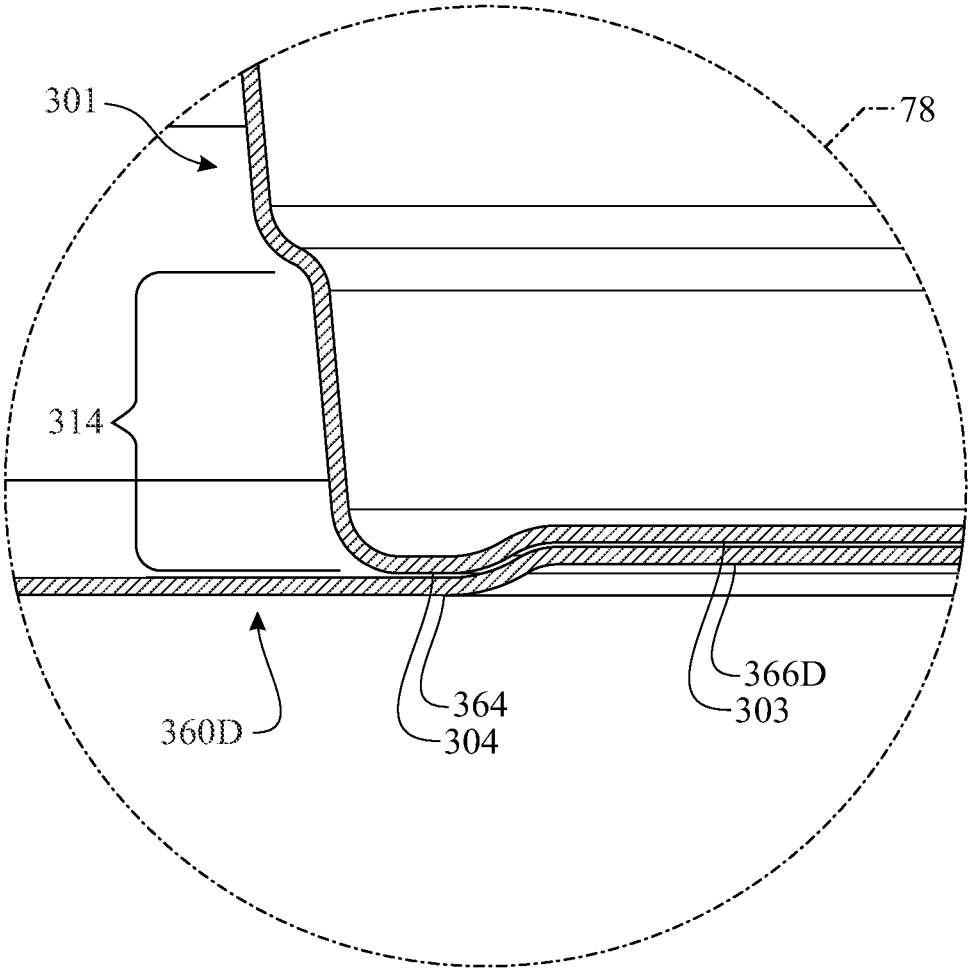
FIG. 78 presents an enlarged sectioned view detailing a stacking registration interface provided between to exemplary resealable container assemblies, wherein the illustration is an enlarged detail view of area 78 circumscribed within FIG. 77.

In a fourth example, the resealable container cap 360 is modified (referenced as a resealable container cap 360D), wherein assembly comprising the resealable container cap 360D and the nesting container body 301 are referred to as a resealable container assembly 300D, as illustrated in FIGS. 76 through 78. The resealable container cap 360D is a variant of the resealable container cap 360B, wherein the resealable container cap 360D lacks a cavity (the resealable cap container nesting cavity 365B of the resealable container cap 360B), while retaining a resealable cap container stacking registration feature 366D extending upwards from an upper surface of the resealable container cap transversing surface 364. The resealable cap container stacking registration feature 366B is preferably of a shape and size that follows a contour of a mating bottom surface of the nesting container body closed bottom wall 303, as illustrated in FIGS. 77 and 78. The resealable cap container stacking registration feature 366D increases registration and retention between the nesting container body with integral cap receiving translative motion guide feature 301 and the resealable container cap 360D. The nesting container body closed bottom wall 303 would be seated upon the resealable cap container stacking registration feature 366D.

The exemplary illustrations can be enhanced with an introduction of additional features and/or function. For example, a tamper indicator can be integrated into the bottom wall 164, 264, 364.

Figure 79:
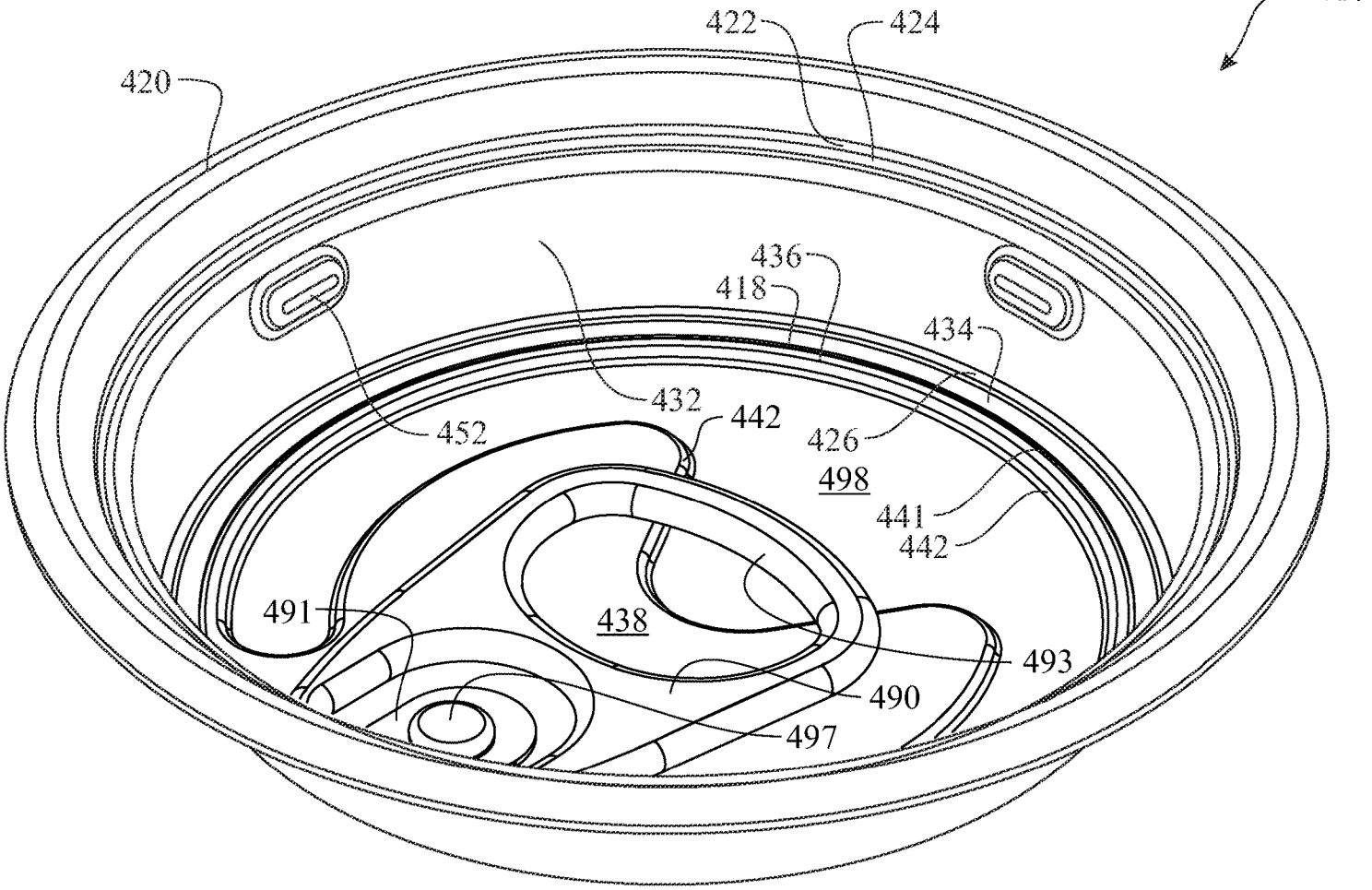
FIG. 79 presents a top, side isometric view introducing a fourth exemplary container lid in accordance with the present invention, wherein the fourth exemplary container lid includes a frustum shaped sidewall comprising a plurality of lid translative motion guide features as introduced in FIG. 1 and a easy open end (full panel removal)
Figure 80:
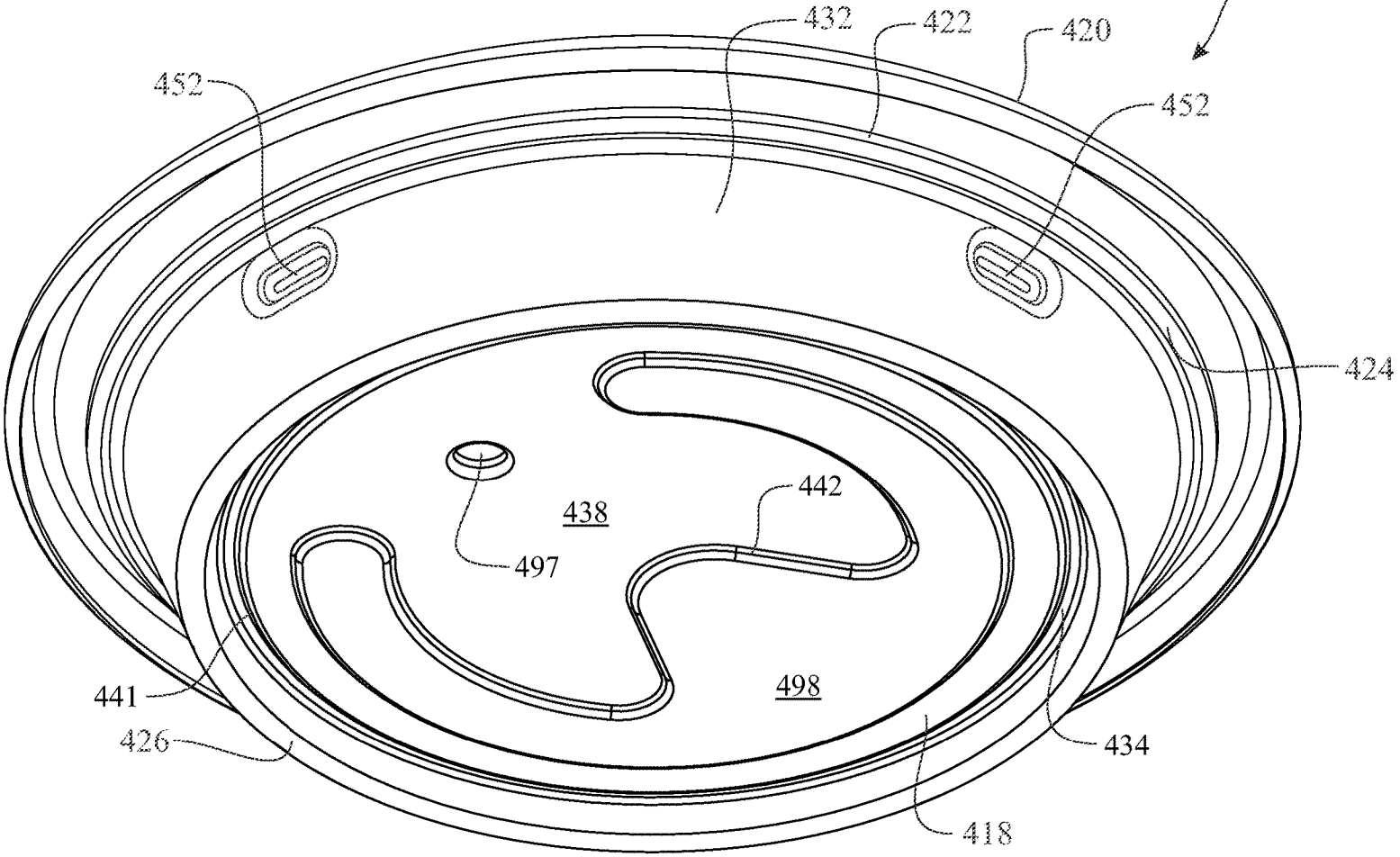
FIG. 80 presents a bottom, side isometric view of the fourth exemplary container lid originally introduced in FIG. 79.
Figure 81:
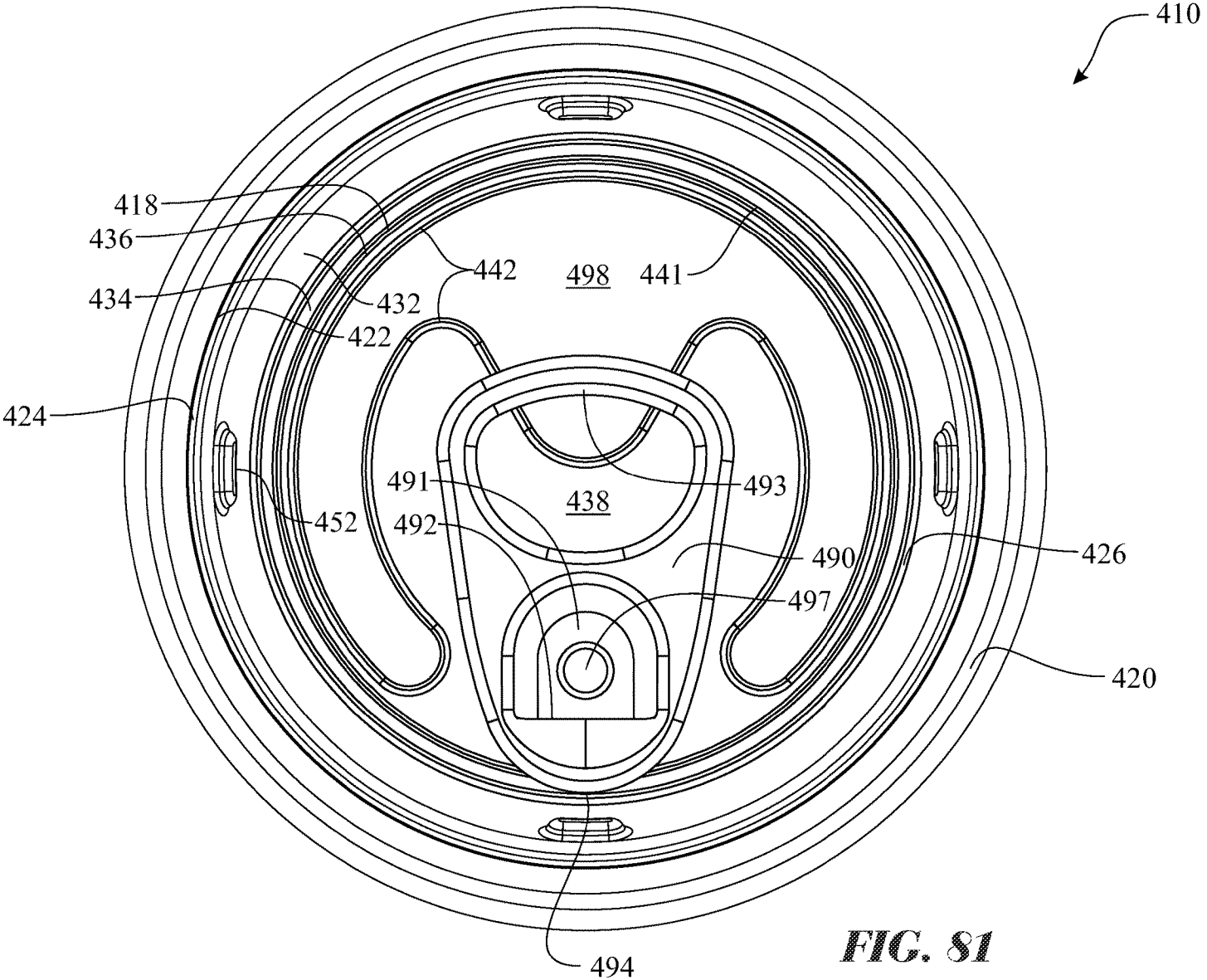
FIG. 81 presents a top, plan view of the fourth exemplary container lid originally introduced in FIG. 79, wherein the illustration provides a detailed view of elements associated with the Stay-On-Tab (SOT) arrangement.
Figure 82:
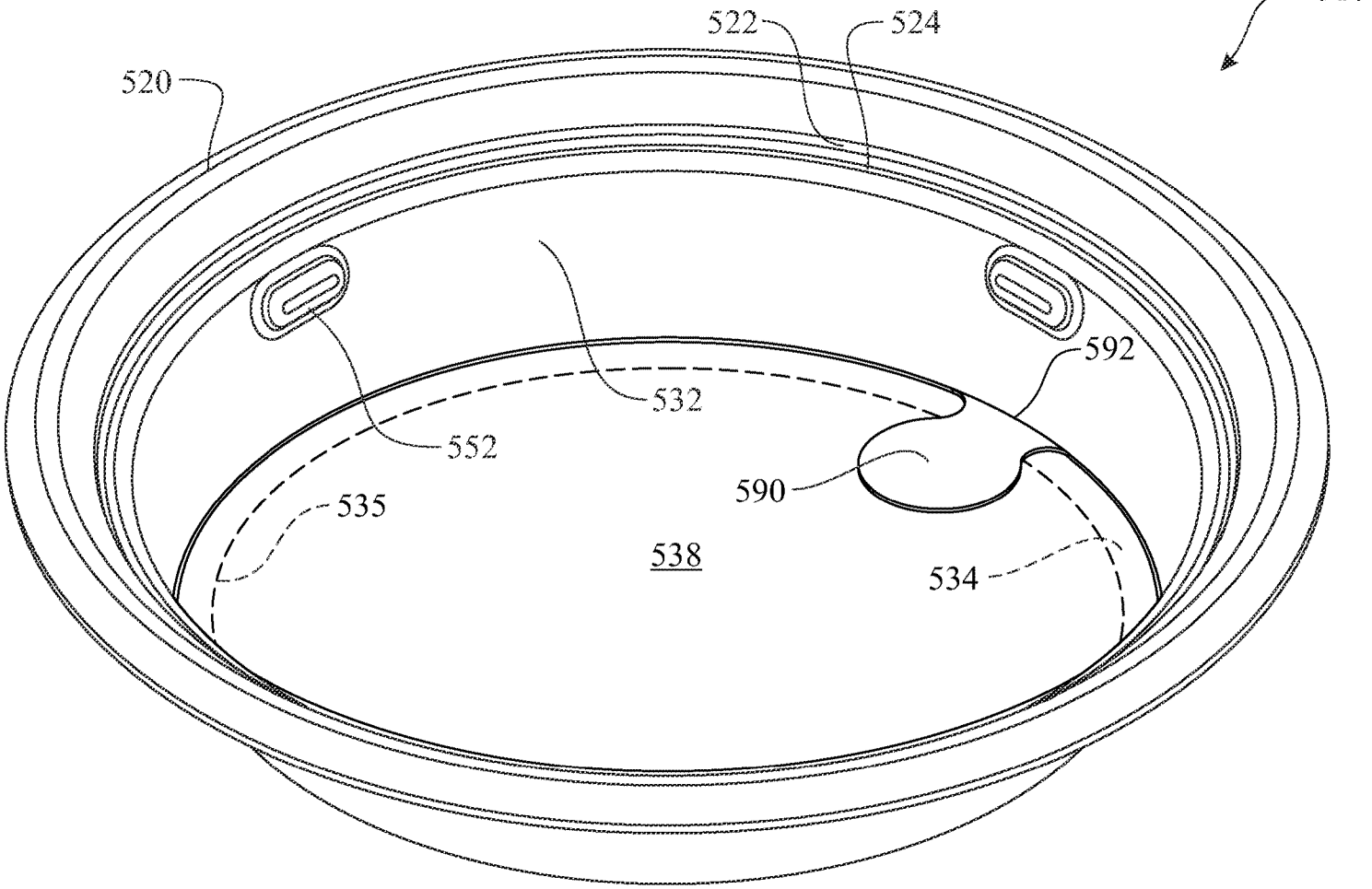
FIG. 82 presents a top, side isometric view introducing a fifth exemplary container lid in accordance with the present invention, wherein the fourth exemplary container lid includes a peel off foil/film sealing a frustum shaped sidewall comprising a plurality of lid translative motion guide features as introduced in FIG. 23.
Figure 83:
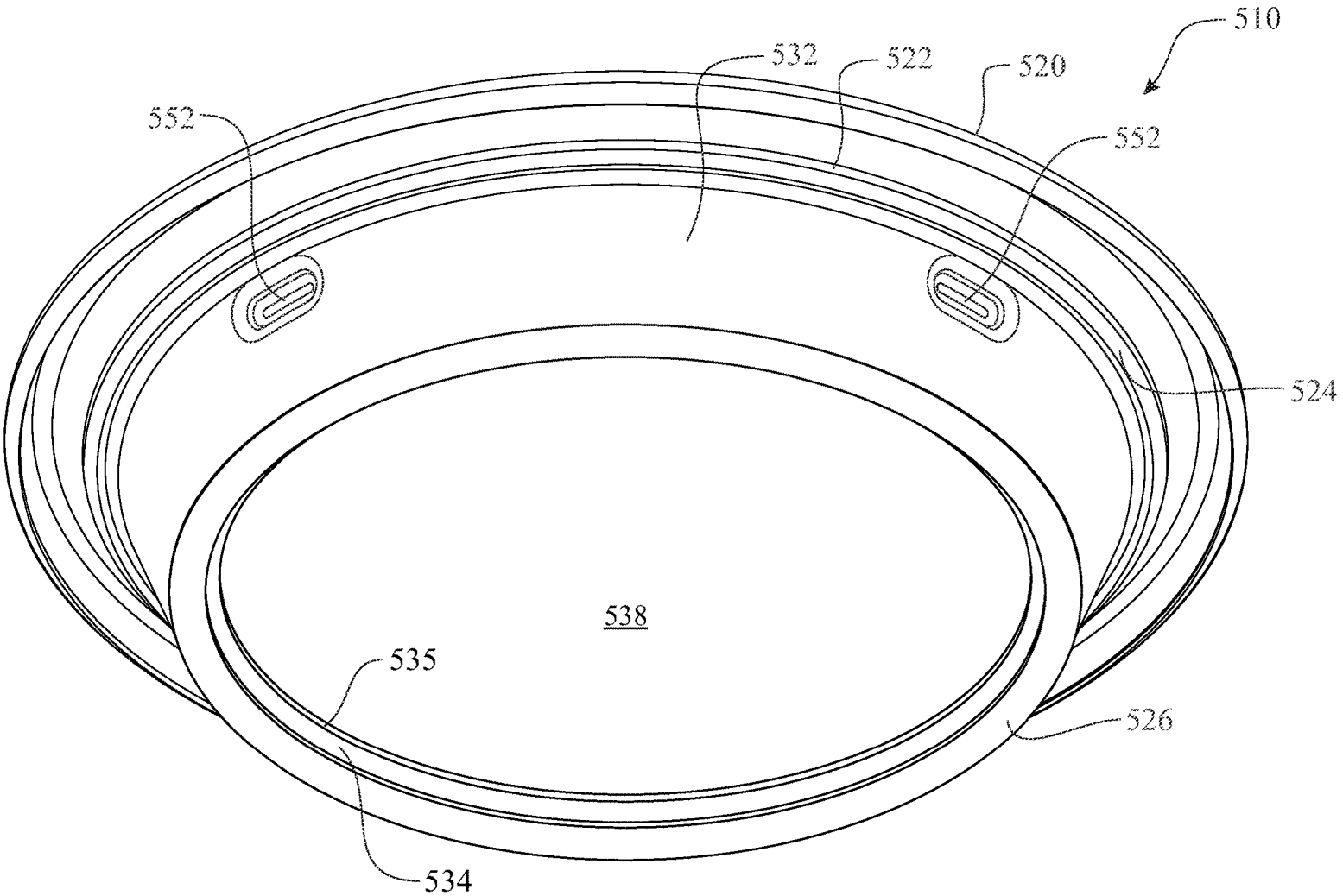
FIG. 83 presents a bottom, side isometric view of the fifth exemplary container lid originally introduced in FIG. 82.
Figure 84:
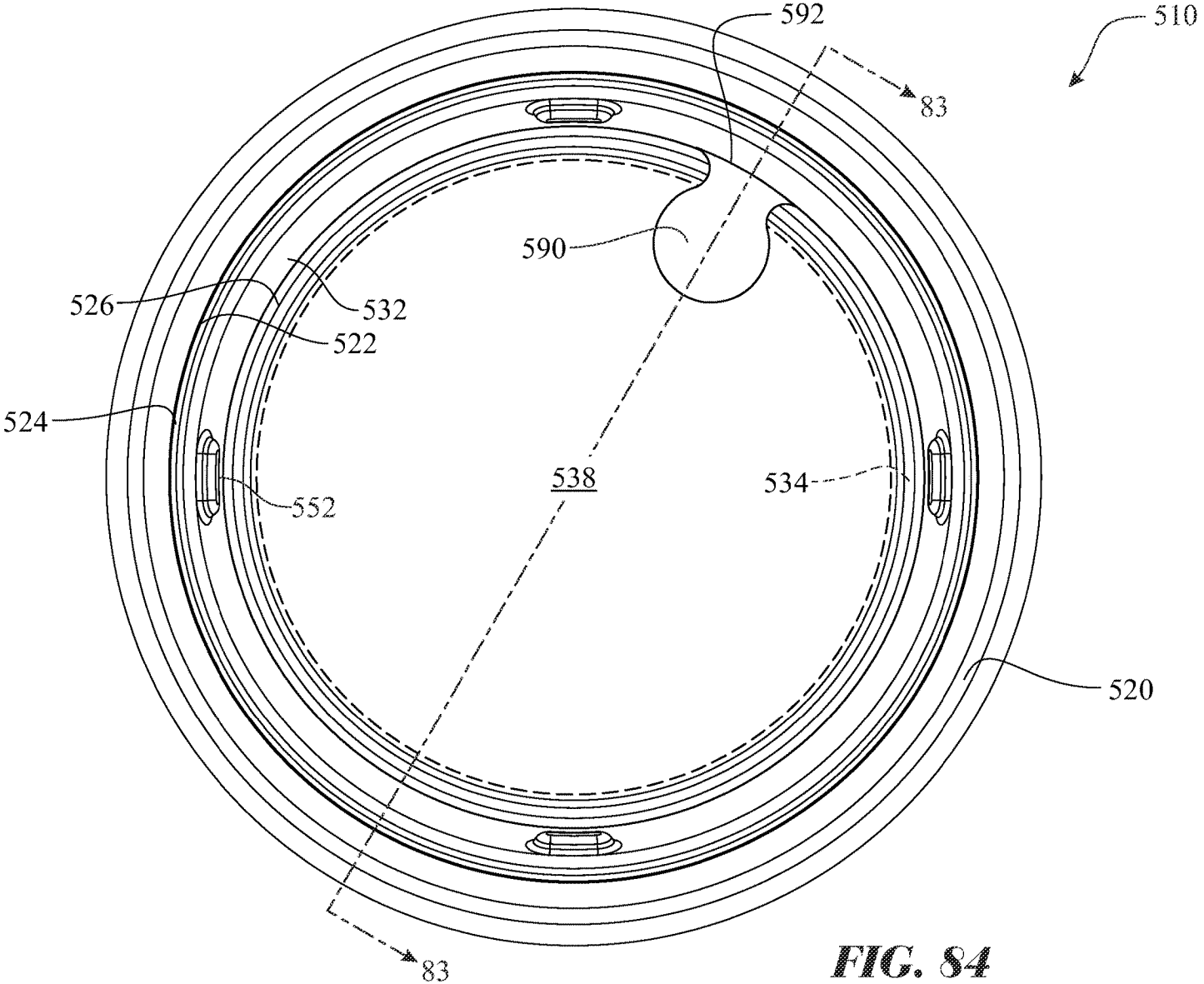
FIG. 84 presents a top, plan view of the fifth exemplary container lid originally introduced in FIG. 82, wherein the illustration provides a detailed view of elements associated with the peel off foil/film arrangement.

The resealable container lid 110 includes a stay-on tab design wherein a lid bottom panel tear panel 138 is retained by a tear panel hinge 139 on the resealable container lid 110. Certain applications prefer to utilize a container design having a larger or full aperture opening by removing a substantial portion of the bottom panel 134, 434. A first example is a resealable container lid 410, illustrated in FIGS. 79 through 81. The resealable container lid 410 includes features similar to the resealable container lid 110. Like features of the resealable container lid 110 and the resealable container lid 410 are numbered the same except preceded by the numeral '4'. The primary distinction between the resealable container lid 110 and the resealable container lid 410 is that a lid bottom panel score line 436 of the resealable container lid 410 circumscribes an area proximate the outer diameter of the lid bottom wall 434, thus enabling removal of the majority of the lid bottom wall 434 from the resealable container lid 410, as compared to the lid bottom wall 134 of the resealable container lid 110, where the lid bottom wall 134 creates an opening that is significantly smaller than the full panel and offset from center of the full panel. The remaining distinctions support the difference in the tear panel lid bottom tear panel 438 being a full panel and removable. A user would initially rotate a pull tab 490 upwards, the pull tab 490 being hingeably formed with a tab retention bracket 491, wherein the tab retention bracket 491 is secured to the lid bottom tear panel 438 by a rivet 497. Motion of the pull tab 490 is controlled by a fold along a tab bracket hinge 492. A tab effecting edge 494 of the pull tab 490 is in registration with a portion of the lid bottom panel score line 436. As the pull tab 490 is rotated upwards, a tab effecting edge 494 of the pull tab 490 initiates a fracture of the lid bottom panel score line 436. Once the lid bottom panel score line 436 is initially fractured, the user would divert from a rotating action to a pulling action applied through the aperture defined by the tab lightening hole 493. The lifting force applied to the pull tab 490 continues to propagate the shearing along the lid bottom panel score line 436 causing separation of the lid bottom tear panel 438 from the resealable container lid 410. Converse to the resealable container lid 110, where the lid bottom panel tear panel 138 remains attached to the resealable container lid 110 by a tear panel hinge 139, the lid bottom panel score line 436 is separated and removed from the resealable container lid 410. The pull tab 490 remains secure to the removed lid bottom tear panel 438 by the rivet 497. Various reinforcement features (442, 498) can be designed into the lid bottom wall 434 to reinforce the lid bottom wall 434, which aids in the initial fracturing step and the continued shearing propagation along the lid bottom panel score line 436.

Figure 85:
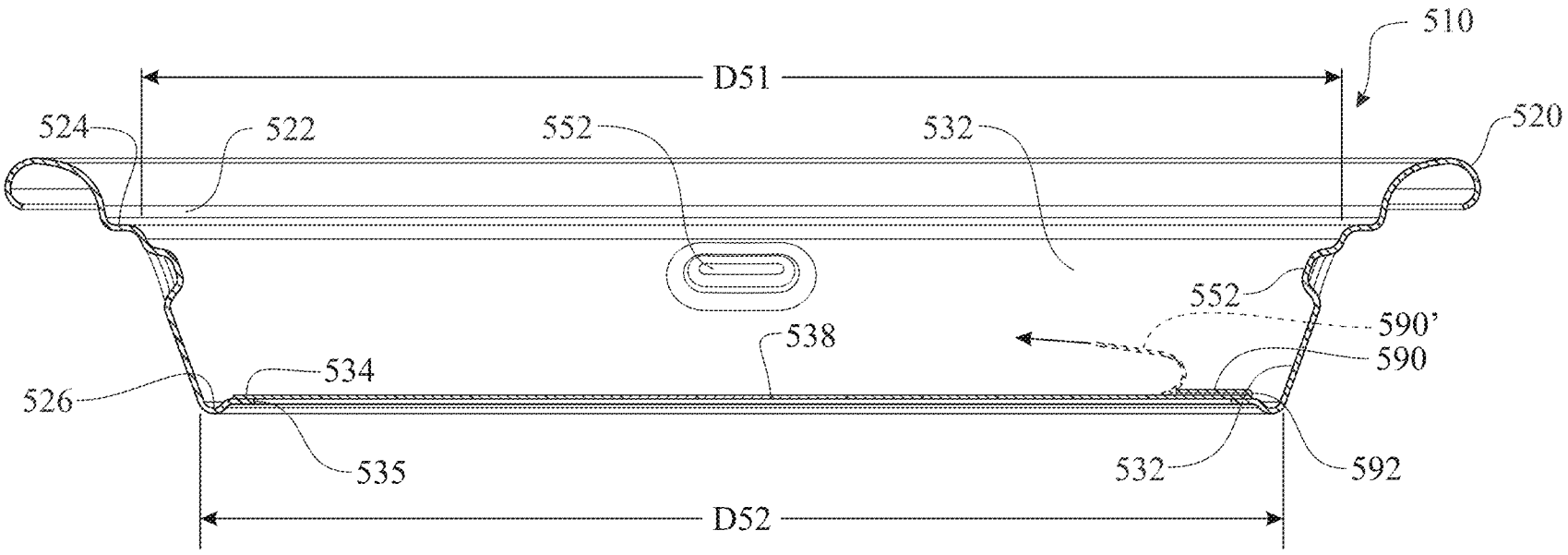
FIG. 85 presents a cross sectioned side elevation view of the fifth exemplary container lid originally introduced in FIG. 82, the section view taken along section line 85-85 of FIG. 84, the illustration presenting a process of removing the peel off tab from the container lid.

A second example is a resealable container lid 510, illustrated in FIGS. 82 through 85. The resealable container lid 510 includes features similar to the resealable container lid 110. Like features of the resealable container lid 110 and the resealable container lid 510 are numbered the same except preceded by the numeral '5'. The 510 includes a lid bottom wall contents access passageway 535 cut about an interior edge of the lid bottom wall 534 or slightly radially inward from an inner peripheral edge of a lid annular countersink 526. A foil panel tab 590 is preferably unitarily formed with the removable foil lid bottom panel 538; the foil panel tab 590 being an extension of the material fabricating the removable foil lid bottom panel 538, wherein a foil tab hinge 592 is provided between the removable foil lid bottom panel 538 and the foil panel tab 590. A peripheral edge of the removable foil lid bottom panel 538 is adhesively bonded to an upper surface of a lid bottom wall 534. For removal, as illustrated in FIG. 85, the user would fold upward and grip the foil panel tab 590 (identified as a foil panel tab 590' once separated) and begin to pull the foil panel tab (in use) 590' in a radially inward and upward direction until the entire removable foil lid bottom panel 538 is separated and removed from the lid bottom wall 534 of the resealable container lid 510. Once the removable foil lid bottom panel 538 is removed from the resealable container lid 510, the lid bottom wall contents access passageway 535 defines and opening allowing access to contents within the container.

The resealable container lid 510 is designed to replicate the nesting capability as the resealable container lid 110 as illustrated in FIG. 7. A upper tubular sidewall radially inner diameter D51, measuring a diameter across an upper edge of the interior surface of the lid frustum shaped sidewall 532 is greater than a lower formation radially outermost diameter D52, measuring a diameter across a radially outermost dimension of an exterior surface of the lid annular countersink 526 enabling an upper placed resealable container lid 510 to seat within the lid frustum shaped sidewall 532 of a lower placed resealable container lid 510.

Figure 86:
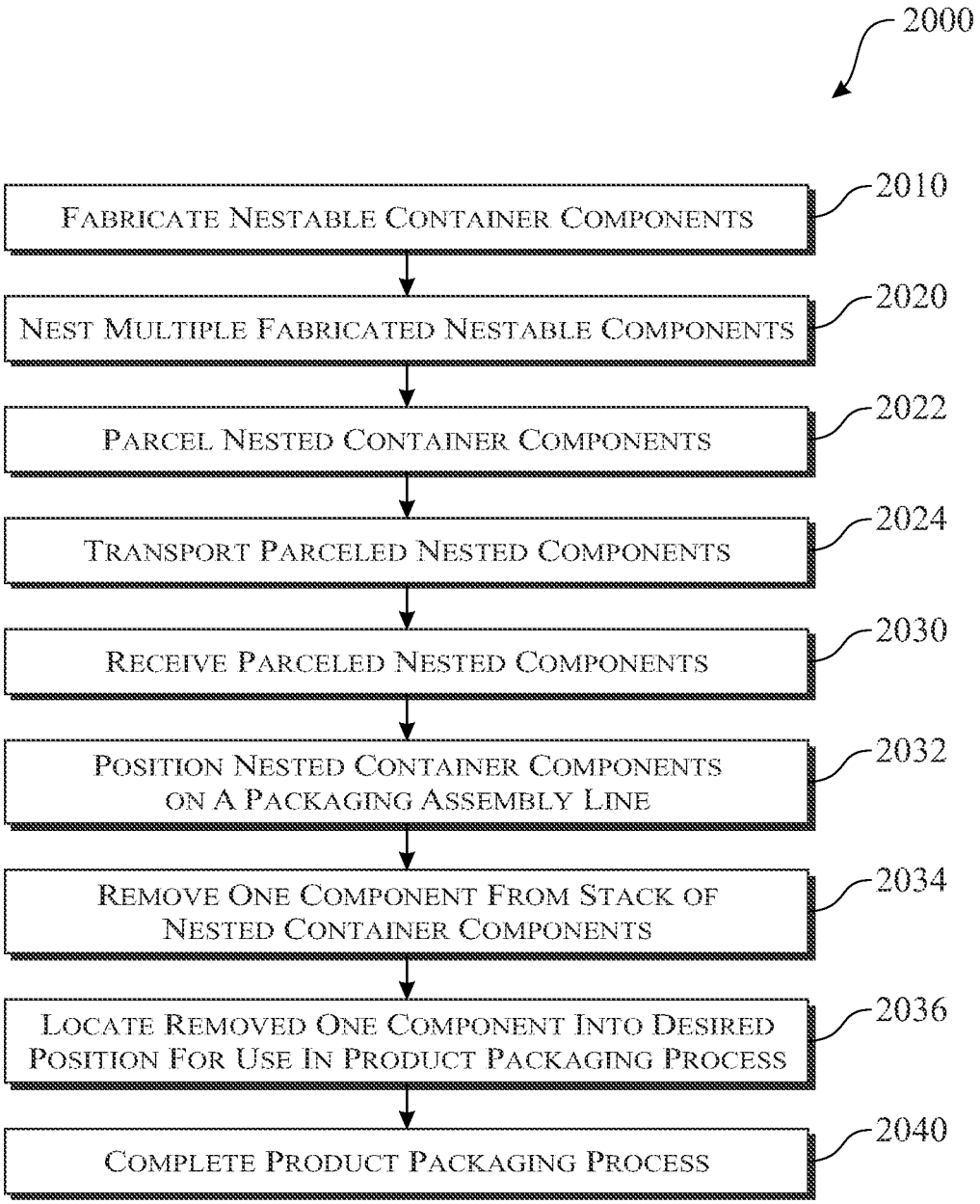
FIG. 86 presents a flow diagram describing a method for processing nestable container components.

Each of the above components 110, 160, 210, 260, 301, 360, 360A, 360B, 360C, 360D 410, 510 is nestable container components. Multiples of like nestable container components can be nested within one another to optimize containment/minimize air volume for shipping. Additionally, the nested design optimizes space and conveyence requirements along an automated contents packaging line. The higher the quantity of materials that can be placed upon the automated contents packaging line and the more reliably they are conveyed, the less time is required for replenishing inventory of the component on the automated contents packaging line. A process employing benefits of the nestability of the nestable container components 110, 160, 210, 260, 301, 360, 360A, 360B, 360C, 360D 410, 510 is described in a nestable container component supply and use flow diagram 2000 presented in FIG. 86.

The nestable container component supply and use flow diagram 2000 initiates with a step of fabricating the nestable container components 110, 160, 210, 260, 301, 360, 360A, 360B, 360C, 360D 410, 510 (block 2010). This can be accomplished using any suitable manufacturing process based upon a material selected for the nestable container components 110, 160, 210, 260, 301, 360, 360A, 360B, 360C, 360D 410, 510. The nestable container components 110, 160, 210, 260, 301, 360, 360A, 360B, 360C, 360D 410, 510 can be fabricated from a sheet of metal, a sheet of steel, a sheet of aluminum, a sheet of plastic, a sheet of processed bamboo or any other suitable material. By initiating the fabricated steps with sheets, the machining processes are reduced and can include a stamping process, a punch process, a step punch process, an ironing process, a turning process, a shearing process, a die forming/cutting process, and the like. Although initiating the fabricated steps with sheets is preferred, the raw material can be provided in other form factors and the manufacturing process can include other steps, such as molding, casting, and the like.

Once fabricated multiples of the nestable container components 110, 160, 210, 260, 301, 360, 360A, 360B, 360C, 360D 410, 510 are stacked in a nested arrangement (block 2020). The nesting is based upon the specific component with details being presented above. Features of one nestable container component 110, 160, 210, 260, 301, 360, 360A, 360B, 360C, 360D 410, 510 can be incorporated into any of the other nestable container components 110, 160, 210, 260, 301, 360, 360A, 360B, 360C, 360D 410, 510. For example, the cap receiving annular component tubular sidewall 232 of the resealable container annular component 210 can have a significantly more tapered (frustum) shape similar to the lid frustum shaped sidewall 132 of the resealable container lid 110 to adjust the nesting process. In addition to a more compact storage as noted above, nesting of the nestable container components 110, 160, 210, 260, 301, 360, 360A, 360B, 360C, 360D 410, 510 also provides radial stability during storage and transport. One nestable container components 110, 160, 210, 260, 301, 360, 360A, 360B, 360C, 360D 410, 510 can easily be removed in an axial direction from a top of a stack of nested container components 110, 160, 210, 260, 301, 360, 360A, 360B, 360C, 360D 410, 510, while retaining stability of the stack when subjected to any radial or partially radially directed force.

The nested stack or stacks of the nestable container components 110, 160, 210, 260, 301, 360, 360A, 360B, 360C, 360D 410, 510 is then placed into a box or other container creating a parcel for transport from the manufacturing facility to a packaging house (step 2022). The box or container can be sealed to avoid exposure to contaminants. The parcel (preferably collected to be multiple parcels such as on a pallet) is transported from the manufacturing facility to a packaging house (step 2024). Transportation can be accomplished using any common commercially available parcel transportation system, including trucking, rail, ships, air and the like.

The parcel containing the nested stack or stacks of the nestable container components 110, 160, 210, 260, 301, 360, 360A, 360B, 360C, 360D 410, 510 is received at the packaging house (step 2030). The nested stack or stacks of the nestable container components 110, 160, 210, 260, 301, 360, 360A, 360B, 360C, 360D 410, 510 are separated from any unwanted materials used during transport. The nested stack or stacks of the nestable container components 110, 160, 210, 260, 301, 360, 360A, 360B, 360C, 360D 410, 510 can remain in at least a portion of the packaging which may be suitable and integrated into the contents packaging process carried out at the packaging facility. The nested stack or stacks of the nestable container components 110, 160, 210, 260, 301, 360, 360A, 360B, 360C, 360D 410, 510 are then positioned in location for use on the packaging assembly line (step 2032). It is desirous to integrate the manner in which the nested stack or stacks of the nestable container components 110, 160, 210, 260, 301, 360, 360A, 360B, 360C, 360D 410, 510 are packaged into the parcel into the component presentation process used by the packaging assembly line. This avoids excess time, manpower, materials and costs.

The packaging assembly line utilizes equipment to remove one individual nestable container component 110, 160, 210, 260, 301, 360, 360A, 360B, 360C, 360D 410, 510 from the stack or stacks of nestable container components 110, 160, 210, 260, 301, 360, 360A, 360B, 360C, 360D 410, 510 located at the respective packaging station (block 2034). The process of removing one nestable container component 110, 160, 210, 260, 301, 360, 360A, 360B, 360C, 360D 410, 510 from the stack of nestable container components 110, 160, 210, 260, 301, 360, 360A, 360B, 360C, 360D 410, 510 can employ any of a number of a variety of material collection and positioning tools. Examples include a robotic controlled mechanical gripper, a robotically controlled vacuum gripper, a robotically controlled static gripper, a robotically controlled static gripper, a robotically controlled magnetic gripper (where the materials are applicable), or any other suitable robotically controlled collection and positioning device. Preferably, the same device retaining the nestable container component 110, 160, 210, 260, 301, 360, 360A, 360B, 360C, 360D 410, 510 is used to position the nestable container component 110, 160, 210, 260, 301, 360, 360A, 360B, 360C, 360D 410, 510 in a desired location for use in the product packaging process along the automated packaging assembly line (block 2036). The product packaging process would continue until the contents are properly and completely packaged in accordance with the designated process (block 2040).

The container lids 160, 260, 360 can be replaced by an accessory, wherein the accessory would include a sidewall 162, (represented by the exterior, product side) 262, (represented by the exterior, product side) 362 and at least one cap translative motion guide feature 181, 281, 381. The accessory can include features similar to a sippy cup, a straw holder and a straw, a bottle nipple, a rotating opening and closure, a drinking spout, a vertically opening and sealing drinking spout, a pivoting opening and sealing drinking spout, a pump dispensing mechanism, a spray dispensing mechanism, or any other suitable accessory.

A safety ring can be provided circumscribing the cylindrical sidewall inverted countersink 170, 270, 370. The safety ring would require a specific applied force to enable rotation of the container cap 160, 260, 360.

The container lid caps 160, 160, 360 can be replaced by other container lid caps having more specialized features and related functions, as shown in the various configurations presented in FIGS. 87 through 101. These specialized caps can be included with the container, sold separately, or both. The specialized caps give the consumer the ability to adapt any container into a specialized application. The specialized caps can be referred to as accessories.

Figure 87:
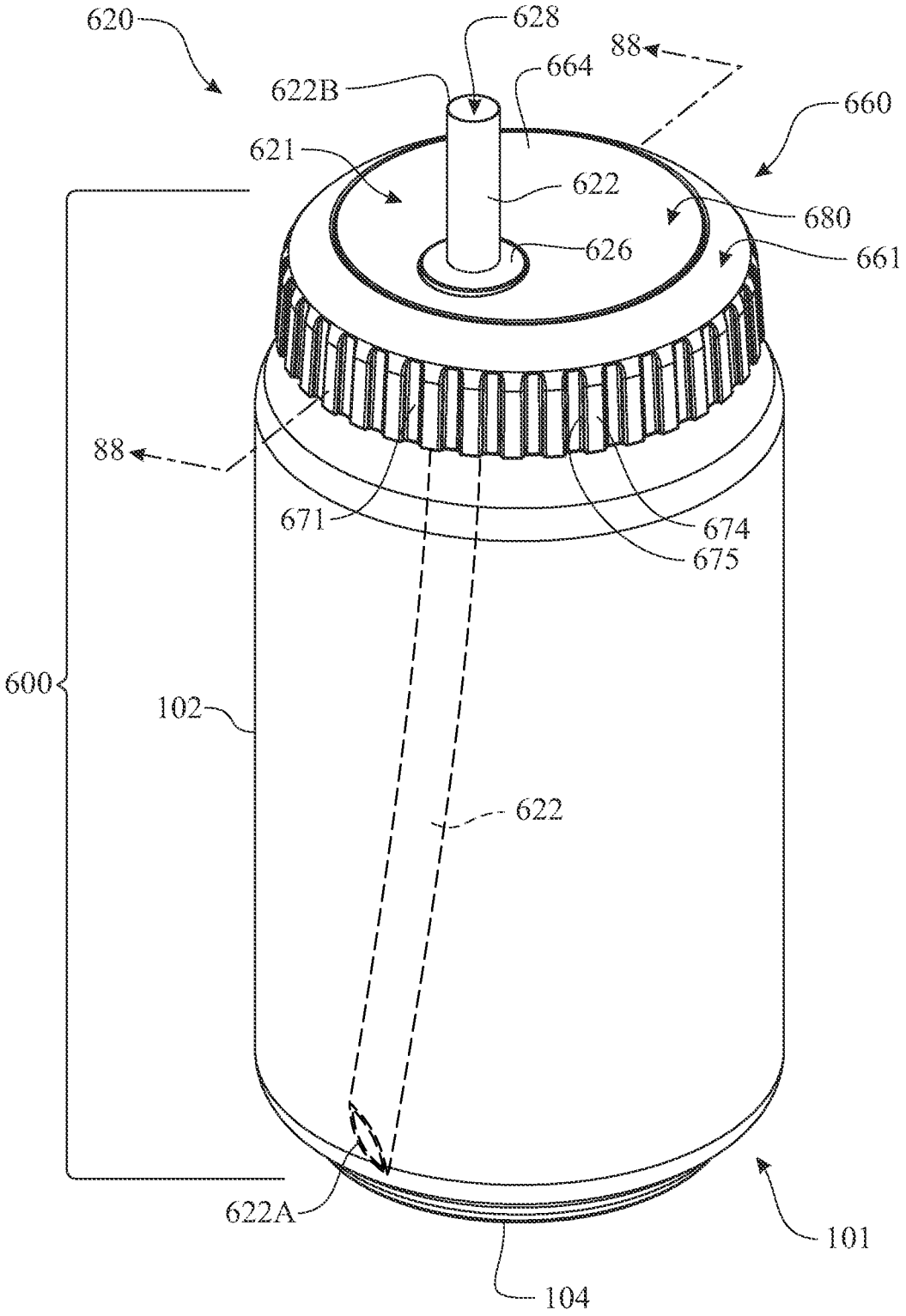
FIG. 87 presents a top isometric view of a first exemplary accessory which can be substituted for a container lid, the accessory being a cap and drinking straw assembly, the cap including a fixed inner cap liner and a rotatable outer cap component for securing the cap assembly to the container lid.
Figure 88:
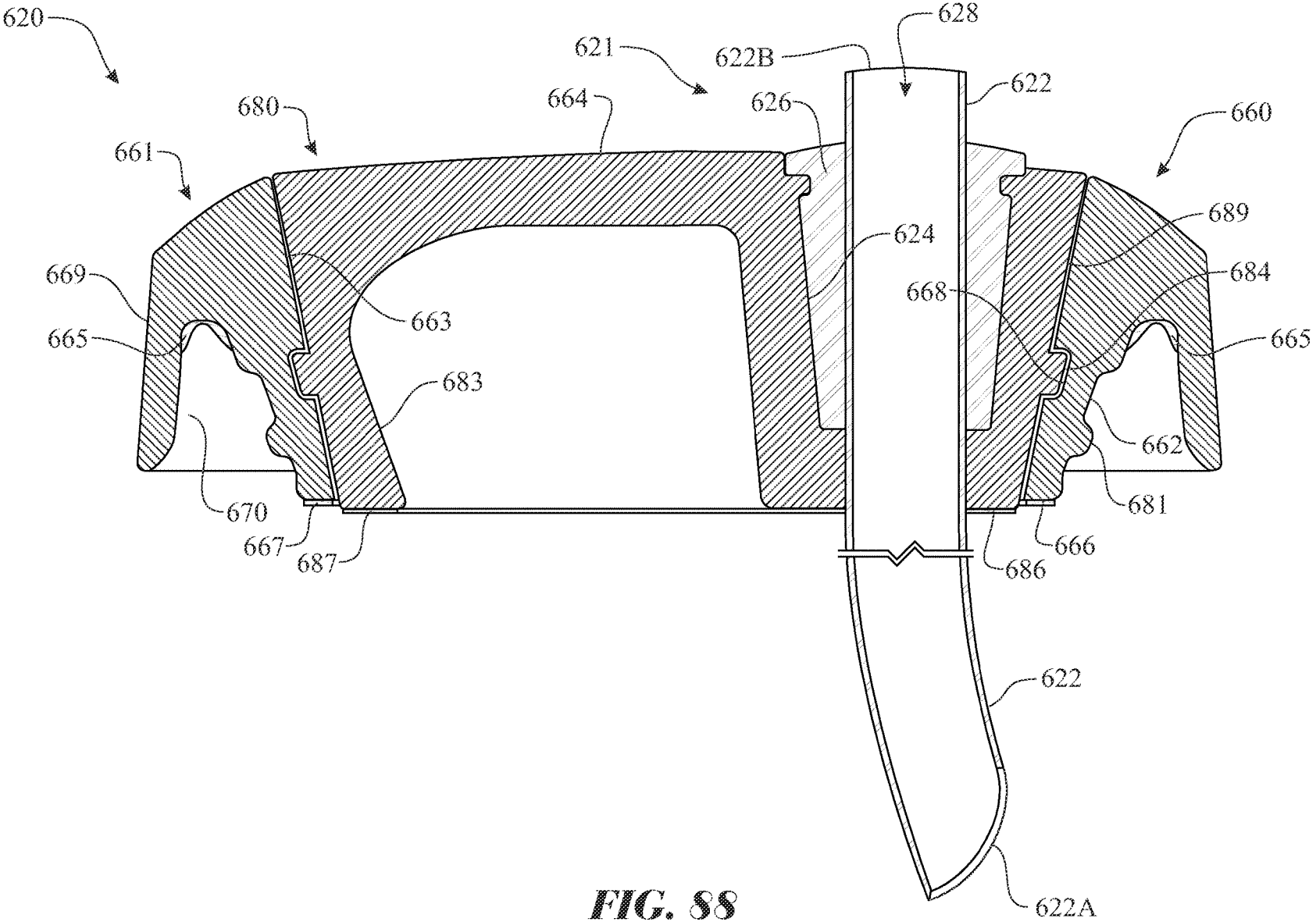
FIG. 88 presents a section elevation view of the cap and drinking straw assembly as shown in FIG. 87.
Figure 89:
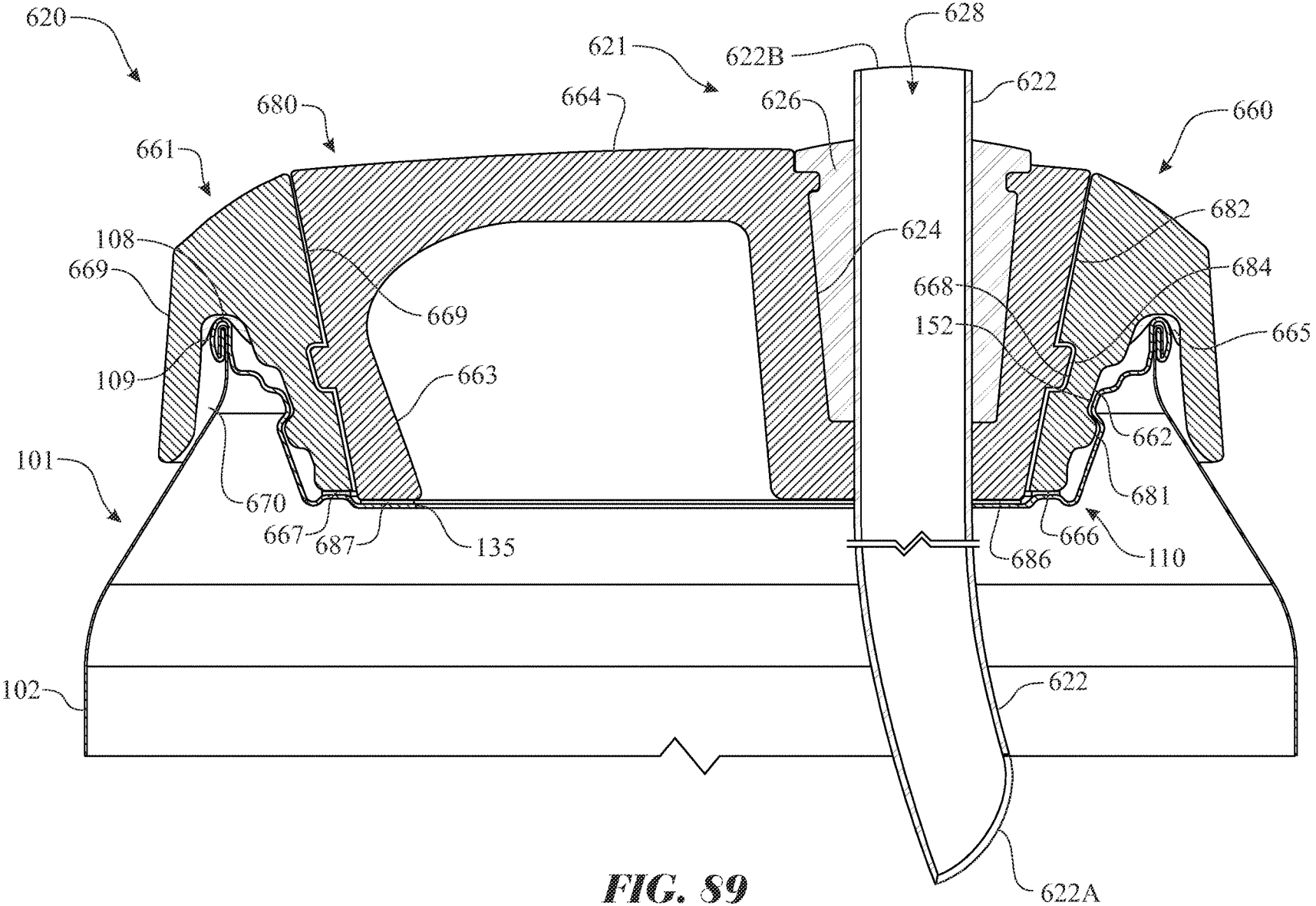
FIG. 89 presents a section elevation view of the cap and drinking straw assembly as shown in FIG. 87, the exemplary cap and drinking straw assembly being shown secured to the container assembly.

A first exemplary specialized cap is a drinking straw accessory 620, detailed in FIGS. 87 through 89. A container assembly 600 refers to an assembly of the drinking straw accessory 620 and the container subassembly comprising the resealable container lid 110 joined to the resealable container body 101. The exemplary drinking straw accessory 620 introduces a drinking straw accessory cap assembly 660, wherein the exemplary drinking straw accessory cap assembly 660 resembles a Mason jar cap assembly design. The Mason jar cap assembly design is illustrated throughout the various accessories described herein. Although the illustrated examples teach a Mason jar cap assembly design, it is understood that any suitable cap design comprising features for engaging with and preferably sealing to the resealable container cap 160. For example, the Mason jar cap assembly design can be replaced with a single component member.

The assembly design of the drinking straw accessory cap assembly 660 employs two elements, a accessory cap inner member 680, which remains in a fixed rotational position, and a accessory cap outer member 661, which rotates, assembling the drinking straw accessory 620 to a respective container lid, such as the resealable container lid 110 or any other suitable container lid. In the exemplary illustration, the resealable container lid 110 is modified to include a lid full bottom panel score line 136, wherein the lid full bottom panel score line 136 is similar to the lid bottom panel score line 136, while the lid full bottom panel score line 136 opens a majority of the lid bottom wall 134. Although the examples presented in FIGS. 87 through 101 illustrate the accessory being secured to the resealable container lid 110 assembled to the resealable container body 101, the container can be a unitary component, wherein the lid translative motion guide feature are integrated into the container body tubular sidewall 102, such as taught in the nesting container body with integral cap receiving translative motion guide feature 301 introduced in FIG. 50.

In the exemplary embodiment, the accessory cap outer member 661 and the accessory cap inner member 680 are rotationally assembled to one another. An accessory cap inner member radially outward facing surface 689 circumscribes a radially outer surface of the accessory cap inner member 680. An accessory cap inner member interior surface 683 is preferably formed on an interior of the accessory cap inner member 680. The removed material defining the accessory cap inner member interior surface 683 reduces material consumption, reduces weight, and improves a rotational motion between the accessory cap outer member 661 and the accessory cap inner member 680. The accessory cap inner member radially outward facing surface 689 can be a frustum shape (as illustrated), an inverted frustum shape (which aids in retaining the accessory cap inner member 680 within the accessory cap outer member 661 when assembled to the resealable container body 101, cylindrical in shape, or of any shape enabling rotation between the accessory cap outer member 661 and the accessory cap inner member 680. An accessory cap outer member radially inward facing surface 663 circumscribes a radially inner surface of the accessory cap outer member 661. The accessory cap outer member radially inward facing surface 663 and the accessory cap inner member radially outward facing surface 689 are designed to rotationally engage with one another.

An accessory cap outer member translative motion guide feature 668 can be formed within the accessory cap outer member radially inward facing surface 663 of the accessory cap outer member 661. An accessory cap inner member translative motion guide feature 684 can be formed in the accessory cap inner member radially outward facing surface 689 of the accessory cap inner member 680. Engagement between the accessory cap outer member translative motion guide feature 668 and the accessory cap inner member translative motion guide feature 684 retain the accessory cap outer member 661 and the accessory cap inner member 680 as a single assembly or the drinking straw accessory cap assembly 660. In the exemplary drinking straw accessory cap assembly 660, the accessory cap outer member translative motion guide feature 668 and the accessory cap inner member translative motion guide feature 684 are formed to translate a rotational motion into an axial motion. In an alternative arrangement, the accessory cap outer member translative motion guide feature 668 and the accessory cap inner member translative motion guide feature 684 can be formed to simply retain an axial registration between the accessory cap outer member 661 and the accessory cap inner member 680. The accessory cap outer member 661 can be at least partially fabricated of a pliant material enabling insertion of the accessory cap inner member 680 into the accessory cap outer member 661.

The drinking straw accessory cap assembly 660 is designed to rotationally engage with the resealable container lid 110. An accessory container receiving annular channel 670 extends upward from a lower edge of the accessory cap outer member 661 forming an annular recess. An accessory cap outer member container socket facing surface 662 is defined on a radially interior side of the accessory container receiving annular channel 670. At least one accessory cap outer member container engaging translative motion guide feature 681 is formed on the accessory cap outer member container socket facing surface 662. The formation of the accessory cap outer member container engaging translative motion guide feature 681 would be similar to the cap translative motion guide feature 181 of the resealable container cap 160 or any other suitable translative motion guide feature designed to engage with the lid translative motion guide feature 152 of the resealable container lid 110, wherein when the accessory cap outer member 661 is rotated about the resealable container lid 110, the rotational motion translated into an axial motion of the drinking straw accessory cap assembly 660 respective to the resealable container lid 110. The interface between the accessory cap outer member container engaging translative motion guide feature 681 and the cap receiving annular component translative motion guide feature 252 is illustrated in FIG. 89.

A peripheral surface 669 of the accessory cap outer member 661 can include a series of grip features formed about the accessory cap outer member radially peripheral surface 669. In the exemplary illustration, the exemplary series of grip features includes a series of accessory grip element bases 671; each accessory grip element base 671 defines a clockwise rotating accessory grip element force application surface 675 and a counterclockwise rotating accessory grip element force application surface 675 extending inward from an accessory grip element 674. During rotation, the user would grasp the grip features, wherein contact with the series of accessory grip element force application surfaces 675 provides a mechanical interface and contact with the accessory grip element 674 provides frictional interface. The mechanical interface requires less force than the frictional interface.

The exemplary drinking straw accessory cap assembly 660 is designed where the accessory cap outer member 661 can rotate and cause an axial motion while the accessory cap inner member 680 remains stationary. This can ensure a desired orientation of the accessory when the accessory assembly is assembled to the resealable container lid 110. Examples where this would be desired is a configuration where the resealable container body 101 includes a grip feature, where the container body tubular sidewall 102 is non-cylindrical, simply having a desire to align the accessory with a print or indicia applied to the container body tubular sidewall 102, or any of a number of difference scenarios. In an alternate arrangement, the drinking straw accessory cap assembly 660 can be a single component which provides different benefits compared to the illustrated two piece arrangement.

An accessory upper annular sealing member 665 can be seated within the accessory container receiving annular channel 670, wherein the accessory upper annular sealing member 665 provides a reliable seal between the accessory cap outer member 661 and the container body and lid assembly seam chine 108 of the resealable container lid 110. The accessory upper annular sealing member 665 can be any suitable shape and material, including those previously described herein. As the accessory cap outer member 661 is rotated about the resealable container lid 110, the container body and lid assembly seam chine 108 would engage with the accessory upper annular sealing member 665, creating an acceptable seal to retain contents within the container assembly 600.

An accessory cap outer member lower annular seal 667 can be provided about a lower, sealing surface 666 of the accessory cap outer member 661. The translative motion would draw an accessory cap outer member lower annular surface 666 of the accessory cap outer member 661 towards a mating surface of the resealable container lid 110 providing a lower sealing interface.

The two piece arrangement of the drinking straw accessory cap assembly 660 provides an ability to include an accessory cap inner member lower annular seal 687 about a lower or bottom surface of the accessory cap inner member 680, such as an accessory cap inner member lower annular surface 686. The translative motion would draw the accessory cap inner member lower annular surface 686 of the accessory cap inner member 680 towards a mating surface of the resealable container lid 110 providing a second or alternative sealing interface.

The primary function of the drinking straw accessory 620 is to provide a supported drinking straw 622 for use with the container, while provide a seal around all other portions of the container. A drinking straw subassembly 621 is integrated into the drinking straw accessory cap assembly 660 creating the drinking straw accessory 620. The drinking straw 622 is fabricated having a tubular shape extending between a drinking straw tapered fluid source end 622A and a drinking straw fluid delivery end 622B. The drinking straw 622 can be any known design, including a straight configuration, a formed configuration, include one or more bending features, and the like. It would be preferred that the drinking straw 622 is of a length enabling the drinking straw tapered fluid source end 622A to be positioned proximate the container closed bottom wall 104 of the resealable container 100. The drinking straw 622 can be formed having a circular cross section shape or any other suitable cross section shape. The drinking straw 622 can be fabricated of any suitable material, including plastic, paper, bamboo, metal, and the like. In the exemplary illustrations presented in FIGS. 87 through 89, the drinking straw 622 includes a drinking straw tapered fluid source end 622A and a drinking straw fluid delivery end 622B. The illustrated drinking straw 622 includes a drinking straw tapered fluid source end 622A formed having a tapered cut, wherein the tapered cut enables the drinking straw tapered fluid source end 622A to pierce a foil or any other seal provided on the container prior to use. Alternatively, the drinking straw tapered fluid source end 622A can be shaped having a transverse cut, similar to the drinking straw fluid delivery end 622B. A drinking straw 622 is inserted through a bore formed through a drinking straw sealing gasket 626.

The drinking straw 622 is inserted through a bore formed through a drinking straw sealing gasket 626. The drinking straw sealing gasket 626 is preferably fabricated of a pliant material, such as rubber, nylon, or any other material that would be suitable for insertion, retention, and sealing about the outer surface of the drinking straw 622.

A drinking straw sealing gasket inner member socket 624 extends downward from the accessory upper transversing surface 664. The drinking straw sealing gasket 626 is inserted into the drinking straw sealing gasket inner member socket 624. The drinking straw sealing gasket 626 would preferably be shaped and sized to substantially or completely seal the drinking straw sealing gasket inner member socket 624. This would avoid leakage of the contents of the container assembly 600 excluding any dispensing through the drinking straw fluid passageway 628 of the drinking straw 622. The drinking straw subassembly 621 collectively includes the drinking straw 622 assembled to the drinking straw sealing gasket 626.

Figure 90:
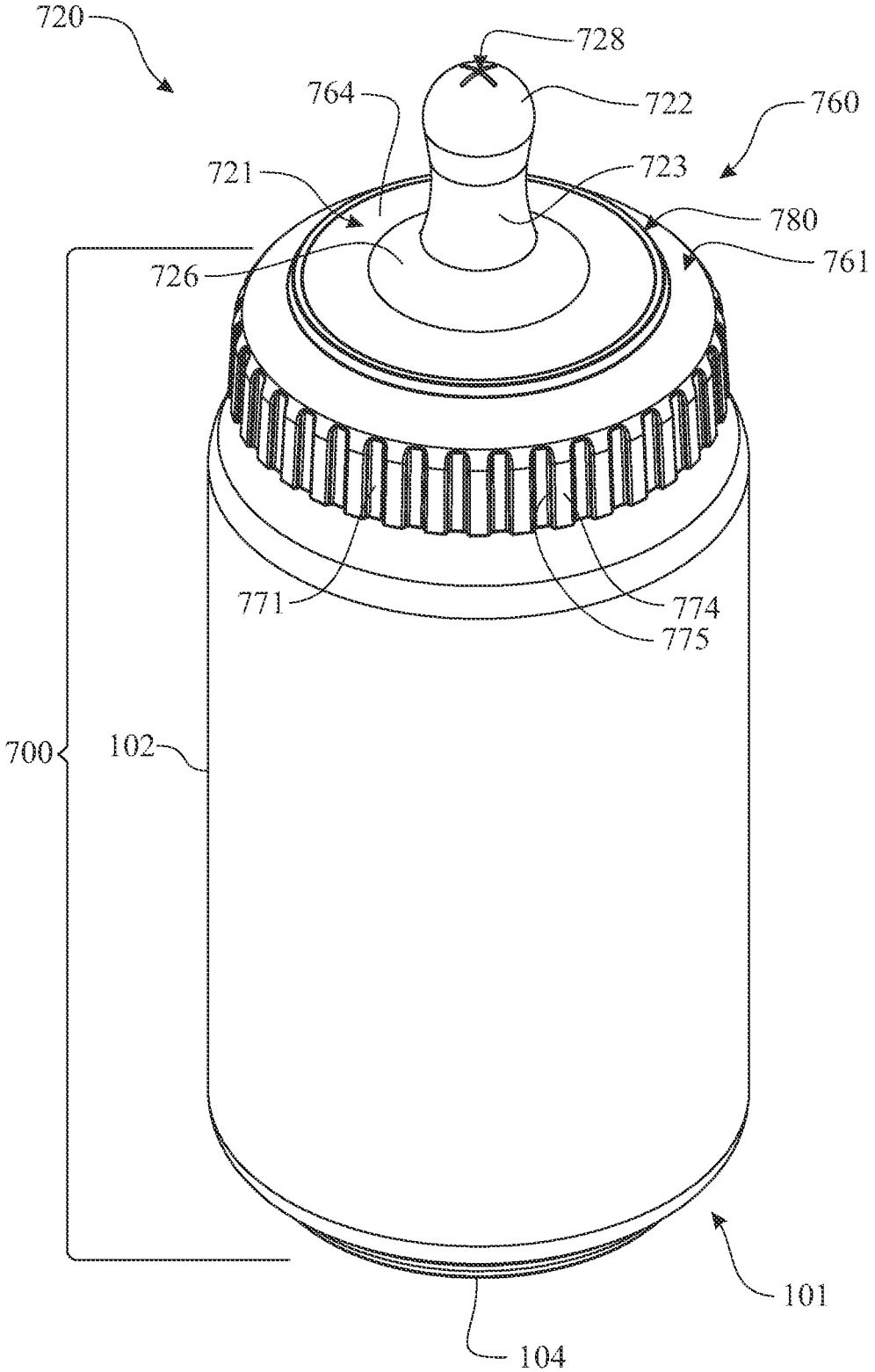
FIG. 90 presents a top isometric view of a second exemplary accessory for use as a container lid, the second exemplary accessory including a baby nipple.

A second exemplary specialized cap is a baby bottle nipple socket accessory 720, detailed in FIG. 90. A container assembly 700 refers to an assembly of the baby bottle nipple accessory 720 and the container subassembly comprising the resealable container lid 110 joined to the resealable container body 101. The baby bottle nipple accessory 720 includes a cap design that are similar to those of the drinking straw accessory 620. Like features of the baby bottle nipple accessory 720 and the drinking straw accessory 620 are numbered the same except preceded by the numeral '7'. A baby bottle nipple cap subassembly 760 of the baby bottle nipple accessory 720 can be configured to include a Mason jar style cap assembly similar to the drinking straw accessory cap assembly 660 of the drinking straw accessory 620 as shown or a unitary cap design. The accessory includes a baby bottle style nipple comprising a nipple formation 722 provided at a free, distal end of a nipple tubular projection 723. A nipple fluid dispensing aperture 728 is cut through the distal end of the nipple formation 722. The nipple portion 772, 773 of the accessory includes a nipple radial flange 726. The nipple formation 722, the nipple tubular projection 723, and the nipple radial flange 726 are preferably fabricated of a unitary construction and material. The nipple radial flange 726 can be integral with an accessory upper transversing surface 764 of an accessory cap inner member 780 or provided as an assembly of separate components. The baby bottle nipple feature 722, 723 of the baby bottle nipple accessory 720 is preferably fabricated of a latex, silicone, or any other suitable material. The baby bottle nipple feature 722, 723, 726 can be overmolded onto the accessory upper transversing surface 764 flange of the socket mating baby bottle nipple rotational attachment element 760, adhesively joined with the flange of the socket mating baby bottle nipple rotational attachment element 760, or by any other suitable joining process. The baby bottle nipple subassembly 721 collectively includes the nipple formation 722 atop a distal end of the nipple tubular projection 723 and the nipple radial flange 726, all preferably integrally fabricated as a unitary element.

Figure 91:
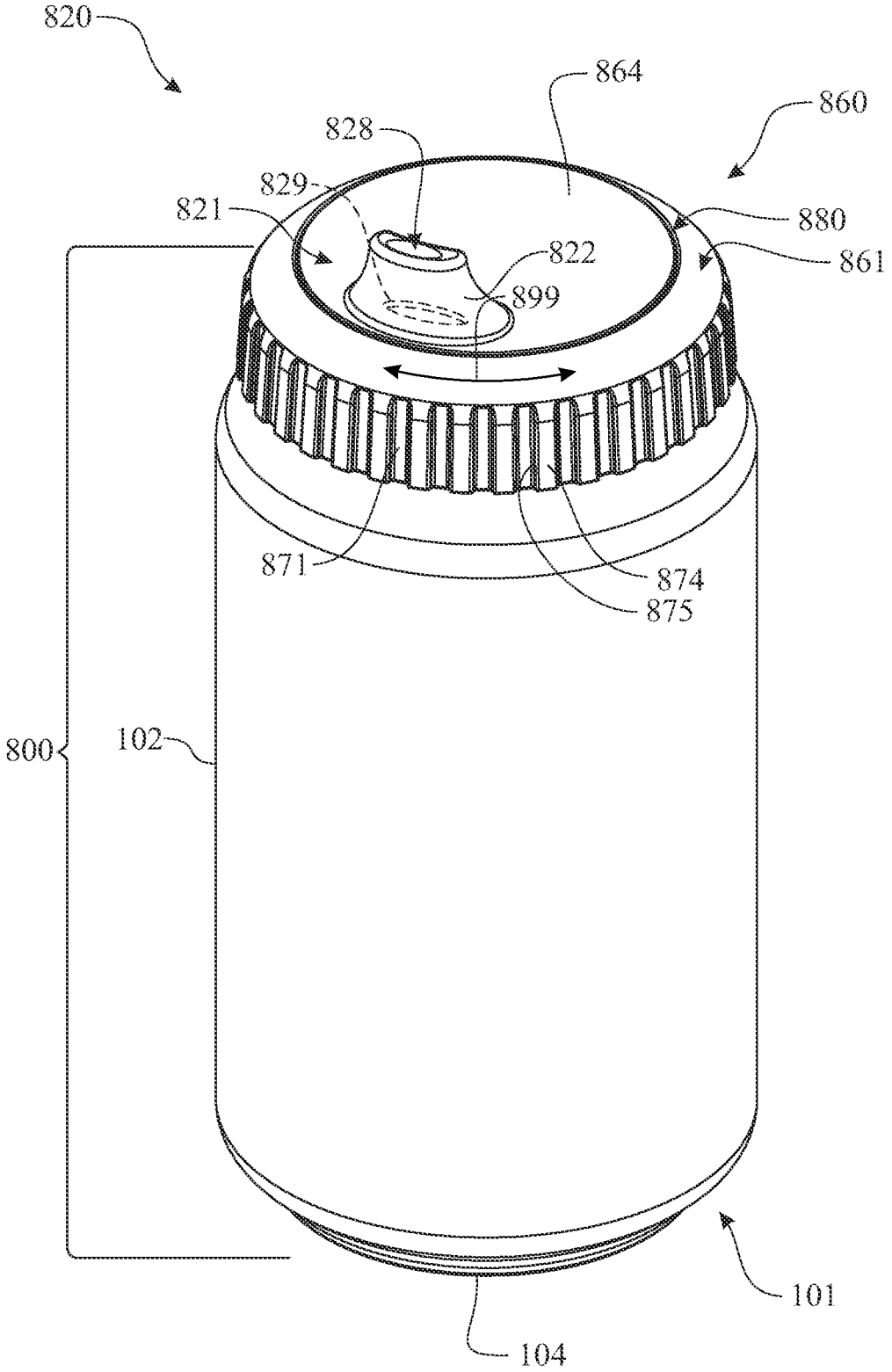
FIG. 91 presents a top isometric view of a third exemplary accessory for use as a container lid, the accessory including a spill-proof children's cap.
Figure 92:
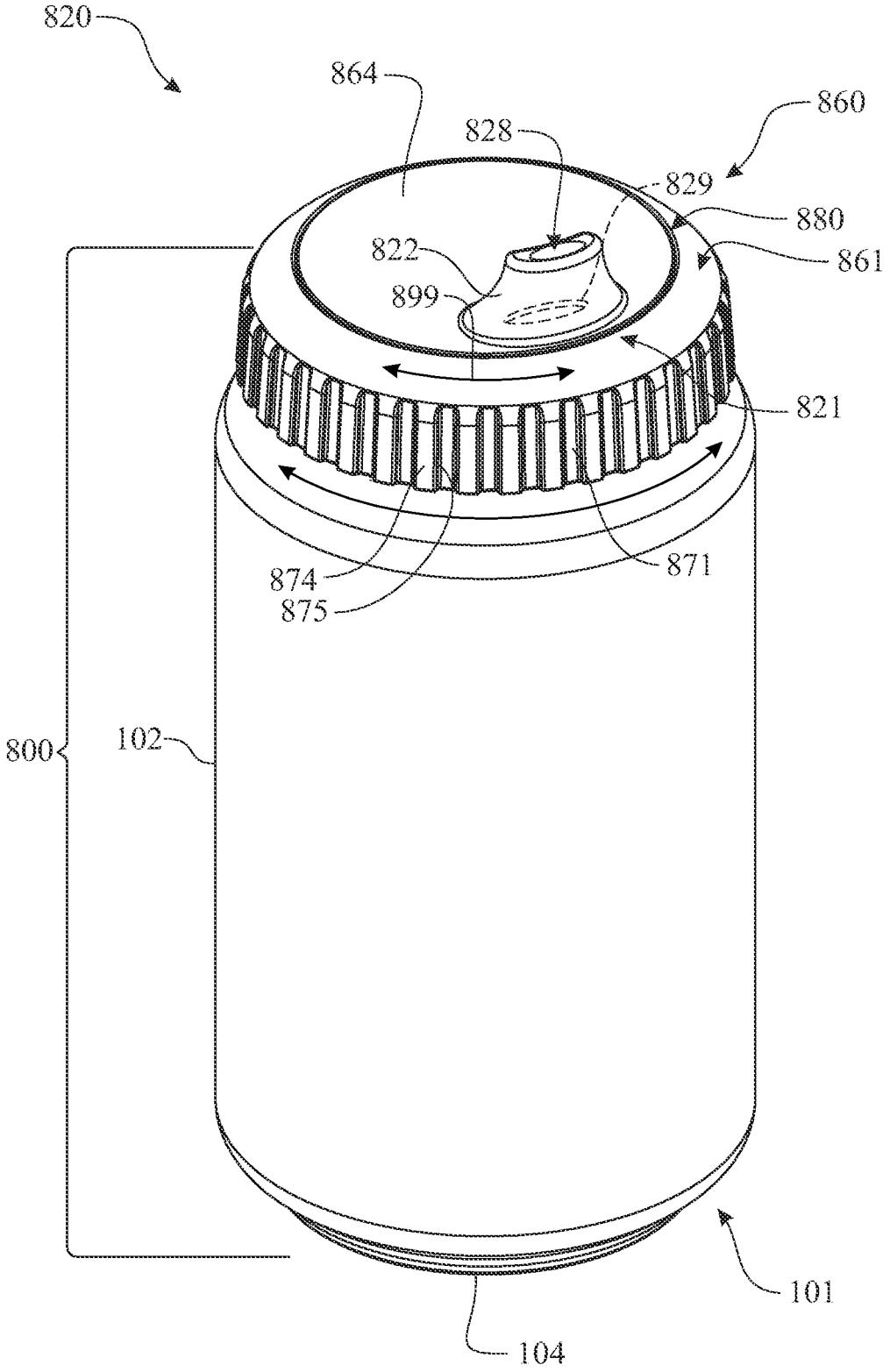
FIG. 92 presents a top isometric view of a third exemplary accessory for use as a container lid, the accessory including a spill-proof children's cap introducing a rotational closure system.

A third exemplary specialized cap is an axial rotation valve dispensing accessory 820, illustrated in FIGS. 91 and 92. A container assembly 800 refers to an assembly of the axial rotation valve dispensing accessory 820 and the container subassembly comprising the resealable container lid 110 joined to the resealable container body 101. The drinking straw accessory 620 and the axial rotation valve dispensing accessory 820 have a number of like features. Like features of the baby bottle nipple accessory 620 and the axial rotation valve dispensing accessory 820 are numbered the same except preceded by the numeral '8'. An axial rotation valve accessory cap assembly 860 of the axial rotation valve dispensing accessory 820 can be configured to include a Mason jar style cap assembly similar to the drinking straw accessory cap assembly 660 as shown or a unitary cap design. The axial rotation valve dispensing portion of the axial rotation valve dispensing accessory 820 includes an accessory transversing upper surface 864 rotationally assembled to the axial rotation valve accessory cap assembly 860. The accessory transversing upper surface 864 can be integral with the accessory cap inner member 880 or rotationally independent of the accessory cap inner member 880. An axially rotating valve contents dispensing projection (spout) 822 extends outward from the accessory transversing upper surface 864. An axial rotation valve dispensing aperture 828 is provided at a dispensing end of the axially rotating valve contents dispensing projection (spout) 822. The axially rotating valve contents dispensing projection (spout) 822 can be shaped and include features resembling and associated with a common children's sippy cup (sipping cup). An axial rotation valve actuation aperture 829 is preferably provided through an outer layer of the accessory transversing upper surface 864. Rotation of the accessory transversing upper surface 864 in accordance with a first direction of an axial rotating valve motion 899 positions the axial rotation valve actuation aperture 829 in registration with a like aperture formed through a second, inner layer of the 864 when placed in an open position and rotation of the accessory transversing upper surface 864 in accordance with a second direction of the axial rotating valve motion 899 positions the axial rotation valve actuation aperture 829 in registration with a solid section of the second, inner layer of the 864 when placed in an closed position. Contents from within the container assembly 800 can be dispensed when the accessory transversing upper surface 864 is placed within the open position and contents are retained within the container assembly 800 when the accessory transversing upper surface 864 is placed within the closed position. Rotating valve elements in lids are known, where the valve provides access and containment of contends within the container. The valve portion described for opening and closing the axially rotating valve contents dispensing projection (spout) 822 is well known by those skilled in the art with the exclusion of introducing a spout formation and is therefore not detailed herein. The axially rotating valve dispenser subassembly 821 collectively includes the axially rotating valve contents dispensing projection (spout) 822 atop the upper portion of the accessory transversing upper surface 864 and a lower portion of the accessory transversing upper surface 864 collectively providing the valve and dispensing functions.

Figure 93:
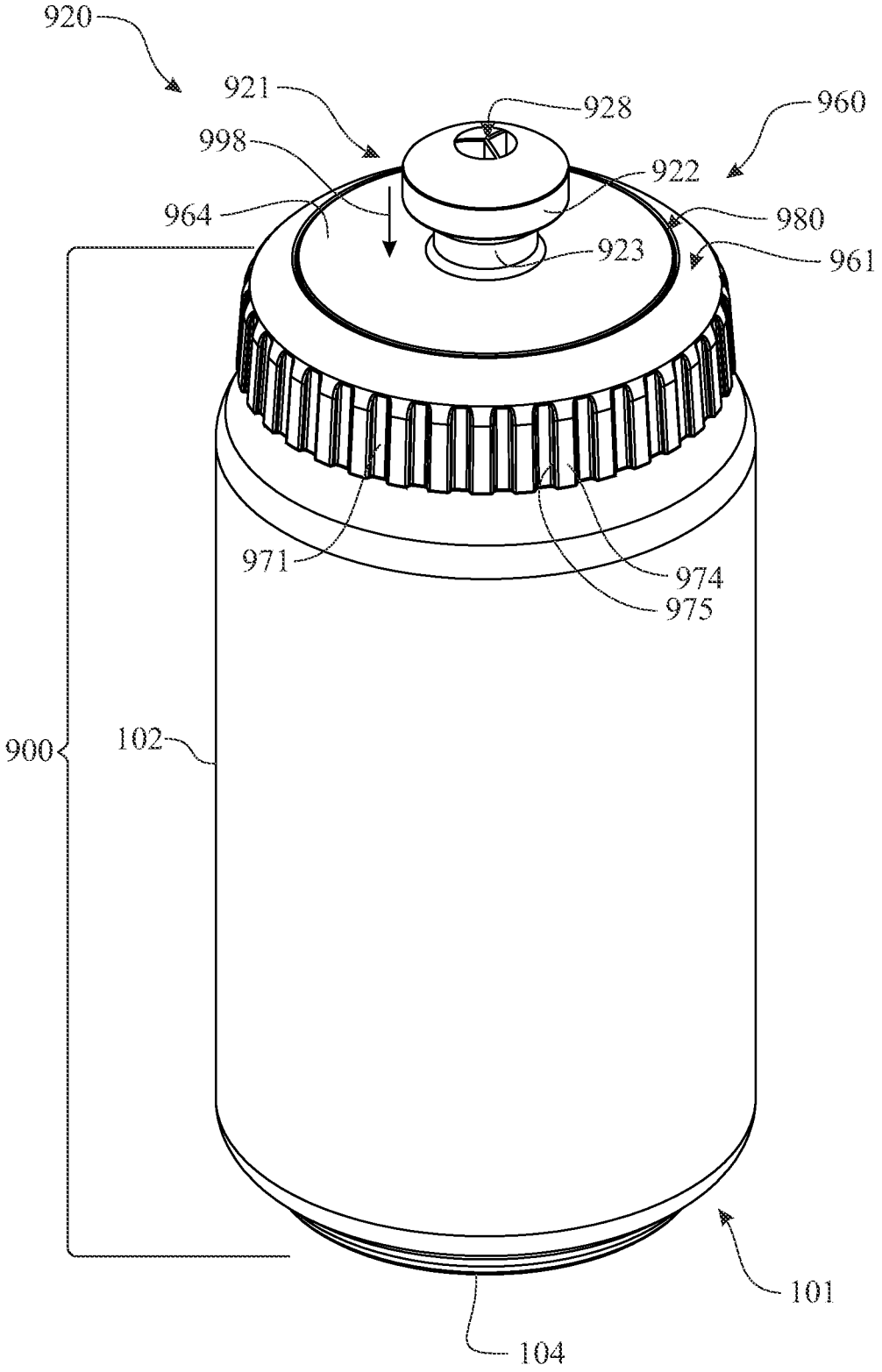
FIG. 93 presents a top isometric view of a fourth exemplary accessory for use as a container lid, the accessory including a resealable sports bottle dispensing mechanism, the resealable sports bottle dispensing mechanism being illustrated in a closed configuration.
Figure 94:
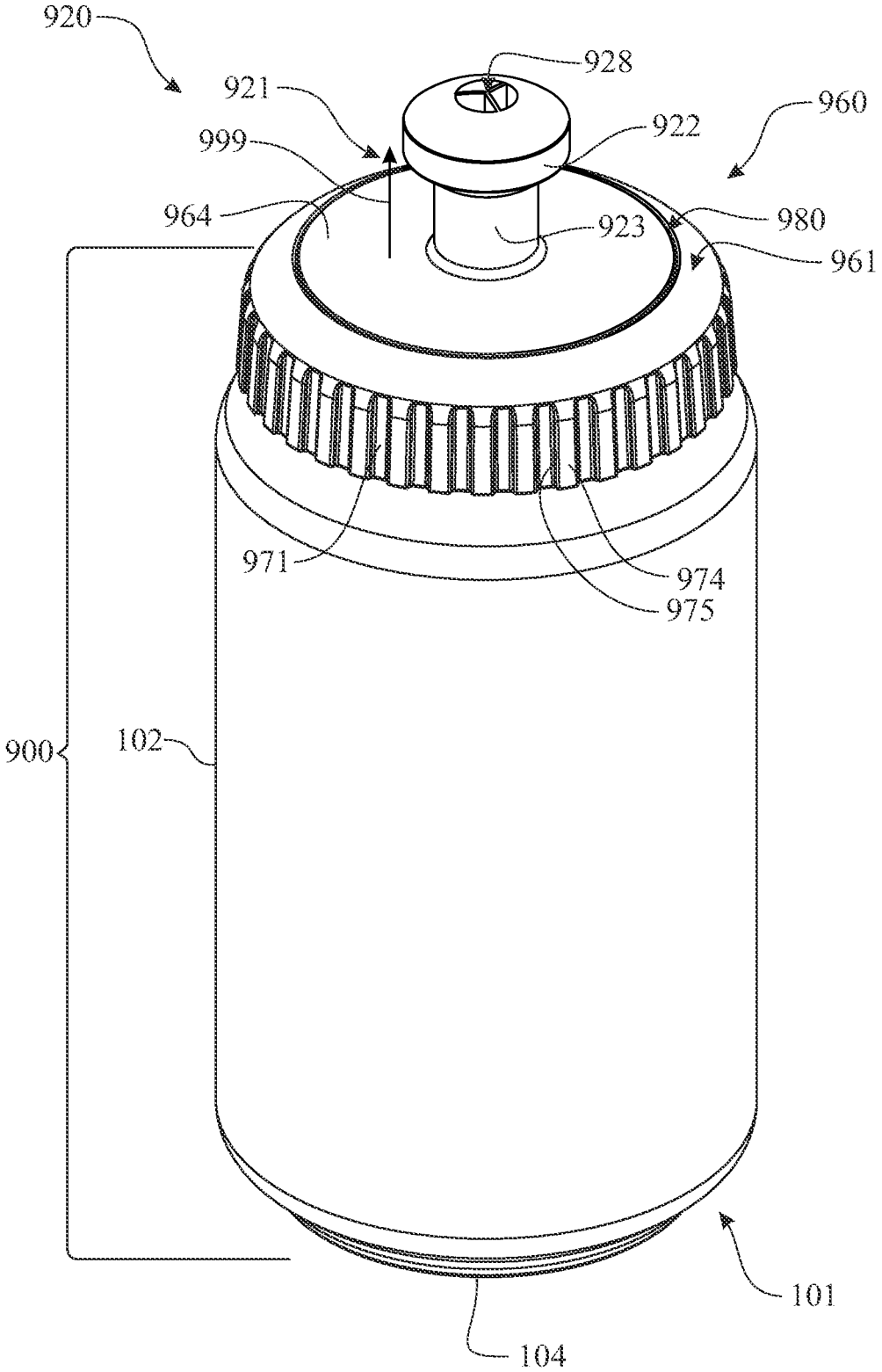
FIG. 94 presents a top isometric view of the fourth exemplary accessory as originally introduced in FIG. 93, the accessory including a resealable sports bottle dispensing mechanism, the resealable sports bottle dispensing mechanism being illustrated in an opened configuration.

A fourth exemplary specialized cap is a axial translation valve dispensing (sports bottle styled) accessory 920, detailed in FIGS. 93 and 94. A container assembly 900 refers to an assembly of the axial translation valve dispensing (sports bottle styled) accessory 920 and the container subassembly comprising the resealable container lid 110 joined to the resealable container body 101. The drinking straw accessory 620 and the axial translation valve dispensing (sports bottle styled) accessory 920 have a number of like features. Like features of the baby bottle nipple accessory 620 and the axial translation valve dispensing (sports bottle styled) accessory 920 are numbered the same except preceded by the numeral '9'. An axial translation valve accessory cap assembly 960 of the axial translation valve dispensing (sports bottle styled) accessory 920 can be configured to include a Mason jar style cap assembly similar to the drinking straw accessory cap assembly 660 drinking straw accessory cap assembly 660 as shown or a unitary cap design. The axial translation valve dispensing (sports bottle styled) accessory 920 includes an axial translation dispensing valve end piece 922 axially moveably along an axial translation valve actuator projecting base 923. An axial translation valve dispensing aperture 928 extends through the axial translation dispensing valve end piece 922. The axial translation dispensing valve end piece 922 includes features providing a function of a valve to enable and restrict dispensing of contents from within the resealable container body 101 based upon an axial position of the axial translation dispensing valve end piece 922 on the axial translation valve actuator projecting base 923. The design of the valve elements and associated process for opening and closing the axial translation dispensing valve end piece 922 is well known by those skilled in the art and is therefore not detailed herein. When the axial translation dispensing valve end piece 922 is in a retracted position (pressed downward in accordance with an axial closing motion 998) as illustrated in FIG. 93, the axial translation dispensing valve end piece 922 seals the container assembly 900. When the axial translation dispensing valve end piece 922 is in an extended position (pulled upward in accordance with an axial opening motion 999) as illustrated in FIG. 94, the position enabled dispensing of contents from within the resealable container body 101. The axially translating valve dispenser subassembly 921 includes the axial translation dispensing valve end piece 922 axially translative respective to the axial translation valve actuator projecting base 923 collectively providing the valve and dispensing functions.

Figure 95:
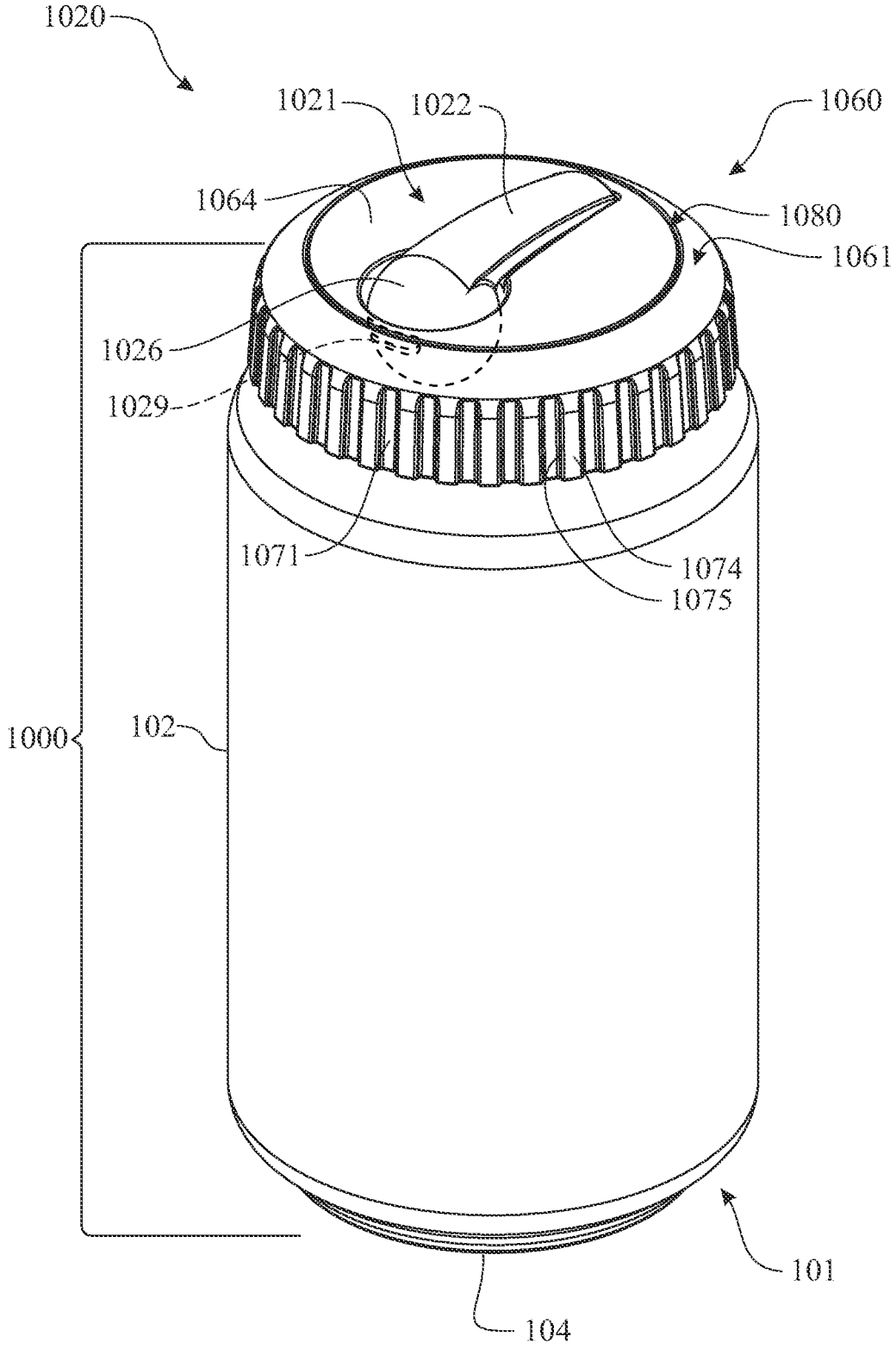
FIG. 95 presents a top isometric view of a fifth exemplary accessory for use as a container lid, the accessory including a pivoting resealable fluid dispensing spout, the pivoting resealable fluid dispensing spout being shown in a closed configuration.
Figure 96:
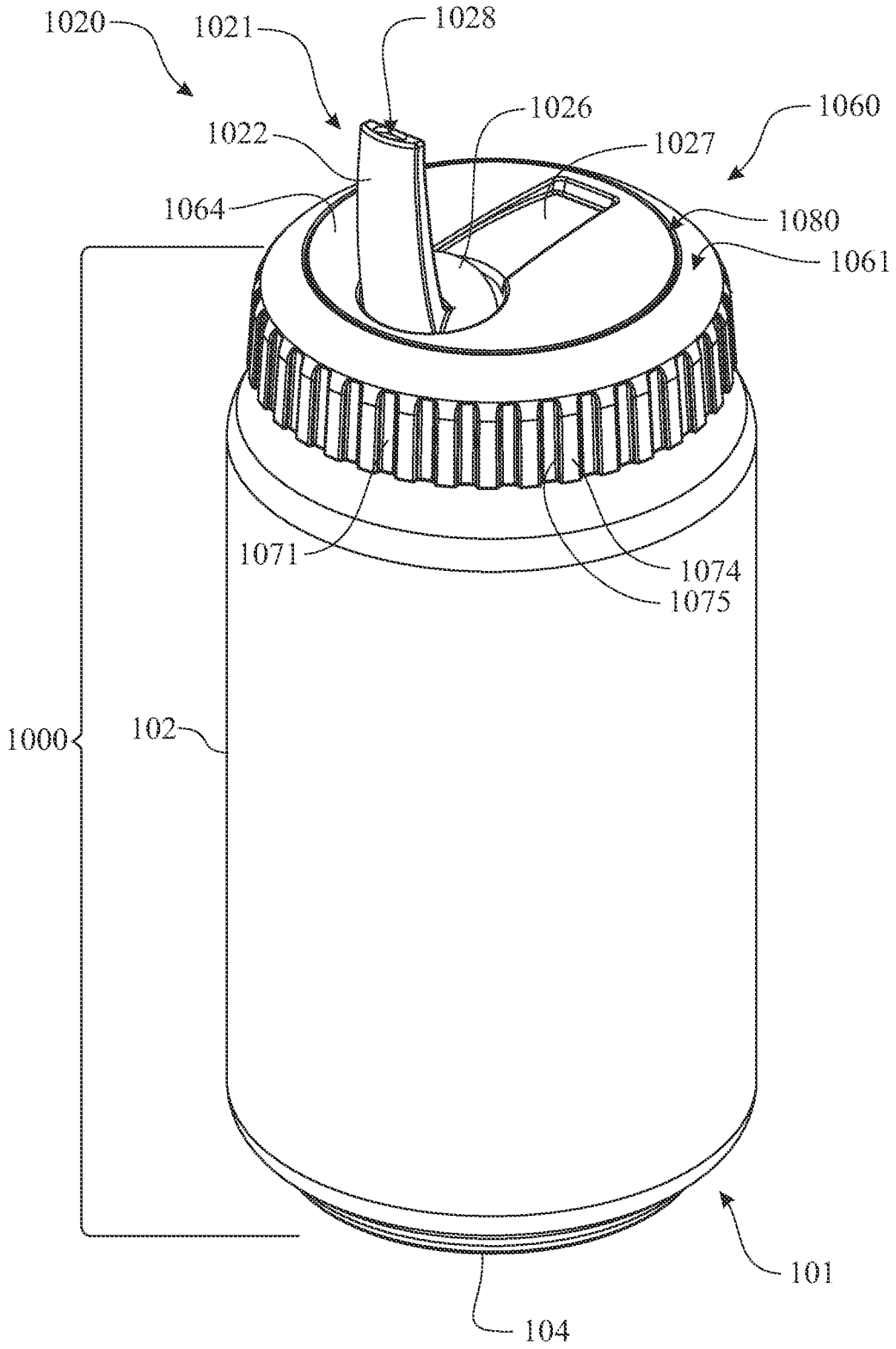
FIG. 96 presents a top isometric view of the pivoting resealable fluid dispensing spout originally introduced in FIG. 95, the pivoting resealable fluid dispensing spout being shown in an open configuration.

A fifth exemplary specialized cap is a pivoting valve dispensing accessory 1020, detailed in FIGS. 95 and 96. A container assembly 1000 refers to an assembly of the pivoting valve dispensing accessory 1020 and the container subassembly comprising the resealable container lid 110 joined to the resealable container body 101. The drinking straw accessory 620 and the pivoting valve dispensing accessory 1020 have a number of like features. Like features of the baby bottle nipple accessory 620 and the pivoting valve dispensing accessory 1020 are numbered the same except preceded by the numeral '10'. A radial rotation valve accessory cap assembly 1060 of the pivoting valve dispensing accessory 1020 can be configured to include a Mason jar style cap assembly similar to the drinking straw accessory cap assembly 660 drinking straw accessory cap assembly 660 as shown or a unitary cap design. The pivoting valve dispensing accessory 1020 includes a pivoting valve contents dispensing projection (spout) 1022 extending radially from a projecting member pivoting valve base 1026. The projecting member pivoting valve base 1026 includes features providing a function of a valve to enable and restrict dispensing of contents from within the resealable container body 101 based upon a pivotal position of a combination of the pivoting valve contents dispensing projection (spout) 1022 and the projecting member pivoting valve base 1026. The projecting member pivoting valve base 1026 pivots between a sealed position (FIG. 95) and a dispensing position (FIG. 96). The pivoting valve contents dispensing projection (spout) 1022 includes a dispensing conduit that extends between a radial rotation valve contents projection dispensing aperture 1028 and a projecting member pivoting base valve aperture 1029. The projecting member pivoting base valve aperture 1029 toggles between the sealed position (FIG. 95) and the dispensing position (FIG. 96) as the projecting member pivoting valve base 1026 is pivoted.

When the pivoting valve contents dispensing projection (spout) 1022 is rotated into the closed position, the projecting member pivoting base valve aperture 1029 is positioned against a solid area of the accessory cap inner member 1080, creating a seal. When the pivoting valve contents dispensing projection (spout) 1022 is rotated into the open position, the projecting member pivoting base valve aperture 1029 aligns with a passageway formed in the accessory cap inner member 1080 enabling dispensing of the contents from within the container 1000. The user can employ the pivoting valve contents dispensing projection (spout) 1022 as a lever to aid in pivoting the projecting member pivoting valve base 1026 between the sealed position (FIG. 95) and the dispensing position (FIG. 96). A radial rotation valve projecting member accepting recess 1027 can be formed within the accessory transversing upper surface 1064, wherein the pivoting valve contents dispensing projection (spout) 1022 would seat within the radial rotation valve projecting member accepting recess 1027, as shown in FIG. 95, when the pivoting valve contents dispensing projection (spout) 1022 is placed within the closed position. Pivoting valve elements in lids are known, where the valve provides access and containment of contends within the container. The pivoting valve portion described for opening and closing the pivoting valve dispensing accessory 1020 is well known by those skilled in the art and is therefore not detailed herein. The pivoting valve dispenser subassembly 1021 includes the pivoting valve contents dispensing projection (spout) 1022 and the projecting member pivoting valve base 1026 pivotally translative respective to the accessory cap inner member 1080 collectively providing the valve and dispensing functions.

Figure 97:
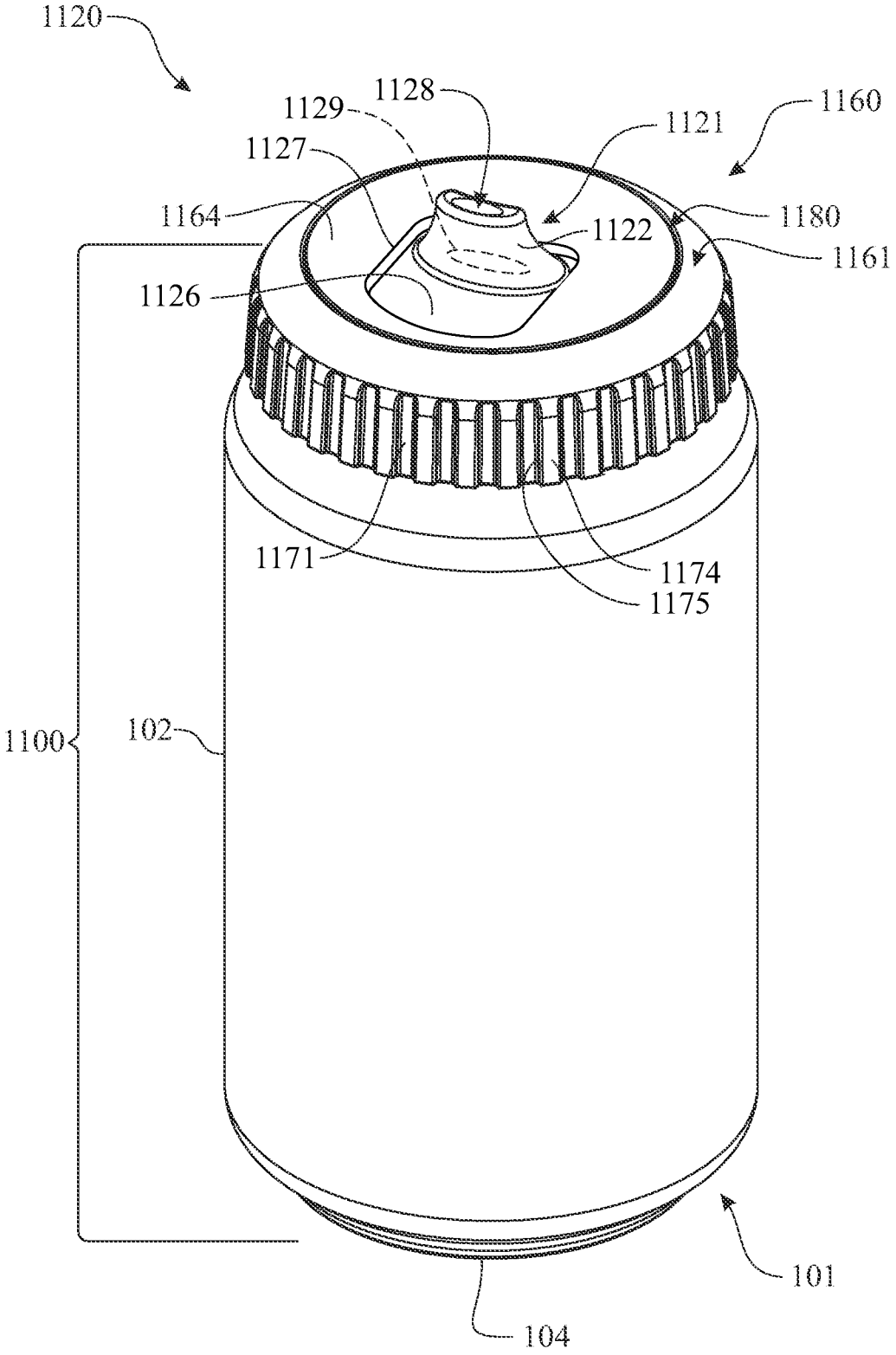
FIG. 97 presents a top isometric view of a sixth exemplary accessory for use as a container lid, the accessory including a sliding dispensing spout, the illustration presenting the sliding dispensing spout being illustrated in a closed position.
Figure 98:
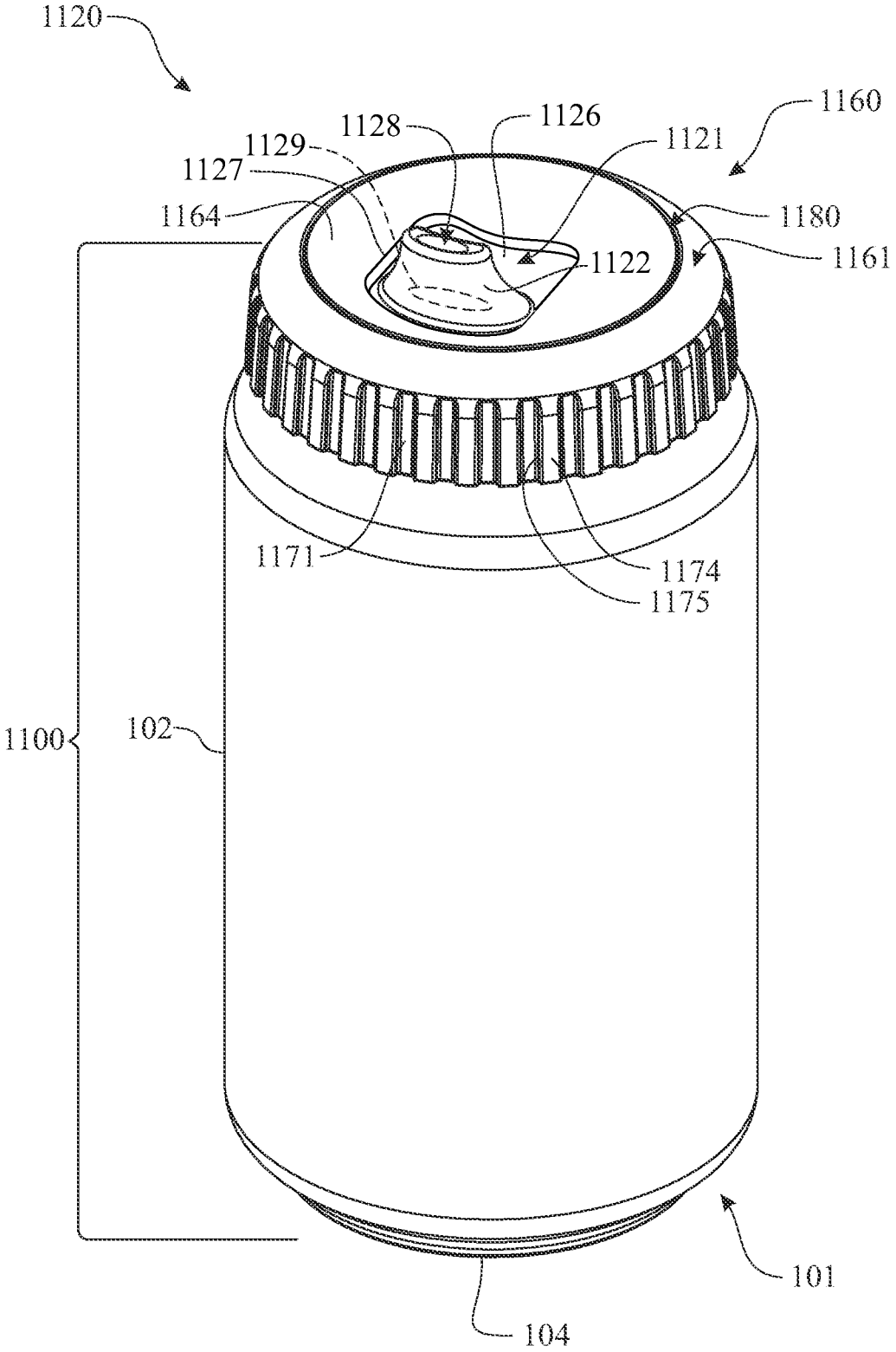
FIG. 98 presents a top isometric view of the sixth exemplary accessory originally introduced in FIG. 97, the illustration presenting the sliding dispensing spout being illustrated in an opened position.

A sixth exemplary specialized cap is a radial translation valve dispensing accessory 1120, detailed in FIGS. 97 and 98. A container assembly 1100 refers to an assembly of the radial translation valve dispensing accessory 1120 and the container subassembly comprising the resealable container lid 110 joined to the resealable container body 101. The drinking straw accessory 620 and the radial translation valve dispensing accessory 1120 have a number of like features. Like features of the baby bottle nipple accessory 620 and the radial translation valve dispensing accessory 1120 are numbered the same except preceded by the numeral '11'. A resealable container cap 160 of the radial translation valve dispensing accessory 1120 can be configured to include a Mason jar style cap assembly similar to the drinking straw accessory cap assembly 660 drinking straw accessory cap assembly 660 as shown or a unitary cap design. A radial translation valve contents dispensing projection (spout) 1122 extends upward from a radial translation valve projecting member sliding base 1126. The radial translation valve projecting member sliding base 1126 is slideably assembled within a radial translation valve projecting member channel 1127 of the accessory cap inner member 1180. A dispensing conduit extends between a radial translation valve dispensing aperture 1128 and a projecting member base valve aperture 1129 through the radial translation valve contents dispensing projection (spout) 1122. The projecting member base valve aperture 1129 in combination with the radial translation valve projecting member sliding base 1126 act as a valve for the radial translation valve dispensing accessory 1120. When the radial translation valve contents dispensing projection (spout) 1122 is slid into a closed position (FIG. 97), the projecting member base valve aperture 1129 is in registration with a solid portion of a lower element within the accessory cap inner member 1180, retaining contents within the container assembly 1100. When the radial translation valve contents dispensing projection (spout) 1122 is slid into an open position (FIG. 98), the projecting member base valve aperture 1129 is in registration with a dispensing aperture provided in the lower element of the accessory cap inner member 1180, enabling dispensing of contents from within the container assembly 1100. Sliding valve elements in lids are known, where the sliding valve provides access and containment of contends within the container. The sliding valve portion described for opening and closing the radial translation valve dispensing accessory 1120 is well known by those skilled in the art with the exclusion of introducing a spout formation and is therefore not detailed herein. The radially translating valve dispenser subassembly 1121 includes the radial translation valve contents dispensing projection (spout) 1122 extending upward from the radial translation valve projecting member sliding base 1126, wherein the radial translation valve contents dispensing projection (spout) 1122 and radial translation valve projecting member sliding base 1126 are radially translative collectively providing the valve and dispensing functions.

Figure 99:
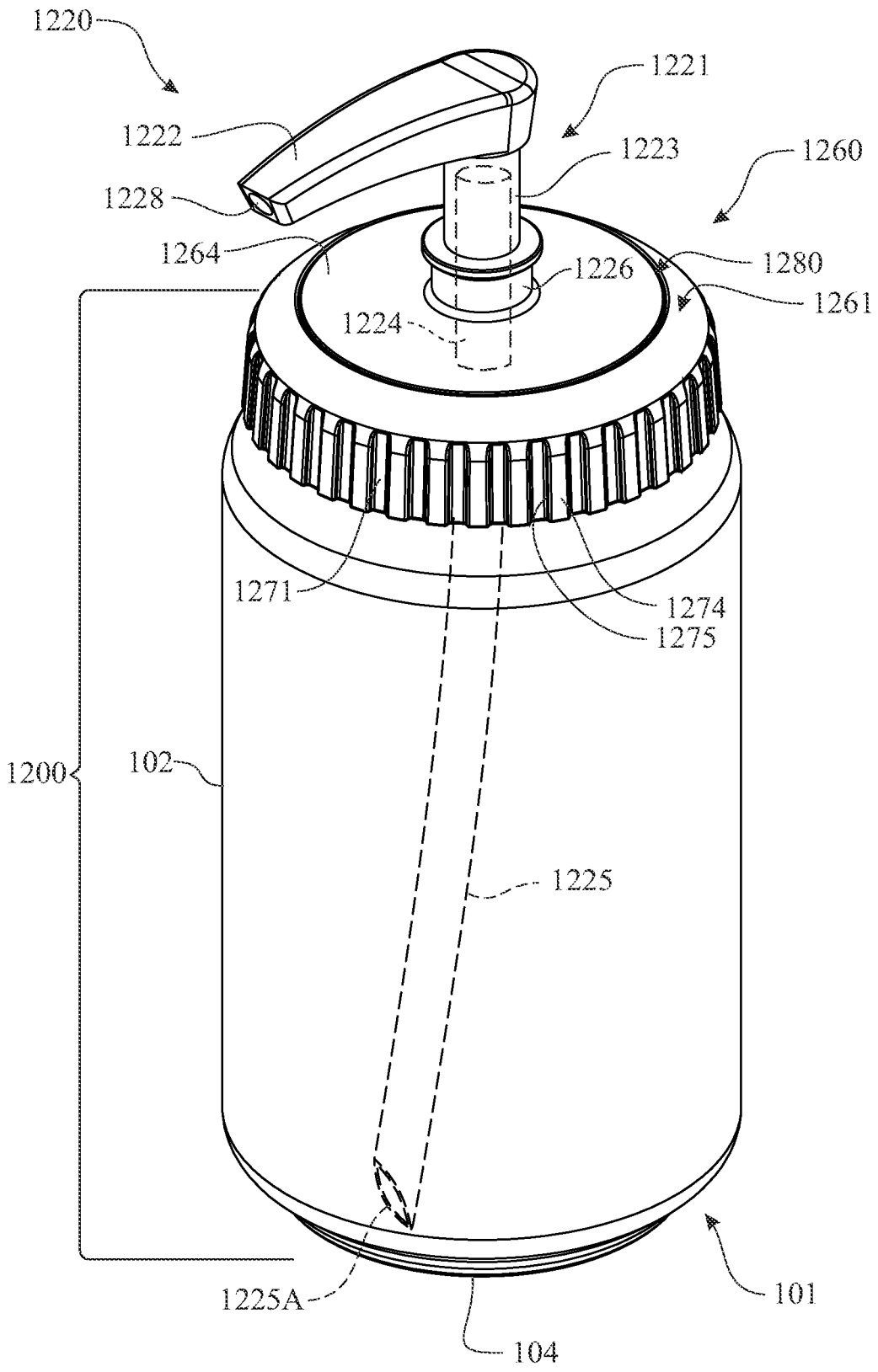
FIG. 99 presents a top isometric view of a seventh exemplary accessory for use as a container lid, the accessory including a pump dispensing assembly.

A seventh exemplary specialized cap is a pump dispenser accessory 1220, detailed in FIG. 99. A container assembly 1200 refers to an assembly of the pump dispenser accessory 1220 and the container subassembly comprising the resealable container lid 110 joined to the resealable container body 101. The drinking straw accessory 620 and the pump dispenser accessory 1220 have a number of like features. Like features of the baby bottle nipple accessory 620 and the pump dispenser accessory 1220 are numbered the same except preceded by the numeral '12'. A pump dispenser accessory cap assembly 1260 of the pump dispenser accessory 1220 can be configured to include a Mason jar style cap assembly similar to the drinking straw accessory cap assembly 660 drinking straw accessory cap assembly 660 as shown or a unitary cap design. The pump dispenser accessory 1220 includes elements to provide a pump dispenser. The exemplary pump dispenser includes a pump dispenser head 1222 extending radially outward form an upper end of a pump dispenser plunger 1223. The pump dispenser plunger 1223 slideably engages with a pump dispenser plunger base 1226. A downward force is applied to the pump dispenser head 1222, causing the pump dispenser plunger 1223 to plunging into the pump dispenser plunger base 1226, actuating a pump subassembly 1224. The pump subassembly 1224 draws contents from within the container assembly 1200 into a pump dispenser contents conduit contents sourcing end 1225A, through a pump dispenser contents supply conduit 1225, and dispenses the contents through a pump dispenser aperture 1228 of the pump dispenser head 1222. Compression pumps 1224 are commonly used for dispensing of soaps, shampoos, cleaning solutions, conditioners, hand sanitizers, moisturizing lotions, condiments, flavorings, syrups, and the like are well known by those skilled in the art and is therefore not detailed herein. The pump actuated dispenser subassembly 1221 includes the pump dispenser head 1222, the pump dispenser plunger 1223, the pump dispenser plunger base 1226, and the pump subassembly 1224 collectively providing the dispensing function.

Figure 100:
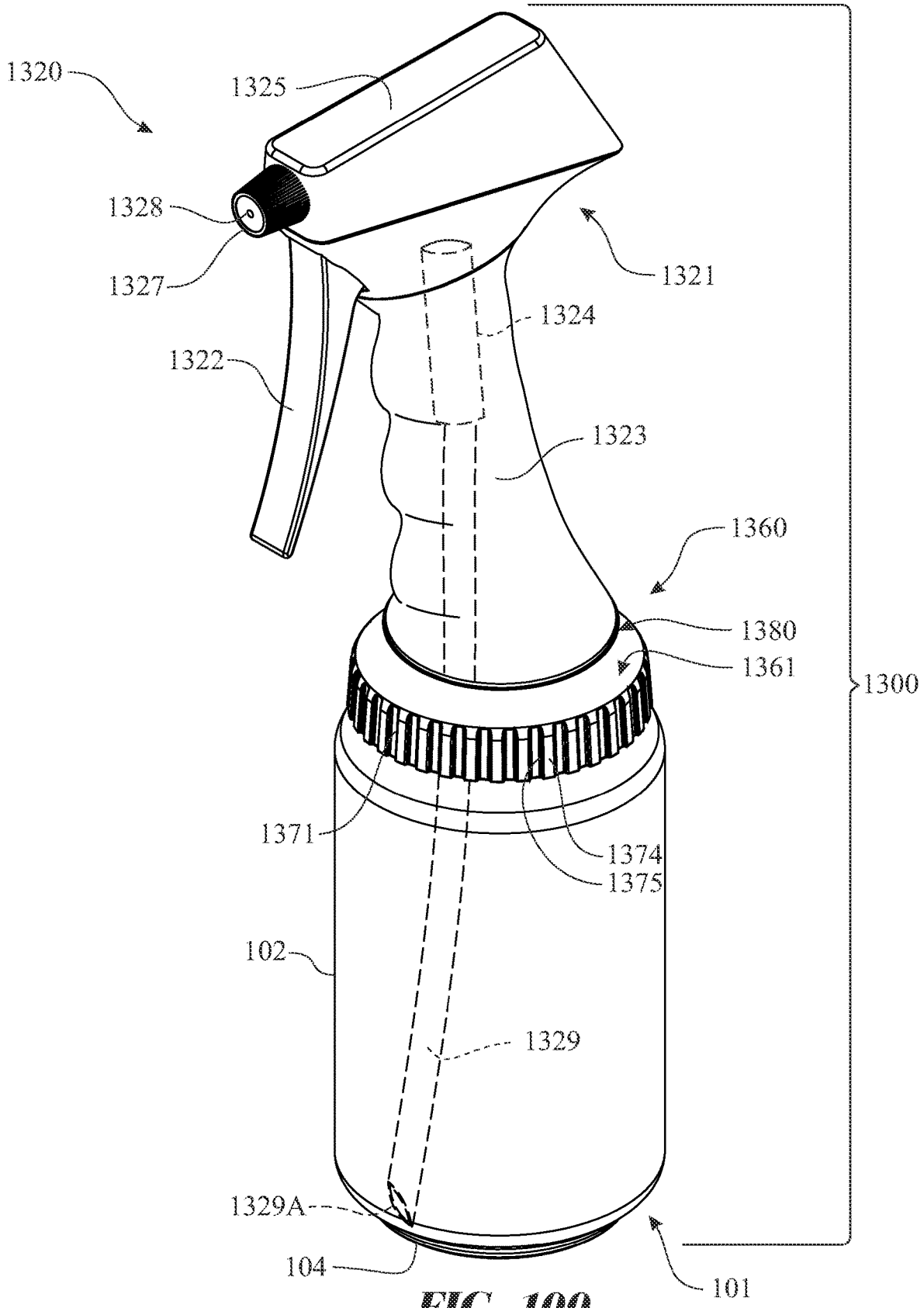
FIG. 100 presents a top isometric view of an eighth exemplary accessory for use as a container lid, the accessory including a trigger dispensing assembly, the arrangement employing a neck of the accessory as a portion of the grip for use in conjunction with the trigger.

An eighth exemplary specialized cap is a spray pump accessory 1320, detailed in FIG. 100. A container assembly 1300 refers to an assembly of the spray pump accessory 1320 and the container subassembly comprising the resealable container lid 110 joined to the resealable container body 101. The drinking straw accessory 620 and the spray pump accessory 1320 have a number of like features. Like features of the baby bottle nipple accessory 620 and the spray pump accessory 1320 are numbered the same except preceded by the numeral '13'. A spray pump accessory cap assembly 1360 of the spray pump accessory 1320 can be configured to include a Mason jar style cap assembly similar to the drinking straw accessory cap assembly 660 drinking straw accessory cap assembly 660 as shown or a unitary cap design. The spray pump accessory 1320 includes elements to provide a spray dispenser. The spray pump accessory 1320 differs from the pump dispenser accessory 1220 wherein the spray pump accessory 1320 is designed to atomize and propel the contents of the container assembly 1300 upon dispensing. The spray pump dispenser subassembly 1321 includes the spray pump head 1325, the spray pump trigger/actuator 1322, the pump subassembly 1324, the spray pump dispensing nozzle 1327, the spray pump handgrip 1323, and the spray pump supply conduit 1329 collectively providing the spray dispensing function.

A spray pump trigger/actuator 1322 is pivotally assembled to a spray pump head 1325. The spray pump trigger/actuator 1322 is mechanically coupled to the pump subassembly 1324. Spray pumps 1324 are commonly used for dispensing of water, cleaning solutions, sanitizers, fungicides, pesticides, surface treatments (plastic moisturizers, etc.), and the like are well known by those skilled in the art and is therefore not detailed herein.

A spray pump dispensing nozzle 1327, comprising a spray pump dispensing aperture 1328, is in fluid communication with the pump subassembly 1324. Features causing the atomizing process are provided within the spray pump dispensing nozzle 1327. The amount of atomization of the dispensed contents can be adjusted by rotating the spray pump dispensing nozzle 1327. The spray pump dispensing nozzle 1327 can be screwed to adjust the shape of the discharging spray. The spray is dispensed through the spray pump dispensing aperture 1328 of the spray pump dispensing nozzle 1327. When the spray pump trigger/actuator 1322 is drawn towards the spray pump handgrip 1323, the motion of the spray pump trigger/actuator 1322 actuates the pump subassembly 1324, drawing fluid from the container body tubular sidewall 102 into the spray pump supply conduit 1329 through a spray pump supply conduit sourcing end 1329A. The fluid continues through the pump subassembly 1324, passing through a conduit (not show) in the spray pump head 1325 and is delivered to the spray pump dispensing nozzle 1327, where a shape of the dispensing spray is determined and formed. The spray is then dispensed through the spray pump dispensing aperture 1328. In the exemplary 1 resealable container 300, the spray pump accessory 1320 includes a spray pump handgrip 1323 extending between the accessory cap inner member 1380 and a base of the spray pump head 1325. The user would grip the spray pump handgrip 1323 and draw the spray pump trigger/actuator 1322 towards the spray pump handgrip 1323 to actuate the pump subassembly 1324.

Figure 101:
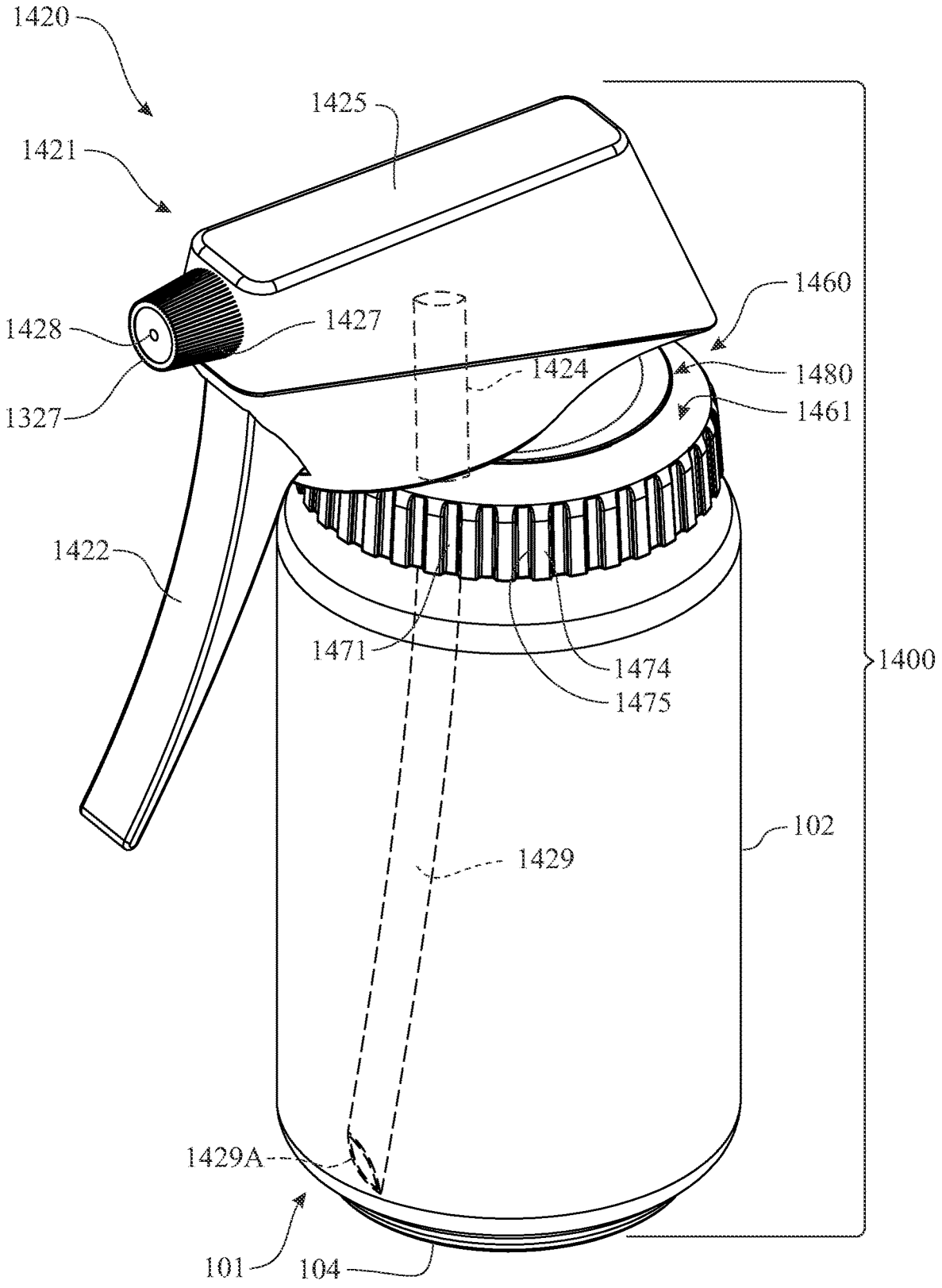
FIG. 101 presents a top isometric view of a ninth exemplary accessory for use as a container lid, the accessory including a trigger dispensing assembly, the arrangement employing the body of the container as a portion of the grip for use in conjunction with the trigger.

A ninth exemplary specialized cap is a spray pump accessory 1420, detailed in FIG. 101. A container assembly 1400 refers to an assembly of the spray pump accessory 1420 and the container subassembly comprising the resealable container lid 110 joined to the resealable container body 101. The container assembly 1400 is a modified version of the 1 resealable container 300. Like features of the spray pump accessory 1320 and the spray pump accessory 1420 are numbered the same except preceded by the numeral '14'. The distinction between the spray pump accessory 1320 and the spray pump accessory 1420 is the configuration of the spray pump accessory 1420 between the spray pump head 1425 and the accessory cap inner member 1480. In the spray pump accessory 1320, the spray pump handgrip 1323 extends between the spray pump head 1325 and the accessory cap inner member 1380, wherein the spray pump handgrip 1323 is used during the squeezing of the spray pump trigger/actuator 1322. The spray pump dispenser subassembly 1421 includes the spray pump head 1425, the spray pump trigger/actuator 1422, the pump subassembly 1424, the spray pump dispensing nozzle 1427, and the spray pump supply conduit 1429 collectively providing the spray dispensing function In the spray pump accessory 1420, the spray pump head 1425 is assembled directly to (or using a very short extension) the accessory cap inner member 1480, as illustrated in FIG. 100, wherein the container body tubular sidewall 102 is used during the squeezing of the spray pump trigger/actuator 1322.

The above are various examples of accessories or specialized caps that are adapted to be assembled to the various containers. More specifically, the various examples of accessories or specialized caps include radially outwardly facing translative motion guide features designed to engage with like radially inwardly facing translative motion guide feature provided on the container (either directly integrated therein or formed within a lid that is seamed to the container body). The exemplary accessories are all illustrated as being provided with the accessory cap outer member. Alternatively, the accessory cap outer member can be procured independent of the accessory, wherein the accessory would be designed for assembly to the accessory cap outer member by the user. This enables the accessory cap outer member to be customized and adaptable to the specific container subassembly. The accessory cap outer member radially inward facing surface would be a common design for each of the accessory cap outer members and the accessory inserts (including the accessory cap inner member).

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

Reference Element Descriptions

| Ref. No. | Description |
|---|---|
| 100 | resealable container assembly |
| 100 | resealable container assembly |
| 101 | resealable container body |
| 102 | container body tubular sidewall |
| 106 | container body sidewall seaming edge |
| 104 | container body closed bottom wall |
| 108 | container body and lid assembly seam chine |

-continued

Reference Element Descriptions

| Ref. No. | Description |
|---|---|
| 109 | container body and lid assembly seam |
| 110 | resealable container lid |
| 118 | resealable container lid bottom wall reinforcement formation |
| 120 | seaming panel |
| 122 | seaming chuck wall |
| 124 | seaming chuck shoulder |
| 126 | lid annular countersink |
| 132 | lid frustum shaped sidewall |
| 134 | lid bottom wall |
| 136 | lid bottom panel score line |
| 138 | lid bottom panel tear panel |
| 139 | tear panel hinge |
| 141 | lid bottom wall to reinforcement formation transition |
| 142 | tear panel to tear panel reinforcing transition |
| 152 | lid translative motion guide feature |
| 160 | resealable container cap |
| 162 | resealable container cap frustum shaped exterior sidewall |
| 163 | resealable container cap frustum shaped interior sidewall |
| 164 | resealable container cap planar transversing surface |
| 165 | cap upper annular sealing member |
| 166 | cap annular countersink formation |
| 167 | cap lower annular sealing member |
| 170 | cylindrical sidewall inverted countersink |
| 171 | resealable container cap grip element base |
| 174 | resealable container cap grip element |
| 181 | cap translative motion guide feature |
| 181A | cap translative motion guide feature leader end |
| 181E | cap translative motion guide feature locking end |
| 190 | tab |
| 191 | tab retention bracket |
| 192 | tab bracket hinge |
| 193 | tab lightening hole |
| 195 | finger access depression |
| 196 | tab stabilizing formation |
| 197 | rivet |
| 198 | tear panel reinforcing formation |
| 200 | resealable container assembly |
| 201 | resealable container body |
| 202 | container body tubular sidewall |
| 203 | container body closed bottom wall |
| 204 | nesting container body annular base |
| 206 | container body sidewall seaming flange |
| 208 | container body and lid assembly seam chine |
| 209 | container body and lid assembly seam |
| 210 | resealable container annular component |
| 220 | seaming panel |
| 222 | seaming chuck wall |
| 224 | seaming chuck shoulder |
| 226 | cap receiving annular component rolled annular end ring |
| 227 | cap receiving annular component rolled bottom edge sealing surface |
| 232 | cap receiving annular component tubular sidewall |
| 235 | cap receiving annular component tubular open passageway |
| 252 | cap receiving annular component translative motion guide feature |
| 253 | cap receiving annular component translative motion guide feature upper surface |
| 260 | resealable container cap |
| 262 | resealable container cap tubular exterior sidewall |
| 263 | resealable container cap tubular interior sidewall |
| 264 | resealable container cap planar transversing surface |
| 265 | cap upper annular sealing member |
| 265A | cap upper annular sealing member |
| 265B | cap upper annular sealing member |
| 266 | cap annular countersink formation |
| 267 | cap lower annular sealing member |
| 268 | cap sidewall transition |
| 270 | cylindrical sidewall inverted countersink |
| 281 | cap translative motion guide feature |
| 281A | cap translative motion guide feature leader end |
| 281E | cap translative motion guide feature locking end |
| 300 | resealable container assembly |
| 300A | resealable container assembly |
| 300B | resealable container assembly |
| 300C | resealable container assembly |
| 300D | resealable container assembly |
| 301 | nesting container body with integral cap receiving translative motion guide feature |
| 301C | nesting container body with integral cap receiving translative motion guide feature |

-continued

Reference Element Descriptions

| Ref. No. | Description |
|---|---|
| 302 | nesting container body frustum shaped sidewall |
| 303 | nesting container body closed bottom wall |
| 304 | nesting container body annular base |
| 305 | nesting container body lower reinforcing annular formation |
| 306 | nesting container body frustum shaped sidewall upper, free edge |
| 307 | nesting container body central or second measurement demarcation |
| 314 | nesting container body first measurement volume |
| 314C | nesting container body first measurement volume |
| 315 | nesting container body second measurement volume |
| 317 | nesting container body third measurement volume |
| 326 | nesting container body to cap receiving sidewall annular transition formation |
| 332 | nesting container body upper edge cap receiving sidewall |
| 352 | nesting container body translative motion guide feature |
| 360 | resealable container cap |
| 360A | resealable container cap |
| 360B | resealable container cap |
| 360C | resealable container cap |
| 360D | resealable container cap |
| 362 | resealable container cap exterior sidewall |
| 363 | resealable container cap interior sidewall |
| 364 | resealable container cap transversing surface |
| 365A | resealable cap container nesting cavity |
| 365B | resealable cap container nesting cavity |
| 365C | resealable cap container nesting cavity |
| 366B | resealable cap container stacking registration feature |
| 366C | resealable cap container stacking registration feature |
| 366D | resealable cap container stacking registration feature |
| 367 | cap bottom wall transition |
| 369 | frustum sidewall to seaming panel transition segment |
| 370 | cylindrical sidewall inverted countersink |
| 381 | cap translative motion guide feature |
| 381A | cap translative motion guide feature leader end |
| 381E | cap translative motion guide feature locking end |
| 399 | interlocking frustum shaped sidewall angle |
| 410 | resealable container lid |
| 418 | resealable container lid bottom wall reinforcement formation |
| 420 | seaming panel |
| 422 | seaming chuck wall |
| 424 | seaming chuck shoulder |
| 426 | lid annular countersink |
| 432 | lid frustum shaped sidewall |
| 434 | lid bottom wall |
| 436 | lid bottom panel score line |
| 438 | lid bottom tear panel |
| 441 | lid bottom wall to reinforcement formation transition |
| 442 | tear panel to tear panel reinforcing transition |
| 452 | lid translative motion guide feature |
| 490 | tab |
| 491 | tab retention bracket |
| 492 | tab bracket hinge |
| 493 | tab lightening hole |
| 494 | tab effecting edge |
| 497 | rivet |
| 498 | tear panel reinforcing formation |
| 510 | resealable container lid |
| 520 | seaming panel |
| 522 | seaming chuck wall |
| 524 | seaming chuck shoulder |
| 526 | lid annular countersink |
| 532 | lid frustum shaped sidewall |
| 534 | lid bottom wall |
| 535 | lid bottom wall contents access passageway |
| 538 | removable foil lid bottom panel |
| 552 | lid translative motion guide feature |
| 590 | foil panel tab |
| 590' | foil panel tab (in use) |
| 592 | foil tab hinge |
| 600 | container assembly |
| 620 | drinking straw accessory |
| 621 | drinking straw subassembly |
| 622 | drinking straw |
| 622A | drinking straw tapered fluid source end |
| 622B | drinking straw fluid delivery end |
| 624 | drinking straw sealing gasket inner member socket |
| 626 | drinking straw sealing gasket |

-continued

Reference Element Descriptions

| Ref. No. | Description |
|---|---|
| 628 | drinking straw fluid passageway |
| 660 | drinking straw accessory cap assembly |
| 661 | accessory cap outer member |
| 662 | accessory cap outer member container socket facing surface |
| 663 | accessory cap outer member radially inward facing surface |
| 664 | accessory upper trans versing surface |
| 665 | accessory upper annular sealing member |
| 666 | accessory cap outer member lower annular surface |
| 667 | accessory cap outer member lower annular seal |
| 668 | accessory cap outer member translative motion guide feature |
| 669 | accessory cap outer member radially peripheral surface |
| 670 | accessory container receiving annular channel |
| 671 | accessory grip element base |
| 674 | accessory grip element |
| 675 | accessory grip element force application surface |
| 680 | accessory cap inner member |
| 681 | accessory cap outer member container engaging translative motion guide feature |
| 683 | accessory cap inner member interior surface |
| 684 | accessory cap inner member translative motion guide feature |
| 686 | accessory cap inner member lower annular surface |
| 687 | accessory cap inner member lower annular seal |
| 689 | accessory cap inner member radially outward facing surface |
| 700 | container assembly |
| 720 | baby bottle nipple accessory |
| 721 | baby bottle nipple subassembly |
| 722 | nipple formation |
| 723 | nipple tubular projection |
| 726 | nipple radial flange |
| 728 | nipple fluid dispensing aperture |
| 760 | baby bottle nipple cap subassembly |
| 761 | accessory cap outer member |
| 764 | accessory upper trans versing surface |
| 771 | accessory grip element base |
| 774 | accessory grip element |
| 775 | accessory grip element force application surface |
| 780 | accessory cap inner member |
| 800 | container assembly |
| 820 | axial rotation valve dispensing accessory |
| 821 | axially rotating valve dispenser subassembly |
| 822 | axially rotating valve contents dispensing projection (spout) |
| 828 | axial rotation valve dispensing aperture |
| 829 | axial rotation valve actuation aperture |
| 860 | axial rotation valve accessory cap assembly |
| 861 | accessory cap outer member |
| 864 | accessory transversing upper surface |
| 871 | accessory grip element base |
| 874 | accessory grip element |
| 875 | accessory grip element force application surface |
| 880 | accessory cap inner member |
| 899 | axial rotating valve motion |
| 900 | container assembly |
| 920 | axial translation valve dispensing (sports bottle styled) accessory |
| 921 | axially translating valve dispenser subassembly |
| 922 | axial translation dispensing valve end piece |
| 923 | axial translation valve actuator projecting base |
| 928 | axial translation valve dispensing aperture |
| 960 | axial translation valve accessory cap assembly |
| 961 | accessory cap outer member |
| 964 | accessory transversing upper surface |
| 971 | accessory grip element base |
| 974 | accessory grip element |
| 975 | accessory grip element force application surface |
| 980 | accessory cap inner member |
| 998 | axial closing motion |
| 999 | axial opening motion |
| 1000 | container assembly |
| 1020 | pivoting valve dispensing accessory |
| 1021 | pivoting valve dispenser subassembly |
| 1022 | pivoting valve contents dispensing projection (spout) |
| 1026 | projecting member pivoting valve base |
| 1027 | radial rotation valve projecting member accepting recess |
| 1028 | radial rotation valve contents projection dispensing aperture |
| 1029 | projecting member pivoting base valve aperture |
| 1060 | radial rotation valve accessory cap assembly |
| 1064 | accessory transversing upper surface |

-continued

Reference Element Descriptions

| Ref. No. | Description |
|---|---|
| 1061 | accessory cap outer member |
| 1071 | accessory grip element base |
| 1074 | accessory grip element |
| 1075 | accessory grip element force application surface |
| 1080 | accessory cap inner member |
| 1100 | container assembly |
| 1120 | radial translation valve dispensing accessory |
| 1121 | radially translating valve dispenser subassembly |
| 1122 | radial translation valve contents dispensing projection (spout) |
| 1126 | radial translation valve projecting member sliding base |
| 1127 | radial translation valve projecting member channel |
| 1128 | radial translation valve dispensing aperture |
| 1129 | projecting member base valve aperture |
| 1160 | radial translation valve accessory cap assembly |
| 1161 | accessory cap outer member |
| 1164 | accessory transversing upper surface |
| 1171 | accessory grip element base |
| 1174 | accessory grip element |
| 1175 | accessory grip element force application surface |
| 1180 | accessory cap inner member |
| 1200 | container assembly |
| 1220 | pump dispenser accessory |
| 1221 | pump actuated dispenser subassembly |
| 1222 | pump dispenser head |
| 1223 | pump dispenser plunger |
| 1224 | pump subassembly |
| 1225 | pump dispenser contents supply conduit |
| 1225A | pump dispenser contents conduit contents sourcing end |
| 1226 | pump dispenser plunger base |
| 1228 | pump dispenser aperture |
| 1260 | pump dispenser accessory cap assembly |
| 1261 | accessory cap outer member |
| 1264 | accessory transversing upper surface |
| 1271 | accessory grip element base |
| 1274 | accessory grip element |
| 1275 | accessory grip element force application surface |
| 1280 | accessory cap inner member |
| 1300 | container assembly |
| 1320 | spray pump accessory |
| 1321 | spray pump dispenser subassembly |
| 1322 | spray pump trigger/actuator |
| 1323 | spray pump handgrip |
| 1324 | pump subassembly |
| 1325 | spray pump head |
| 1327 | spray pump dispensing nozzle |
| 1328 | spray pump dispensing aperture |
| 1329 | spray pump supply conduit |
| 1329A | spray pump supply conduit sourcing end |
| 1360 | spray pump accessory cap assembly |
| 1361 | spray pump accessory cap outer member |
| 1371 | accessory grip element base |
| 1374 | accessory grip element |
| 1375 | accessory grip element force application surface |
| 1380 | accessory cap inner member |
| 1400 | container assembly |
| 1420 | spray pump accessory |
| 1421 | spray pump dispenser subassembly |
| 1422 | spray pump actuator member |
| 1424 | pump subassembly |
| 1425 | spray pump head |
| 1427 | spray pump nozzle |
| 1428 | spray pump dispensing aperture |
| 1429 | spray pump supply conduit |
| 1429A | spray pump supply conduit sourcing end |
| 1460 | spray pump accessory cap assembly |
| 1461 | spray pump accessory cap outer member |
| 1464 | accessory transversing upper surface |
| 1471 | accessory grip element base |
| 1474 | accessory grip element |
| 1475 | accessory grip element force application surface |
| 1480 | accessory cap inner member |
| 2000 | nestable container component supply and use flow diagram |
| 2010 | fabricate nestable container components step |
| 2020 | nest multiple fabricated nestable container components step |
| 2022 | parcel nested multiple fabricated nestable container components step |

-continued

| Reference Element Descriptions | |
|---|---|
| Ref. No. | Description |
| 2024 | transport parceled nested container components to packaging facility step |
| 2030 | receive transported parceled nested container components at packaging facility step |
| 2032 | position stack of nested container components on packaging assembly line step |
| 2034 | remove individual component from stack of nested components step |
| 2036 | locate removed individual component into desired position for use in product packaging process step |
| 2040 | complete product packaging step |

What is claimed is:

1. A nestable container component comprising:

at least one container component translative motion guide feature integral with a tubular cap and container translative motion engaging sidewall, the tubular translative motion guide feature containing sidewall extending between an upper peripheral edge and a lower peripheral edge;

an upper tubular sidewall radially inner diameter spanning a radially interior surface of the upper peripheral edge of the tubular cap and container translative motion engaging sidewall; and a radially outward directed upper formation arranged to be one of (a) contiguous with the upper peripheral edge of the tubular cap and container translative motion engaging sidewall and (b) an upper transition extending between and each respective edge being contiguous with the radially outward directed upper formation and the upper peripheral edge of the tubular cap and container translative motion engaging sidewall;

a radially inward directed lower formation arranged to be one of (a) contiguous with the lower peripheral edge of the tubular cap and container translative motion engaging sidewall and (b) a lower transition extending between and each respective edge being contiguous with the radially inward directed lower formation and the lower peripheral edge of the tubular cap and container translative motion engaging sidewall;

a radially outermost diameter of the lower formation, wherein the radially outermost diameter of the lower formation is smaller than the upper tubular sidewall radially inner diameter;

wherein when a first nestable container component is nested within a second nestable container component orienting a radially outward surface of the tubular cap and container translative motion engaging sidewall of the first nestable container component and a radially inward surface of the tubular cap and container translative motion engaging sidewall of the second nestable container component facing in a direction opposing one another, wherein the at least one container component translative motion guide feature is an assembly element of a plug style container closure arrangement between the-plug style container closure and one of a container lid component or a container body component, wherein the at least one container component translative motion guide feature has an angular length about the respective circumference of the tubular cap and container translative motion engaging sidewall that is equal to or less than 180 degrees divided by the number of the at least one container component translative motion guide feature, wherein the at least one container component translative motion guide feature is designed to at least one of:

(a) create an axial motion as a result of a rotation motion when engaged with a mating translative motion guide feature of a mating container component and (b) control an axial motion as a result of a rotation motion when engaged with a mating translative motion guide feature of a mating container component, wherein the at least one container component translative motion guide feature is oriented as one of:

(a) when the nestable container component is a container body component, the at least one container component translative motion guide feature extends radially from a radially interior surface of the container body sidewall for engaging with a mating translative motion guide feature extending radially from a radially exterior surface of the plug style container closure, the at least one container component translative motion guide feature being located at a location that is below the upper peripheral edge of the container body component, (b) when the nestable container component is a container lid component, the at least one container component translative motion guide feature extends radially from a radially interior surface of the container lid sidewall for engaging with a mating translative motion guide feature extending radially from a radially exterior surface of the plug style container closure, or (c) when the nestable container component is a container closure component, the at least one container component translative motion guide feature extends radially from a radially exterior surface of the container closure sidewall for engaging with a mating translative motion guide feature extending radially from a radially interior surface of one of the container body component or the container lid component, wherein a plurality of like shaped and sized individual nestable container components are arranged into a nested arrangement, wherein a total height of the nested arrangement that is less than a sum of the overall heights of a total count of the like shaped and sized individual nestable container components contained within the nested arrangement.

2. The nestable container component in accordance with claim 1, wherein when a first like component is inserted nesting within a second like component, a bottommost portion of the first like component resides at a location being at least one of:

(a) contacting a top surface of the at least one container component translative motion guide feature of the second like component, (b) contacting the at least one container component translative motion guide feature of the second like component, (c) partially overlapping the at least one container component translative motion guide feature of the second like component, (d) completely overlapping the at least one container component translative motion guide feature of the second like component, (e) below the at least one container component translative motion guide feature of the second like component.

3. The nestable container component in accordance with claim 1, wherein the tubular cap and container translative motion engaging sidewall extends in accordance with one of:

a) wherein the nestable container component is the container body component, the tubular cap and container translative motion engaging sidewall extends between a transition defining a chine and a transition defining a container body annular base, b) wherein the nestable container component is the container lid component, the tubular cap and container translative motion engaging sidewall extends between a transition defining a container body joining formation portion and a transition defining a lower annular formation, or c) wherein the nestable container component is the container closure component, the tubular cap and container translative motion engaging sidewall extends between a transition defining an inverted countersink and a transition defining a lower annular formation.

4. The nestable container component in accordance with claim 1, further comprising a chuck shoulder, wherein the chuck shoulder is integral with the upper transition.

5. The nestable container component in accordance with claim 1, wherein the at least one container component translative motion guide feature of one of the container body component or the container lid component is a radially interior at least one container component translative motion guide feature comprising an upper engaging surface and a lower engaging surface, wherein the at least one container component translative motion guide feature of the container closure component includes an upper engaging surface and a lower engaging surface, wherein when the container closure component and one of the container body component or the container lid component are assembled to one another, (a) one of the upper engaging surface or the lower engaging surface of the container closure component at least one container component translative motion guide feature engages with one of the upper engaging surface or lower engaging surface of the radially interior at least one container component translative motion guide feature, and (b) a second feature of the container closure component engages with a mating second feature of the one of the container body component or the container lid component, wherein each of the second features are independent of the respective at least one container component translative motion guide features.

6. The nestable container component in accordance with any of the claim 1, wherein the nestable container component is the container lid component, in at least one of:

a) the container lid component further comprising a ring end formation defining an open bottom wall, b) the container lid component further comprising a closed bottom wall, wherein the nesting of the container lid component includes an overlapping of sidewalls of adjacently nested container lid components, c) the sidewall of the container lid component having a frustum shape, the container lid component further comprising a closed bottom wall, wherein the nesting of the container lid component includes an overlapping of sidewalls of adjacently nested container lid components, d) the container lid component is designed wherein a lower portion of an upper nested container lid component overlaps a sidewall of a lower adjacently nested container lid component when placed in nested arrangement of adjacent container lid components.

7. The nestable container component in accordance with claim 1, wherein the tubular cap and container translative motion engaging sidewall is formed having a frustum shape.

8. The nestable container component in accordance with claim 1, wherein when a first nestable container component is nested with a second, like nestable container component the nested first nestable container component and the second, like nestable container component are restricted against an independent radial motion, while enabling an axially independent motion respective to one another.

9. The nestable container component in accordance with claim 1, wherein nesting is enabled by the arrangement of the lower peripheral edge of the first nestable container component tubular cap and container translative motion engaging sidewall having a smaller diameter than an interior diameter of a radially outward extending container joining formation on the upper peripheral edge of the second, like nestable container component tubular cap and container translative motion engaging sidewall.

10. The nestable container component in accordance with claim 1, further comprising a chine, wherein the chine is one of:

(a) an upper surface of a seaming panel peripherally formed about and extending upward and radially outward from the upper peripheral edge of the tubular cap and container translative motion engaging sidewall, wherein the seaming panel is adapted to assemble the container lid to a container body sidewall seaming edge of a container body, or (b) an upper surface of a rolled upper, free edge formed about an upper peripheral edge of a nestable container body component.

11. The nestable container component in accordance with claim 1, wherein a plurality of like nestable container components are nested together, wherein adjacent nestable container components are designed to provide a nesting arrangement having at least one of:

(a) the radially outward surface of the frustum shaped tubular cap and container translative motion engaging sidewall of the first nestable container component contacts a radially inward surface of the at least one container component translative motion guide feature of the second, adjacent nestable container component, (b) the radially inward surface of the frustum shaped tubular cap and container translative motion engaging sidewall of the second nestable container component contacts a radially outward surface of the at least one container component translative motion guide feature of the first, adjacent nestable container component, (c) the lower peripheral edge of the tubular cap and container translative motion engaging sidewall of the first nestable container component contacts a radially inward surface of the at least one container component translative motion guide feature of the second nestable container component, (d) an annular end ring formed at the lower peripheral edge of the tubular cap and container translative motion engaging sidewall of the first nestable container component contacts a radially inward surface of the at least one container component translative motion guide feature of the second nestable container component, (e) a sidewall transition formed proximate the lower peripheral edge of the tubular cap and container translative motion engaging sidewall of the first nestable container component contacts the radially interior surface of the frustum shaped tubular cap and container translative motion engaging sidewall of the second nestable container component, (f) an exterior surface of the frustum shaped tubular cap and container translative motion engaging sidewall of the first nestable container component contacts an interior surface of the frustum shaped tubular cap and container translative motion engaging sidewall of the second nestable container component and one of:

(i) the radially inward surface of the at least one container component translative motion guide feature of the second, adjacent nestable container component contacts the radially exterior surface of the frustum shaped tubular cap and container translative motion engaging sidewall of the first nestable container component, and (ii) a gap is provided between the radially inward surface of the at least one container component translative motion guide feature of the second, adjacent nestable container component and the radially exterior surface of the frustum shaped tubular cap and container translative motion engaging sidewall of the first nestable container component, and (g) a radially outward surface of the at least one container component translative motion guide feature of the first, adjacent nestable container component contacts an upper surface of a inverted countersink peripherally formed about and extending upward and radially outward from the upper peripheral edge of the second nestable container component.

12. The nestable container component in accordance with claim 1, wherein the nestable container component is fabricated of at least one metal.

13. The nestable container component in accordance with claim 1, wherein the at least one container component translative motion guide feature is unitarily formed with the tubular cap and container translative motion engaging sidewall.

14. The nestable container component in accordance with claim 1, wherein the nestable container component is a container body component, the container body component including at least one of:

(a) the tubular cap and container translative motion engaging sidewall including a frustum shape, (b) the tubular cap and container translative motion engaging sidewall having a frustum shape, (c) a substantially cylindrically shaped sidewall, (d) the translative motion guide feature extending radially inward from the frustum shaped sidewall, (e) the translative motion guide feature extending radially inward from an upper edge cap receiving sidewall, (f) the translative motion guide feature extending radially inward from the upper edge cap receiving sidewall, wherein the upper edge cap receiving sidewall is cylindrical in shape, (g) the translative motion guide feature extending radially inward from the upper edge cap receiving sidewall, wherein the upper edge cap receiving sidewall has a cylindrical shape and is radially outwardly offset from an upper edge of a frustum shaped portion of the frustum shaped sidewall, (h) the translative motion guide feature extending radially inward from the upper edge cap receiving sidewall, wherein the upper edge cap receiving sidewall has a frustum shape, (i) the translative motion guide feature extending radially inward from the upper edge cap receiving sidewall, wherein the upper edge cap receiving sidewall has a frustum shape and is radially outwardly offset from an upper edge of a frustum shaped portion of the frustum shaped sidewall, (j) an outwardly rolled upper edge, (k) an outwardly formed container body joining formation, (l) at least one measurement demarcation, wherein the at least one measurement demarcation defines a predetermined volume, (m) at least two concentrically arranged frustum shaped sections collectively forming the frustum shaped sidewall, each intersection between adjacently located concentrically arranged frustum shaped sections creating a demarcation, (n) at least two concentrically arranged frustum shaped sections collectively forming the frustum shaped sidewall, each intersection between adjacently located concentrically arranged frustum shaped sections creating a demarcation, wherein the demarcation defines a measurement of a predetermined volume, (o) a stackable feature provided in a lower portion of the container body component tubular cap and container translative motion engaging sidewall, restricting independent radial motion, while enabling an axially independent motion between a lower portion of the container body component tubular cap and container translative motion engaging sidewall and a stackable feature provided as a cavity formed within the bottom wall of a container closure, (p) a stackable retention feature provided as an inverted frustum including a retention feature provided in a lower portion of the container body component tubular cap and container translative motion engaging sidewall, (q) a stackable feature provided as a recessed formation within the bottom wall of the container body component restricting independent radial motion, while enabling an axially independent motion between the container body component stackable feature and a stackable feature provided as a bossed registration formation within the bottom wall of a container closure component, and (r) a bottom wall of the container body component having a recess extending into an interior void of the container body component.

15. The nestable container component in accordance with claim 1, wherein the nestable container component is a container lid, the container lid comprising at least one of:

(a) the tubular cap and container translative motion engaging sidewall including a frustum shape,
(b) the tubular cap and container translative motion engaging sidewall is a frustum shape,
(c) the tubular cap and container translative motion engaging sidewall having a substantially cylindrically shape,
(d) the tubular cap and container translative motion engaging sidewall having an arched shape,
(e) the translative motion guide feature extending radially inward from the tubular cap and container translative motion engaging sidewall,
(f) the translative motion guide feature extending radially inward from the tubular cap and container translative motion engaging sidewall, wherein a section of the tubular cap and container translative motion engaging sidewall comprising the translative motion guide feature is substantially cylindrical in shape,
(g) the translative motion guide feature extending radially inward from the tubular cap and container translative motion engaging sidewall, wherein the tubular cap and container translative motion engaging sidewall is frustum in shape,
(h) the translative motion guide feature extending radially inward from the tubular cap and container translative motion engaging sidewall, wherein a section of the tubular cap and container translative motion engaging sidewall comprising the translative motion guide feature is arched in shape,
(i) a stay-on tab,
(j) the stay-on tab in conjunction with a tear panel defined by a score line,
(k) a rivet assembling the stay-on tab to a lid bottom wall,
(l) a rolled annular end ring circumscribing a lower peripheral end of the tubular cap and container translative motion engaging sidewall defining a tubular open passageway,
(m) a pull tab,
(n) the pull tab assembled to a lid bottom tear panel, the lid bottom tear panel defined by a score line circumscribing a container lid bottom wall,
(o) the rivet assembling the pull tab to the lid bottom removable tear panel,
(p) a removable foil lid bottom panel,
(q) the removable foil lid bottom panel, removably bonded to the container lid annular bottom wall,
(r) the removable foil lid bottom panel comprising a foil panel tab, and(s)
(s) the foil panel tab and the removable foil lid bottom panel hingeably joined to one another.

16. The nestable container component in accordance with claim 1, wherein the nestable container component is a container closure, the container closure comprising at least one of:
(a) the tubular cap and container translative motion engaging sidewall having a frustum shape,
(b) the tubular cap and container translative motion engaging sidewall having a substantially cylindrical shape,
(c) the tubular cap and container translative motion engaging sidewall having an arched shape,
(d) the closure translative motion guide feature extending radially outward from the frustum shaped sidewall,
(e) the closure translative motion guide feature extending radially outward from the cylindrical shaped sidewall,
(f) the closure translative motion guide feature extending radially outward from the arched shaped sidewall,
(g) a stackable feature provided as a cavity formed within the bottom wall,
(h) a stackable retention feature provided as a cavity including a retention feature formed within the bottom wall,
(i) a stackable feature provided as a bossed registration formation within the bottom wall,
(j) a sealing member provided as a compliant annular sealing member on the radially outward surface of the container closure,
(k) a sealing member provided as a compliant annular sealing member on the radially outward surface of the container closure, where in the sealing member contacts the adjacent sealant surface of the resealable container,
(l) a sealing member including an elongated projection extending from a base, the base being carried by an interior surface of an inverted countersink of the container closure, the projection having a radially inward facing surface and a radially outward facing surface,
(m) a sealing member of a complaint material, the sealing member designed to form a wedge on a sealing surface, the sealing member being carried by the interior surface of the inverted countersink,
(n) a grip enhancing feature, integrally formed in the radially outward surface of the container closure inverted countersink, and
(o) a grip enhancing feature, integrally formed in the radially outward surface of the container closure inverted countersink, wherein the grip enhancing feature can be any one of:
(i) a radially outward extending boss grip enhancing feature,
(ii) a radially inward extending deboss grip enhancing feature,
(iii) a knurled grip enhancing feature,
(iv) an applied, aggregate coating grip enhancing feature,
(v) an applied, anti-slip coating grip enhancing feature.

17. A container assembly comprising the nestable container component in accordance with claim 1, the container assembly including at least two of:
a container body component, a container lid component, and a container closure component,
wherein at least one of the container body component, the container lid component, and the container closure component is the nestable container component.

18. A container assembly comprising the nestable container component in accordance with claim 1, wherein the radially outward directed formation includes at least one of a seaming chuck shoulder, a seaming chuck wall, a seaming panel, an axially extending segment, a radially extending segment, an inverted countersink, a sidewall to inverted countersink transition segment, a rolled edge, a chine, and a container sealing formation.

19. A container assembly comprising the nestable container component in accordance with claim 1, wherein the radially inward directed lower formation includes at least one of a countersink, a sealing surface, a rolled annular end ring, a cap sidewall transition, a cap annular countersink transition, a sidewall to bottom panel planar transversing surface, and a rolled bottom edge sealing surface.

* * * * *